US009761240B2

(12) United States Patent
Kikuiri et al.

(10) Patent No.: US 9,761,240 B2
(45) Date of Patent: Sep. 12, 2017

(54) AUDIO DECODING DEVICE, AUDIO CODING DEVICE, AUDIO DECODING METHOD, AUDIO CODING METHOD, AUDIO DECODING PROGRAM, AND AUDIO CODING PROGRAM

(71) Applicant: NTT DOCOMO, INC., Chiyoda-ku, Tokyo (JP)

(72) Inventors: Kei Kikuiri, Tokyo (JP); Atsushi Yamaguchi, Tokyo (JP)

(73) Assignee: NTT DoCoMo, Inc, Tokyo (JP)

( * ) Notice: Subject to any disclaimer, the term of this patent is extended or adjusted under 35 U.S.C. 154(b) by 194 days.

(21) Appl. No.: 14/523,260

(22) Filed: Oct. 24, 2014

(65) Prior Publication Data

US 2015/0051904 A1 Feb. 19, 2015

Related U.S. Application Data

(63) Continuation of application No. PCT/JP2013/061105, filed on Apr. 12, 2013.

(30) Foreign Application Priority Data

Apr. 27, 2012 (JP) ..... 2012-103519
Nov. 20, 2012 (JP) ..... 2012-254496

(51) Int. Cl.
*G10L 19/02* (2013.01)
*G10L 19/03* (2013.01)
(Continued)

(52) U.S. Cl.
CPC ..... *G10L 19/265* (2013.01); *G10L 19/24* (2013.01); *G10L 21/038* (2013.01)

(58) Field of Classification Search
CPC ..... G10L 19/06; G10L 19/24; G10L 21/038; G10L 21/04; G10L 19/0208;
(Continued)

(56) References Cited

U.S. PATENT DOCUMENTS 5,684,920 A * 11/1997 Iwakami ..... G10L 19/0204 704/201
5,737,716 A * 4/1998 Bergstrom ..... G10L 19/02 704/202
(Continued)

FOREIGN PATENT DOCUMENTS

CN 102379004 A 3/2012
EP 2 677 519 A1 12/2013
(Continued)

OTHER PUBLICATIONS

International Preliminary Report on Patentability and Written Opinion in corresponding International Application No. PCT/JP2013/061105, dated Nov. 6, 2014, 6 pages.
(Continued)

*Primary Examiner* — Abdelali Serrou
(74) *Attorney, Agent, or Firm* — Brinks Gilson & Lione

(57) ABSTRACT

An objective of the present invention is to correct a temporal envelope shape of a decoded signal with a small information volume and to reduce perceptible distortions. An audio decoding device which decodes a coded audio signal and outputs an audio signal comprises: a coded series analysis unit that analyzes a coded series which contains the coded audio signal; an audio decoding unit that receives from the coded series analysis unit the coded series which contains the coded audio signal and decodes same, obtaining an audio signal; a temporal envelope shape establishment unit that receives information from the coded series analysis unit and/or the audio decoding unit, and, on the basis of the information, establishes a temporal envelope shape of the decoded audio signal; and a temporal envelope correction unit that, on the basis of the temporal envelope shape which is established with the temporal envelope shape establish-
(Continued)

ment unit, corrects the temporal envelope shape of the decoded audio signal and outputs same.

10 Claims, 150 Drawing Sheets

(51) Int. Cl.
*G10L 19/26* (2013.01)
*G10L 19/24* (2013.01)
*G10L 21/038* (2013.01)

(58) Field of Classification Search
CPC ..... G10L 19/038; G10L 21/0208; G10L 21/0232; G10L 19/0204; G10L 19/008; G10L 19/03; G10L 19/04; G10L 19/0212; G10L 19/167; G10L 19/26; G10L 19/00; G10L 19/005; G10L 19/07; G10L 19/12; G10L 19/265; G10L 2021/02082; G10L 21/00; G10L 25/18
See application file for complete search history.

(56) References Cited

U.S. PATENT DOCUMENTS 6,360,200 B1 3/2002 Edler et al.
6,680,972 B1 * 1/2004 Liljeryd ..... G10L 21/038 375/240
6,978,236 B1 * 12/2005 Liljeryd ..... G10L 19/0208 704/200
7,069,212 B2 * 6/2006 Tanaka ..... G10L 21/038 704/205
7,191,121 B2 3/2007 Liljeryd et al.
8,352,279 B2 * 1/2013 Gao ..... G10L 19/0204 704/219
8,655,649 B2 2/2014 Tsujino et al.
9,064,500 B2 6/2015 Tsujino et al.
2003/0187663 A1 * 10/2003 Truman ..... G10L 21/038 704/500
2003/0233236 A1 * 12/2003 Davidson ..... G10L 21/038 704/258
2006/0085200 A1 * 4/2006 Allamanche ..... H04S 3/02 704/500
2006/0239473 A1 * 10/2006 Kjorling ..... H04S 5/005 381/98
2008/0027717 A1 1/2008 Rajendran et al.
2008/0126081 A1 * 5/2008 Geiser ..... G10L 21/038 704/201
2009/0028240 A1 1/2009 Huang et al.
2009/0306971 A1 * 12/2009 Kim ..... G10L 21/0364 704/203
2010/0063812 A1 * 3/2010 Gao ..... G10L 19/0204 704/230
2010/0063827 A1 * 3/2010 Gao ..... G10L 21/038 704/500
2011/0144979 A1 * 6/2011 Jung ..... G10L 19/018 704/200.1
2012/0010879 A1 1/2012 Tsujino et al.
2012/0016667 A1 * 1/2012 Gao ..... G10L 21/038 704/203
2014/0163972 A1 6/2014 Tsujino et al.

FOREIGN PATENT DOCUMENTS

JP 2009-545778 A 12/2009
JP 2011-34046 A 2/2011
JP 2013-242514 12/2013
TW 201007700 A1 2/2010

OTHER PUBLICATIONS

International Search Report in Corresponding International Application No. PCT/JP2013/061105, dated May 14, 2013, 1 page.
Office Action, and English language translation thereof, in corresponding Chinese Application No. 201380021992.X, dated Apr. 29, 2016, 15 pages.
Notification of Reasons for Refusal, and English language translation thereof, in corresponding Japanese Application No. 2012-254496, dated Mar. 22, 2016, 6 pages.
Geiser, Bernd et al., "Bandwidth Extension for Hierarchical Speech and Audio Coding in ITU-T Rec. G.729.1", *IEEE Transactions on Audio, Speech, and Language Processing*, vol. 15, No. 8, Nov. 2007, pp. 2496-2509, XP011192970.
Extended European Search Report in European Application No. 13781215.2, dated Sep. 29, 2015, 11 pages.
Decision of Rejection, and English language translation thereof, in corresponding Taiwan Application No. 102114359, dated Jun. 25, 2015, 8 pages.
Japanese Office Action, dated Apr. 4, 2017, pp. 1-8, Japanese Patent Application No. 216-099513, Japanese Patent Office, Tokyo, Japan.

* cited by examiner

AUDIO DECODING DEVICE, AUDIO CODING DEVICE, AUDIO DECODING METHOD, AUDIO CODING METHOD, AUDIO DECODING PROGRAM, AND AUDIO CODING PROGRAM

RELATED APPLICATIONS

This application is a continuation application of PCT/JP2013/061105 having an international filing date of Apr. 12, 2013, which claims priority to JP2012-103519 filed Apr. 27, 2012 and JP2012-254496 filed Nov. 20, 2012. This application incorporates PCT/JP2013/061105, JP2012-103519 and JP2012-254496 herein by reference.

BACKGROUND OF THE INVENTION

1. Field of the Invention

The present invention relates to a speech decoding device, a speech encoding device, a speech decoding method, a speech encoding method, a speech decoding program, and a speech encoding program.

2. Description of the Related Art

Speech encoding for compressing the amount of data of speech signals and audio signals to a few tenths of the original size is an extremely important technique in terms of transmission and accumulation of signals. Examples of speech encoding techniques widely used include code excited linear prediction (CELP) that encodes a signal in a time domain, transform coded excitation (TCX) that encodes a signal in a frequency domain, and "MPEG4 AAC" standardized by "ISO/IEC MPEG".

As a method for improving the performance of speech codec and enabling high speech quality at a low bit rate, bandwidth extension techniques have become widely used in these days in which a high frequency component is generated using a low frequency component of speech. An exemplary bandwidth extension technique is called a spectral band replication (SBR) used in "MPEG4 AAC".

In speech encoding, the temporal envelope shape of a decoded signal obtained by decoding a code sequence obtained by encoding an input signal may greatly differ from the temporal envelope shape of the input signal, and such a difference may be perceived as distortions. Also, when the bandwidth extension techniques are used, since a high frequency component is generated by using a signal obtained by encoding and decoding a low frequency component of a speech signal with the speech encoding techniques as described above, the temporal envelope shape of the high frequency component may likewise differ and such a difference may be perceived as distortions.

The method below is a known method for solving this problem (see Patent Literature 1 below). Specifically, in order to generate high frequency component, a high frequency component in an arbitrary time segment is divided into frequency bands. When energy information for each frequency band is calculated and encoded, the energy information for each frequency band is calculated and encoded for respective time segments shorter than the aforementioned time segment. In doing so, with respect to the divided frequency band and the short time segment, the bandwidth of each frequency band and the length of the short time segment can be set flexibly. A decoding device therefore can control energy of a high frequency component for each short time segment in the time direction. That is, the decoding device can control the temporal envelope of a high frequency component for each short time segment.

CITATION LIST—PATENT LITERATURE

Patent Literature 1: U.S. Pat. No. 7,191,121

SUMMARY OF THE INVENTION

Technical Problem

According to the method in Patent Literature 1 above, however, in order to exactly control the temporal envelope of a high frequency component, it is necessary to perform division into extremely short time segments and to calculate and encode the energy information for each frequency band at each short time segment. This significantly increases the amount of information and makes low bit rate encoding difficult.

In view of the aforementioned problem, the present invention aims to modify the temporal envelope shape of a decoded signal with a small amount of information in order to achieve less perception of distortions.

Solution to Problem

The applicant invented a speech decoding device characterized in having the following first to fourth aspects in order to achieve the object above.

A speech decoding device according to the first aspect is a speech decoding device that decodes an encoded speech signal to output a speech signal. The speech decoding device comprises a code sequence analyzer that analyzes a code sequence including the encoded speech signal, a speech decoder that receives and decodes the code sequence including the encoded speech signal from the code sequence analyzer to obtain a speech signal, a temporal envelope shape determiner that receives information from at least one of the code sequence analyzer and the speech decoder and determines a temporal envelope shape of the decoded speech signal, based on the information, and a temporal envelope modifier that modifies the temporal envelope shape of the decoded speech signal, based on the temporal envelope shape determined by the temporal envelope shape determiner, and outputs the modified speech signal.

A speech decoding device according to the second aspect is a speech decoding device that decodes an encoded speech signal to output a speech signal. The speech decoding device comprises a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal, based on the first information, a low frequency temporal envelope shape determiner that receives second information from at least one of the code sequence demultiplexer and the low frequency decoder and determines a temporal envelope shape of the decoded low frequency signal, based on the second information, a low frequency temporal envelope modifier that modifies the temporal envelope shape of the decoded low frequency signal, based on the temporal envelope shape determined by the low frequency temporal envelope shape determiner, and outputs the modified low frequency signal, and a low frequency/high frequency signal combiner that receives the low frequency signal whose temporal envelope shape is modified from the low frequency temporal envelope modifier, receives the high frequency signal from the high frequency decoder and combines the low frequency signal whose temporal envelope shape is modified and the high frequency signal to obtain a speech signal to be output.

A speech decoding device according to the third aspect is a speech decoding device that decodes an encoded speech signal to output a speech signal. The speech decoding device comprises a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal, based on the first information, a high frequency temporal envelope shape determiner that receives second information from at least one of the code sequence demultiplexer, the low frequency decoder and the high frequency decoder and determines a temporal envelope shape of the generated high frequency signal, based on the second information, a high frequency temporal envelope modifier that modifies the temporal envelope shape of the generated high frequency signal, based on the temporal envelope shape determined by the high frequency temporal envelope shape determiner, and outputs the modified high frequency signal, and a low frequency/high frequency signal combiner that receives the low frequency signal from the low frequency decoder, receives the high frequency signal whose temporal envelope shape is modified from the high frequency temporal envelope modifier and combines the low frequency signal and the high frequency signal whose temporal envelope shape is modified to obtain a speech signal to be output.

A speech decoding device according to the fourth aspect is a speech decoding device that decodes an encoded speech signal to output a speech signal. The speech decoding device comprises a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal, based on the first information, a low frequency temporal envelope shape determiner that receives second information from at least one of the code sequence demultiplexer and the low frequency decoder and determines a temporal envelope shape of the decoded low frequency signal, based on the second information, a low frequency temporal envelope modifier that modifies the temporal envelope shape of the decoded low frequency signal, based on the temporal envelope shape determined by the low frequency temporal envelope shape determiner, and outputs the modified low frequency signal, a high frequency temporal envelope shape determiner that receives third information from at least one of the code sequence demultiplexer, the low frequency decoder and the high frequency decoder and determines a temporal envelope shape of the generated high frequency signal, based on the third information, a high frequency temporal envelope modifier that modifies the temporal envelope shape of the generated high frequency signal, based on the temporal envelope shape determined by the high frequency temporal envelope shape determiner, and outputs the modified high frequency signal, and a low frequency/high frequency signal combiner that receives the low frequency signal whose temporal envelope shape is modified from the low frequency temporal envelope modifier, receives the high frequency signal whose temporal envelope shape is modified from the high frequency temporal envelope modifier and combines the low frequency signal whose temporal envelope shape is modified and the high frequency signal whose temporal envelope shape is modified to obtain a speech signal to be output.

In the speech decoding device according to the second or fourth aspect, the high frequency decoder may receive information from at least one of the code sequence demultiplexer, the low frequency decoder and the low frequency temporal envelope modifier and may generate a high frequency signal based on the information.

Also, in the speech decoding device according to the first to fourth aspects, the high frequency temporal envelope modifier may modify the temporal envelope shape of an intermediate signal appearing when generating the high frequency signal in the high frequency decoder, based on the temporal envelope shape determined by the high frequency temporal envelope shape determiner, and the high frequency decoder may carry out a process of generating a residual high frequency signal based on the intermediate signal whose temporal envelope shape is modified.

The invention of the speech decoding device according to the foregoing first to fourth aspects may be understood as an invention of a speech decoding method and can be described as follows.

A speech decoding method according to the first aspect is a speech decoding method executed by a speech decoding device that decodes an encoded speech signal to output a speech signal. The speech decoding method comprises a code sequence analyzing step of analyzing a code sequence including the encoded speech signal, a speech decoding step of receiving and decoding the code sequence including the encoded speech signal after the analysis to obtain a speech signal, a temporal envelope shape determining step of receiving information obtained in at least one of the code sequence analyzing step and the speech decoding step and determining a temporal envelope shape of the decoded speech signal based on the information, and a temporal envelope modifying step of modifying the temporal envelope shape of the decoded speech signal, based on the temporal envelope shape determined by the temporal envelope shape determining step, and outputting the modified speech signal.

A speech decoding method according to the second aspect is a speech decoding method executed by a speech decoding device that decodes an encoded speech signal to output a speech signal. The speech decoding method comprises a code sequence inverse multiplexing step of dividing a code sequence including the encoded speech signal into at least a code sequence including encoded information of a low frequency signal of the speech signal and a code sequence including encoded information of a high frequency signal of the speech signal, a low frequency decoding step of receiving and decoding the code sequence including encoded information of the low frequency signal obtained by division to obtain a low frequency signal, a high frequency decoding step of receiving first information obtained in at least one of the code sequence inverse multiplexing step and the low frequency decoding step and generating a high frequency signal based on the first information, a low frequency temporal envelope shape determining step of receiving second information obtained in at least one of the code sequence inverse multiplexing step and the low frequency decoding step and determining a temporal envelope shape of the decoded low frequency signal based on the second information, a low frequency temporal envelope modifying step of modifying the temporal envelope shape of the decoded low frequency signal, based on the temporal envelope shape determined by the low frequency temporal envelope shape determining step, and outputting the modified low frequency signal, and a low frequency/high frequency signal combining step of receiving the low frequency signal whose temporal envelope shape is modified obtained in the low frequency temporal envelope modifying step, receiving the high frequency signal obtained in the high frequency decoding step and combining the low frequency signal whose temporal envelope shape is modified and the high frequency signal to obtain a speech signal to be output.

A speech decoding method according to the third aspect is a speech decoding method executed by a speech decoding device that decodes an encoded speech signal to output a speech signal. The speech decoding method comprises a code sequence inverse multiplexing step of dividing a code sequence including the encoded speech signal into at least a code sequence including encoded information of a low frequency signal of the speech signal and a code sequence including encoded information of a high frequency signal of the speech signal, a low frequency decoding step of receiving and decoding the code sequence including encoded information of the low frequency signal obtained by division to obtain a low frequency signal, a high frequency decoding step of receiving first information obtained in at least one of the code sequence inverse multiplexing step and the low frequency decoding step and generating a high frequency signal based on the first information, a high frequency temporal envelope shape determining step of receiving second information obtained in at least one of the code sequence inverse multiplexing step, the low frequency decoding step and the high frequency decoding step and determining a temporal envelope shape of the generated high frequency signal based on the second information, a high frequency temporal envelope modifying step of modifying the temporal envelope shape of the generated high frequency signal, based on the temporal envelope shape determined by the high frequency temporal envelope shape determining step, and outputting the modified high frequency signal, and a low frequency/high frequency signal combining step of receiving the low frequency signal obtained in the low frequency decoding step, receiving the high frequency signal whose temporal envelope shape is modified obtained in the high frequency temporal envelope modifying step and combining the low frequency signal and the high frequency signal whose temporal envelope shape is modified to obtain a speech signal to be output.

A speech decoding method according to the fourth aspect is a speech decoding method executed by a speech decoding device that decodes an encoded speech signal to output a speech signal. The speech decoding method comprises a code sequence inverse multiplexing step of dividing a code sequence including the encoded speech signal into at least a code sequence including encoded information of a low frequency signal of the speech signal and a code sequence including encoded information of a high frequency signal of the speech signal, a low frequency decoding step of receiving and decoding the code sequence including encoded information of the low frequency signal obtained in the code sequence inverse multiplexing step to obtain a low frequency signal, a high frequency decoding step of receiving first information obtained in at least one of the code sequence inverse multiplexing step and the low frequency decoding step and generating a high frequency signal based on the first information, a low frequency temporal envelope shape determining step of receiving second information obtained in at least one of the code sequence inverse multiplexing step and the low frequency decoding step and determining a temporal envelope shape of the decoded low frequency signal based on the second information, a low frequency temporal envelope modifying step of modifying the temporal envelope shape of the decoded low frequency signal, based on the temporal envelope shape determined by the low frequency temporal envelope shape determining step, and outputting the modified low frequency signal, a high frequency temporal envelope shape determining step of receiving third information from at least one of the code sequence inverse multiplexing step, the low frequency decoding step and the high frequency decoding step and determining a temporal envelope shape of the generated high frequency signal based on the third information, a high frequency temporal envelope modifying step of modifying the temporal envelope shape of the generated high frequency signal, based on the temporal envelope shape determined by the high frequency temporal envelope shape determining step, and outputting the modified high frequency signal, and a low frequency/high frequency signal combining step of receiving the low frequency signal whose temporal envelope shape is modified obtained in the low frequency temporal envelope modifying step, receiving the high frequency signal whose temporal envelope shape is modified obtained in the high frequency temporal envelope modifying step and combining the low frequency signal whose temporal envelope shape is modified and the high frequency signal whose temporal envelope shape is modified to obtain a speech signal to be output.

Furthermore, the invention of the speech decoding device according to the foregoing first to fourth aspects can be understood as an invention of a speech decoding program and can be described as follows.

A speech decoding program according to the first aspect is a speech decoding program for causing a computer provided in a speech decoding device, which decodes an encoded speech signal to output a speech signal, to function as a code sequence analyzer that analyzes a code sequence including the encoded speech signal, a speech decoder that receives and decodes the code sequence including the encoded speech signal from the code sequence analyzer to obtain a speech signal, a temporal envelope shape determiner that receives information from at least one of the code sequence analyzer and the speech decoder and determines a temporal envelope shape of the decoded speech signal based on the information, and a temporal envelope modifier that modifies the temporal envelope shape of the decoded speech signal, based on the temporal envelope shape determined by the temporal envelope shape determiner, and outputs the modified speech signal.

A speech decoding program according to the second aspect is a speech decoding program for causing a computer provided in a speech decoding device, which decodes an encoded speech signal to output a speech signal, to function as a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal based on the first information, a low frequency temporal envelope shape determiner that receives second information from at least one of the code sequence demultiplexer and the low frequency decoder and determines a temporal envelope shape of the decoded low frequency signal based on the second information, a low frequency temporal envelope modifier that modifies the temporal envelope shape of the decoded low frequency signal, based on the temporal envelope shape determined by the low frequency temporal envelope shape determiner, and outputs the modified low frequency signal, and a low frequency/high frequency signal combiner that receives the low frequency signal whose temporal envelope shape is modified from the low frequency temporal envelope modifier, receives the high frequency signal from the high frequency decoder and combines the low frequency signal whose temporal envelope shape is modified and the high frequency signal to obtain a speech signal to be output.

A speech decoding program according to the third aspect is a speech decoding program for causing a computer provided in a speech decoding device, which decodes an encoded speech signal to output a speech signal, to function as a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal based on the first information, a high frequency temporal envelope shape determiner that receives second information from at least one of the code sequence demultiplexer, the low frequency decoder and the high frequency decoder and determines a temporal envelope shape of the generated high frequency signal based on the second information, a high frequency temporal envelope modifier that modifies the temporal envelope shape of the generated high frequency signal, based on the temporal envelope shape determined by the high frequency temporal envelope shape determiner, and outputs the modified high frequency signal, and a low frequency/high frequency signal combiner that receives the low frequency signal from the low frequency decoder, receives the high frequency signal whose temporal envelope shape is modified from the high frequency temporal envelope modifier and combines the low frequency signal and the high frequency signal whose temporal envelope shape is modified to obtain a speech signal to be output.

A speech decoding program according to the fourth aspect is a speech decoding program for causing a computer provided in a speech decoding device, which decodes an encoded speech signal to output a speech signal, to function as a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives first information from at least one of the code sequence demultiplexer and the low frequency decoder and generates a high frequency signal based on the first information, a low frequency temporal envelope shape determiner that receives second information from at least one of the code sequence demultiplexer and the low frequency decoder, and determines a temporal envelope shape of the decoded low frequency signal based on the second information, a low frequency temporal envelope modifier that modifies the temporal envelope shape of the decoded low frequency signal, based on the temporal envelope shape determined by the low frequency temporal envelope shape determiner, and outputs the modified low frequency signal, a high frequency temporal envelope shape determiner that receives third information from at least one of the code sequence demultiplexer, the low frequency decoder and the high frequency decoder and determines a temporal envelope shape of the generated high frequency signal based on the third information, a high frequency temporal envelope modifier that modifies the temporal envelope shape of the generated high frequency signal, based on the temporal envelope shape determined by the high frequency temporal envelope shape determiner, and outputs the modified high frequency signal, and a low frequency/high frequency signal combiner that receives the low frequency signal whose temporal envelope shape is modified from the low frequency temporal envelope modifier, receives the high frequency signal whose temporal envelope shape is modified from the high frequency temporal envelope modifier and combines the low frequency signal whose temporal envelope shape is modified and the high frequency signal whose temporal envelope shape is modified to obtain a speech signal to be output.

The applicant invented a speech encoding device characterized in having the following first to fourth aspects in order to achieve the object above.

A speech encoding device according to the first aspect is a speech encoding device that encodes an input speech signal to output a code sequence. The speech encoding device comprises a speech encoder that encodes the speech signal, a temporal envelope information encoder that calculates and encodes temporal envelope information of the speech signal, and a code sequence multiplexer that multiplexes a code sequence including the speech signal obtained by the speech encoder and a code sequence of the temporal envelope information obtained by the temporal envelope information encoder.

A speech encoding device according to the second aspect is a speech encoding device that encodes an input speech signal to output a code sequence. The speech encoding device comprises a low frequency encoder that encodes a low frequency component of the speech signal, a high frequency encoder that encodes a high frequency component of the speech signal, a low frequency temporal envelope information encoder that calculates and encodes temporal envelope information of the low frequency component, based on at least one of the speech signal, an encoding result in the low frequency encoder and information obtained in a process of the low frequency encoding, and a code sequence multiplexer that multiplexes a code sequence including the low frequency component obtained by the low frequency encoder, a code sequence including the high frequency component obtained by the high frequency encoder and a code sequence of the temporal envelope information of the low frequency component obtained by the low frequency temporal envelope information encoder.

A speech encoding device according to the third aspect is a speech encoding device that encodes an input speech signal to output a code sequence. The speech encoding device comprises a low frequency encoder that encodes a low frequency component of the speech signal, a high frequency encoder that encodes a high frequency component of the speech signal, a high frequency temporal envelope information encoder that calculates and encodes temporal envelope information of the high frequency component, based on at least one of the speech signal, an encoding result in the low frequency encoder, information obtained in a process of the low frequency encoding, an encoding result in the high frequency encoder and information obtained in a process of the high frequency encoding, and a code sequence multiplexer that multiplexes a code sequence including the low frequency component obtained by the low frequency encoder, a code sequence including the high frequency component obtained by the high frequency encoder and a code sequence of the temporal envelope information of the high frequency component obtained by the high frequency temporal envelope information encoder.

A speech encoding device according to the fourth aspect is a speech encoding device that encodes an input speech signal to output a code sequence. The speech encoding device comprises a low frequency encoder that encodes a low frequency component of the speech signal, a high frequency encoder that encodes a high frequency component of the speech signal, a low frequency temporal envelope information encoder that calculates and encodes temporal envelope information of the low frequency component, based on at least one of the speech signal, an encoding result in the low frequency encoder and information obtained in a process of the low frequency encoding, a high frequency temporal envelope information encoder that calculates and encodes temporal envelope information of the high frequency component, based on at least one of the speech signal, an encoding result in the low frequency encoder, information obtained in a process of the low frequency encoding, an encoding result in the high frequency encoder and information obtained in a process of the high frequency encoding, and a code sequence multiplexer that multiplexes a code sequence including the low frequency component obtained by the low frequency encoder, a code sequence including the high frequency component obtained by the high frequency encoder, a code sequence of the temporal envelope information of the low frequency component obtained by the low frequency temporal envelope information encoder and a code sequence of the temporal envelope information of the high frequency component obtained by the high frequency temporal envelope information encoder.

The invention of the speech encoding device according to the foregoing first to fourth aspects can be understood as an invention of a speech encoding method and can be described as follows.

A speech encoding method according to the first aspect is a speech encoding method executed by a speech encoding device that encodes an input speech signal to output a code sequence. The speech encoding method comprises a speech encoding step of encoding the speech signal, a temporal envelope information encoding step of calculating and encoding temporal envelope information of the speech signal, and a code sequence multiplexing step of multiplexing a code sequence including the speech signal obtained in the speech encoding step and a code sequence of the temporal envelope information obtained in the temporal envelope information encoding step.

A speech encoding method according to the second aspect is a speech encoding method executed by a speech encoding device that encodes an input speech signal to output a code sequence. The speech encoding method comprises a low frequency encoding step of encoding a low frequency component of the speech signal, a high frequency encoding step of encoding a high frequency component of the speech signal, a low frequency temporal envelope information encoding step of calculating and encoding temporal envelope information of the low frequency component, based on at least one of the speech signal, an encoding result in the low frequency encoding step and information obtained in a process of the low frequency encoding, and a code sequence multiplexing step of multiplexing a code sequence including the low frequency component obtained in the low frequency encoding step, a code sequence including the high frequency component obtained in the high frequency encoding step and a code sequence of the temporal envelope information of the low frequency component obtained in the low frequency temporal envelope information encoding step.

A speech encoding method according to the second aspect is a speech encoding method executed by a speech encoding device that encodes an input speech signal to output a code sequence. The speech encoding method comprises a low frequency encoding step of encoding a low frequency component of the speech signal, a high frequency encoding step of encoding a high frequency component of the speech signal, a high frequency temporal envelope information encoding step of calculating and encoding temporal envelope information of the high frequency component, based on at least one of the speech signal, an encoding result in the low frequency encoding step, information obtained in a process of the low frequency encoding, an encoding result in the high frequency encoding step and information obtained in a process of the high frequency encoding, and a code sequence multiplexing step of multiplexing a code sequence including the low frequency component obtained in the low frequency encoding step, a code sequence including the high frequency component obtained in the high frequency encoding step and a code sequence of the temporal envelope information of the high frequency component obtained in the high frequency temporal envelope information encoding step.

A speech encoding method according to the fourth aspect is a speech encoding method executed by a speech encoding device that encodes an input speech signal to output a code sequence. The speech encoding method comprises a low frequency encoding step of encoding a low frequency component of the speech signal, a high frequency encoding step of encoding a high frequency component of the speech signal, a low frequency temporal envelope information encoding step of calculating and encoding temporal envelope information of the low frequency component, based on at least one of the speech signal, an encoding result in the low frequency encoding step and information obtained in a process of the low frequency encoding, a high frequency temporal envelope information encoding step of calculating and encoding temporal envelope information of the high frequency component, based on at least one of the speech signal, an encoding result in the low frequency encoding step, information obtained in a process of the low frequency encoding, an encoding result in the high frequency encoding step and information obtained in a process of the high frequency encoding, and a code sequence multiplexing step of multiplexing a code sequence including the low frequency component obtained in the low frequency encoding step, a code sequence including the high frequency component obtained in the high frequency encoding step, a code sequence of the temporal envelope information of the low frequency component obtained in the low frequency temporal envelope information encoding step and a code sequence of the temporal envelope information of the high frequency component obtained in the high frequency temporal envelope information encoding step.

The invention of the speech encoding device according to the foregoing first to fourth aspects can be understood as an invention of a speech encoding program and can be described as follows.

A speech encoding program according to the first aspect is a speech encoding program for causing a computer provided in a speech encoding device, which encodes an input speech signal to output a code sequence, to function as a speech encoder that encodes the speech signal, a temporal envelope information encoder that calculates and encodes temporal envelope information of the speech signal, and a code sequence multiplexer that multiplexes a code sequence including the speech signal obtained by the speech encoder and a code sequence of the temporal envelope information obtained by the temporal envelope information encoder.

A speech encoding program according to the second aspect is a speech encoding program for causing a computer provided in a speech encoding device, which encodes an input speech signal to output a code sequence, to function as a low frequency encoder that encodes a low frequency component of the speech signal, a high frequency encoder that encodes a high frequency component of the speech signal, a low frequency temporal envelope information encoder that calculates and encodes temporal envelope information of the low frequency component, based on at least one of the speech signal, an encoding result in the low frequency encoder and information obtained in a process of the low frequency encoding, and a code sequence multiplexer that multiplexes a code sequence including the low frequency component obtained by the low frequency encoder, a code sequence including the high frequency component obtained by the high frequency encoder and a code sequence of the temporal envelope information of the low frequency component obtained by the low frequency temporal envelope information encoder.

A speech encoding program according to the third aspect is a speech encoding program for causing a computer provided in a speech encoding device, which encodes an input speech signal to output a code sequence, to function as a low frequency encoder that encodes a low frequency component of the speech signal, a high frequency encoder that encodes a high frequency component of the speech signal, a high frequency temporal envelope information encoder that calculates and encodes temporal envelope information of the high frequency component, based on at least one of the speech signal, an encoding result in the low frequency encoder, information obtained in a process of the low frequency encoding, an encoding result in the high frequency encoder and information obtained in a process of the high frequency encoding, and a code sequence multiplexer that multiplexes a code sequence including the low frequency component obtained by the low frequency encoder, a code sequence including the high frequency component obtained by the high frequency encoder and a code sequence of the temporal envelope information of the high frequency component obtained by the high frequency temporal envelope information encoder.

A speech encoding program according to the fourth aspect is a speech encoding program for causing a computer provided in a speech encoding device, which encodes an input speech signal to output a code sequence, to function as a low frequency encoder that encodes a low frequency component of the speech signal, a high frequency encoder that encodes a high frequency component of the speech signal, a low frequency temporal envelope information encoder that calculates and encodes temporal envelope information of the low frequency component, based on at least one of the speech signal, an encoding result in the low frequency encoder and information obtained in a process of the low frequency encoding, a high frequency temporal envelope information encoder that calculates and encodes temporal envelope information of the high frequency component, based on at least one of the speech signal, an encoding result in the low frequency encoder, information obtained in a process of the low frequency encoding, an encoding result in the high frequency encoder and information obtained in a process of the high frequency encoding, and a code sequence multiplexer that multiplexes a code sequence including the low frequency component obtained by the low frequency encoder, a code sequence including the high frequency component obtained by the high frequency encoder, a code sequence of the temporal envelope information of the low frequency component obtained by the low frequency temporal envelope information encoder and a code sequence of the temporal envelope information of the high frequency component obtained by the high frequency temporal envelope information encoder.

The applicant invented a speech decoding device characterized in having the following fifth to sixth aspects in order to achieve the object above.

A speech decoding device according to the fifth aspect is a speech decoding device that decodes an encoded speech signal to output a speech signal. The speech decoding device comprises a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives information from at least one of the code sequence demultiplexer and the low frequency decoder and generates a high frequency signal based on the information, a temporal envelope shape determiner that receives information from at least one of the code sequence demultiplexer, the low frequency decoder and the high frequency decoder and determines temporal envelope shapes of the decoded low frequency signal and the generated high frequency signal, a low frequency temporal envelope modifier that modifies the temporal envelope shape of the decoded low frequency signal, based on the temporal envelope shape determined by the temporal envelope shape determiner, and outputs the modified low frequency signal, a high frequency temporal envelope modifier that modifies the temporal envelope shape of the generated high frequency signal, based on the temporal envelope shape determined by the temporal envelope shape determiner, and outputs the modified high frequency signal, and a low frequency/high frequency signal combiner that receives the low frequency signal modified in temporal envelope from the low frequency temporal envelope modifier, receives the high frequency signal modified in temporal envelope from the high frequency temporal envelope modifier and synthesizes a speech signal to be output.

A speech decoding device according to the sixth aspect is a speech decoding device that decodes an encoded speech signal to output a speech signal. The speech decoding device comprises a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives information from at least one of the code sequence demultiplexer and the low frequency decoder and generates a high frequency signal based on the information, a temporal envelope shape determiner that receives information from at least one of the code sequence demultiplexer, the low frequency decoder and the high frequency decoder and determines temporal envelope shapes of the decoded low frequency signal and the generated high frequency signal, a temporal envelope modifier that receives the decoded low frequency signal from the low frequency decoder, receives the generated high frequency signal from the high frequency decoder, modifies the temporal envelope shapes of the decoded low frequency signal and the generated high frequency signal, based on the temporal envelope shapes determined by the temporal envelope shape determiner, and outputs the modified low frequency signal and high frequency signal, and a low frequency/high frequency signal combiner that receives the low frequency signal and high frequency signal modified in temporal envelope from the temporal envelope modifier and synthesizes a speech signal to be output.

In the speech decoding device according to the fifth aspect, the high frequency decoder may receive information from at least one of the code sequence demultiplexer, the low frequency decoder and the low frequency temporal envelope modifier, and may generate a high frequency signal based on the information.

Furthermore, in the speech decoding device according to the fifth aspect, the high frequency temporal envelope modifier may modify a temporal envelope shape of an intermediate signal appearing when generating a high frequency signal in the high frequency decoder, based on the temporal envelope shape determined by the temporal envelope shape determiner, and the high frequency decoder may carry out a process of generating a residual high frequency signal based on the intermediate signal whose temporal envelope shape is modified.

Furthermore, in the speech decoding device according to the sixth aspect, the high frequency decoder may receive information from at least one of the code sequence demultiplexer and the low frequency decoder and may generate a high frequency signal based on the information.

Furthermore, in the speech decoding device according to the sixth aspect, the temporal envelope modifier may modify a temporal envelope shape of an intermediate signal appearing when generating a high frequency signal in the high frequency decoder, based on the temporal envelope shape determined by the temporal envelope shape determiner, and the high frequency decoder may carry out a process of generating a residual high frequency signal based on the intermediate signal whose temporal envelope shape is modified.

The invention of the speech decoding device according to the foregoing fifth and sixth aspects may be understood as an invention of a speech decoding method and can be described as follows.

A speech decoding method according to the fifth aspect is a speech decoding method executed by a speech decoding device that decodes an encoded speech signal to output a speech signal. The speech decoding method comprises a code sequence inverse multiplexing step of dividing a code sequence including the encoded speech signal into at least a code sequence including encoded information of a low frequency signal of the speech signal and a code sequence including encoded information of a high frequency signal of the speech signal, a low frequency decoding step of receiving and decoding the code sequence including encoded information of the low frequency signal obtained by division to obtain a low frequency signal, a high frequency decoding step of receiving information obtained in at least one of the code sequence inverse multiplexing step and the low frequency decoding step and generating a high frequency signal based on the information, a temporal envelope shape determining step of receiving information obtained in at least one of the code sequence inverse multiplexing step, the low frequency decoding step and the high frequency decoding step and determining temporal envelope shapes of the decoded low frequency signal and the generated high frequency signal, a low frequency temporal envelope modifying step of modifying the temporal envelope shape of the decoded low frequency signal, based on the temporal envelope shape determined by the temporal envelope shape determining step, and outputting the modified low frequency signal, a high frequency temporal envelope modifying step of modifying the temporal envelope shape of the generated high frequency signal, based on the temporal envelope shape determined by the temporal envelope shape determining step, and outputting the modified high frequency signal, and a low frequency/high frequency signal combining step of receiving the low frequency signal modified in temporal envelope obtained in the low frequency temporal envelope modifying step, receiving the high frequency signal modified in temporal envelope obtained in the high frequency temporal envelope modifying step and synthesizing a speech signal to be output.

A speech decoding method according to the sixth aspect is a speech decoding method executed by a speech decoding device that decodes an encoded speech signal to output a speech signal. The speech decoding method comprises a code sequence inverse multiplexing step of dividing a code sequence including the encoded speech signal into at least a code sequence including encoded information of a low frequency signal of the speech signal and a code sequence including encoded information of a high frequency signal of the speech signal, a low frequency decoding step of receiving and decoding the code sequence including encoded information of the low frequency signal obtained by division to obtain a low frequency signal, a high frequency decoding step of receiving information obtained in at least one of the code sequence inverse multiplexing step and the low frequency decoding step and generating a high frequency signal based on the information, a temporal envelope shape determining step of receiving information obtained in at least one of the code sequence inverse multiplexing step, the low frequency decoding step and the high frequency decoding step and determining temporal envelope shapes of the decoded low frequency signal and the generated high frequency signal, a temporal envelope modifying step of receiving the decoded low frequency signal obtained in the low frequency decoding step, receiving the generated high frequency signal obtained in the high frequency decoding step, modifying the temporal envelope shapes of the decoded low frequency signal and the generated high frequency signal, based on the temporal envelope shapes determined by the temporal envelope shape determining step, and outputting the modified low frequency signal and high frequency signal, and a low frequency/high frequency signal combining step of receiving the low frequency signal and high frequency signal modified in temporal envelope obtained in the temporal envelope modifying step and synthesizing a speech signal to be output.

The invention of the speech decoding device according to the foregoing fifth to sixth aspects may be understood as an invention of a speech decoding program and can be described as follows.

A speech decoding program according to the fifth aspect is a speech decoding program for causing a computer provided in a speech decoding device, which decodes an encoded speech signal to output a speech signal, to function as a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives information from at least one of the code sequence demultiplexer and the low frequency decoder and generates a high frequency signal, based on the information, a temporal envelope shape determiner that receives information from at least one of the code sequence demultiplexer, the low frequency decoder and the high frequency decoder and determines temporal envelope shapes of the decoded low frequency signal and the generated high frequency signal, a low frequency temporal envelope modifier that modifies the temporal envelope shape of the decoded low frequency signal, based on the temporal envelope shape determined by the temporal envelope shape determiner, and outputs the modified low frequency signal, a high frequency temporal envelope modifier that modifies the temporal envelope shape of the generated high frequency signal, based on the temporal envelope shape determined by the temporal envelope shape determiner, and outputs the modified high frequency signal, and a low frequency/high frequency signal combiner that receives the low frequency signal modified in temporal envelope from the low frequency temporal envelope modifier, receives the high frequency signal modified in temporal envelope from the high frequency temporal envelope modifier and synthesizes a speech signal to be output.

A speech decoding program according to the sixth aspect is a speech decoding program for causing a computer provided in a speech decoding device, which decodes an encoded speech signal to output a speech signal, to function as a code sequence demultiplexer that divides a code sequence including the encoded speech signal into at least a code sequence including encoded information of a low frequency signal of the speech signal and a code sequence including encoded information of a high frequency signal of the speech signal, a low frequency decoder that receives and decodes the code sequence including encoded information of the low frequency signal from the code sequence demultiplexer to obtain a low frequency signal, a high frequency decoder that receives information from at least one of the code sequence demultiplexer and the low frequency decoder and generates a high frequency signal based on the information, a temporal envelope shape determiner that receives information from at least one of the code sequence demultiplexer, the low frequency decoder and the high frequency decoder and determines temporal envelope shapes of the decoded low frequency signal and the generated high frequency signal, a temporal envelope modifier that receives the decoded low frequency signal from the low frequency decoder, receives the generated high frequency signal from the high frequency decoder, modifies the temporal envelope shapes of the decoded low frequency signal and the generated high frequency signal, based on the temporal envelope shapes determined by the temporal envelope shape determiner, and outputs the modified low frequency signal and high frequency signal, and a low frequency/high frequency signal combiner that receives the low frequency signal and high frequency signal modified in temporal envelope from the temporal envelope modifier and synthesizes a speech signal to be output.

The present invention is also directed to a speech decoding device that decodes an encoded speech signal to output a speech signal, the speech decoding device comprising:

a code sequence analyzer that analyzes a code sequence including the encoded speech signal;

a speech decoder that receives and decodes the code sequence including the encoded speech signal from the code sequence analyzer to obtain a speech signal;

a temporal envelope shape determiner that receives information from at least one of the code sequence analyzer and the speech decoder and determines a temporal envelope shape of the decoded speech signal based on the information; and a temporal envelope modifier that modifies the temporal envelope shape of the decoded speech signal based on the temporal envelope shape determined by the temporal envelope shape determiner and outputs the modified speech signal.

The present invention is also directed to a speech decoding device that decodes an encoded speech signal to output a speech signal, the speech decoding device comprising:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives first information from at least one of the code sequence demultiplexer and the low frequency decoder and generates a high frequency signal based on the first information;

a low frequency temporal envelope shape determiner that receives second information from at least one of the code sequence demultiplexer and the low frequency decoder and determines a temporal envelope shape of the decoded low frequency signal based on the second information;

a low frequency temporal envelope modifier that modifies the temporal envelope shape of the decoded low frequency signal based on the temporal envelope shape determined by the low frequency temporal envelope shape determiner and outputs the modified low frequency signal; and a low frequency/high frequency signal combiner that receives the low frequency signal, whose temporal envelope shape is modified, from the low frequency temporal envelope modifier, receives the high frequency signal from the high frequency decoder and combines the low frequency signal, whose temporal envelope shape is modified, and the high frequency signal to obtain a speech signal to be output.

The present invention is also directed to a speech decoding device that decodes an encoded speech signal to output a speech signal, the speech decoding device comprising:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives first information from at least one of the code sequence demultiplexer and the low frequency decoder and generates a high frequency signal based on the first information;

a low frequency temporal envelope shape determiner that receives second information from at least one of the code sequence demultiplexer and the low frequency decoder and determines a temporal envelope shape of the decoded low frequency signal based on the second information;

a low frequency temporal envelope modifier that modifies the temporal envelope shape of the decoded low frequency signal based on the temporal envelope shape determined by the low frequency temporal envelope shape determiner and outputs the modified low frequency signal;

a high frequency temporal envelope shape determiner that receives third information from at least one of the code sequence demultiplexer, the low frequency decoder and the high frequency decoder and determines a temporal envelope shape of the generated high frequency signal based on the third information;

a high frequency temporal envelope modifier that modifies the temporal envelope shape of the generated high frequency signal based on the temporal envelope shape determined by the high frequency temporal envelope shape determiner and outputs the modified high frequency signal; and a low frequency/high frequency signal combiner that receives the low frequency signal, whose temporal envelope shape is modified, from the low frequency temporal envelope modifier, receives the high frequency signal, whose temporal envelope shape is modified, from the high frequency temporal envelope modifier and combines the low frequency signal, whose temporal envelope shape is modified, and the high frequency signal, whose temporal envelope shape is modified, to obtain a speech signal to be output.

In the speech decoding device discussed above, the high frequency decoder receives information from at least one of the code sequence demultiplexer, the low frequency decoder and the low frequency temporal envelope modifier and generates a high frequency signal based on the information.

In the speech decoding device discussed above, the high frequency temporal envelope modifier modifies, based on the temporal envelope shape determined by the high frequency temporal envelope shape determiner, a temporal envelope shape of an intermediate signal appearing when the high frequency decoder generates a high frequency signal, and the high frequency decoder generates a residual high frequency signal based on the intermediate signal whose temporal envelope shape is modified.

The present invention is also directed to a speech encoding device that encodes an input speech signal to output a code sequence, the speech encoding device comprising:

a speech encoder that encodes the speech signal;

a temporal envelope information encoder that calculates and encodes temporal envelope information of the speech signal; and a code sequence multiplexer that multiplexes a code sequence including the speech signal obtained by the speech encoder and a code sequence of the temporal envelope information obtained by the temporal envelope information encoder.

The present invention is also directed to a speech encoding device that encodes an input speech signal to output a code sequence, the speech encoding device comprising:

a low frequency encoder that encodes a low frequency component of the speech signal;

a high frequency encoder that encodes a high frequency component of the speech signal;

a low frequency temporal envelope information encoder that calculates and encodes temporal envelope information of the low frequency component, based on at least one of the speech signal, an encoding result in the low frequency encoder and information obtained in a process of the low frequency encoding; and a code sequence multiplexer that multiplexes a code sequence including the low frequency component obtained by the low frequency encoder, a code sequence including the high frequency component obtained by the high frequency encoder and a code sequence of the temporal envelope information of the low frequency component obtained by the low frequency temporal envelope information encoder.

The present invention is also directed to a speech encoding device that encodes an input speech signal to output a code sequence, the speech encoding device comprising:

a low frequency encoder that encodes a low frequency component of the speech signal;

a high frequency encoder that encodes a high frequency component of the speech signal;

a low frequency temporal envelope information encoder that calculates and encodes temporal envelope information of the low frequency component, based on at least one of the speech signal, an encoding result in the low frequency encoder and information obtained in a process of the low frequency encoding;

a high frequency temporal envelope information encoder that calculates and encodes temporal envelope information of the high frequency component, based on at least one of the speech signal, an encoding result in the low frequency encoder, information obtained in a process of the low frequency encoding, an encoding result in the high frequency encoder and information obtained in a process of the high frequency encoding; and a code sequence multiplexer that multiplexes a code sequence including the low frequency component obtained by the low frequency encoder, a code sequence including the high frequency component obtained by the high frequency encoder, a code sequence of the temporal envelope information of the low frequency component obtained by the low frequency temporal envelope information encoder and a code sequence of the temporal envelope information of the high frequency component obtained by the high frequency temporal envelope information encoder.

The present invention is also directed to a speech decoding method executed by a speech decoding device that decodes an encoded speech signal to output a speech signal, the speech decoding method comprising:

a code sequence analyzing step of analyzing a code sequence including the encoded speech signal;

a speech decoding step of receiving and decoding the analyzed code sequence including the encoded speech signal to obtain a speech signal;

a temporal envelope shape determining step of receiving information obtained in at least one of the code sequence analyzing step and the speech decoding step, and determining a temporal envelope shape of the decoded speech signal based on the information; and a temporal envelope modifying step of modifying the temporal envelope shape of the decoded speech signal based on the temporal envelope shape determined in the temporal envelope shape determining step and outputting the modified speech signal.

The present invention is also directed to a speech decoding method executed by a speech decoding device that decodes an encoded speech signal to output a speech signal, the speech decoding method comprising:

a code sequence inverse multiplexing step of dividing a code sequence including the encoded speech signal into at least a code sequence including encoded information of a low frequency signal of the speech signal and a code sequence including encoded information of a high frequency signal of the speech signal;

a low frequency decoding step of receiving and decoding the code sequence including encoded information of the low frequency signal obtained by division to obtain a low frequency signal;

a high frequency decoding step of receiving first information obtained in at least one of the code sequence inverse multiplexing step and the low frequency decoding step and generating a high frequency signal based on the first information;

a low frequency temporal envelope shape determining step of receiving second information obtained in at least one of the code sequence inverse multiplexing step and the low frequency decoding step and determining a temporal envelope shape of the decoded low frequency signal based on the second information;

a low frequency temporal envelope modifying step of modifying the temporal envelope shape of the decoded low frequency signal based on the temporal envelope shape determined by the low frequency temporal envelope shape determining step, and outputting the modified low frequency signal; and a low frequency/high frequency signal combining step of receiving the low frequency signal, whose temporal envelope shape is modified, obtained in the low frequency temporal envelope modifying step, receiving the high frequency signal obtained in the high frequency decoding step, and combining the low frequency signal, whose temporal envelope shape is modified, and the high frequency signal to obtain a speech signal to be output.

The present invention is also directed to a speech decoding method executed by a speech decoding device that decodes an encoded speech signal to output a speech signal, the speech decoding method comprising:

a code sequence inverse multiplexing step of dividing a code sequence including the encoded speech signal into at least a code sequence including encoded information of a low frequency signal of the speech signal and a code sequence including encoded information of a high frequency signal of the speech signal;

a low frequency decoding step of receiving and decoding the code sequence including encoded information of the low frequency signal obtained in the code sequence inverse multiplexing step to obtain a low frequency signal; a high frequency decoding step of receiving first information obtained in at least one of the code sequence inverse multiplexing step and the low frequency decoding step and generating a high frequency signal based on the first information;

a low frequency temporal envelope shape determining step of receiving second information obtained in at least one of the code sequence inverse multiplexing step and the low frequency decoding step and determining a temporal envelope shape of the decoded low frequency signal based on the second information;

a low frequency temporal envelope modifying step of modifying the temporal envelope shape of the decoded low frequency signal based on the temporal envelope shape determined in the low frequency temporal envelope shape determining step, and outputting the modified low frequency signal; a high frequency temporal envelope shape determining step of receiving third information from at least one of the code sequence inverse multiplexing step, the low frequency decoding step and the high frequency decoding step and determining a temporal envelope shape of the generated high frequency signal based on the third information;

a high frequency temporal envelope modifying step of modifying the temporal envelope shape of the generated high frequency signal based on the temporal envelope shape determined in the high frequency temporal envelope shape determining step and outputting the modified high frequency signal; and a low frequency/high frequency signal combining step of receiving the low frequency signal, whose temporal envelope shape is modified, obtained in the low frequency temporal envelope modifying step, receiving the high frequency signal, whose temporal envelope shape is modified, obtained in the high frequency temporal envelope modifying step and combining the low frequency signal, whose temporal envelope shape is modified, and the high frequency signal, whose temporal envelope shape is modified, to obtain a speech signal to be output.

The present invention is also directed to a speech encoding method executed by a speech encoding device that encodes an input speech signal to output a code sequence, the speech encoding method comprising:

a speech encoding step of encoding the speech signal; a temporal envelope information encoding step of calculating and encoding temporal envelope information of the speech signal; and a code sequence multiplexing step of multiplexing a code sequence including the speech signal obtained in the speech encoding step and a code sequence of the temporal envelope information obtained in the temporal envelope information encoding step.

The present invention is also directed to a speech encoding method executed by a speech encoding device that encodes an input speech signal to output a code sequence, the speech encoding method comprising:

a low frequency encoding step of encoding a low frequency component of the speech signal;

a high frequency encoding step of encoding a high frequency component of the speech signal;

a low frequency temporal envelope information encoding step of calculating and encoding temporal envelope information of the low frequency component, based on at least one of the speech signal, an encoding result in the low frequency encoding step and information obtained in a process of the low frequency encoding; and a code sequence multiplexing step of multiplexing a code sequence including the low frequency component obtained in the low frequency encoding step, a code sequence including the high frequency component obtained in the high frequency encoding step and a code sequence of the temporal envelope information of the low frequency component obtained in the low frequency temporal envelope information encoding step.

The present invention is also directed to a speech encoding method executed by a speech encoding device that encodes an input speech signal to output a code sequence, the speech encoding method comprising:

a low frequency encoding step of encoding a low frequency component of the speech signal;

a high frequency encoding step of encoding a high frequency component of the speech signal;

a low frequency temporal envelope information encoding step of calculating and encoding temporal envelope information of the low frequency component, based on at least one of the speech signal, an encoding result in the low frequency encoding step, and information obtained in the low frequency encoding step;

a high frequency temporal envelope information encoding step of calculating and encoding temporal envelope information of the high frequency component, based on at least one of the speech signal, an encoding result in the low frequency encoding step, information obtained in the low frequency encoding step, an encoding result in the high frequency encoding step and information obtained in the high frequency encoding step; and a code sequence multiplexing step of multiplexing a code sequence including the low frequency component obtained in the low frequency encoding step, a code sequence including the high frequency component obtained in the high frequency encoding step, a code sequence of the temporal envelope information of the low frequency component obtained in the low frequency temporal envelope information encoding step, and a code sequence of the temporal envelope information of the high frequency component obtained in the high frequency temporal envelope information encoding step.

The present invention is also directed to a speech decoding program for causing a computer provided in a speech decoding device, which decodes an encoded speech signal to output a speech signal, to function as:

a code sequence analyzer that analyzes a code sequence including the encoded speech signal;

a speech decoder that receives and decodes the code sequence including the encoded speech signal from the code sequence analyzer to obtain a speech signal; a temporal envelope shape determiner that receives information from at least one of the code sequence analyzer and the speech decoder and determines a temporal envelope shape of the decoded speech signal based on the information; and a temporal envelope modifier that modifies the temporal envelope shape of the decoded speech signal based on the temporal envelope shape determined by the temporal envelope shape determiner, and outputs the modified speech signal.

The present invention is also directed to a speech decoding program for causing a computer provided in a speech decoding device, which decodes an encoded speech signal to output a speech signal, to function as:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives and decodes the code sequence including encoded information of the low frequency signal from the code sequence demultiplexer to obtain a low frequency signal;

a high frequency decoder that receives first information from at least one of the code sequence demultiplexer and the low frequency decoder and generates a high frequency signal based on the first information;

a low frequency temporal envelope shape determiner that receives second information from at least one of the code sequence demultiplexer and the low frequency decoder and determines a temporal envelope shape of the decoded low frequency signal based on the second information;

a low frequency temporal envelope modifier that modifies the temporal envelope shape of the decoded low frequency signal based on the temporal envelope shape determined by the low frequency temporal envelope shape determiner and outputs the modified low frequency signal; and a low frequency/high frequency signal combiner that receives the low frequency signal. whose temporal envelope shape is modified, from the low frequency temporal envelope modifier, receives the high frequency signal from the high frequency decoder and combines the low frequency signal, whose temporal envelope shape is modified, and the high frequency signal to obtain a speech signal to be output.

The present invention is also directed to a speech decoding program for causing a computer provided in a speech decoding device, which decodes an encoded speech signal to output a speech signal, to function as:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives first information from at least one of the code sequence demultiplexer and the low frequency decoder and generates a high frequency signal based on the first information;

a high frequency temporal envelope shape determiner that receives second information from at least one of the code sequence demultiplexer, the low frequency decoder and the high frequency decoder and determines a temporal envelope shape of the generated high frequency signal based on the second information;

a high frequency temporal envelope modifier that modifies the temporal envelope shape of the generated high frequency signal based on the temporal envelope shape determined by the high frequency temporal envelope shape determiner and outputs the modified high frequency signal; and a low frequency/high frequency signal combiner that receives the low frequency signal from the low frequency decoder, receives the high frequency signal, whose temporal envelope shape is modified, from the high frequency temporal envelope modifier and combines the low frequency signal and the high frequency signal, whose temporal envelope shape is modified, to obtain a speech signal to be output.

The present invention is also directed to a speech decoding program for causing a computer provided in a speech decoding device, which decodes an encoded speech signal to output a speech signal, to function as:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives first information from at least one of the code sequence demultiplexer and the low frequency decoder and generates a high frequency signal based on the first information;

a low frequency temporal envelope shape determiner that receives second information from at least one of the code sequence demultiplexer and the low frequency decoder and determines a temporal envelope shape of the decoded low frequency signal based on the second information;

a low frequency temporal envelope modifier that modifies the temporal envelope shape of the decoded low frequency signal based on the temporal envelope shape determined by the low frequency temporal envelope shape determiner and outputs the modified low frequency signal;

a high frequency temporal envelope shape determiner that receives third information from at least one of the code sequence demultiplexer, the low frequency decoder and the high frequency decoder and determines a temporal envelope shape of the generated high frequency signal based on the third information;

a high frequency temporal envelope modifier that modifies the temporal envelope shape of the generated high frequency signal based on the temporal envelope shape determined by the high frequency temporal envelope shape determiner, and outputs the modified high frequency signal; and a low frequency/high frequency signal combiner that receives the low frequency signal, whose temporal envelope shape is modified, from the low frequency temporal envelope modifier, receives the high frequency signal, whose temporal envelope shape is modified, from the high frequency temporal envelope modifier and combines the low frequency signal, whose temporal envelope shape is modified, and the high frequency signal, whose temporal envelope shape is modified, to obtain a speech signal to be output.

The present invention is also directed to a speech encoding program for causing a computer provided in a speech encoding device, which encodes an input speech signal to output a code sequence, to function as:

a speech encoder that encodes the speech signal;

a temporal envelope information encoder that calculates and encodes temporal envelope information of the speech signal; and a code sequence multiplexer that multiplexes a code sequence including the speech signal obtained by the speech encoder and a code sequence of the temporal envelope information obtained by the temporal envelope information encoder.

The present invention is also directed to a speech encoding program for causing a computer provided in a speech encoding device, which encodes an input speech signal to output a code sequence, to function as:

a low frequency encoder that encodes a low frequency component of the speech signal;

a high frequency encoder that encodes a high frequency component of the speech signal;

a low frequency temporal envelope information encoder that calculates and encodes temporal envelope information of the low frequency component, based on at least one of the speech signal, an encoding result in the low frequency encoder and information obtained by the low frequency encoder; and a code sequence multiplexer that multiplexes a code sequence including the low frequency component obtained by the low frequency encoder, a code sequence including the high frequency component obtained by the high frequency encoder and a code sequence of the temporal envelope information of the low frequency component obtained by the low frequency temporal envelope information encoder.

The present invention is also directed to a speech encoding program for causing a computer provided in a speech encoding device, which encodes an input speech signal to output a code sequence, to function as:

a low frequency encoder that encodes a low frequency component of the speech signal;

a high frequency encoder that encodes a high frequency component of the speech signal;

a high frequency temporal envelope information encoder that calculates and encodes temporal envelope information of the high frequency component, based on at least one of the speech signal, an encoding result from the low frequency encoder, information obtained by the low frequency encoder, an encoding result from the high frequency encoder, and information obtained by the high frequency encoder; and a code sequence multiplexer that multiplexes a code sequence including the low frequency component obtained by the low frequency encoder, a code sequence including the high frequency component obtained by the high frequency encoder, and a code sequence of the temporal envelope information of the high frequency component obtained by the high frequency temporal envelope information encoder.

The present invention is also directed to a speech encoding program for causing a computer provided in a speech encoding device, which encodes an input speech signal to output a code sequence, to function as:

a low frequency encoder that encodes a low frequency component of the speech signal;

a high frequency encoder that encodes a high frequency component of the speech signal;

a low frequency temporal envelope information encoder that calculates and encodes temporal envelope information of the low frequency component, based on at least one of the speech signal, an encoding result from the low frequency encoder and information obtained by the low frequency encoder;

a high frequency temporal envelope information encoder that calculates and encodes temporal envelope information of the high frequency component, based on at least one of the speech signal, an encoding result from the low frequency encoder, information obtained by the low frequency encoder, an encoding result from the high frequency encoder, and information obtained by the high frequency encoder; and a code sequence multiplexer that multiplexes a code sequence including the low frequency component obtained by the low frequency encoder, a code sequence including the high frequency component obtained by the high frequency encoder, a code sequence of the temporal envelope information of the low frequency component obtained by the low frequency temporal envelope information encoder and a code sequence of the temporal envelope information of the high frequency component obtained by the high frequency temporal envelope information encoder.

The present invention is also directed to a speech decoding device that decodes an encoded speech signal to output a speech signal, the speech decoding device comprising:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives information from at least one of the code sequence demultiplexer and the low frequency decoder and generates a high frequency signal based on the information;

a temporal envelope shape determiner that receives information from at least one of the code sequence demultiplexer, the low frequency decoder, and the high frequency decoder and determines temporal envelope shapes of the decoded low frequency signal and the generated high frequency signal;

a low frequency temporal envelope modifier that modifies the temporal envelope shape of the decoded low frequency signal based on the temporal envelope shape determined by the temporal envelope shape determiner and outputs the modified low frequency signal;

a high frequency temporal envelope modifier that modifies the temporal envelope shape of the generated high frequency signal based on the temporal envelope shape determined by the temporal envelope shape determiner and outputs the modified high frequency signal; and a low frequency/high frequency signal combiner that receives the low frequency signal, whose temporal envelope is modified, from the low frequency temporal envelope modifier, receives the high frequency signal, whose temporal envelope is modified, from the high frequency temporal envelope modifier and synthesizes a speech signal to be output.

The present invention is also directed to a speech decoding device that decodes an encoded speech signal to output a speech signal, the speech decoding device comprising:

a code sequence demultiplexer that divides a code sequence including the encoded speech signal into at least a code sequence including encoded information of a low frequency signal of the speech signal and a code sequence including encoded information of a high frequency signal of the speech signal;

a low frequency decoder that receives from the code sequence demultiplexer and decodes the code sequence including encoded information of the low frequency signal to obtain a low frequency signal;

a high frequency decoder that receives information from at least one of the code sequence demultiplexer and the low frequency decoder and generates a high frequency signal based on the information;

a temporal envelope shape determiner that receives information from at least one of the code sequence demultiplexer, the low frequency decoder and the high frequency decoder and determines temporal envelope shapes of the decoded low frequency signal and the generated high frequency signal;

a temporal envelope modifier that receives the decoded low frequency signal from the low frequency decoder, receives the generated high frequency signal from the high frequency decoder, modifies the temporal envelope shapes of the decoded low frequency signal and the generated high frequency signal, based on the temporal envelope shapes determined by the temporal envelope shape determiner, and outputs the modified low frequency signal and high frequency signal; and a low frequency/high frequency signal combiner that receives the low frequency signal and high frequency signal, whose temporal envelopes are modified, from the temporal envelope modifier and synthesizes a speech signal to be output.

In the speech decoding device discussed above, the high frequency decoder receives information from at least one of the code sequence demultiplexer, the low frequency decoder and the low frequency temporal envelope modifier and generates a high frequency signal based on the information.

In the speech decoding device discussed above, the high frequency temporal envelope modifier modifies, based on the temporal envelope shape determined by the temporal envelope shape determiner, a temporal envelope shape of an intermediate signal appearing when the high frequency decoder generates a high frequency signal, and the high frequency decoder generates a residual high frequency signal based on the intermediate signal whose temporal envelope shape is modified.

In the speech decoding device discussed above, the high frequency decoder receives information from at least one of the code sequence demultiplexer and the low frequency decoder and generates a high frequency signal based on the information.

In the speech decoding device discussed above, the temporal envelope modifier modifies, based on the temporal envelope shape determined by the temporal envelope shape determiner, a temporal envelope shape of an intermediate signal appearing when the high frequency decoder generates a high frequency signal, and the high frequency decoder generates a residual high frequency signal based on the intermediate signal whose temporal envelope shape is modified.

The present invention is also directed to a speech decoding method executed by a speech decoding device that decodes an encoded speech signal to output a speech signal, the speech decoding method comprising:

a code sequence inverse multiplexing step of dividing a code sequence including the encoded speech signal into at least a code sequence including encoded information of a low frequency signal of the speech signal and a code sequence including encoded information of a high frequency signal of the speech signal;

a low frequency decoding step of receiving and decoding the code sequence including encoded information of the low frequency signal obtained in the code sequence inverse multiplexing step to obtain a low frequency signal; a high frequency decoding step of receiving information obtained in at least one of the code sequence inverse multiplexing step and the low frequency decoding step and generating a high frequency signal based on the information;

a temporal envelope shape determining step of receiving information obtained in at least one of the code sequence inverse multiplexing step, the low frequency decoding step and the high frequency decoding step and determining temporal envelope shapes of the decoded low frequency signal and the generated high frequency signal;

a low frequency temporal envelope modifying step of modifying the temporal envelope shape of the decoded low frequency signal based on the temporal envelope shape determined by the temporal envelope shape determining step and outputting the modified low frequency signal;

a high frequency temporal envelope modifying step of modifying the temporal envelope shape of the generated high frequency signal based on the temporal envelope shape determined by the temporal envelope shape determining step and outputting the modified high frequency signal; and a low frequency/high frequency signal combining step of receiving the low frequency signal modified in temporal envelope obtained in the low frequency temporal envelope modifying step, receiving the high frequency signal modified in temporal envelope obtained in the high frequency temporal envelope modifying step and synthesizing a speech signal to be output.

The present invention is also directed to a speech decoding method executed by a speech decoding device that decodes an encoded speech signal to output a speech signal, the speech decoding method comprising:

a code sequence inverse multiplexing step of dividing a code sequence including the encoded speech signal into at least a code sequence including encoded information of a low frequency signal of the speech signal and a code sequence including encoded information of a high frequency signal of the speech signal;

a low frequency decoding step of receiving and decoding the code sequence including encoded information of the low frequency signal obtained in the code sequence inverse multiplexing step to obtain a low frequency signal; a high frequency decoding step of receiving information obtained in at least one of the code sequence inverse multiplexing step and the low frequency decoding step and generating a high frequency signal based on the information;

a temporal envelope shape determining step of receiving information obtained in at least one of the code sequence inverse multiplexing step, the low frequency decoding step and the high frequency decoding step and determining temporal envelope shapes of the decoded low frequency signal and the generated high frequency signal;

a temporal envelope modifying step of receiving the decoded low frequency signal obtained in the low frequency decoding step, receiving the generated high frequency signal obtained in the high frequency decoding step, modifying the temporal envelope shapes of the decoded low frequency signal and the generated high frequency signal, based on the temporal envelope shapes determined by the temporal envelope shape determining step and outputting the modified low frequency signal and high frequency signal; and a low frequency/high frequency signal combining step of receiving the low frequency signal and high frequency signal, whose temporal envelopes are modified, obtained in the temporal envelope modifying step and synthesizing a speech signal to be output.

The present invention is also directed to a speech decoding program for causing a computer provided in a speech decoding device, which decodes an encoded speech signal to output a speech signal, to function as:

a code sequence demultiplexer that divides a code sequence including the encoded speech signal into at least a code sequence including encoded information of a low frequency signal of the speech signal and a code sequence including encoded information of a high frequency signal of the speech signal; a low frequency decoder that receives from the code sequence demultiplexer and decodes the code sequence including encoded information of the low frequency signal to obtain a low frequency signal;

a high frequency decoder that receives information from at least one of the code sequence demultiplexer and the low frequency decoder and generates a high frequency signal based on the information;

a temporal envelope shape determiner that receives information from at least one of the code sequence demultiplexer, the low frequency decoder and the high frequency decoder and determines temporal envelope shapes of the decoded low frequency signal and the generated high frequency signal;

a low frequency temporal envelope modifier that modifies the temporal envelope shape of the decoded low frequency signal based on the temporal envelope shape determined by the temporal envelope shape determiner and outputs the modified low frequency signal;

a high frequency temporal envelope modifier that modifies the temporal envelope shape of the generated high frequency signal based on the temporal envelope shape determined by the temporal envelope shape determiner and outputs the modified high frequency signal; and a low frequency/high frequency signal combiner that receives the low frequency signal modified in temporal envelope from the low frequency temporal envelope modifier, receives the high frequency signal, whose temporal envelope is modified, from the high frequency temporal envelope modifier and synthesizes a speech signal to be output.

The present invention is also directed to a speech decoding program for causing a computer provided in a speech decoding device, which decodes an encoded speech signal to output a speech signal, to function as:

a code sequence demultiplexer that divides a code sequence including the encoded speech signal into at least a code sequence including encoded information of a low frequency signal of the speech signal and a code sequence including encoded information of a high frequency signal of the speech signal; a low frequency decoder that receives from the code sequence demultiplexer and decodes the code sequence including encoded information of the low frequency signal to obtain a low frequency signal;

a high frequency decoder that receives information from at least one of the code sequence demultiplexer and the low frequency decoder and generates a high frequency signal based on the information;

a temporal envelope shape determiner that receives information from at least one of the code sequence demultiplexer, the low frequency decoder and the high frequency decoder and determines temporal envelope shapes of the decoded low frequency signal and the generated high frequency signal;

a temporal envelope modifier that receives the decoded low frequency signal from the low frequency decoder, receives the generated high frequency signal from the high frequency decoder, modifies the temporal envelope shapes of the decoded low frequency signal and the generated high frequency signal, based on the temporal envelope shapes determined by the temporal envelope shape determiner, and outputs the modified low frequency signal and high frequency signal; and a low frequency/high frequency signal combiner that receives the low frequency signal and high frequency signal, whose temporal envelopes are modified, from the temporal envelope modifier and synthesizes a speech signal to be output.

BRIEF DESCRIPTION OF THE DRAWINGS

FIG. 120 is a figure showing the configuration of the second modification 160B of the speech decoding device according to the eighth embodiment.

FIG. 121 is a figure showing the configuration of the 3rd modification 160C of the speech decoding device according to the eighth embodiment.

FIG. 122 is a flow chart showing the operation of the 3rd modification 160C of the speech decoding device according to the eighth embodiment.

FIG. 123 is a figure showing the configuration of the 4th modification 160D of the speech decoding device according to the eighth embodiment.

FIG. 124 is a flow chart showing the operation of the 4th modification 160D of the speech decoding device according to the eighth embodiment.

FIG. 125 is a figure showing the configuration of the fifth modification 160E of the speech decoding device according to the eighth embodiment.

FIG. 126 is a flow chart showing the operation of the fifth modification 160E of the speech decoding device according to the eighth embodiment.

FIG. 127 is a figure showing the configuration of the sixth modification 160F of the speech decoding device according to the eighth embodiment.

FIG. 128 is a flow chart showing the operation of the sixth modification 160F of the speech decoding device according to the eighth embodiment.

FIG. 129 is a figure showing the configuration of the seventh modification 160G of the speech decoding device according to the eighth embodiment.

FIG. 130 is a flow chart showing the operation of the seventh modification 160G of the speech decoding device according to the eighth embodiment.

FIG. 131 is a figure showing the configuration of the eighth modification 160H of the speech decoding device according to the eighth embodiment.

Figure 132:
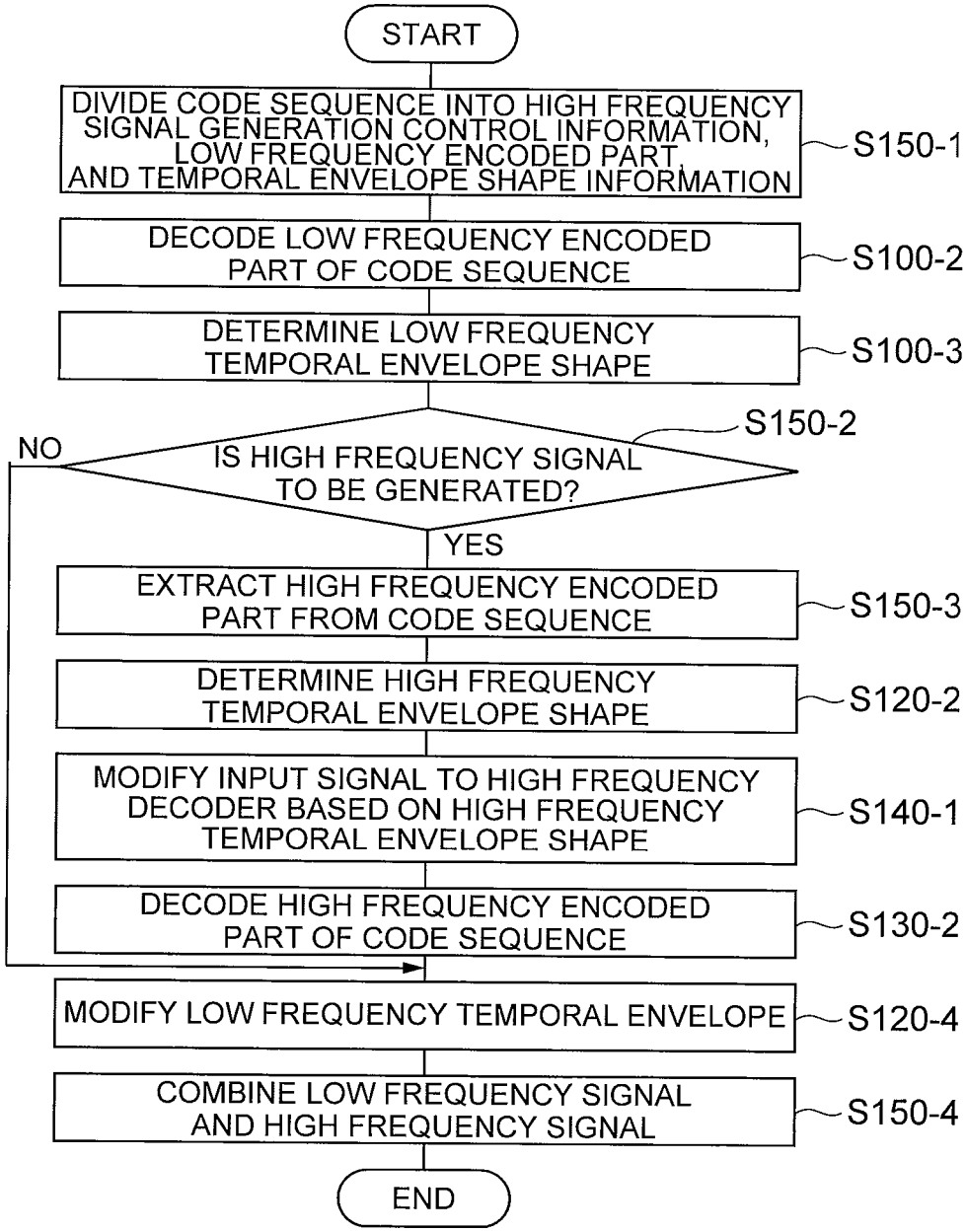

FIG. 132 is a flow chart showing the operation of the eighth modification 160H of the speech decoding device according to the eighth embodiment.

Figure 133:
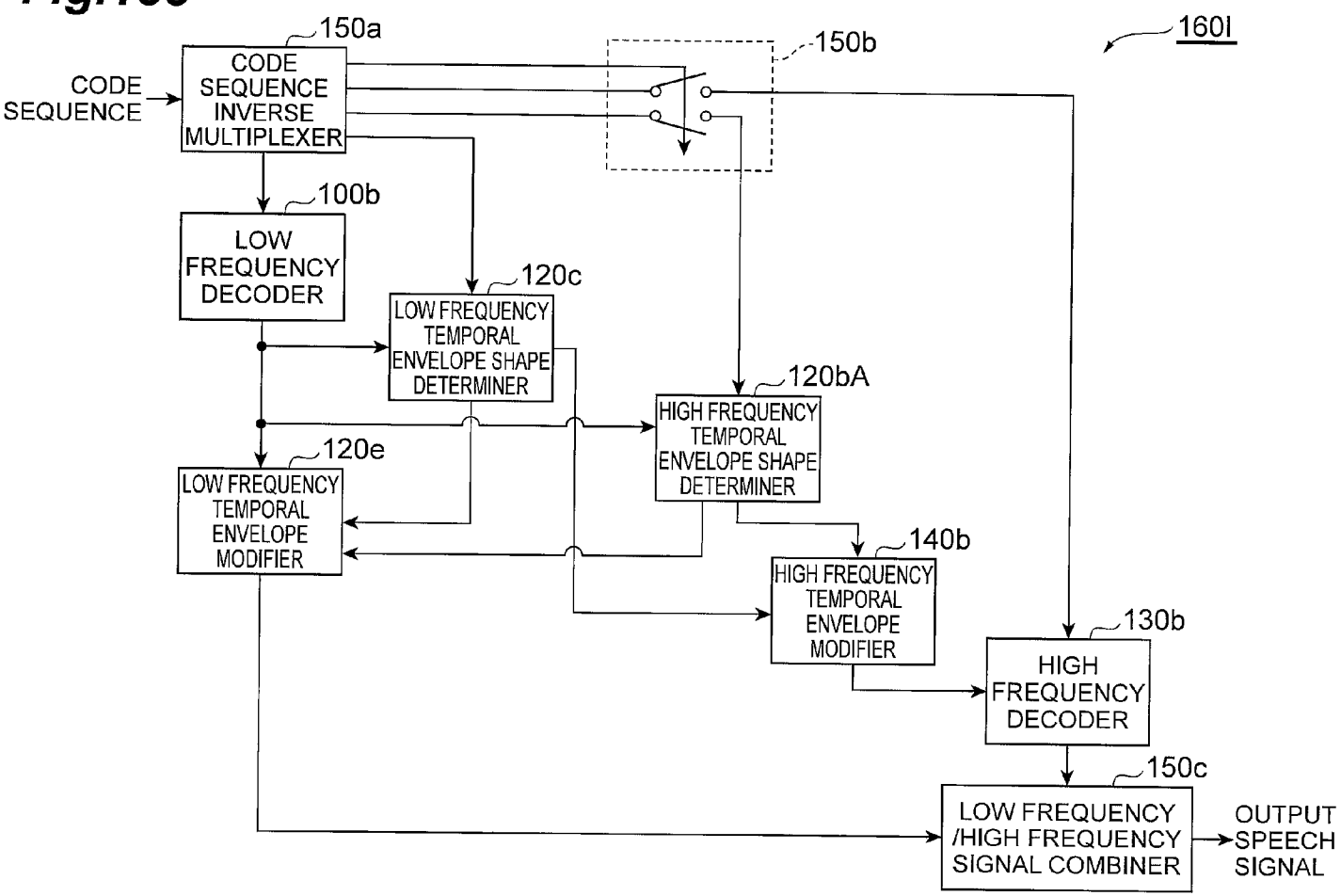

FIG. 133 is a figure showing the configuration of the ninth modification 160I of the speech decoding device according to the eighth embodiment.

Figure 134:
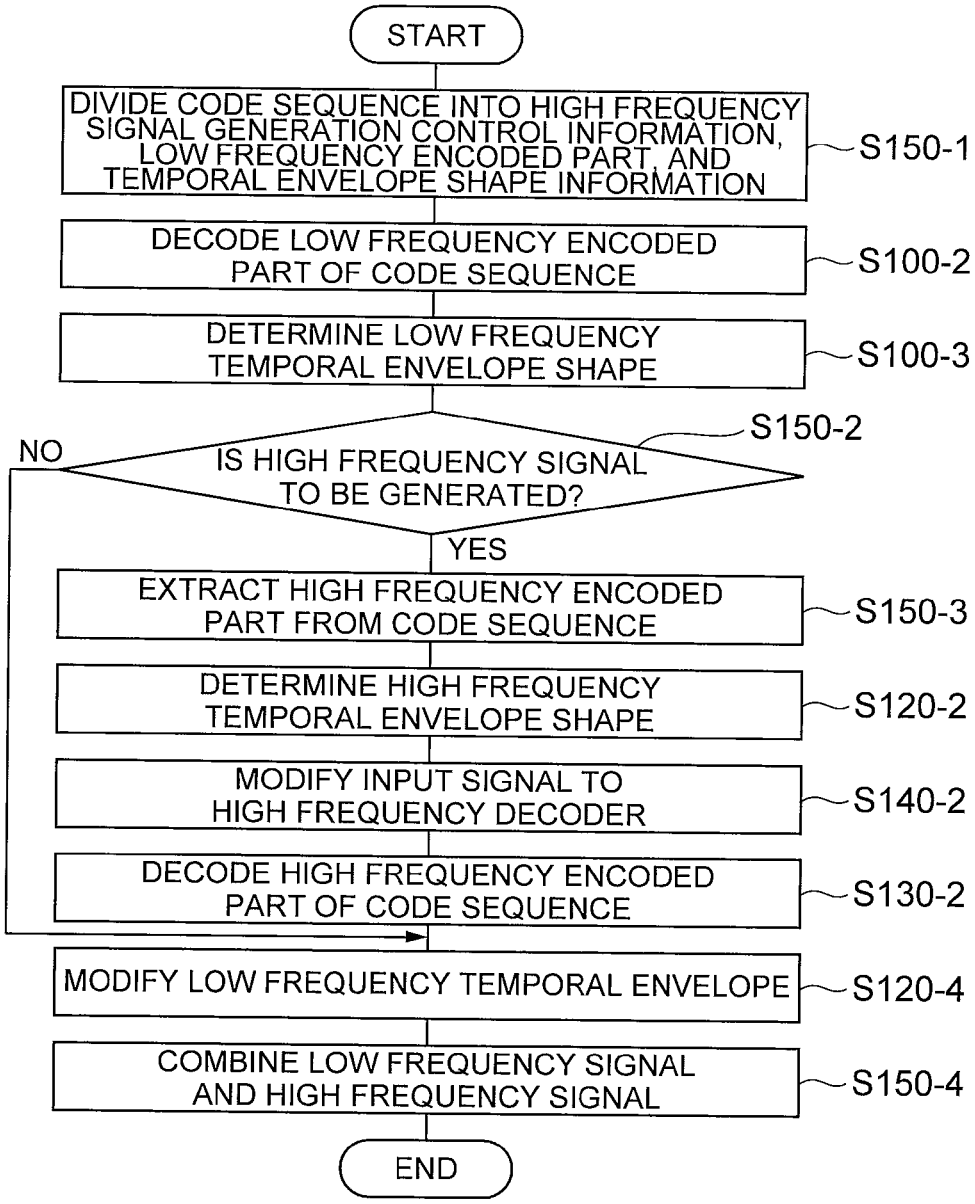

FIG. 134 is a flow chart showing the operation of the ninth modification 160I of the speech decoding device according to the eighth embodiment.

Figure 135:
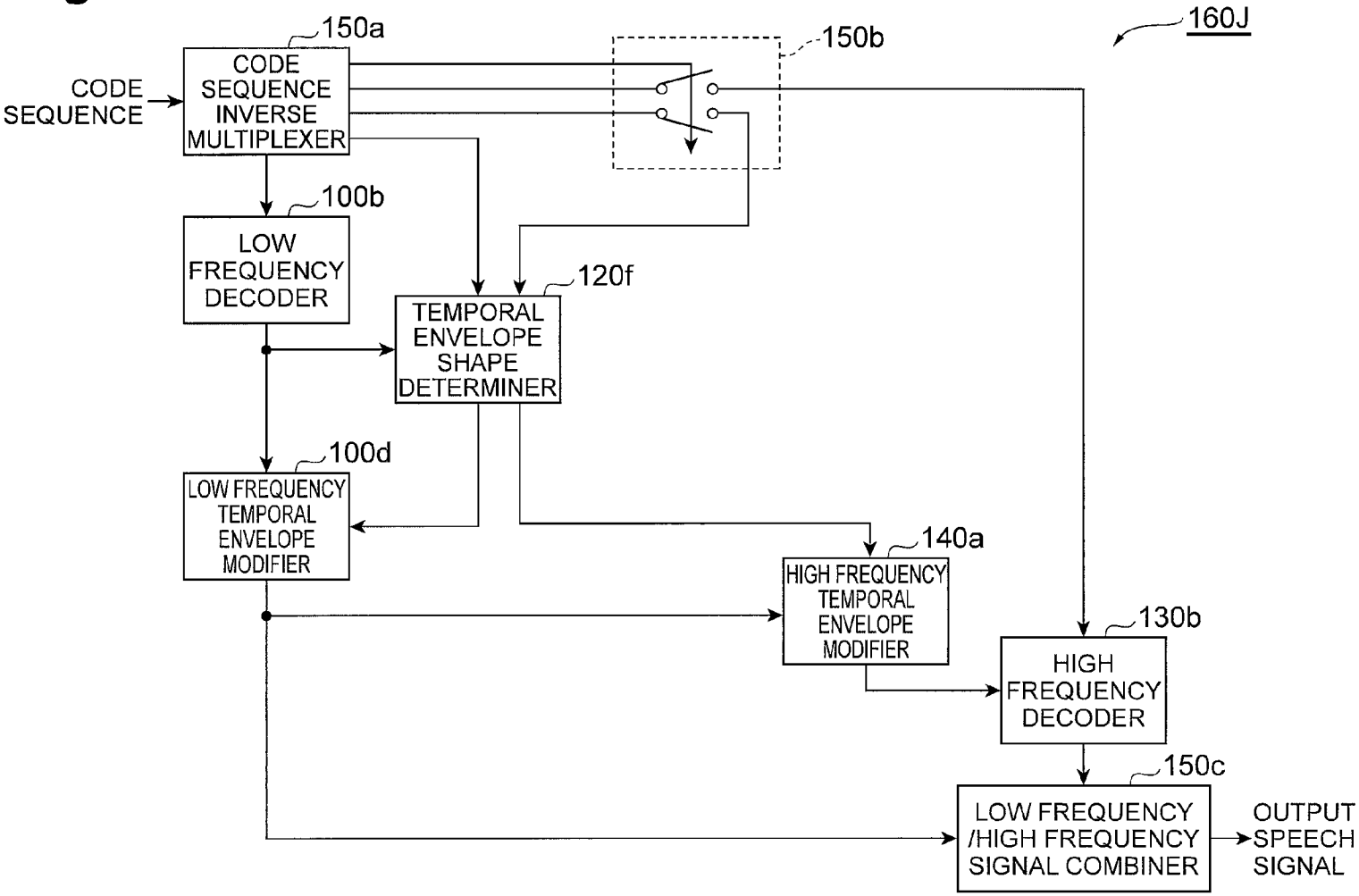

FIG. 135 is a figure showing the configuration of the tenth modification 160J of the speech decoding device according to the eighth embodiment.

Figure 136:
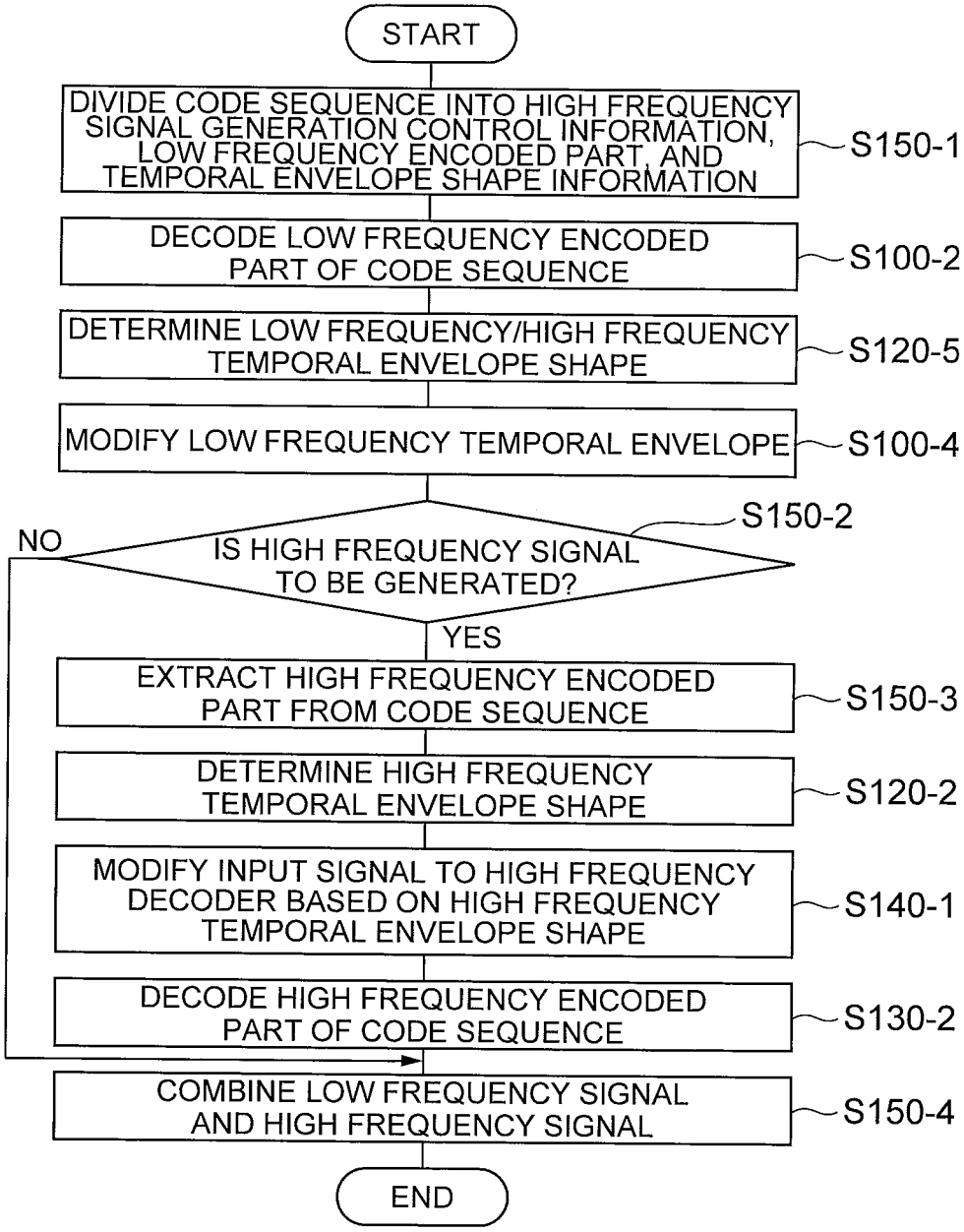

FIG. 136 is a flow chart showing the operation of the tenth modification 160J of the speech decoding device according to the eighth embodiment.

Figure 137:
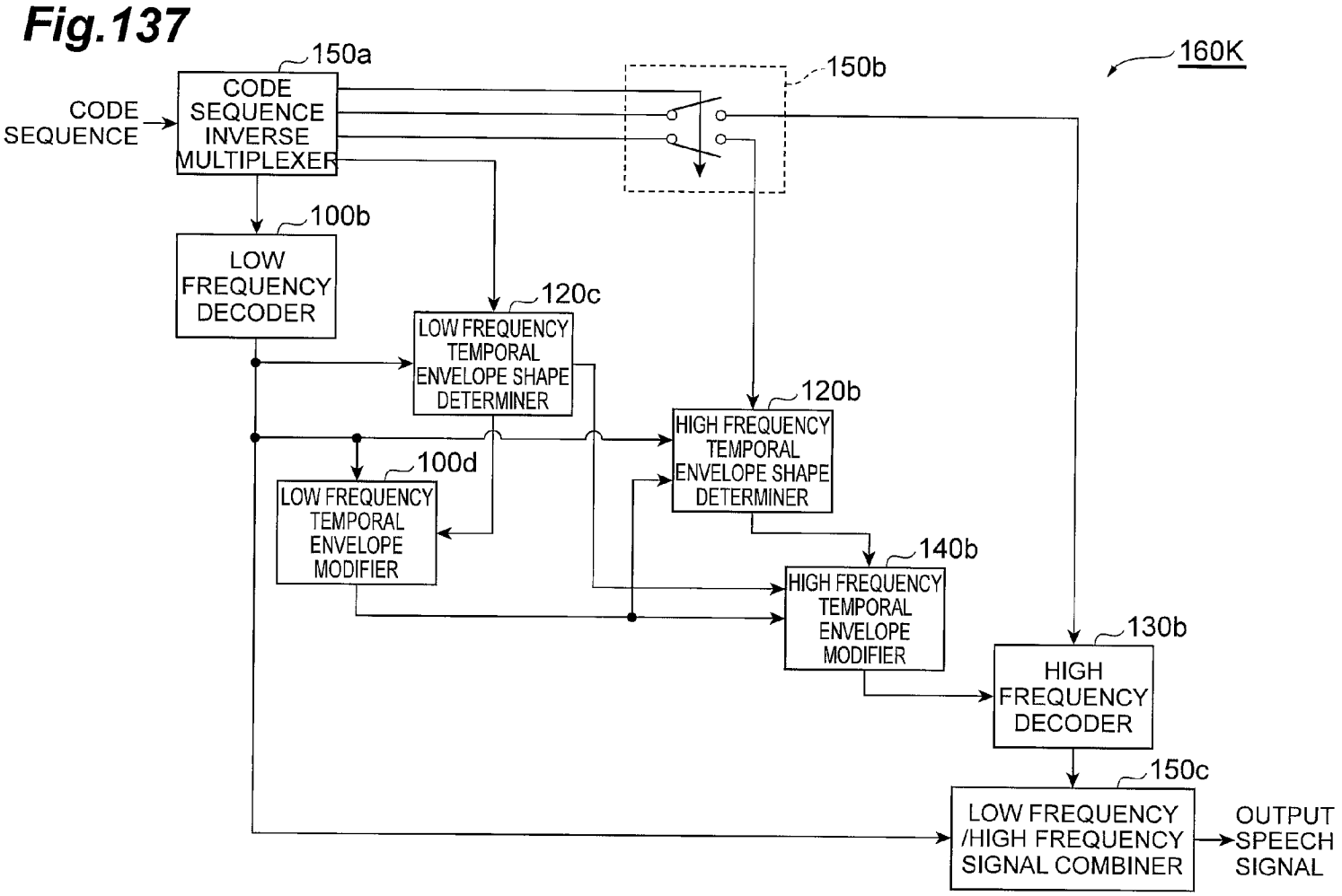

FIG. 137 is a figure showing the configuration of the 11th modification 160K of the speech decoding device according to the eighth embodiment.

Figure 138:
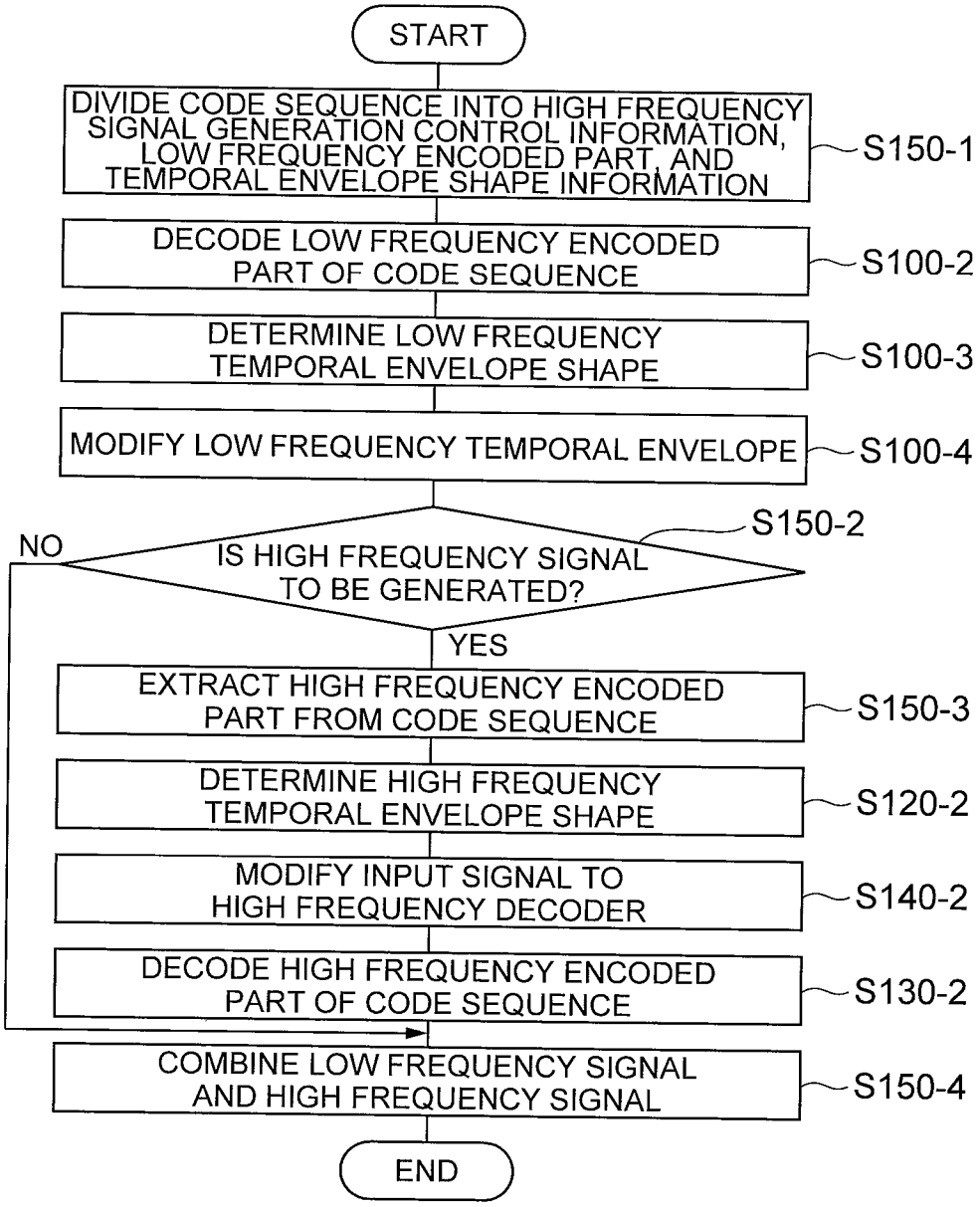

FIG. 138 is a flow chart showing the operation of the 11th modification 160K of the speech decoding device according to the eighth embodiment.

Figure 139:
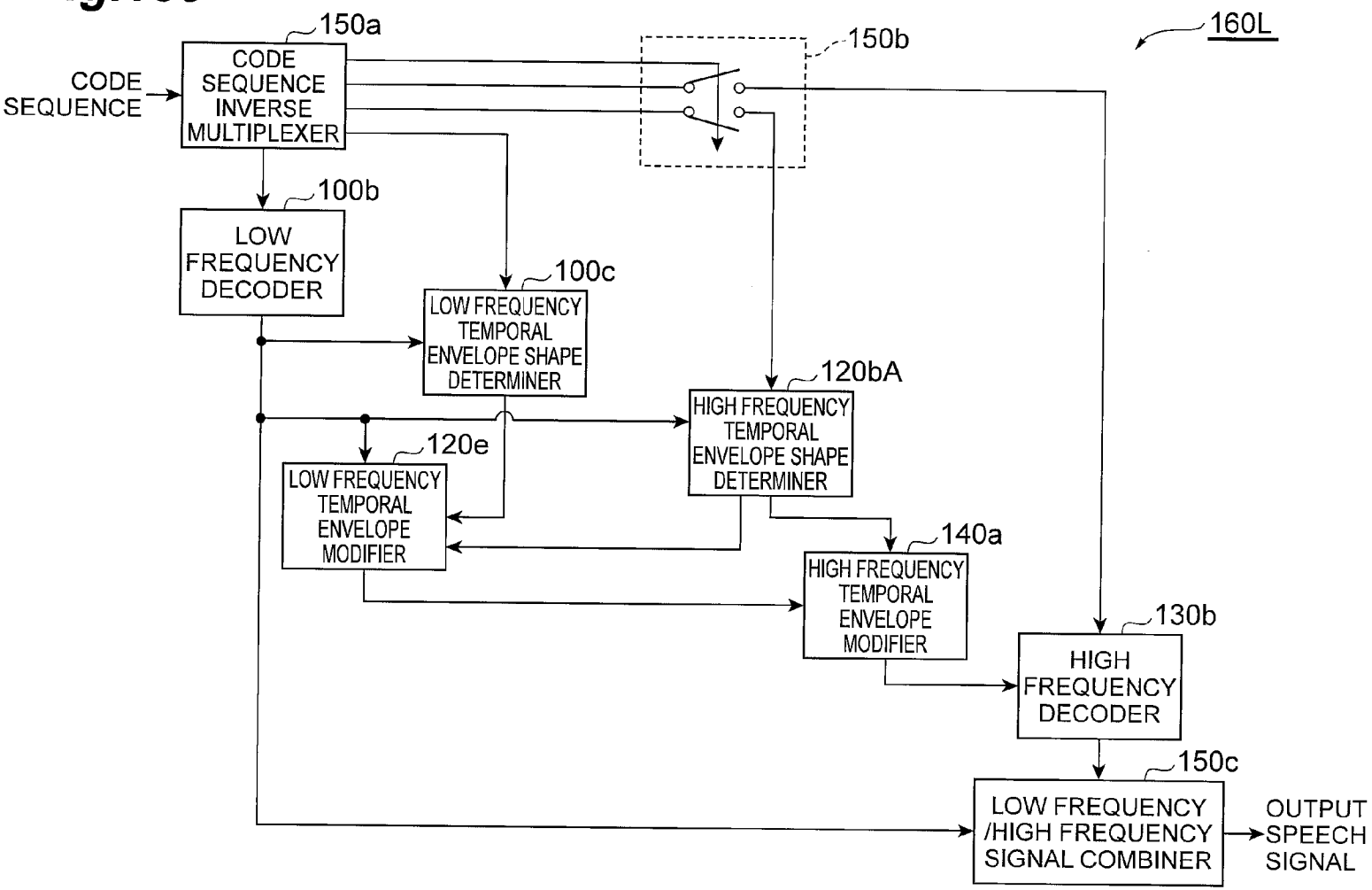

FIG. 139 is a figure showing the configuration of the 12th modification 160L of the speech decoding device according to the eighth embodiment.

Figure 140:
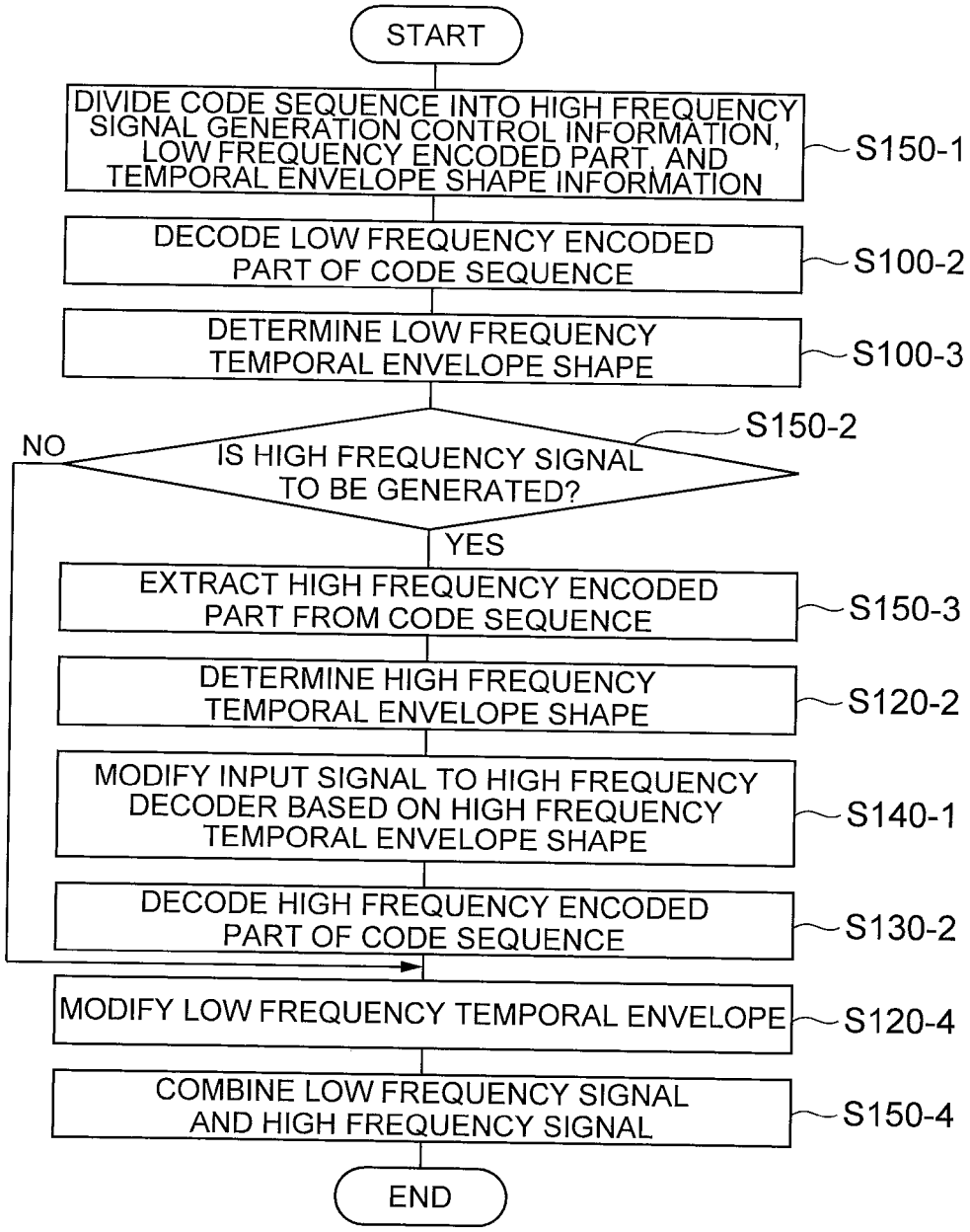

FIG. 140 is a flow chart showing the operation of the 12th modification 160L of the speech decoding device according to the eighth embodiment.

Figure 141:
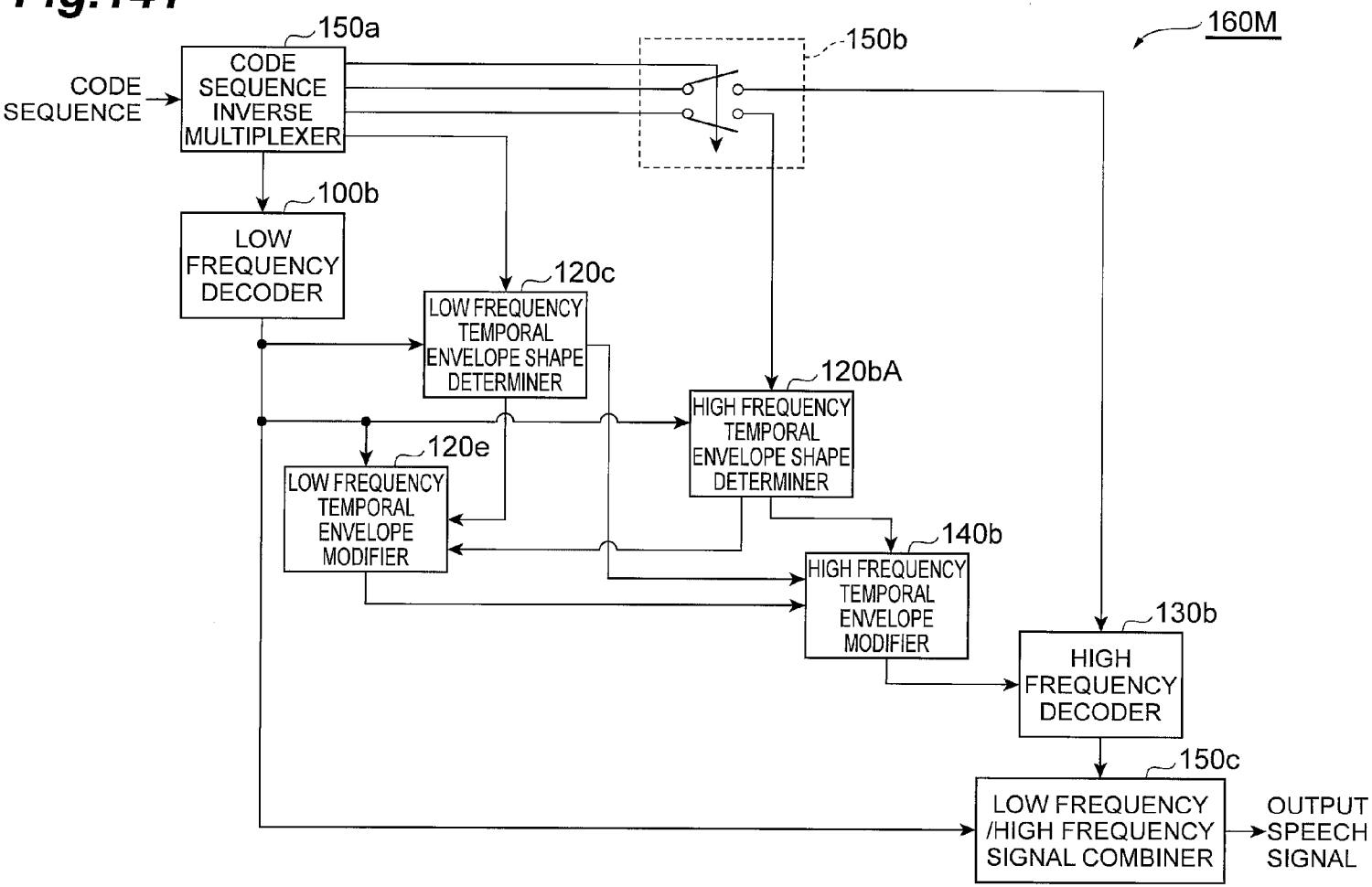

FIG. 141 is a figure showing the configuration of the 13th modification 160M of the speech decoding device according to the eighth embodiment.

Figure 142:
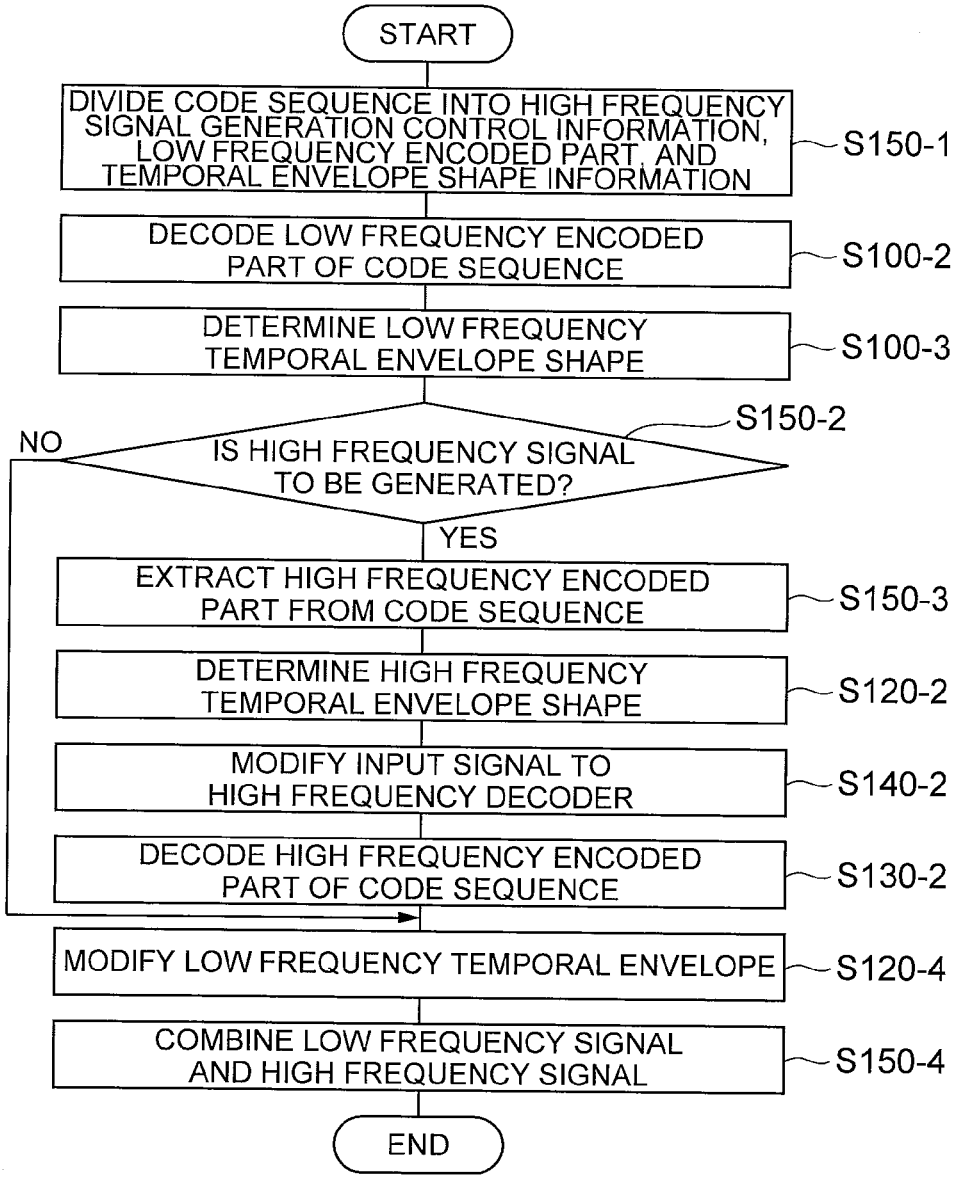

FIG. 142 is a flow chart showing the operation of the 13th modification 160M of the speech decoding device according to the eighth embodiment.

Figure 143:
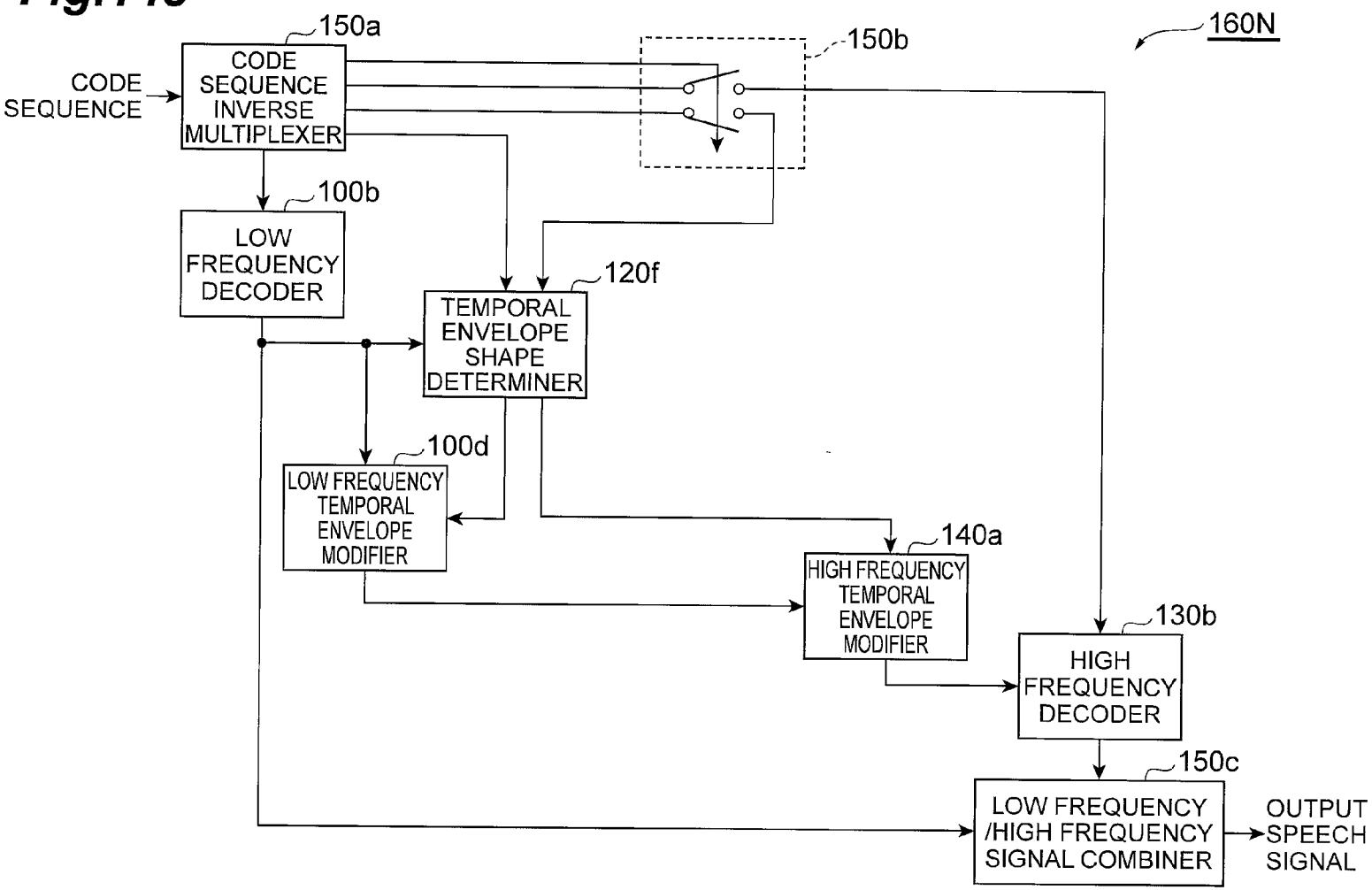

FIG. 143 is a figure showing the configuration of the 14th modification 160N of the speech decoding device according to the eighth embodiment.

Figure 144:
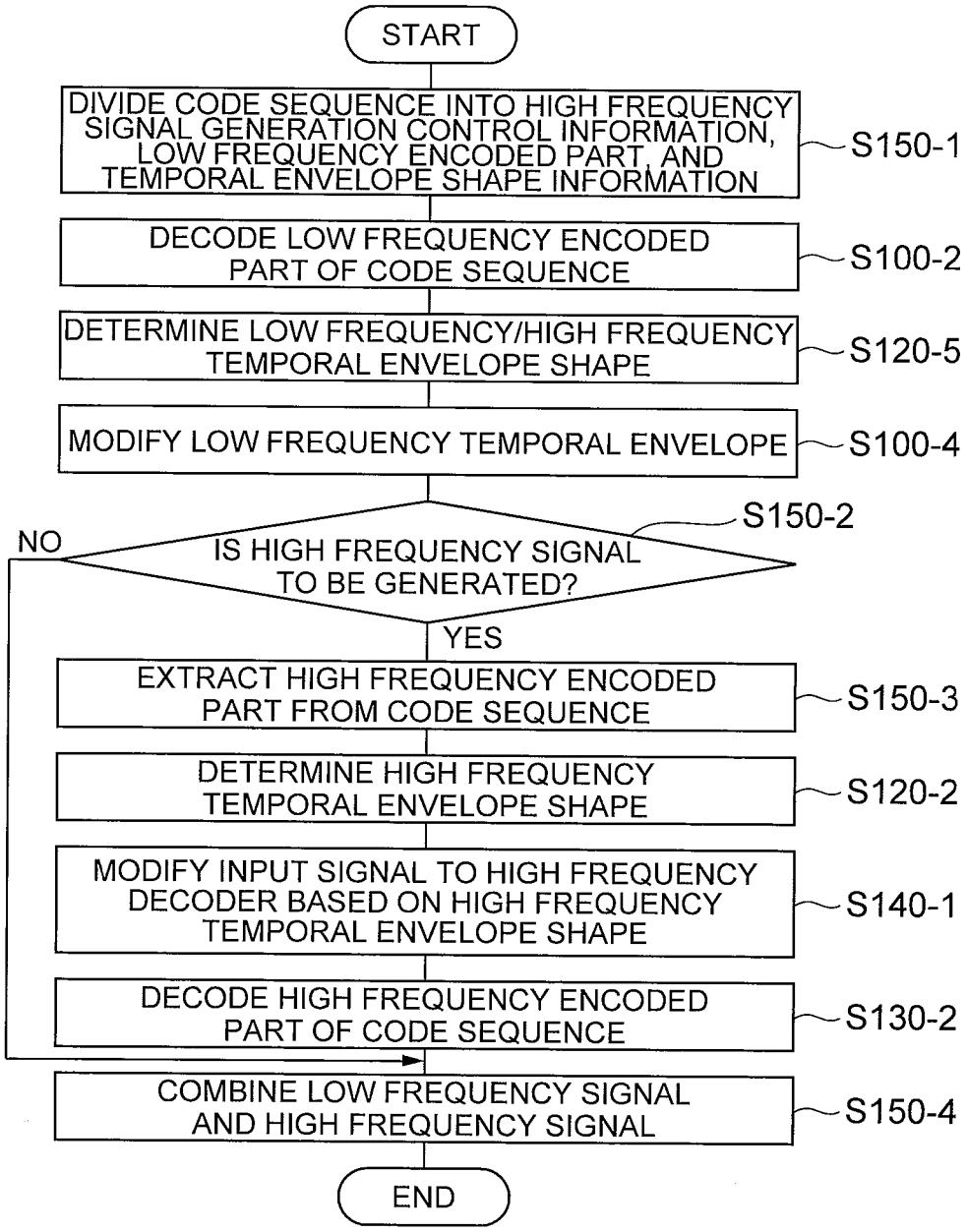

FIG. 144 is a flow chart showing the operation of the 14th modification 160N of the speech decoding device according to the eighth embodiment.

Figure 145:
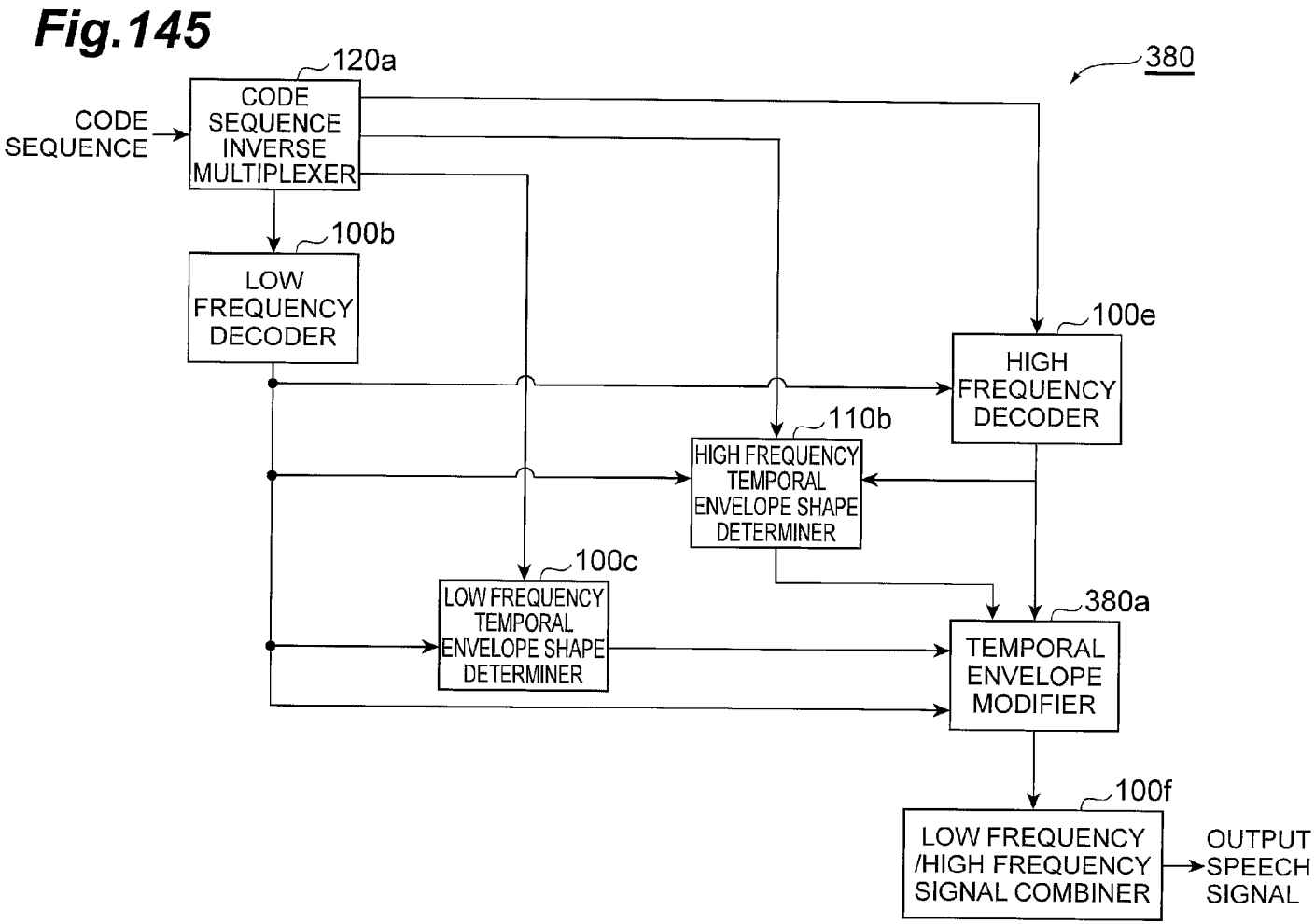

FIG. 145 is a figure showing the configuration of the speech decoding device 380 according to a ninth embodiment.

Figure 146:
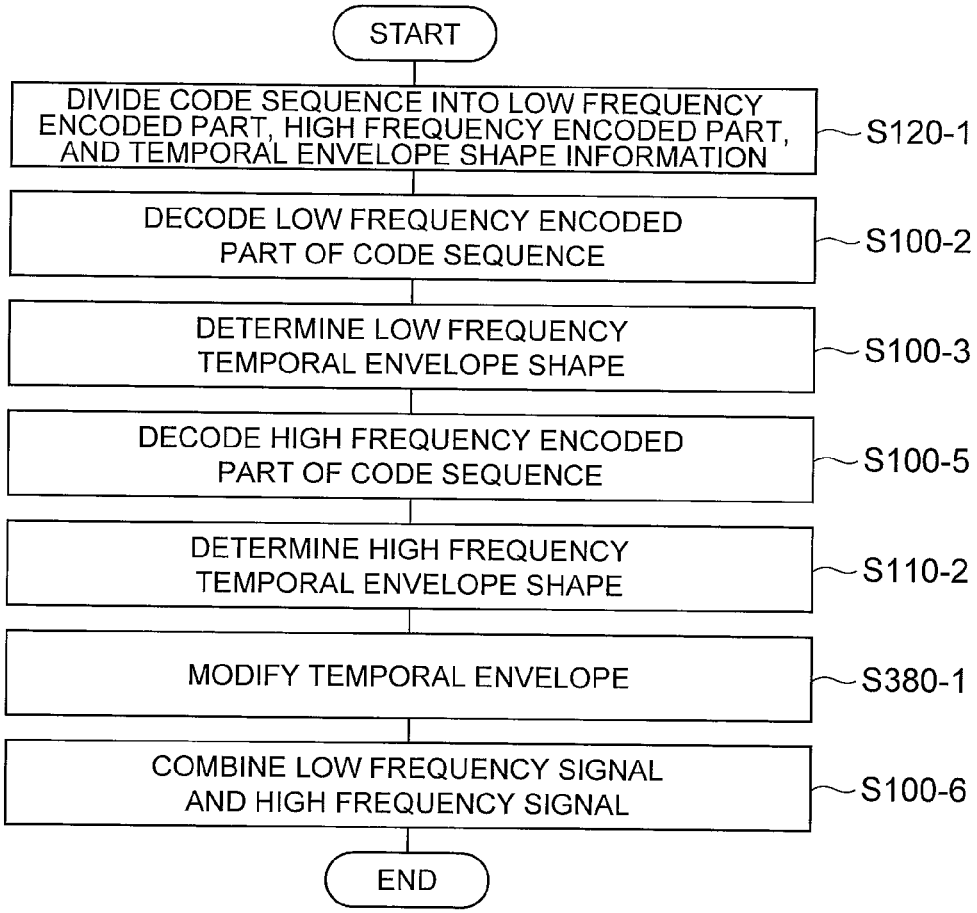

FIG. 146 is a flow chart showing the operation of the speech decoding device 380 according to the ninth embodiment.

Figure 147:
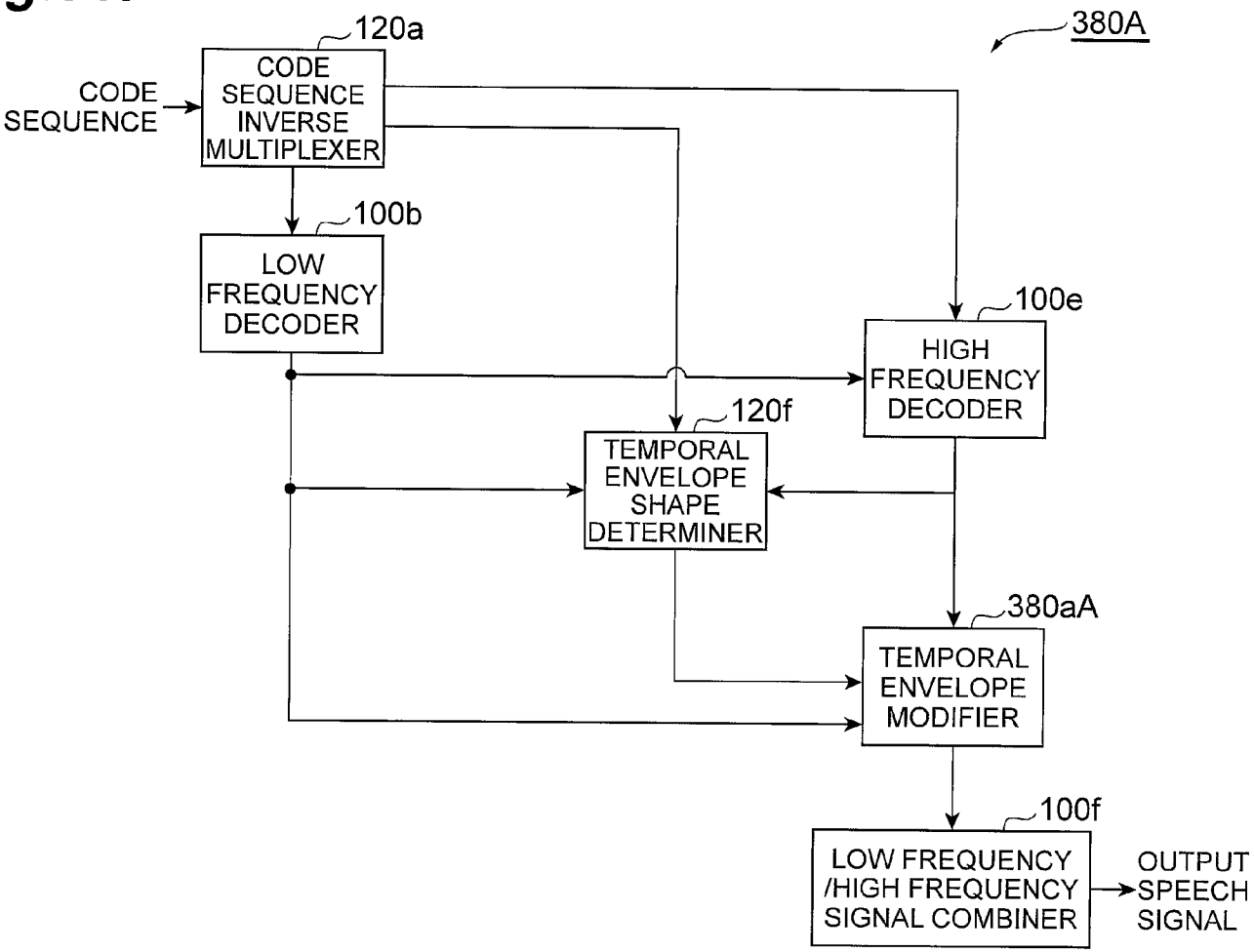

FIG. 147 is a figure showing the configuration of the first modification 380A of the speech decoding device according to the ninth embodiment.

Figure 148:
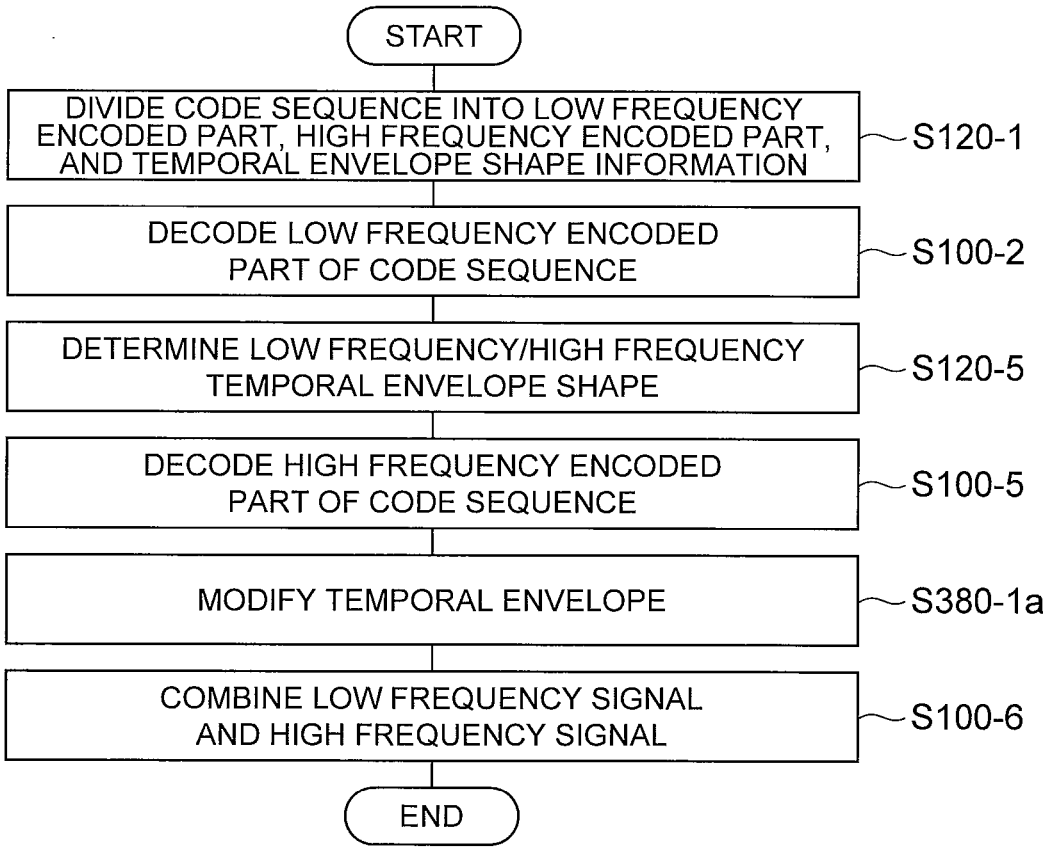

FIG. 148 is a flow chart showing the operation of the first modification 380A of the speech decoding device according to the ninth embodiment.

Figure 149:
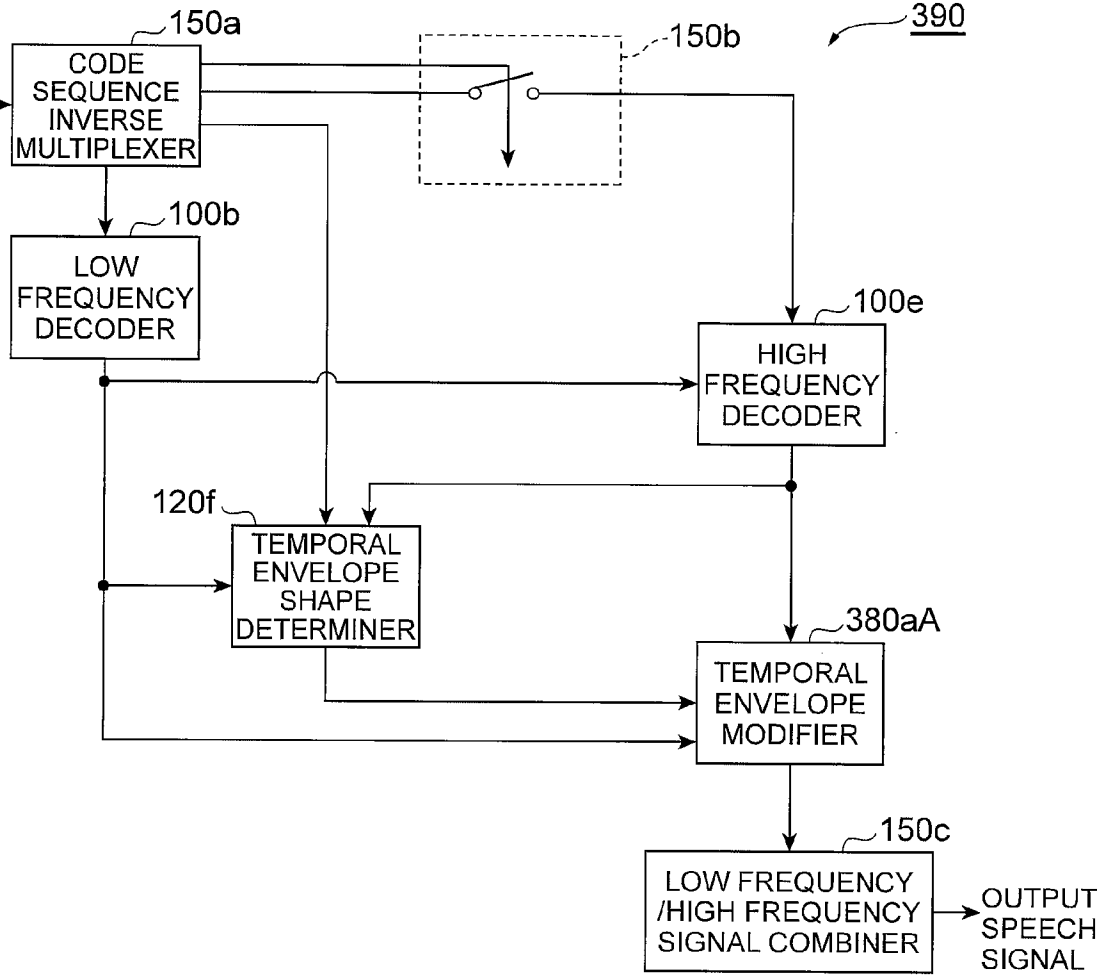

FIG. 149 is a figure showing the configuration of the speech decoding device 390 according to a tenth embodiment.

Figure 150:
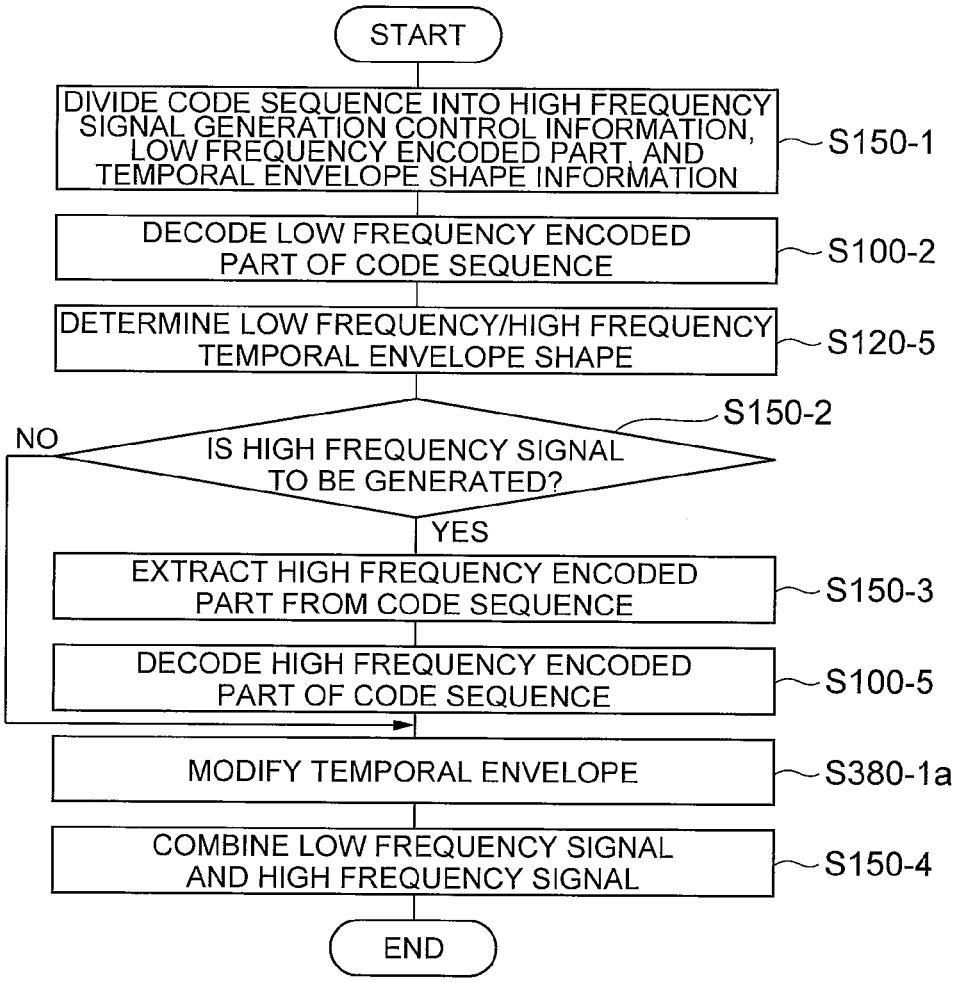

FIG. 150 is a flow chart showing the operation of the speech decoding device 390 according to the tenth embodiment.

DETAILED DESCRIPTION OF THE PREFERRED EMBODIMENTS

Various embodiments will be described with reference to the accompanying drawings. The same parts are denoted with the same reference signs, if possible, and an overlapping description will be omitted.

First Embodiment

Figure 1:
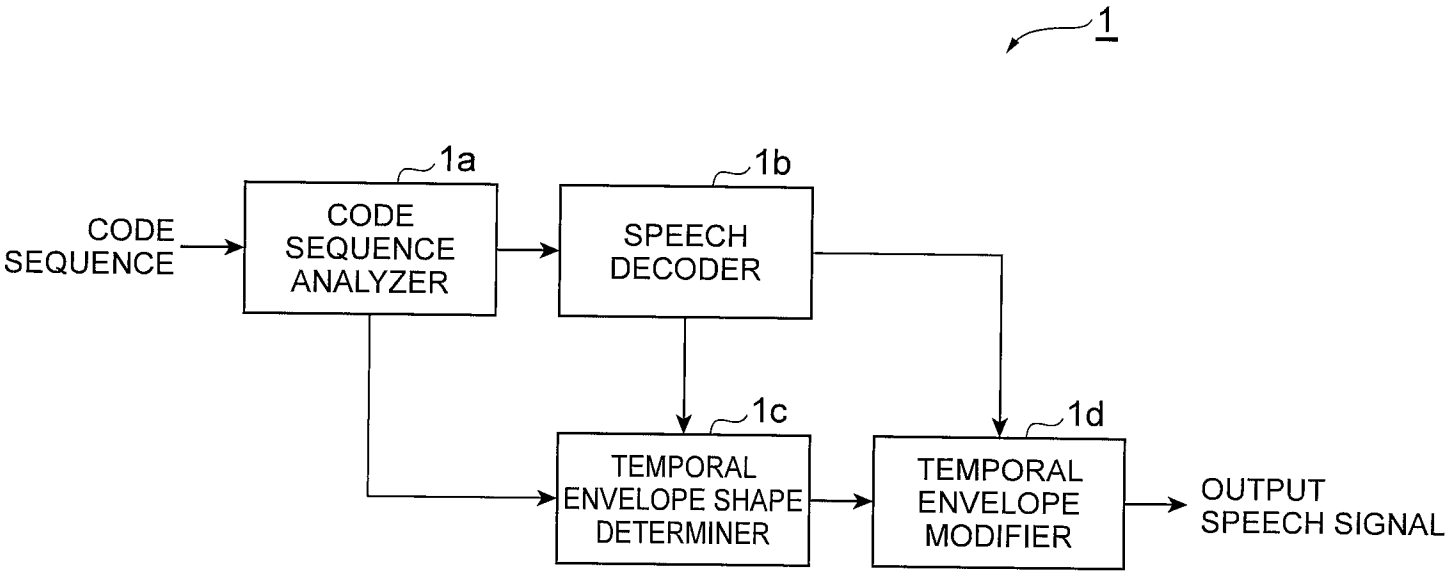
FIG. 1 is a figure showing the configuration of the speech decoding device 1 according to a first embodiment.

FIG. 1 is a diagram showing the configuration of a speech decoding device 1 according to a first embodiment. A communication device of the speech decoding device 1 receives a multiplexed code sequence output from a speech encoding device 2 described below and outputs a decoded speech signal to the outside. As shown in FIG. 1, the speech decoding device 1 functionally includes a code sequence analyzer 1*a*, a speech decoder 1*b*, a temporal envelope shape determiner 1*c*, and a temporal envelope modifier 1*d*.

Figure 2:
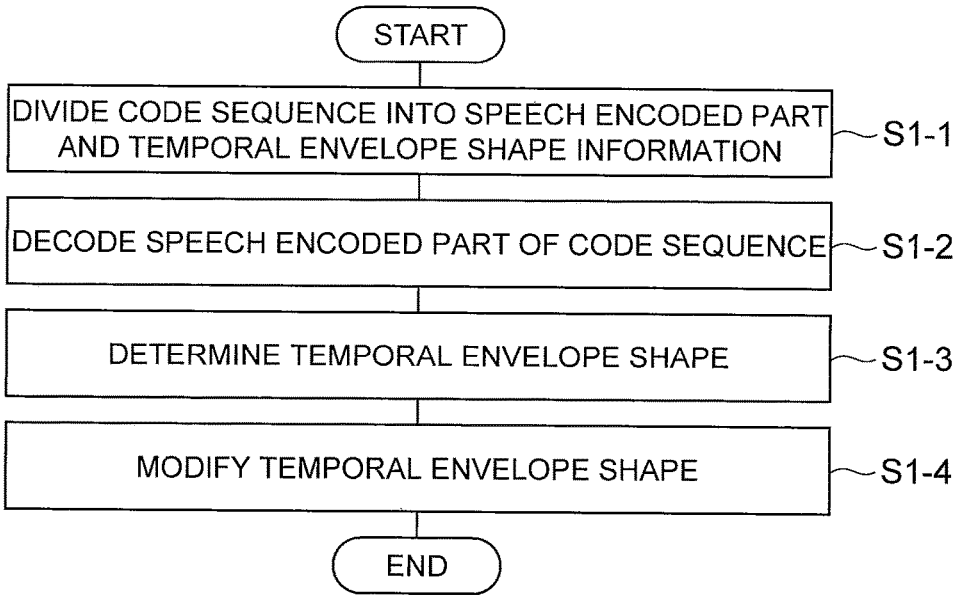
FIG. 2 is a flow chart showing the operation of the speech decoding device according to the first embodiment.

FIG. 2 is a flowchart showing the operation of the speech decoding device 1 according to the first embodiment.

The code sequence analyzer 1*a* analyzes a code sequence and divides the code sequence into a speech encoded part and information about the temporal envelope shape (step S1-1).

The speech decoder 1*b* decodes the speech encoded part of the code sequence to obtain a decoded signal (step S1-2).

The temporal envelope shape determiner 1*c* determines the temporal envelope shape of the decoded signal, based on at least one of the information about the temporal envelope shape divided by the code sequence analyzer 1*a* and the decoded signal obtained by the speech decoder 1*b* (step S1-3).

For example, it is determined that the temporal envelope shape of the decoded signal is flat. For example, parameters representing the power of the decoded signal or parameters similar thereto are calculated. Thereafter, the dispersion, or a parameter similar thereto, of the parameters is calculated. The calculated parameter is compared with a predetermined threshold to determine whether the temporal envelope shape is flat or determine the degree of flatness. In another example, the ratio, or a parameter similar thereto, of an arithmetic mean to a geometric mean of the parameters, or parameters similar thereto, representing the power of the decoded signal and is compared with a predetermined threshold to determine whether the temporal envelope shape is flat or determine the degree of flatness. The method of determining that the temporal envelope shape of the decoded signal is flat is not limited to the above examples.

For example, it is determined that the temporal envelope shape of the decoded signal is onset. For example, parameters, or parameters similar thereto, representing the power of the decoded signal are determined, differential values of the parameters in time direction are calculated, and the maximum value in the differential values in an arbitrary time segment is calculated. The maximum value is compared with a predetermined threshold to determine whether the temporal envelope shape is rising or determine the degree of onset. The method of determining that the temporal envelope shape of the decoded signal is onset is not limited to the above examples.

For example, it is determined that the temporal envelope shape of a low frequency signal is offset. For example, parameters, or parameters similar thereto, representing the power of the decoded signal are determined, differential values of the parameters in time direction are calculated, and the minimum value of the differential values in an arbitrary time segment is calculated. The minimum value is compared with a predetermined threshold to determine whether the temporal envelope shape is offset or determine the degree of offset. The method of determining that the temporal envelope shape of the decoded signal is offset is not limited to the above examples.

The above examples can also be applied to a case where the decoded signal is output as a time domain signal from the speech decoder 1*b*, and can also be applied to a case where the decoded signal is output as a plurality of subband signals.

The temporal envelope modifier 1*d* modifies the shape of the temporal envelope of the decoded signal output from the speech decoder 1*b*, based on the temporal envelope shape determined by the temporal envelope shape determiner 1*c* (step S1-4).

For example, if the decoded signal is expressed by a plurality of subband signals, the temporal envelope modifier 1*d* uses a predetermined function $F(X_{dec}(k,i))$ for a plurality of subband signals $X_{dec}(k,i)$ $(0 \le k < k_h,\ t(l) \le i < t(l+1))$ of the decoded signal within an arbitrary time segment to calculate $X'_{dec}(k,i)$ using the following equation (1):

$$X'_{dec}(k,i)=F(X_{dec}(k,i)) \quad \text{[Eq. 1]}$$

$X'_{dec}(k,i)$ being calculated as subband signals of the decoded signal whose temporal envelope shape is modified. The temporal envelope modifier 1*d* synthesizes a time domain signal from the subband signals and outputs the synthesized signal.

For example, when it is determined that the temporal envelope shape of the decoded signal is flat, the temporal envelope shape of the decoded signal can be modified by the following process. For example, the subband signals $X_{dec}(k,i)$ are divided into $M_{dec}$ frequency bands having boundaries represented by $B_{dec}(m)$ $(m=0, \ldots, M_{dec},\ M_{dec} \ge 1)$ $(B_{dec}(0) \ge 0,\ B_{dec}(M_{dec}) < k_h)$ and, using a predetermined function $F(X_{dec}(k,i)$ expressed by the equations below for the subband signals $X_{dec}(k,i)$ $(B_{dec}(m) \le k < B_{dec}(m+1))$ $t(l) \le i < t(l+1))$ included in the m-th frequency band, $$F(X_{dec}(k,i)) = \sqrt{\frac{\sum_{n=t_E(l)}^{t_E(l+1)-1} \sum_{j=B_{dec}(m)}^{B_{dec}(m+1)-1} |X_{dec}(j,n)|^2}{(t_E(l+1)-t_E(l)) \cdot (B_{dec}(m+1)-B_{dec}(m))}} \frac{X_{dec}(k,i)}{\sqrt{|X_{dec}(k,i)|^2}} \quad \text{or} \quad \text{[Eq. 2]}$$

$$F(X_{dec}(k,i)) = \sqrt{\frac{\sum_{n=t_E(l)}^{t_E(l+1)-1} \sum_{j=B_{dec}(m)}^{B_{dec}(m+1)-1} |X_{dec}(j,n)|^2}{t_E(l+1)-t_E(l)}} \frac{X_{dec}(k,i)}{\sqrt{\sum_{j=B_{dec}(m)}^{B_{dec}(m+1)-1} |X_{dec}(j,i)|^2}}$$

$X'_{dec}(k,i)$ is calculated as subband signals of the decoded signal whose temporal envelope shape is modified. In another example, a predetermined function $F(X_{dec}(k,i))$ defined by is used to perform a smoothing filter process on the subband signals $X_{dec}(k,i)$.

$$F(X_{dec}(k,i)) = \sum_{p=0}^{N_{filt}-1} a(p) X_{dec}(k, i-p) \quad \text{[Eq. 3]}$$

With the definition of $(N_{filt} \ge 1)$, $X'_{dec}(k,i)$ are calculated as subband signals of the decoded signal whose temporal envelope shape is modified. The process can be performed such that the powers of the subband signals before and after the filter process are matched in each frequency band having the boundaries represented by the $B_{dec}(m)$.

In another example, the subband signals $X_{dec}(k,i)$ are linearly predicted in the frequency direction in each frequency band having the boundaries represented by the $B_{dec}(m)$ to obtain a linear prediction coefficient $\alpha_p(m)$ $(m=0, \ldots, M_{dec-1})$, and a predetermined function $F(X_{dec}(k,i))$ is used to perform a linear prediction inverse filter process on the subband signals $X_{dec}(k,i)$.

$$F(X_{dec}(k,i)) = X_{dec}(k,i) + \sum_{p=1}^{N_{pred}} \alpha_p(m) X_{dec}(k-p, i) \quad \text{[Eq. 4]}$$

With the definition of $(N_{pred} \ge 1)$, $X'_{dec}(k,i)$ are calculated as subband signals of the decoded signal whose temporal envelope shape is modified.

The process of modifying the temporal envelope into a flat shape can be carried out in any combination of the above examples.

The processes performed by the temporal envelope modifier 1*d* to modify the temporal envelope of the decoded signal into a flat shape are not limited to the above examples.

For example, when it is determined that the temporal envelope shape of the decoded signal is onset, the temporal envelope shape of the decoded signal can be modified by the following process.

For example, a predetermined function $F(X_{dec}(k,i))$ set forth below is defined using a function incr(i) that monotonously increases relative to i.

$$F(X_{dec}(k,i)) = incr(i) \frac{X_{dec}(k,i)}{\sqrt{|X_{dec}(k,i)|^2}} \quad \text{[Eq. 5]}$$

$X'_{dec}(k,i)$ are calculated as the subband signals of the decoded signal whose temporal envelope shape is modified. A process can be performed such that the powers of the subband signals before and after modification of the temporal envelope shape are matched in each frequency band having the boundaries represented by the $B_{dec}(m)$.

The temporal envelope modifier 1*d* carries out a process of modifying the temporal envelope shape of a plurality of subband signals of the decoded signal when it is onset, and the process is not limited to the above examples.

For example, when it is determined that the temporal envelope shape of the decoded signal is offset, the temporal envelope shape of the decoded signal can be modified by the following process.

For example, a predetermined function $F(X_{dec}(k,i))$ set forth below includes a function decr(i) that monotonously decreases relative to i.

$$F(X_{dec}(k,i)) = decr(i) \frac{X_{dec}(k,i)}{\sqrt{|X_{dec}(k,i)|^2}} \quad \text{[Eq. 6]}$$

$X'_{dec}(k,i)$ are calculated as subband signals of the low frequency signal whose temporal envelope shape is modified. A process can be performed such that the powers of the subband signals before and after modification of the temporal envelope shape are matched in each frequency band having the boundaries represented by the $B_{dec}(m)$.

The temporal envelope modifier 1*d* performs a process of modifying the temporal envelope shape of a plurality of subband signals of the decoded signal when it is offset, and the process is not limited to the above examples.

For example, if the decoded signal can be represented as a time domain signal, as shown below, the temporal envelope modifier 1*d* applies a predetermined function $F_t(x_{dec}(i))$ for the decoded signal $x_{dec}(i)$ $(t(l)\leq i<t(l+1))$ in an arbitrary time segment to obtain $x'_{dec}(i)$.

$$x'_{dec}(i)=F_t(x_{dec}(i)) \quad \text{[Eq. 7]}$$

Which is output as a decoded signal whose temporal envelope shape is modified.

For example, when it is determined that the temporal envelope shape of the decoded signal is flat, the temporal envelope shape of the decoded signal can be modified by the following process. For example, a predetermined function $F_t(x_{dec}(i))$ set forth below for the decoded signal $x_{dec}(i)$ is used.

$$F_t(x_{dec}(i)) = \sqrt{\frac{\sum_{n=t_E(l)}^{t_E(l+1)-1} |x_{dec}(n)|^2}{(t_E(l+1)-t_E(l))}} \frac{x_{dec}(i)}{\sqrt{|x_{dec}(i)|^2}} \quad \text{[Eq. 8]}$$

To output $x'_{dec}(i)$ as a decoded signal whose temporal envelope shape is modified.

In another example, a predetermined function $F_t(x_{dec}(i))$ set forth below to perform a smoothing filter process on the decoded signal $x_{dec}(i)$.

$$F_t(x_{dec}(i)) = \sum_{p=0}^{N_{filt}-1} a(p)x_{dec}(i-p) \quad \text{[Eq. 9]}$$

With a definition of $(N_{filt}\geq 1)$, $x'_{dec}(i)$ is output as a decoded signal whose temporal envelope shape is modified.

The process of modifying the temporal envelope into a flat shape can be carried out in any combination of the above examples.

For example, when it is determined that the temporal envelope shape of the decoded signal is onset, the temporal envelope shape of the decoded signal can be modified by the following process.

For example, a predetermined function $F_t(x_{dec}(i))$ set forth below uses a function incr(i) that monotonously increases relative to i.

$$F_t(x_{dec}(i)) = incr(i)\frac{x_{dec}(i)}{\sqrt{|x_{dec}(i)|^2}} \quad \text{[Eq. 10]}$$

$x'_{dec}(i)$ is output as a decoded signal whose temporal envelope shape is modified.

The temporal envelope modifier 1*d* carries out a process of modifying the temporal envelope of the decoded signal when it is onset, and the process is not limited to the above examples.

For example, when it is determined that the temporal envelope shape of the decoded signal is offset, the temporal envelope shape of the decoded signal can be modified by the following process.

For example, a predetermined function $F_t(x_{dec}(i))$ set forth below uses a function decr(i) that monotonously decreases relative to i.

$$F_t(x_{dec}(i)) = decr(i)\frac{x_{dec}(i)}{\sqrt{|x_{dec}(i)|^2}} \quad \text{[Eq. 11]}$$

x'dec(i) is output as a decoded signal whose temporal envelope shape is modified. The temporal envelope modifier 1*d* carries out a process of modifying the temporal envelope of the decoded signal when it is offset, and the process is not limited to the above examples.

For example, if the decoded signal is expressed by frequency domain transform coefficients $X_{dec}(k)$ $(0\leq k<k_h)$ by a time-frequency transform, such as the discrete Fourier transform, the discrete cosine transform, or the modified discrete cosine transform, a predetermined function $F_f(X_{dec}(k)$ is used in the following equation (12).

[Eq. 12]

$$X'_{dec}(k)=F_f(X_{dec}(k) \quad \text{formula (51)}$$

$X'_{dec}(k)$ are calculated as frequency domain transform coefficients of the decoded signal whose temporal envelope shape is modified, and then transformed into a time domain signal by a predetermined frequency transform to be output.

For example, when it is determined that the temporal envelope shape of the decoded signal is flat, the temporal envelope shape of the decoded signal can be modified by the following process.

In $M_{dec}$ arbitrary frequency bands $B_{dec}(m)$ having boundaries represented by $B_{dec}(m)$ $(m=0, \ldots, M_{dec}, M_{dec}\geq 1)$ $(B_{dec}(0)\geq 0, B_{dec}(M_{dec})<k_h)$, a linear prediction coefficient $\alpha_p(m)$ $(m=0, \ldots, M_{dec}-1)$ is obtained by linear prediction in a frequency direction, and a predetermined function $F_f(X_{dec}(k))$ set forth below is used to perform a linear prediction inverse filter process on the transform coefficients $X_{dec}(k)$.

$$F_f(X_{dec}(k)) = X_{dec}(k) + \sum_{p=1}^{N_{pred}} \alpha_p(m)X_{dec}(k-p) \quad \text{[Eq. 13]}$$

With a definition of $(N_{pred}\geq 1)$, $X'_{dec}(k,i)$ are calculated as transform coefficients of the decoded signal whose temporal envelope shape is modified.

The temporal envelope modifier 1*d* performs a process of modifying the temporal envelope of the decoded signal into a flat shape, and the process is not limited to the above examples.

Figure 3:
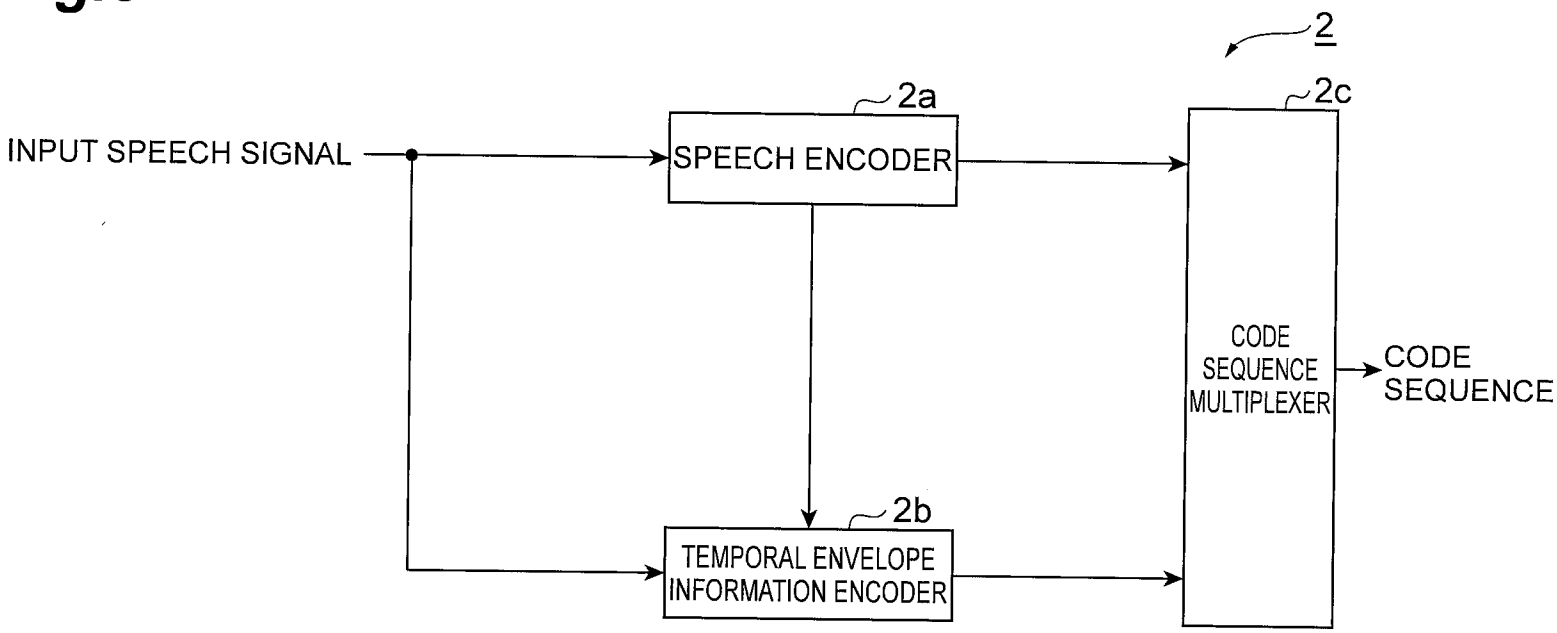
FIG. 3 is a figure showing the configuration of the speech to digital converter 2 according to the first embodiment.

FIG. 3 is a diagram showing the configuration of a speech encoding device 2 according to the first embodiment. A communication device of the speech encoding device 2 receives a speech signal to be encoded from the outside and outputs the encoded code sequence to the outside. As shown in FIG. 3, the speech encoding device 2 functionally includes a speech coder 2*a*, a temporal envelope information encoder 2*b*, and a code sequence multiplexer 2*c*.

Figure 4:
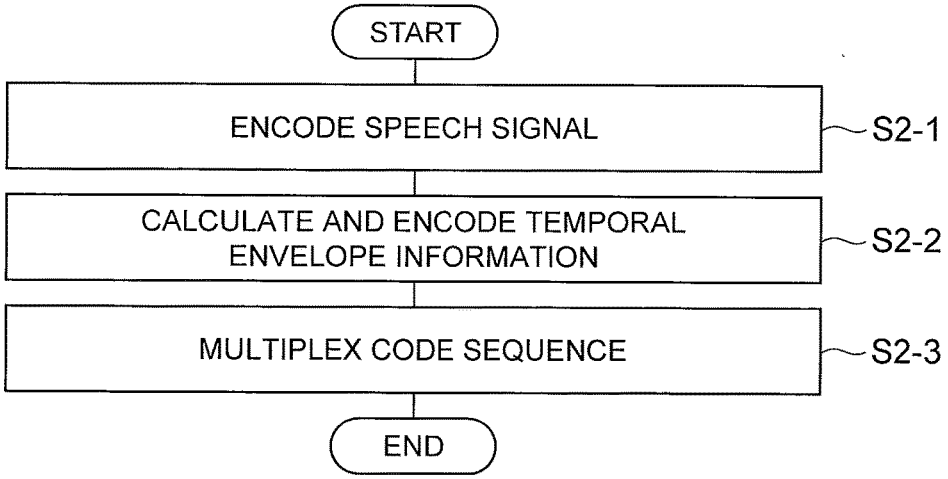
FIG. 4 is a flow chart showing the operation of the speech to digital converter 2 according to the first embodiment.

FIG. 4 is a flowchart showing the operation of the speech encoding device 2 according to the first embodiment.

The speech coder 2*a* encodes an input speech signal (step S2-1).

The temporal envelope information encoder 2*b* calculates and encodes temporal envelope information, based on at least one of the input speech signal and information obtained in the encoding process including the encoding result of the input speech signal in the speech coder 2*a* (step S2-2).

For example, the temporal envelope $E_t(i)$ of the input speech signal x(i), which is a time domain signal in an arbitrary time segment $t(l) \le i < t(l+1)$), can be calculated as the power of the decoded signal normalized in the time segment.

$$E_t(i) = \frac{|x(i)|^2}{\sum_{n=t(l)}^{t(l+1)-1} |x(n)|^2} \quad \text{[Eq. 14]}$$

For example, if the input speech signal is calculated as a plurality of subband signals X(k,i) in the speech coder 2*a*, as the time envelop of the input speech signal, the temporal envelope E(k,i) of the subband signals X(k,i) ($B(m) \le k < B(m+1)$, $t(l) < i < t(l+1)$) of the input speech signal divided into M frequency bands having boundaries represented by B(m) ($m=0, \ldots, M$, $M \ge 1$) ($B(0) \ge 0$, $B(M) < k_h$) in an arbitrary time segment $t(l) \le i < t(l+1)$ and included in the m-th frequency band can be calculated as the power of the subband signals of the input speech signal normalized in the time segment.

$$E(k, i) = \frac{\sum_{j=B(m)}^{B(m+1)-1} |X(j, n)|^2}{\sum_{n=t(l)}^{t(l+1)} \sum_{j=B(m)}^{B(m+1)-1} |X(j, n)|^2} \quad \text{[Eq. 15]}$$

The temporal envelope of the input speech signal is not limited to the above examples as long as it is a parameter indicating variations of the magnitude of the input speech signal in the time direction.

For example, the decoded signal $x_{dec}(i)$ is calculated based on the encoding result of the input speech signal in the speech coder 2*a*, and the temporal envelope $E_{dec,t}(i)$ of the decoded signal $x_{dec}(i)$ in an arbitrary time segment $t(l) \le i < t(l+1)$ can be calculated as the power of the decoded signal normalized in the time segment.

$$E_{dec,t}(i) = \frac{|x_{dec}(i)|^2}{\sum_{n=t(l)}^{t(l+1)-1} |x_{dec}(n)|^2} \quad \text{[Eq. 16]}$$

For example, if the subband signals $X_{dec}(k,i)$ of the decoded signal are calculated during the process of encoding the input speech signal in the speech coder 2*a* or based on the encoding result, as the time envelop of the decoded signal, the temporal envelope $E_{dec}(k,i)$ of the subband signals $X_{dec}(k,i)$ ($B(m) \le k < B(m+1)$, $t(l) \le i < t(l+1)$) of the input speech signal divided into M frequency bands having boundaries represented by B(m) ($m=0, \ldots M$, $M \ge 1$) ($B(0) \ge 0$, $B(M) < k_h$) in an arbitrary time segment $t(l) \le i < t(l+1)$ and included in the m-th frequency band can be calculated as the power of the subband signals of the input speech signal normalized in the time segment.

$$E_{dec}(k, i) = \frac{\sum_{j=B(m)}^{B(m+1)-1} |X_{dec}(j, n)|^2}{\sum_{n=t(l)}^{t(l+1)} \sum_{j=B(m)}^{B(m+1)-1} |X_{dec}(j, n)|^2} \quad \text{[Eq. 17]}$$

For example, the temporal envelope information encoder 2*b* calculates information representing the degree of flatness as temporal envelope information. For example, at least one of a parameter, and a parameter similar thereto, representing the dispersion of the temporal envelope of the input speech signal and the decoded signal is calculated. In another example, at least one of the ratio, and a parameter similar thereto, of an arithmetic mean to a geometric mean of the temporal envelope of the input speech signal and the decoded signal is calculated. In this case, the temporal envelope information encoder 2*b* may calculate information representing the flatness of the temporal envelope of the input speech signal as the temporal envelope information, and the process thereby is not limited to the above examples. The parameter is then encoded. For example, the differential value of the parameter of the input speech signal and the decoded signal or the absolute value of the differential value is encoded. For example, at least one of the value of the parameter of the input speech signal and the absolute value is encoded. For example, if the flatness of the temporal envelope is expressed by information of being flat or not, the information can be encoded by one bit. For example, for the time domain input speech signal, the information can be encoded by one bit in the arbitrary time segment. For example, when the information is encoded for each of the M frequency bands of the subband signals of the input speech signal, it can be encoded by M bits. The method of encoding the temporal envelope information is not limited to the above examples.

For example, the temporal envelope information encoder 2*b* calculates information representing the degree of onset as the temporal envelope information. For example, in an arbitrary time segment $t(l) \le i < t(l+1)$, the maximum value of the differential value of the temporal envelope of the input speech signal in time direction is calculated.

$$d_{Et,max}(k) = \max(E_t(k,i) - E_t(k,i-1))$$

$$d_{Kdec,t,max}(k) = \max(E_{dec,t}(k,i) - E_{dec,t}(k,i-1))$$

or $$d_{Emax}(k) = \max(E(k,i) - E(k,i-1))$$

$$d_{Edec,max}(k) = \max(E_{dec}(k,i) - E_{dec}(k,i-1)) \quad \text{[Eq. 18]}$$

In these equations, the maximum value of the differential value of a parameter in time direction, the parameter being obtained by smoothing the temporal envelope in time direction, can be calculated in place of the temporal envelope.

In this case, the temporal envelope information encoder 2*b* may calculate information representing the degree of onset of the temporal envelope of the input speech signal as the temporal envelope information, and the process thereby is not limited to the above examples. The parameter is then encoded. For example, at least one of the differential value of the parameter of the input speech signal and the decoded signal and the absolute value of the differential value is encoded. For example, if the rise of the temporal envelope is represented by information of being onset or not, the information can be encoded by one bit. For example, for the time domain input speech signal, the information can be encoded by one bit in the arbitrary time segment. For example, when the information is encoded for each of the M frequency bands of the subband signals of the input speech signal, it can be encoded by M bits. The method of encoding the temporal envelope information is not limited to the above examples.

For example, the temporal envelope information encoder 2*b* calculates information representing the degree of offset as the temporal envelope information. For example, in the arbitrary time segment $t(l) \le i < t(l+1)$, the minimum value of the differential value in time direction of the temporal envelope of the input speech signal is calculated.

$$d_{Et,min}(k)=\min(E_t(k,i)-E_t(k,i-1))$$

$$d_{Edec,t,min}(k)=\min(E_{dec,t}(k,i)-E_{dec,t}(k,i-1))$$

or $$d_{Emin}(k)=\min(E(k,i)-E(k,i-1))$$

$$d_{Edec,min}(k)=\min(E_{dec}(k,i)-E_{dec}(k,i-1)) \quad \text{[Eq. 19]}$$

In these equations, the minimum value of the differential value of a parameter in time direction, the parameter being obtained by smoothing the temporal envelope in time direction, can be calculated in place of the temporal envelope. In this case, the temporal envelope information encoder 2*b* may calculate information representing the degree of offset of the temporal envelope of the subband signals of the input speech signal as the temporal envelope information, and the process thereby is not limited to the above examples. The parameter is then encoded. For example, at least one of the differential value of the parameter of the input speech signal and the decoded signal and the absolute value of the differential value is encoded. For example, if the fall of the temporal envelope is represented by information of being offset or not, the information can be encoded by one bit. For example, for the time domain input speech signal, the information can be encoded by one bit in the arbitrary time segment. For example, when the information is encoded for each of the M frequency bands of the subband signals of the input speech signal, it can be encoded by M bits. The method of encoding the temporal envelope information is not limited to the above examples.

In the above examples, in the arbitrary time segment $t(l) \le i < t(l+1)$, an encoding parameter (for example, the gain of a codebook in CELP encoding) having a correlation to the power of a time segment shorter than the time segment can be used in the speech coder 2*a*, in place of the temporal envelope of the input speech signal.

The code sequence multiplexer 2*c* receives the code sequence of the input speech signal from the speech coder 2*a*, receives the temporal envelope shape information encoded by the temporal envelope information encoder 2*b* and outputs a multiplexed code sequence (step S2-3).

Second Embodiment

Figure 5:
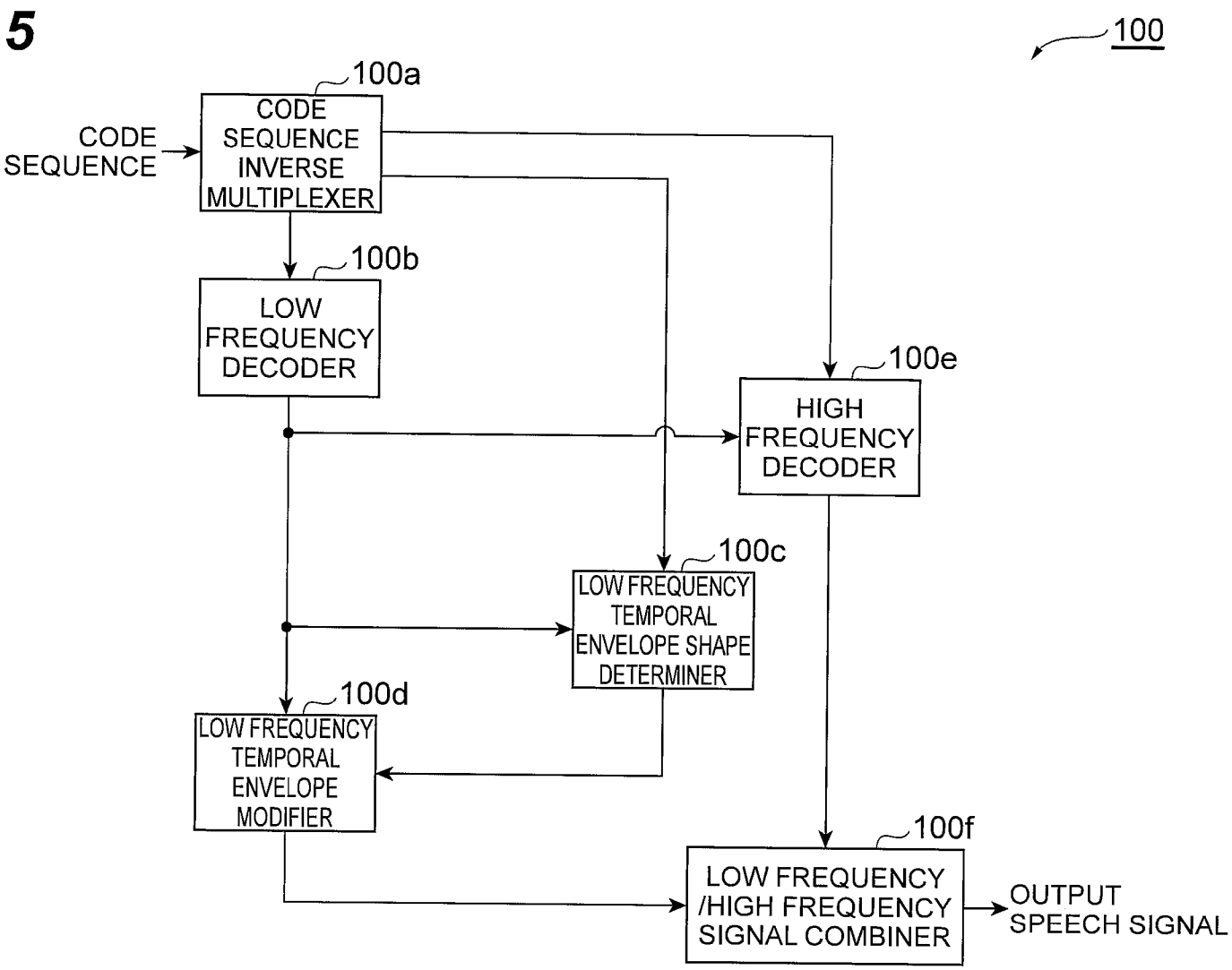
FIG. 5 is a figure showing the configuration of the speech decoding device 100 according to a second embodiment.

FIG. 5 is a diagram showing the configuration of a speech decoding device 100 according to an second embodiment. A communication device of the speech decoding device 100 receives a multiplexed code sequence output from a speech encoding device 200 described below and outputs a decoded speech signal to the outside. As shown in FIG. 5, the speech decoding device 100 functionally includes a code sequence demultiplexer 100*a*, a low frequency decoder 100*b*, a low frequency temporal envelope shape determiner 100*c*, a low frequency temporal envelope modifier 100*d*, a high frequency decoder 100*e*, and a low frequency/high frequency signal combiner 100*f*.

Figure 6:
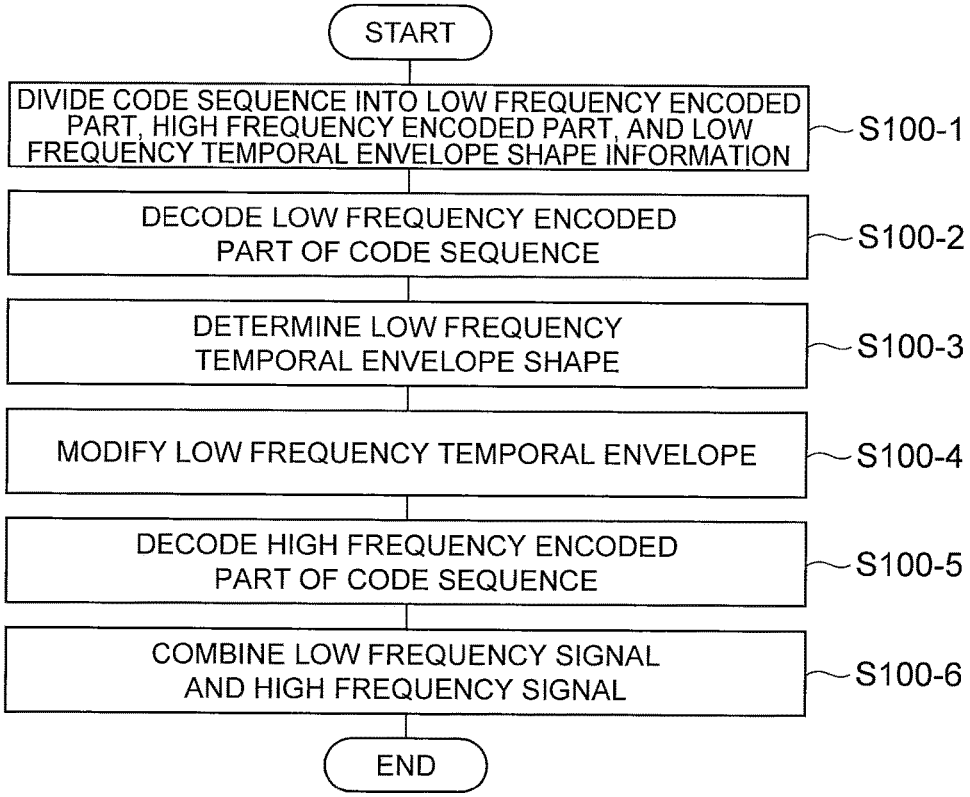
FIG. 6 is a flow chart showing the operation of the speech decoding device according to the second embodiment.

FIG. 6 is a flowchart showing the operation of the speech decoding device according to the second embodiment.

The code sequence demultiplexer 100*a* divides a code sequence into a low frequency encoded part, which is the encoded low frequency signal, and a high frequency encoded part, which is the encoded high frequency signal (step S100-1).

The low frequency decoder 100*b* decodes the low frequency encoded part divided by the code sequence demultiplexer 100*a* to obtain a low frequency signal (step S100-2).

The low frequency temporal envelope shape determiner 100*c* determines the temporal envelope shape of the low frequency signal, based on at least one of information about the low frequency temporal envelope shape divided by the code sequence demultiplexer 100*a* and the low frequency signal obtained by the low frequency decoder 100*b* (step S100-3).

Examples include a case where it is determined that the temporal envelope shape of the low frequency signal is flat, a case where it is determined that the temporal envelope shape of the low frequency signal is onset, and a case where it is determined that the temporal envelope shape of the low frequency signal is offset.

The temporal envelope shape of the low frequency signal is determined, for example, by replacing the decoded signal obtained by the speech decoder 1*b* with the low frequency signal obtained by the low frequency decoder 100*b* in the process of determining the temporal envelope shape of the decoded signal by the temporal envelope shape determiner 1*c*.

The low frequency temporal envelope modifier 100*d* modifies the shape of the temporal envelope of the low frequency signal output from the low frequency decoder 100*b*, based on the temporal envelope shape determined by the low frequency temporal envelope shape determiner 100*c* (step S100-4).

The temporal envelope shape of the low frequency signal can be modified, for example, by replacing the decoded signal obtained by the speech decoder 1*b* with the low frequency signal obtained by the low frequency decoder 100*b* in the process of modifying the temporal envelope shape of the decoded signal in the temporal envelope modifier 1*d*.

The high frequency decoder 100*e* decodes the high frequency encoded part divided by the code sequence demultiplexer 100*a* to obtain a high frequency signal (step S100-5).

The decoding of the high frequency signal in the high frequency decoder 100*e* can be performed by a method of decoding a code sequence in which a high frequency signal is encoded by at least one of domain signals of a time domain signal, a subband signal, and a frequency domain signal.

For example, in some speech decoding devices, a high frequency signal can be generated by a bandwidth extension technique that generates a high frequency signal using the decoding result obtained by the low frequency decoder. In such speech decoding devices, if information required to generate a high frequency signal by a bandwidth extension technique is included in the code sequence, part of the code sequence that includes the information is the high frequency encoded part. A high frequency signal is then generated by decoding the high frequency encoded part divided by the code sequence demultiplexer 100*a* and obtaining the information required for the bandwidth extension technique. By contrast, if information required to generate a high frequency signal by a bandwidth extension technique is not included in the code sequence, the code sequence demultiplexer 100*a* inputs nothing to the high frequency decoder 100*e* and generates a high frequency signal through a predetermined process or a process using the decoding result obtained by the low frequency decoder.

The low frequency/high frequency signal combiner 100*f* combines the low frequency signal having the temporal envelope shape modified by the low frequency temporal envelope modifier 100*d* and the high frequency signal obtained by the high frequency decoder 100*e* to output a speech signal including a low frequency component and a high frequency component (step S100-6).

Figure 7:
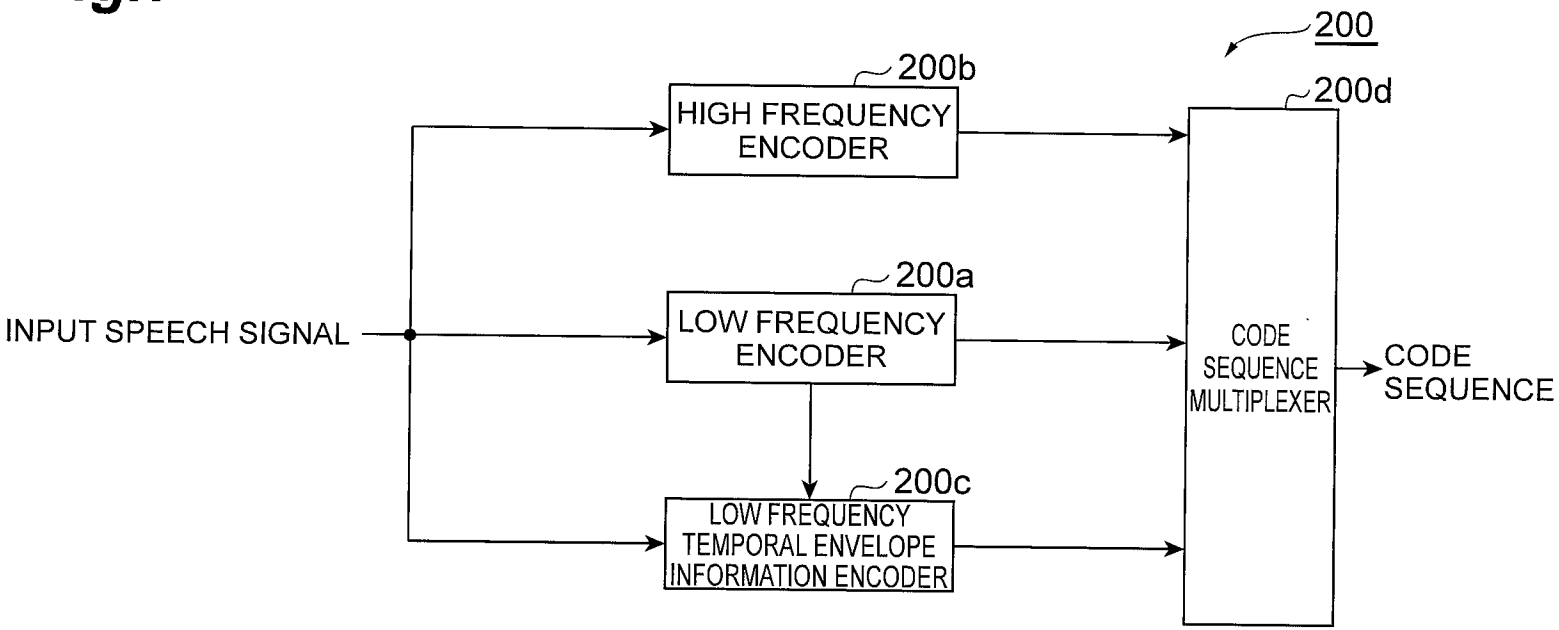
FIG. 7 is a figure showing the configuration of the speech to digital converter 200 according to the second embodiment.

FIG. 7 is a diagram showing the configuration of the speech encoding device 200 according to the second embodiment. A communication device of the speech encoding device 200 receives a speech signal to be encoded from the outside and outputs the encoded code sequence to the outside. As shown in FIG. 1, the speech encoding device 200 functionally includes a low frequency encoder 200*a*, a high frequency encoder 200*b*, a low frequency temporal envelope information encoder 200*c*, and a code sequence multiplexer 200*d*.

Figure 8:
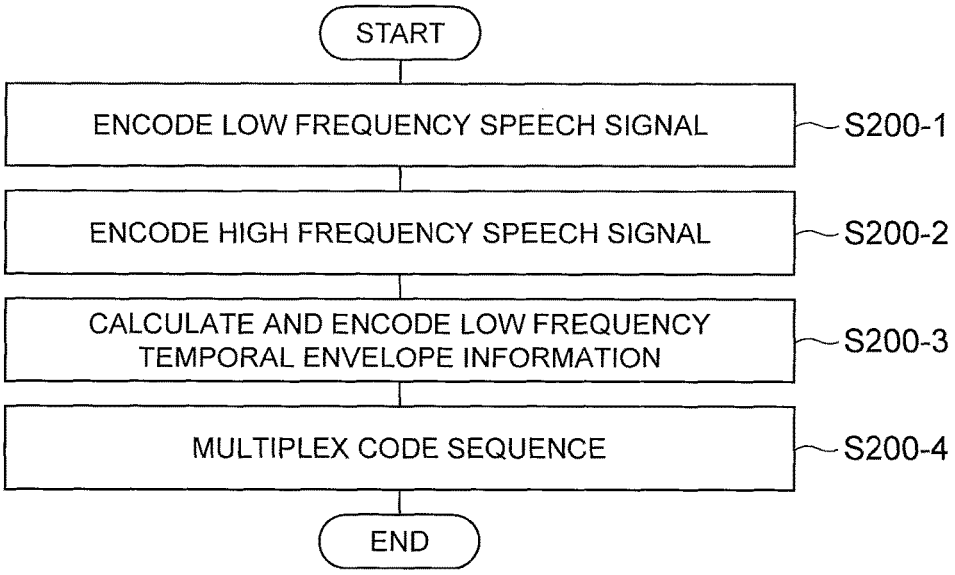
FIG. 8 is a flow chart showing the operation of the speech to digital converter 200 according to the second embodiment.

FIG. 8 is a flowchart showing the operation of the speech encoding device 200 according to the second embodiment.

The low frequency encoder 200*a* encodes a low frequency signal corresponding to the low frequency component of the input speech signal (step S200-1).

The high frequency encoder 200*b* encodes a high frequency signal corresponding to the high frequency component of the input speech signal (step S200-2).

The low frequency temporal envelope information encoder 200*c* calculates and encodes low frequency temporal envelope shape information, based on at least one of the input speech signal and information obtained in the encoding process including the encoding result of the input speech signal in the low frequency encoder 200*a* (step S200-3).

The process of calculating and encoding low frequency temporal envelope shape information can be performed in the same manner, for example, by using the low frequency signal of the input speech signal in place of the input speech signal and using the low frequency decoded signal obtained by decoding the encoding result in the low frequency encoder 200*a* in place of the decoded signal, in the process of calculating and encoding temporal envelope information on the input speech signal in the temporal envelope information encoder 2*b*.

The code sequence multiplexer 200*d* receives the code sequence of the low frequency speech signal from the low frequency encoder 200*a*, receives the code sequence of the high frequency speech signal from the high frequency encoder 200*b*, receives the low frequency temporal envelope shape information encoded by the low frequency temporal envelope information encoder 200*c* and outputs a multiplexed code sequence (step S200-4).

First Modification of Speech Decoding Device of Second Embodiment

Figure 9:
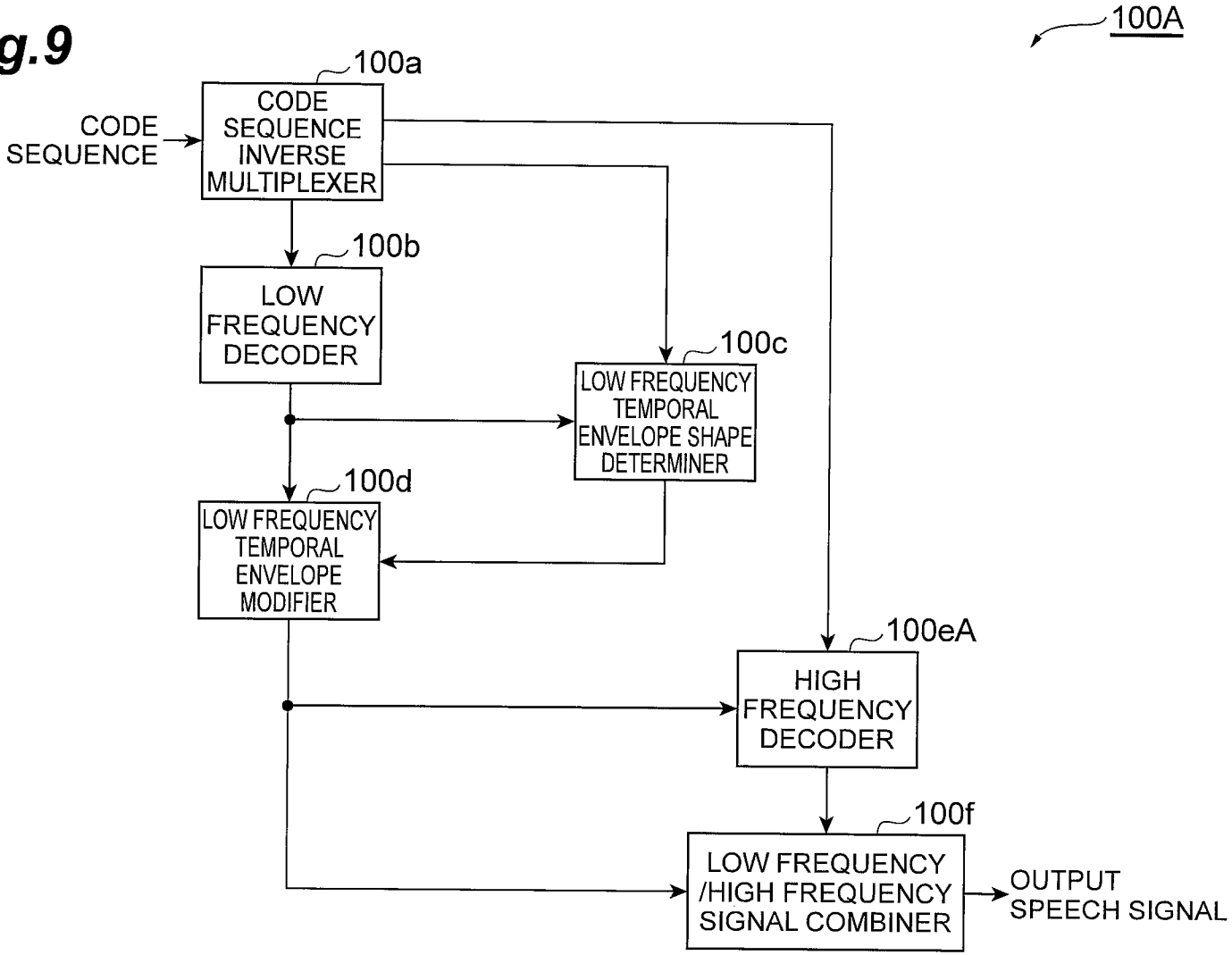
FIG. 9 is a figure showing the configuration of the first modification 100A of the speech decoding device according to the second embodiment.

FIG. 9 is a diagram showing the configuration of a first modification 100A of the speech decoding device according to the second embodiment.

Figure 10:
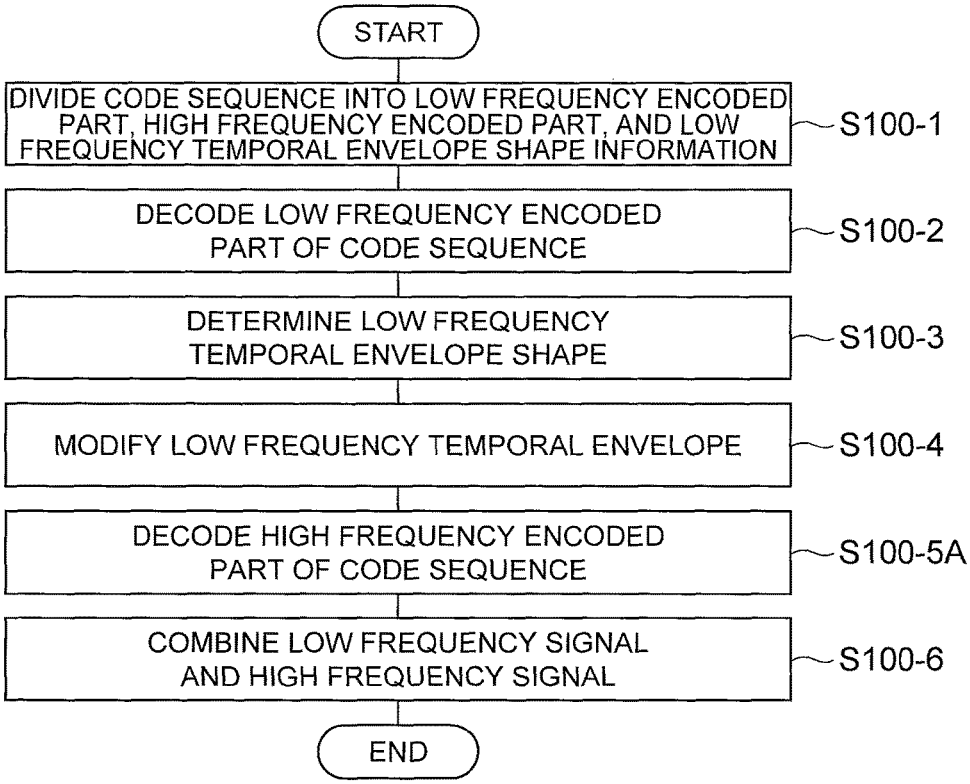
FIG. 10 is a flow chart showing the operation of the first modification 100A of the speech decoding device according to the second embodiment.

FIG. 10 is a flowchart showing the operation of the first modification 100A of the speech decoding device according to the second embodiment.

A high frequency decoder 100*e*A decodes the high frequency encoded part divided by the code sequence demultiplexer 100*a* to obtain a high frequency signal (step S100-5A).

The high frequency decoder 100*e*A differs from the high frequency decoder 100*e* in that the low frequency signal having the temporal envelope shape modified by the low frequency temporal envelope modifier 100*d* is used when the low frequency decoded signal obtained by the low frequency decoder is used in decoding of the high frequency signal.

Second Modification of Speech Decoding Device of Second Embodiment

Figure 11:
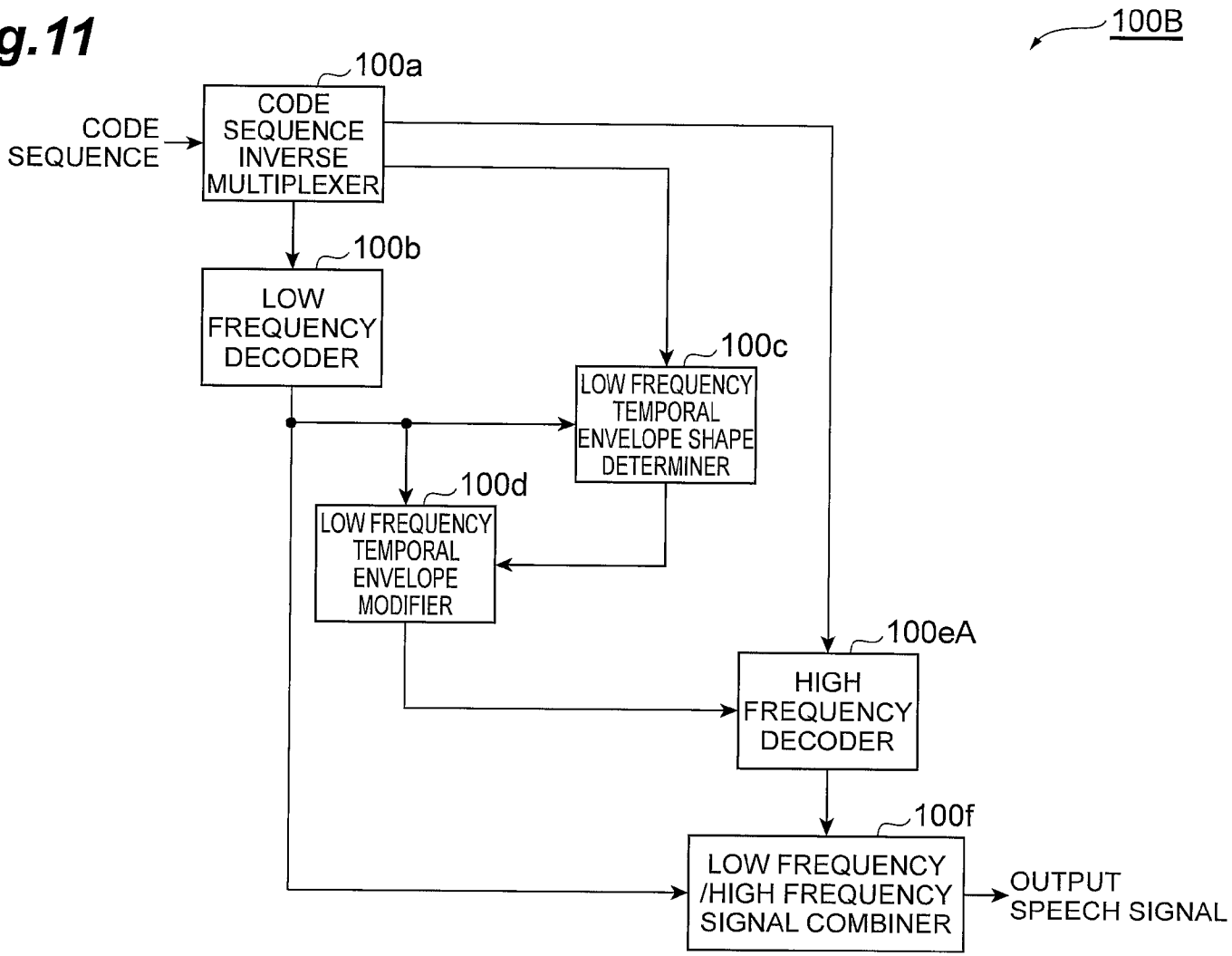
FIG. 11 is a figure showing the configuration of the first modification 100A of the speech to digital converter according to the second embodiment.

FIG. 11 is a diagram showing the configuration of a first modification 100A of the speech decoding device according to the second embodiment.

The difference from the first modification of the speech decoding device in the second embodiment is that the low frequency signal input to the low frequency/high frequency signal combiner 100*f* is not output from the low frequency temporal envelope modifier 100*d* but output from the low frequency decoder 100*b*.

Third Embodiment

Figure 12:
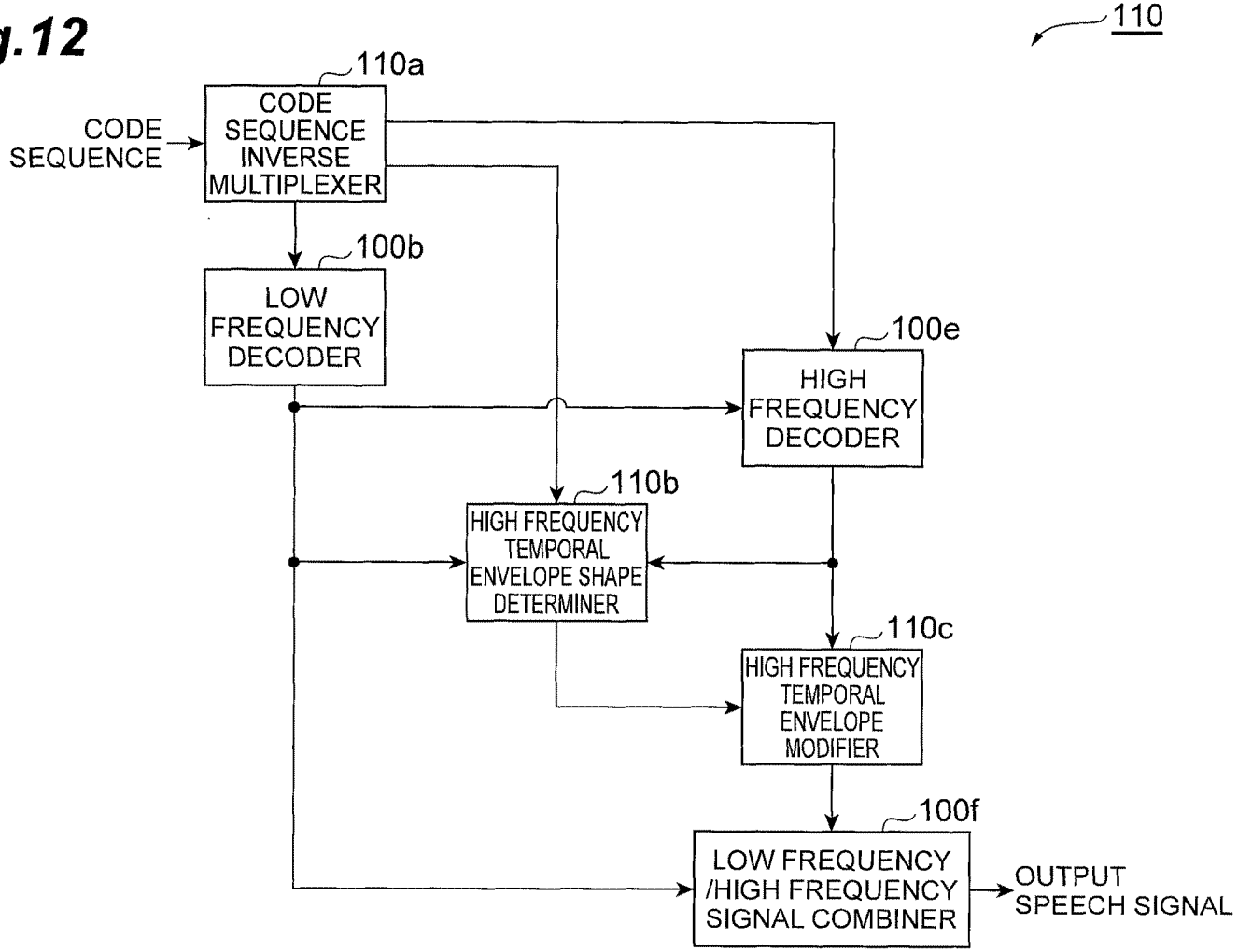
FIG. 12 is a figure showing the configuration of the speech decoding device 110 according to a third embodiment.

FIG. 12 is a diagram showing the configuration of a speech decoding device 110 according to a third embodiment. A communication device of the speech decoding device 110 receives a multiplexed code sequence output from a speech encoding device 210 described below and outputs a decoded speech signal to the outside. As shown in FIG. 12, the speech decoding device 110 functionally includes a code sequence demultiplexer 110*a*, a low frequency decoder 100*b*, a high frequency decoder 100*e*, a high frequency temporal envelope shape determiner 110*b*, a high frequency temporal envelope modifier 110*c*, and a low frequency/high frequency signal combiner 100*f*.

Figure 13:
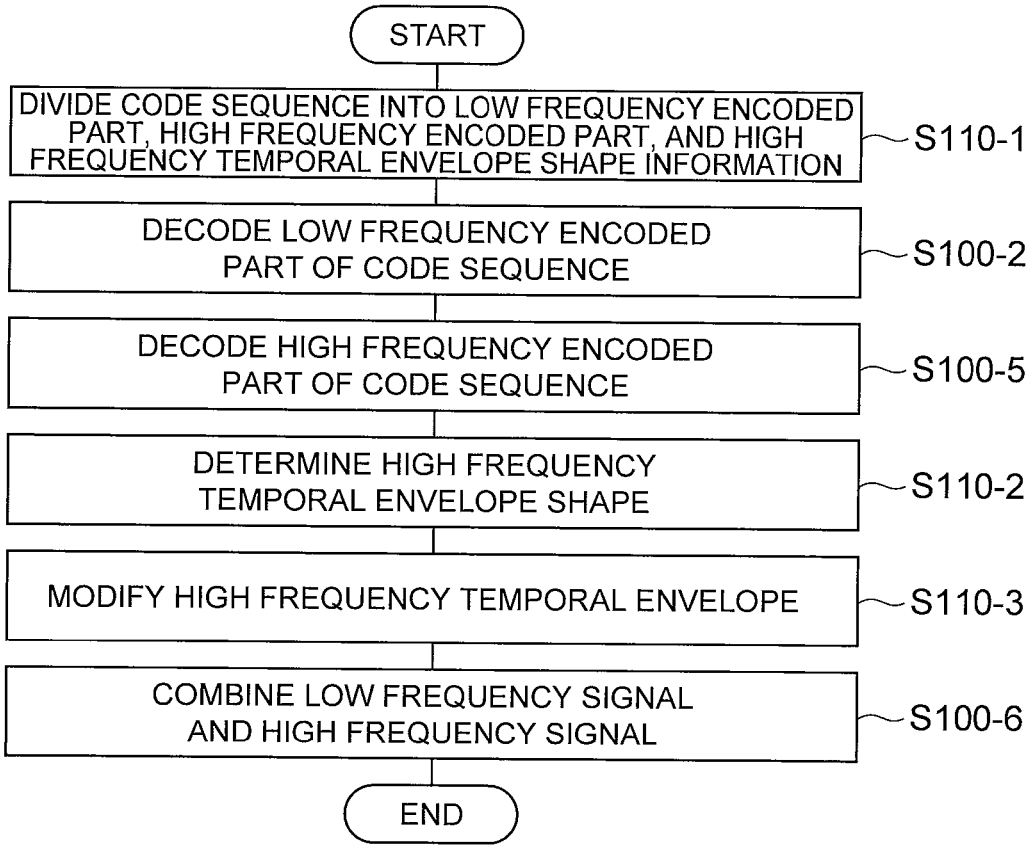
FIG. 13 is a flow chart showing the operation of the speech decoding device according to the third embodiment.

FIG. 13 is a flowchart showing the operation of the speech decoding device according to the third embodiment.

The code sequence demultiplexer 110*a* divides a code sequence into a low frequency encoded part, a high frequency encoded part and information about the high frequency temporal envelope shape (step S110-1).

The high frequency temporal envelope shape determiner 110*b* determines the temporal envelope shape of the high frequency signal, based on at least one of information about the high frequency temporal envelope shape divided by the code sequence demultiplexer 110*a*, the high frequency signal obtained by the high frequency decoder 100*e* and the low frequency signal obtained by the low frequency decoder 100*b* (step S110-2).

Examples include a case where it is determined that the temporal envelope shape of the high frequency signal is flat, a case where it is determined that the temporal envelope shape of the high frequency signal is onset, and a case where it is determined that the temporal envelope shape of the high frequency signal is offset.

The temporal envelope shape of the high frequency signal is determined, for example, by replacing the decoded signal obtained by the speech decoder 1*b* with the high frequency signal obtained by the high frequency decoder 100*e* in the process of determining the temporal envelope shape of the decoded signal in the temporal envelope shape determiner 1*c*. Similarly, the decoded signal obtained by the speech decoder 1*b* can be replaced with the low frequency signal obtained by the low frequency decoder 100*b*.

The high frequency temporal envelope modifier 110*c* modifies the shape of the temporal envelope of the high frequency signal output from the high frequency decoder 110*e*, based on the temporal envelope shape determined by the high frequency temporal envelope shape determiner 110*b* (step S110-3). For example, when it is determined that the temporal envelope shape of the high frequency signal is flat, the temporal envelope shape of the high frequency signal can be modified by the following process.

The temporal envelope shape of the high frequency signal can be modified, for example, by replacing the decoded signal obtained by the speech decoder 1*b* with the high frequency signal obtained by the high frequency decoder 100*e* in the process of modifying the temporal envelope shape of the decoded signal in the temporal envelope modifier 1*d*.

Figure 14:
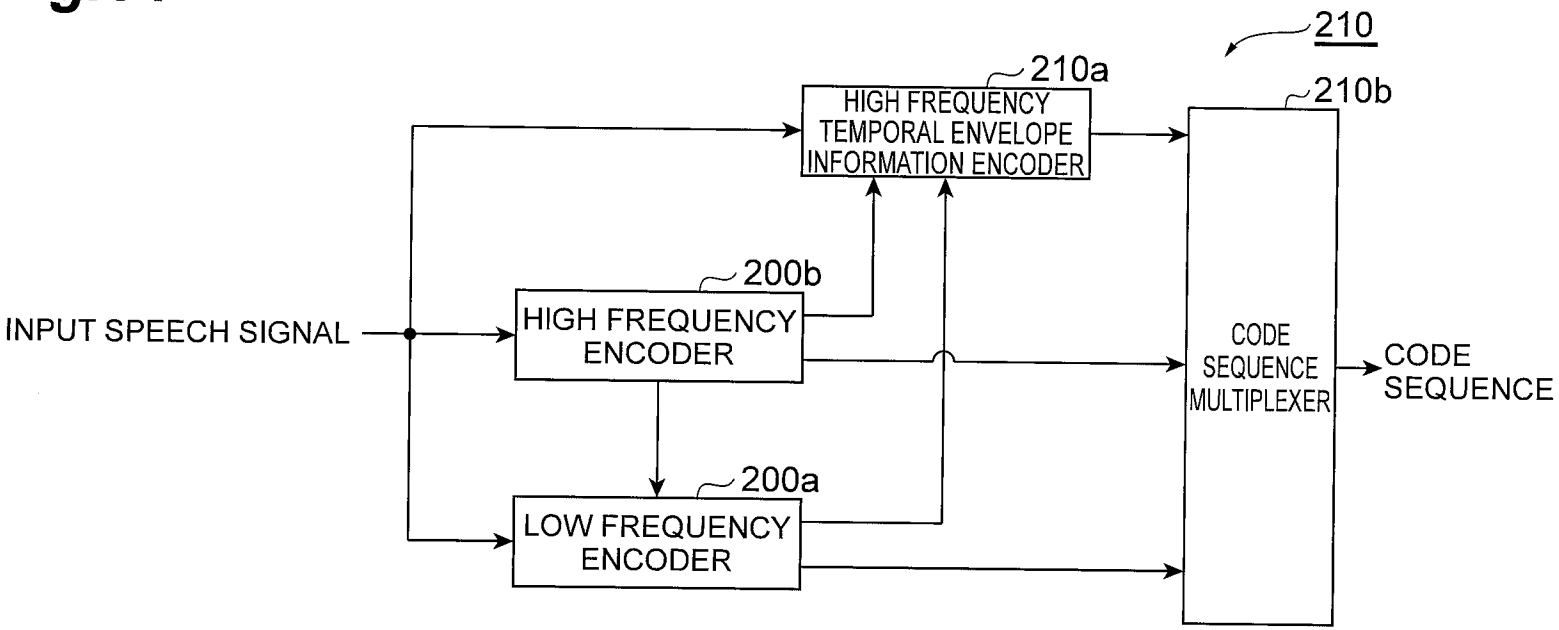
FIG. 14 is a figure showing the configuration of the speech to digital converter 210 according to the third embodiment.

FIG. 14 is a diagram showing the configuration of the speech encoding device 210 according to the third embodiment. A communication device of the speech encoding device 210 receives a speech signal to be encoded from the outside and outputs the encoded code sequence to the outside. As shown in FIG. 14, the speech encoding device 210 functionally includes a low frequency encoder 200*a*, a high frequency encoder 200*b*, a high frequency temporal envelope information encoder 210*a*, and a code sequence multiplexer 210*b*.

Figure 15:
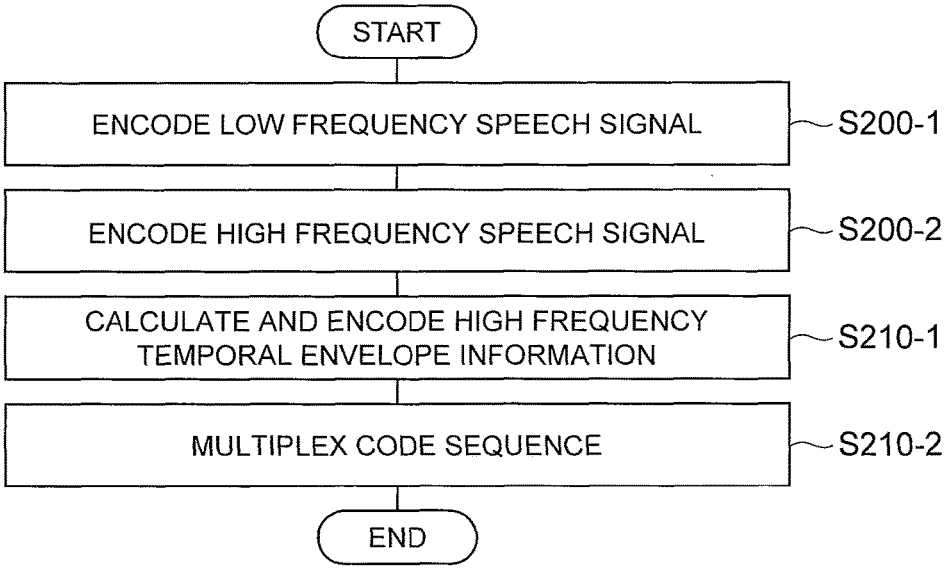
FIG. 15 is a flow chart showing the operation of the speech to digital converter 210 according to the third embodiment.

FIG. 15 is a flowchart showing the operation of the speech encoding device 210 according to the third embodiment.

The high frequency temporal envelope information encoder 210*a* calculates and encodes high frequency temporal envelope shape information, based on at least one of the input speech signal, information obtained in the encoding process including the encoding result of the input speech signal in the low frequency encoder 200*a*, and information obtained in the encoding process including the encoding result of the input speech signal in the high frequency encoder 200*b* (step S210-1).

Calculating and encoding high frequency temporal envelope shape information can be performed similarly, for example, in the process of calculating and encoding the temporal envelope information on the input speech signal in the temporal envelope information encoder 2*b* where the high frequency signal of the input speech signal is used in place of the input speech signal, and the high frequency decoded signal obtained by decoding the encoding result in the high frequency encoder 200*b* is used in place of the decoded signal.

The code sequence multiplexer 210*b* receives the code sequence of the low frequency speech signal from the low frequency encoder 200*a*, receives the code sequence of the high frequency speech signal from the high frequency encoder 200*b*, receives the encoded high frequency temporal envelope shape information from the high frequency temporal envelope information encoder 210*a* and outputs a multiplexed code sequence (step S210-2).

Fourth Embodiment

Figure 16:
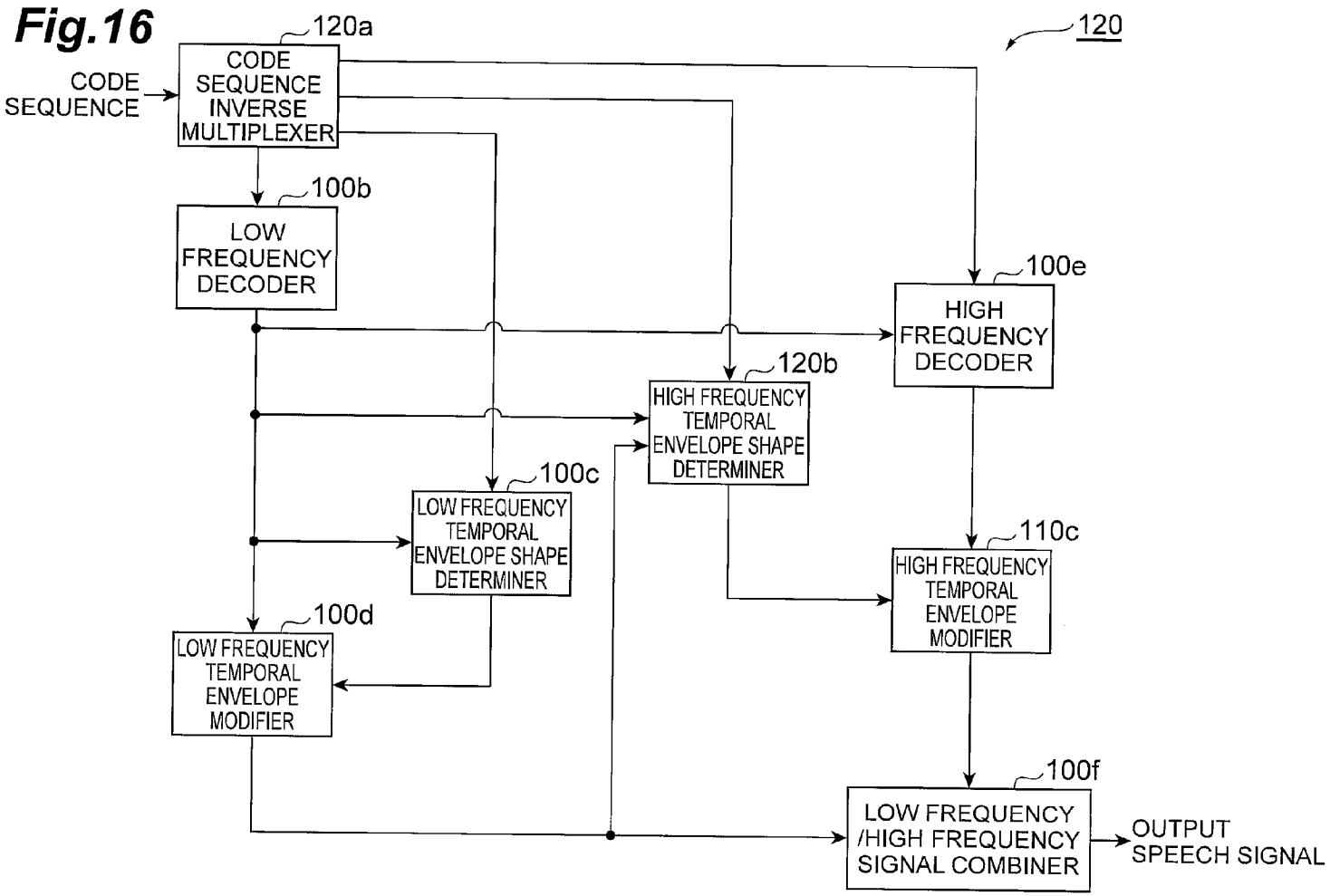
FIG. 16 is a figure showing the configuration of the speech decoding device 120 according to a fourth embodiment.

FIG. 16 is a diagram showing the configuration of a speech decoding device 120 according to a fourth embodiment. A communication device of the speech decoding device 120 receives a multiplexed code sequence output from a speech encoding device 220 described below and outputs a decoded speech signal to the outside. As shown in FIG. 16, the speech decoding device 120 functionally includes a code sequence demultiplexer 120*a*, a low frequency decoder 100*b*, a low frequency temporal envelope shape determiner 100*c*, a low frequency temporal envelope modifier 100*d*, a high frequency decoder 100*e*, a high frequency temporal envelope shape determiner 120*b*, a high frequency temporal envelope modifier 110*c*, and a low frequency/high frequency signal combiner 100*f*.

Figure 17:
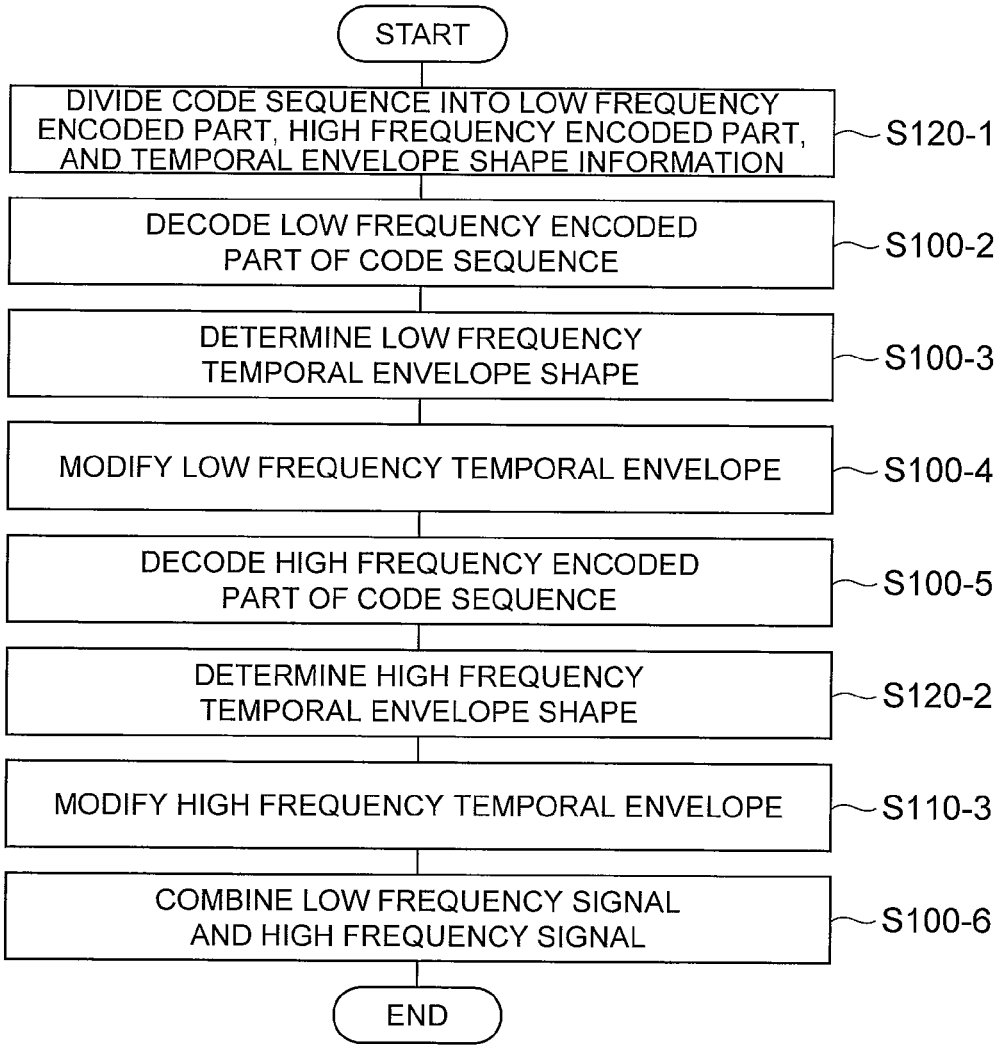
FIG. 17 is a flow chart showing the operation of the speech decoding device 120 according to the fourth embodiment.

FIG. 17 is a flowchart showing the operation of the speech decoding device 120 according to the fourth embodiment.

The code sequence demultiplexer 120*a* divides a code sequence into a low frequency encoded part, a high frequency encoded part, information about the low frequency temporal envelope shape and information about the high frequency temporal envelope shape (step S120-1).

In doing so, the information about the low frequency temporal envelope shape and the information about the high frequency temporal envelope shape can be divided, for example, from a code sequence including information about the low frequency temporal envelope shape and information about the high frequency temporal envelope shape that are separately encoded or can be divided from a code sequence including information about the frequency temporal envelope shape and information about the high frequency temporal envelope shape that are encoded in combination. For example, they can be divided from a code sequence including information in which information about the low frequency temporal envelope shape and information about the high frequency temporal envelope shape are represented by a single piece of information and encoded.

The high frequency temporal envelope shape determiner 120*b* determines the temporal envelope shape of the high frequency signal, based on at least one of the information about the high frequency temporal envelope shape divided by the code sequence demultiplexer 120*a*, the low frequency signal obtained by the low frequency decoder 100*b*, and the low frequency signal having the temporal envelope shape modified by the low frequency temporal envelope modifier 100*d* (step S120-2).

Examples include a case where it is determined that the temporal envelope shape of the high frequency signal is flat, a case where it is determined that the temporal envelope shape of the high frequency signal is onset, and a case where it is determined that the temporal envelope shape of the high frequency signal is offset.

If the process of determining the high frequency temporal envelope shape in the high frequency temporal envelope shape determiner 120*b* is based on the low frequency signal having the temporal envelope shape modified by the low frequency temporal envelope modifier 100*d*, the decoded signal obtained by the speech decoder 1*b* can be replaced with the low frequency signal having the temporal envelope shape modified by the low frequency temporal envelope modifier 100*d* in the process of determining the temporal envelope shape of the decoded signal in the temporal envelope shape determiner 1*c*.

Figure 18:
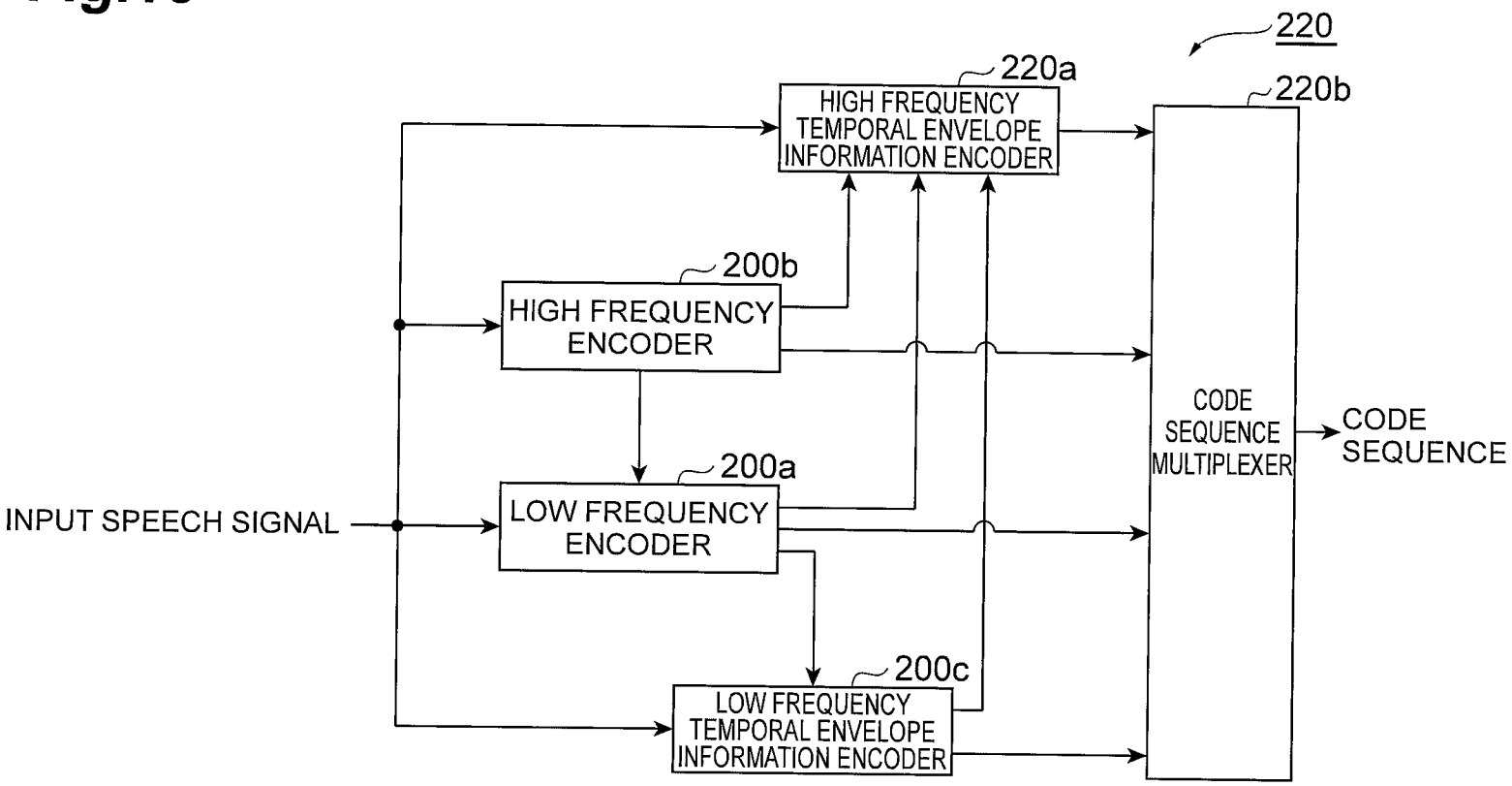
FIG. 18 is a figure showing the configuration of the speech to digital converter 220 according to the fourth embodiment.

FIG. 18 is a diagram showing the configuration of the speech encoding device 220 according to the fourth embodiment. A communication device of the speech encoding device 220 receives a speech signal to be encoded from the outside and outputs the encoded code sequence to the outside. As shown in FIG. 18, the speech encoding device 220 functionally includes a low frequency encoder 200*a*, a high frequency encoder 200*b*, a low frequency temporal envelope information encoder 200*c*, a high frequency temporal envelope information encoder 220*a*, and a code sequence multiplexer 220*b*.

Figure 19:
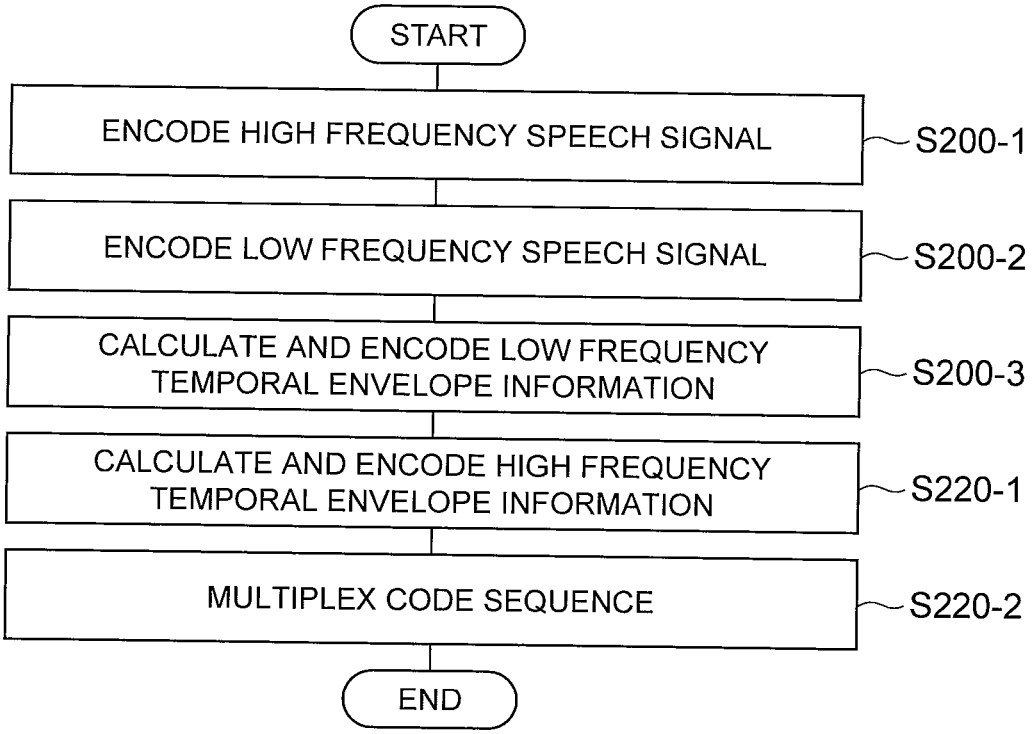
FIG. 19 is a flow chart showing the operation of the speech to digital converter 220 according to the fourth embodiment.

FIG. 19 is a flowchart showing the operation of the speech encoding device 220 according to the fourth embodiment.

The high frequency temporal envelope information encoder 220*a* calculates and encodes high frequency temporal envelope shape information, based on at least one of the input speech signal, information obtained in the encoding process including the encoding result of the input speech signal in the low frequency encoder 200*a*, information obtained in the encoding process including the encoding result of the input speech signal in the high frequency encoder 200*b*, and information obtained in the encoding process including the encoding result of the low frequency temporal envelope information in the low frequency temporal envelope information encoder 200*c* (step S220-1).

Calculating and encoding high frequency temporal envelope shape information can be performed, for example, in the process of calculating and encoding the temporal envelope information on the high frequency signal by the high frequency temporal envelope information encoder 210*a*. For example, the process may be based on the encoding result of the low frequency temporal envelope information. For example, only when the result indicating that the low frequency temporal envelope is flat is obtained as the encoding result of the low frequency temporal envelope information, can whether the high frequency temporal envelope is flat be encoded as the high frequency temporal envelope information.

The code sequence multiplexer 220*b* receives the code sequence of the low frequency speech signal from the low frequency encoder 200*a*, receives the code sequence of the high frequency speech signal from the high frequency encoder 200*b*, receives the encoded low frequency temporal envelope shape information from the low frequency temporal envelope information encoder 200*c*, receives the encoded high frequency temporal envelope shape information from the high frequency temporal envelope information encoder 210*a*, and outputs a multiplexed code sequence (step S220-2).

In doing so, in the encoding of the information about the low frequency temporal envelope shape and the information about the high frequency temporal envelope shape, for example, separately encoded information about the low frequency temporal envelope shape and information about the high frequency temporal envelope shape may be received, or unitedly encoded information about the frequency temporal envelope shape and information about the high frequency temporal envelope shape may be received. For example, information about the low frequency temporal envelope shape and information about the high frequency temporal envelope shape, both being represented by a single piece of information and encoded, may be received.

First Modification of Speech Decoding Device of Fourth Embodiment

Figure 20:
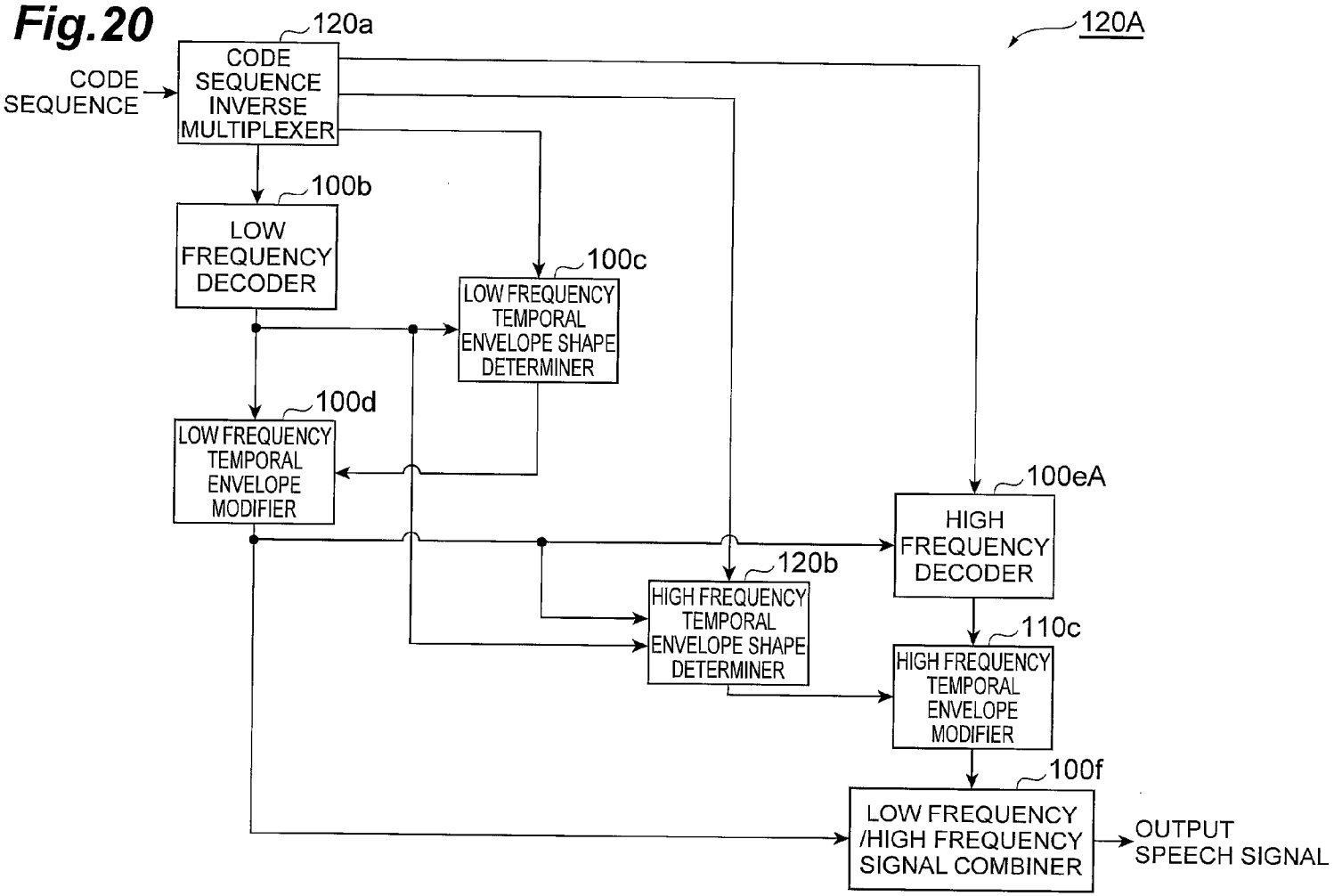
FIG. 20 is a figure showing the configuration of the first modification 120A of the speech decoding device according to the fourth embodiment.

FIG. 20 is a diagram showing the configuration of a first modification 120A of the speech decoding device according to the fourth embodiment. The difference from the speech decoding device 120 in the fourth embodiment is that the low frequency signal having the temporal envelope shape modified by the low frequency temporal envelope modifier 100*d* is used in decoding a high frequency signal in the high frequency decoder 100*e*A.

Figure 21:
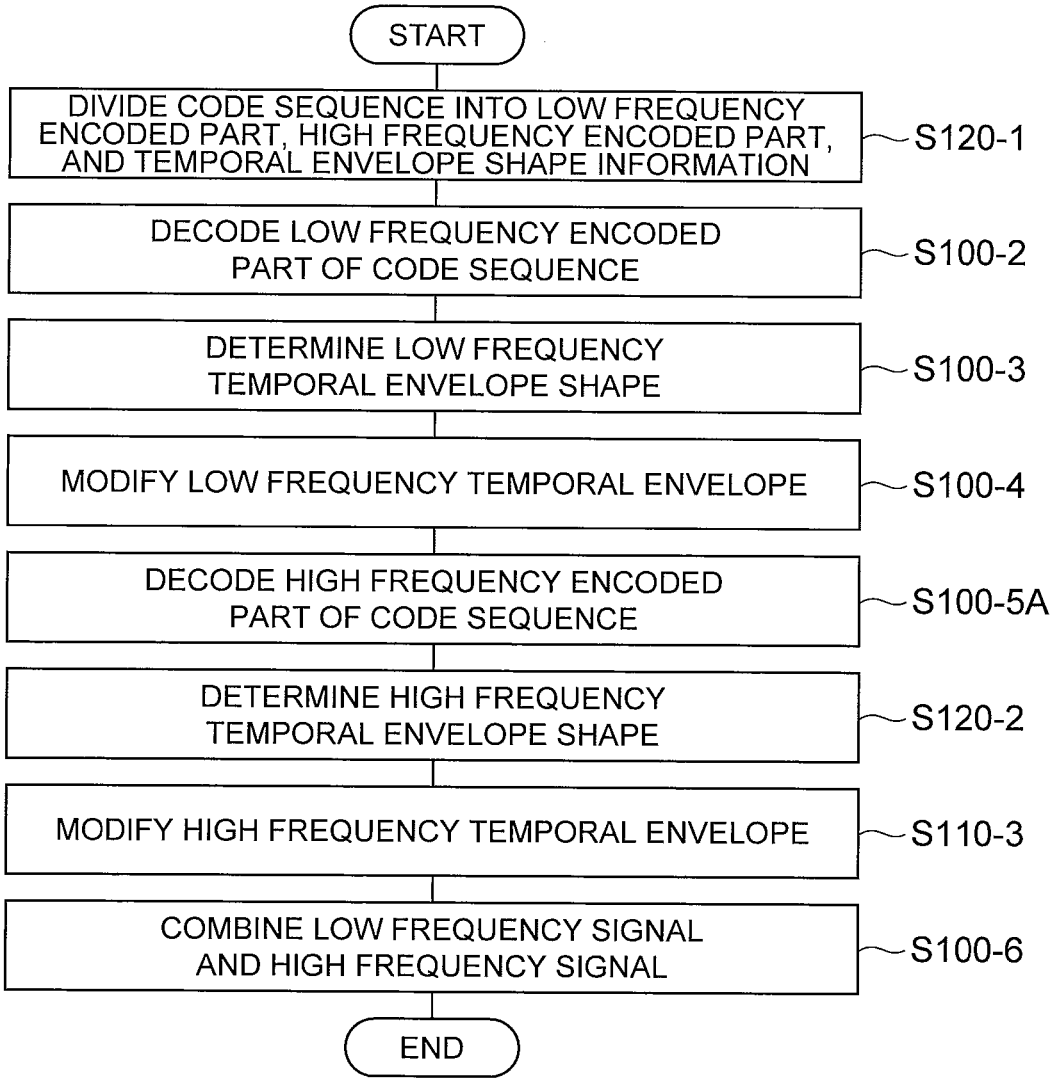
FIG. 21 is a flow chart showing the operation of the first modification 120A of the speech decoding device according to the fourth embodiment.

FIG. 21 is a flowchart showing the operation of the first modification 120A of the speech decoding device according to the fourth embodiment. In step 100-5A in FIG. 21, when the low frequency decoded signal obtained by the low frequency decoder 100*b* is used in decoding a high frequency signal, the low frequency signal having the temporal envelope shape modified by the low frequency temporal envelope modifier 100*d* is used.

Second Modification of Speech Decoding Device of Fourth Embodiment

Figure 22:
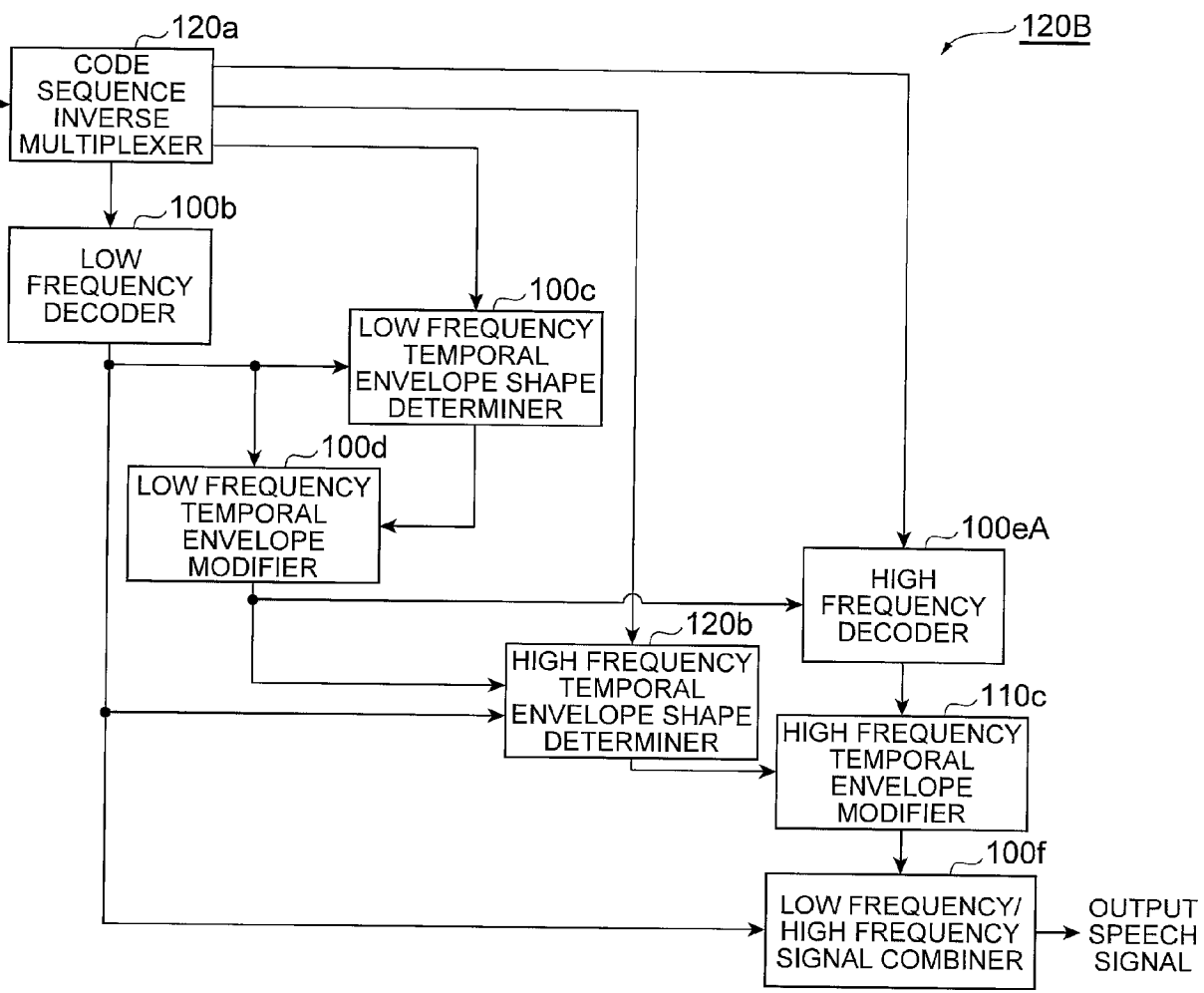
FIG. 22 is a figure showing the configuration of the second modification 120B of the speech decoding device according to the fourth embodiment.

FIG. 22 is a diagram showing the configuration of a second modification 120B of the speech encoding device according to the fourth embodiment. The difference from the first modification of the speech decoding device in the fourth embodiment is that the low frequency signal input to the low frequency/high frequency signal combiner 100*f* is not output from the low frequency temporal envelope modifier 100*d* but output from the low frequency decoder 100*b*.

Figure 23:
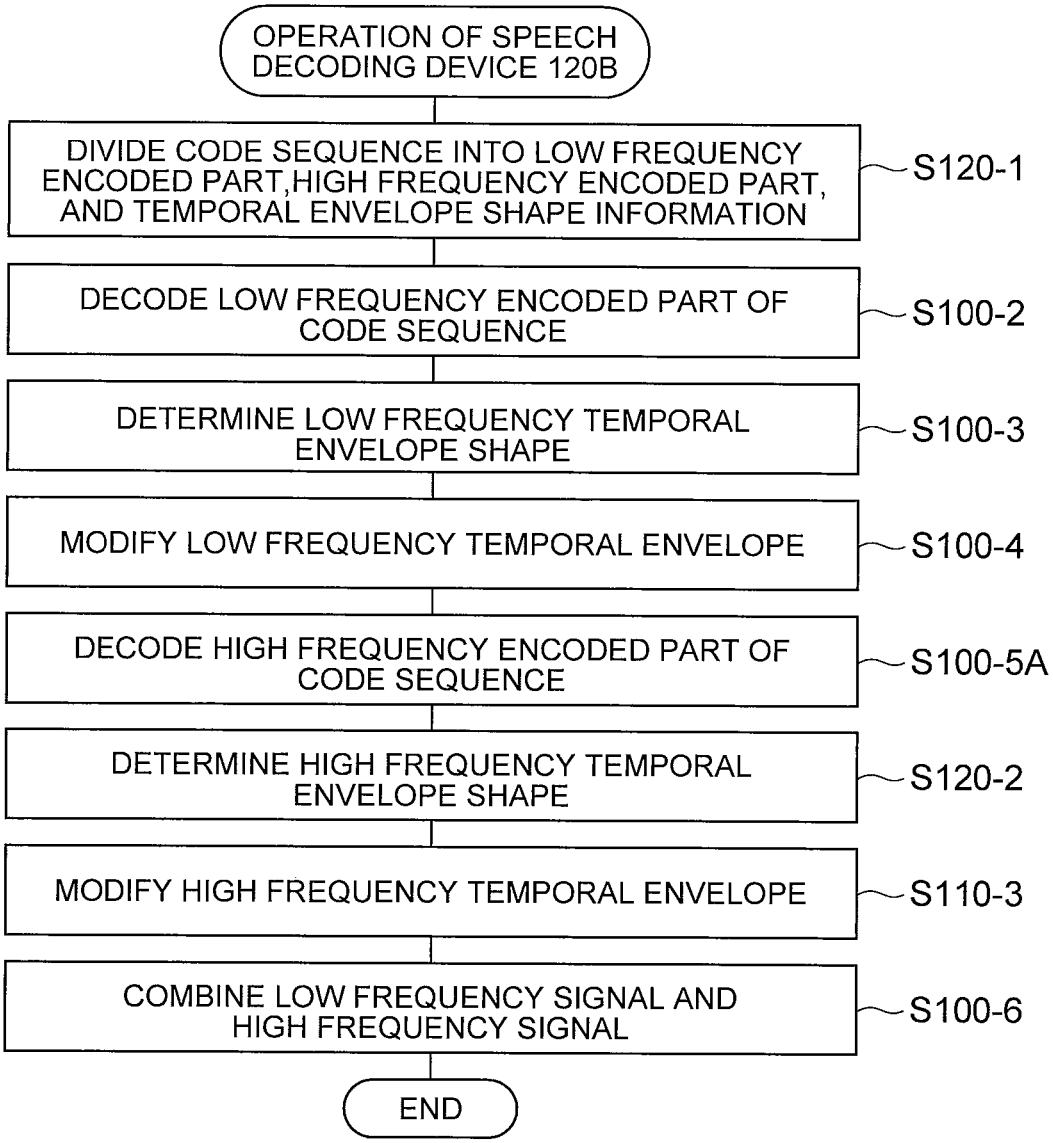
FIG. 23 is a flow chart showing the operation of the second modification 120B of the speech decoding device according to the fourth embodiment.

FIG. 23 is a flowchart showing the operation of the second modification 120B of the speech decoding device according to the fourth embodiment. In step S100-6 in FIG. 23, the low frequency signal from the low frequency decoder 100*b* and the high frequency signal from the high frequency temporal envelope modifier 110*c* are combined.

Third Modification of Speech Decoding Device of Fourth Embodiment

Figure 24:
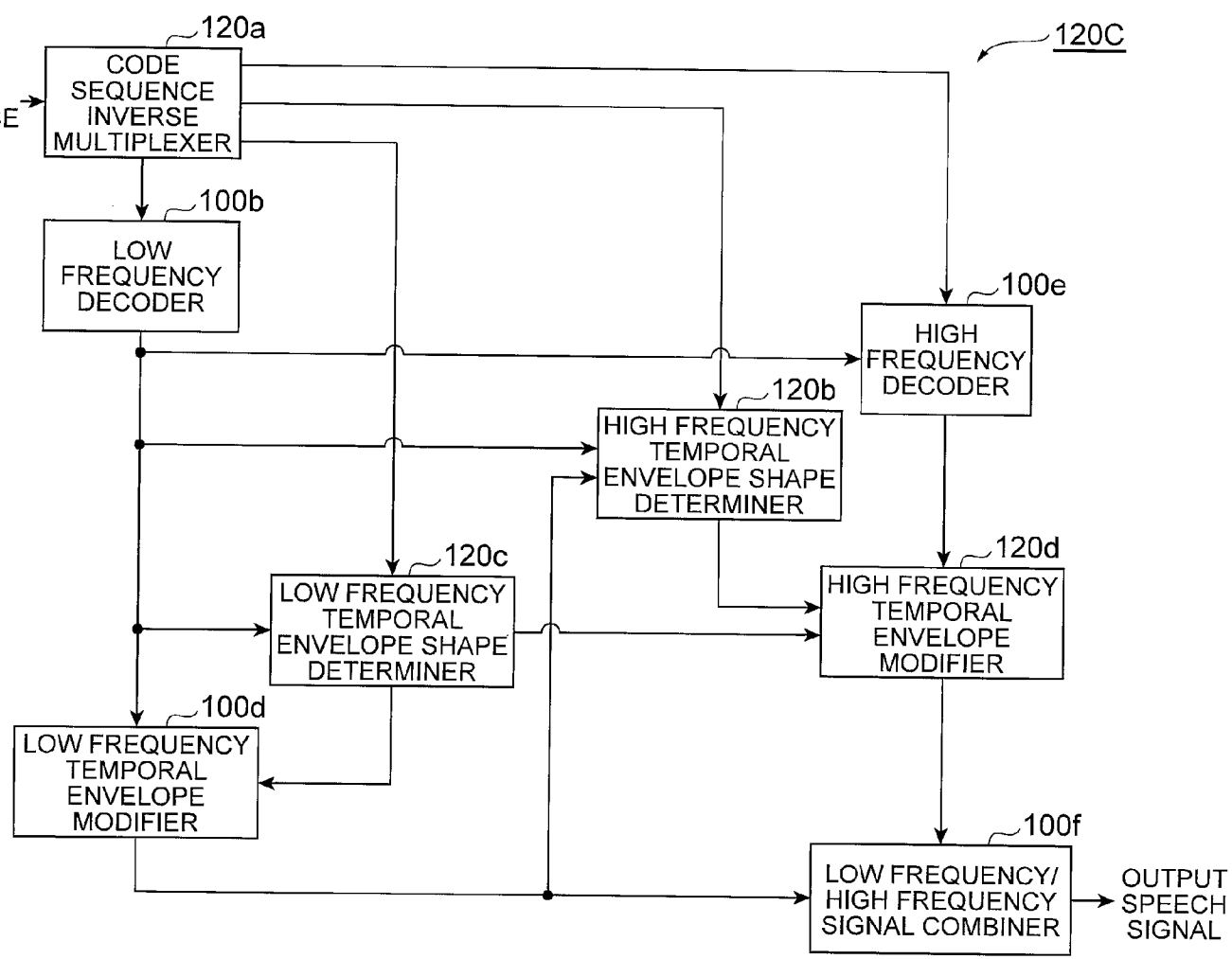
FIG. 24 is a figure showing the configuration of the 3rd modification 120C of the speech decoding device according to the fourth embodiment.

FIG. 24 is a diagram showing the configuration of a third modification 120C of the speech decoding device according to the fourth embodiment.

Figure 25:
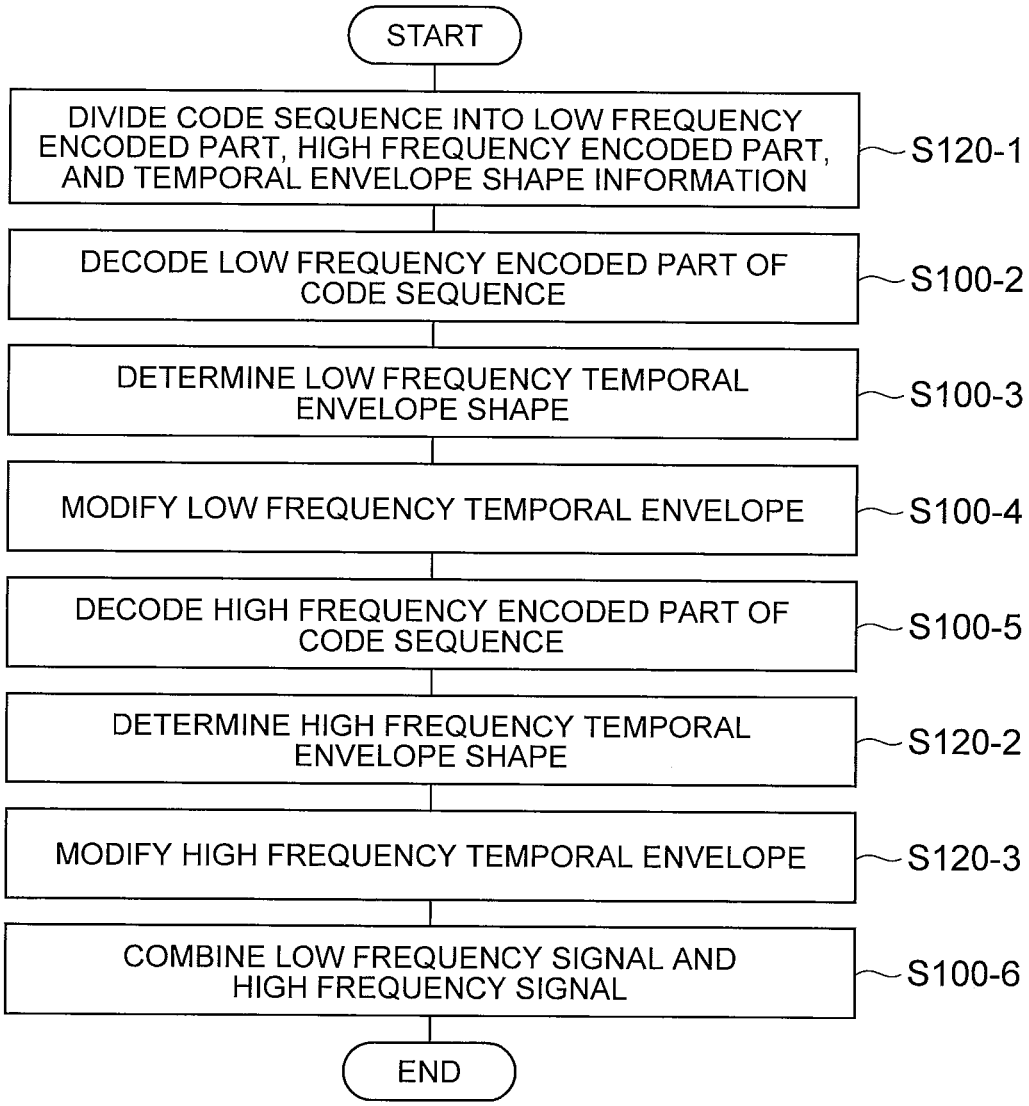
FIG. 25 is a flow chart showing the operation of the 3rd modification 120C of the speech decoding device according to the fourth embodiment.

FIG. 25 is a flowchart showing the operation of the third modification 120C of the speech decoding device according to the fourth embodiment.

The present modification differs from the speech decoding device 120 according to the fourth embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

In the present modification, the low frequency temporal envelope shape determiner 120*c* differs from the low frequency temporal envelope shape determiner 100*c* in that it also notifies the high frequency temporal envelope modifier 120*d* of the determined temporal envelope shape.

The high frequency temporal envelope modifier 120*d* differs from the high frequency temporal envelope modifier 110*c* in that the shape of the temporal envelope of the high frequency signal output from the high frequency decoder 100*e* is modified, based on at least one of the temporal envelope shape determined by the high frequency temporal envelope shape determiner 120*b* and the temporal envelope shape determined by the low frequency temporal envelope shape determiner 120*c* (S120-3).

For example, if the low frequency temporal envelope shape determiner 120*c* determines that the temporal envelope shape is flat, the temporal envelope of the high frequency signal output from the high frequency decoder 100*e* is modified into a flat shape, irrespective of the temporal envelope shape determined by the high frequency temporal envelope shape determiner 120*b*. For example, if the low frequency temporal envelope shape determiner 120*c* determines that the temporal envelope shape is not flat, the temporal envelope of the high frequency signal output from the high frequency decoder 100*e* is not modified into a flat shape, irrespective of the temporal envelope shape determined by the high frequency temporal envelope shape determiner 120*b*. This is applicable to the cases of onset and offset and is not limited to any specific temporal envelope shape.

Fourth Modification of Speech Decoding Device of Fourth Embodiment

Figure 26:
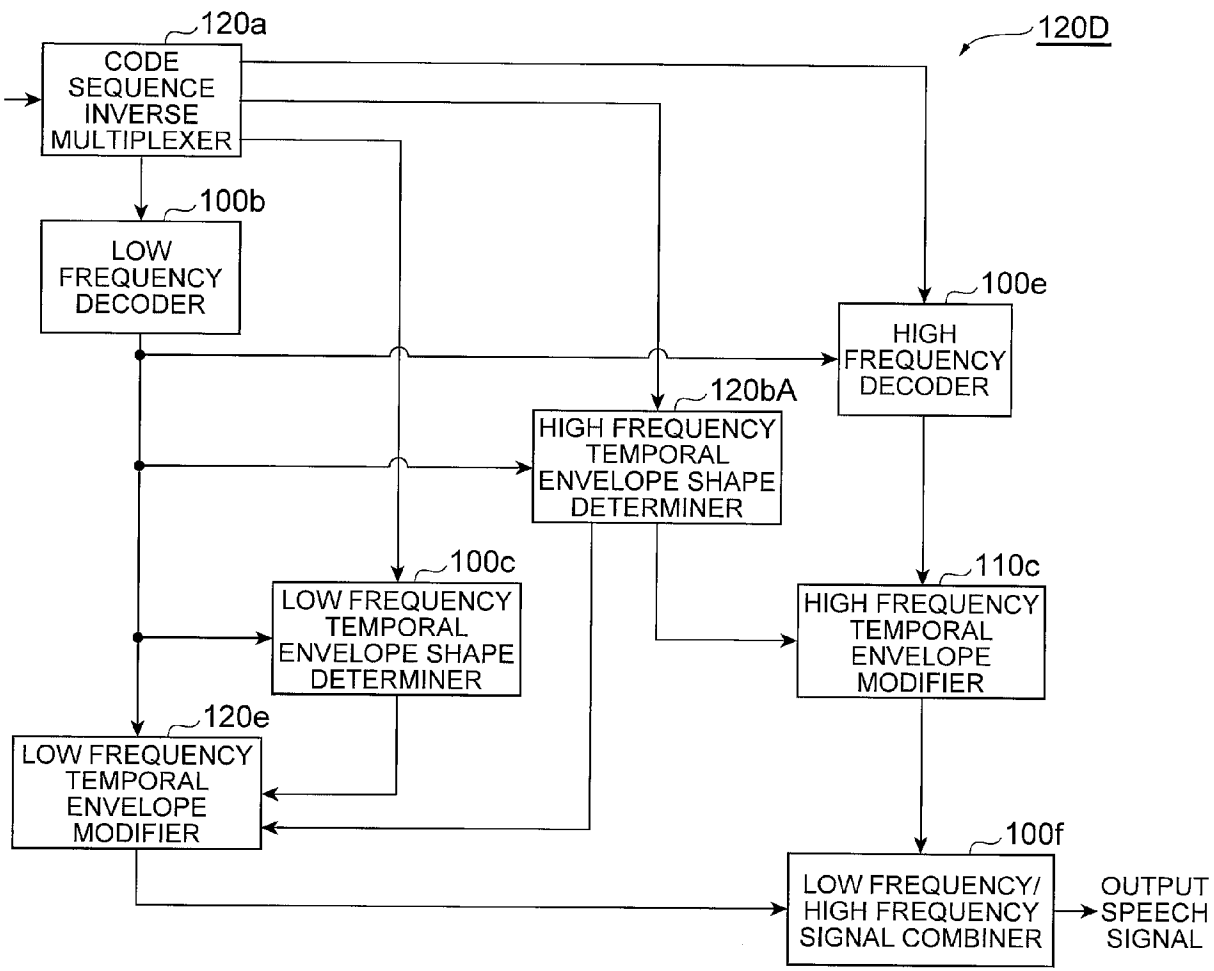
FIG. 26 is a figure showing the configuration of the 4th modification 120D of the speech decoding device according to the fourth embodiment.

FIG. 26 is a diagram showing the configuration of a fourth modification 120D of the speech decoding device according to the fourth embodiment.

Figure 27:
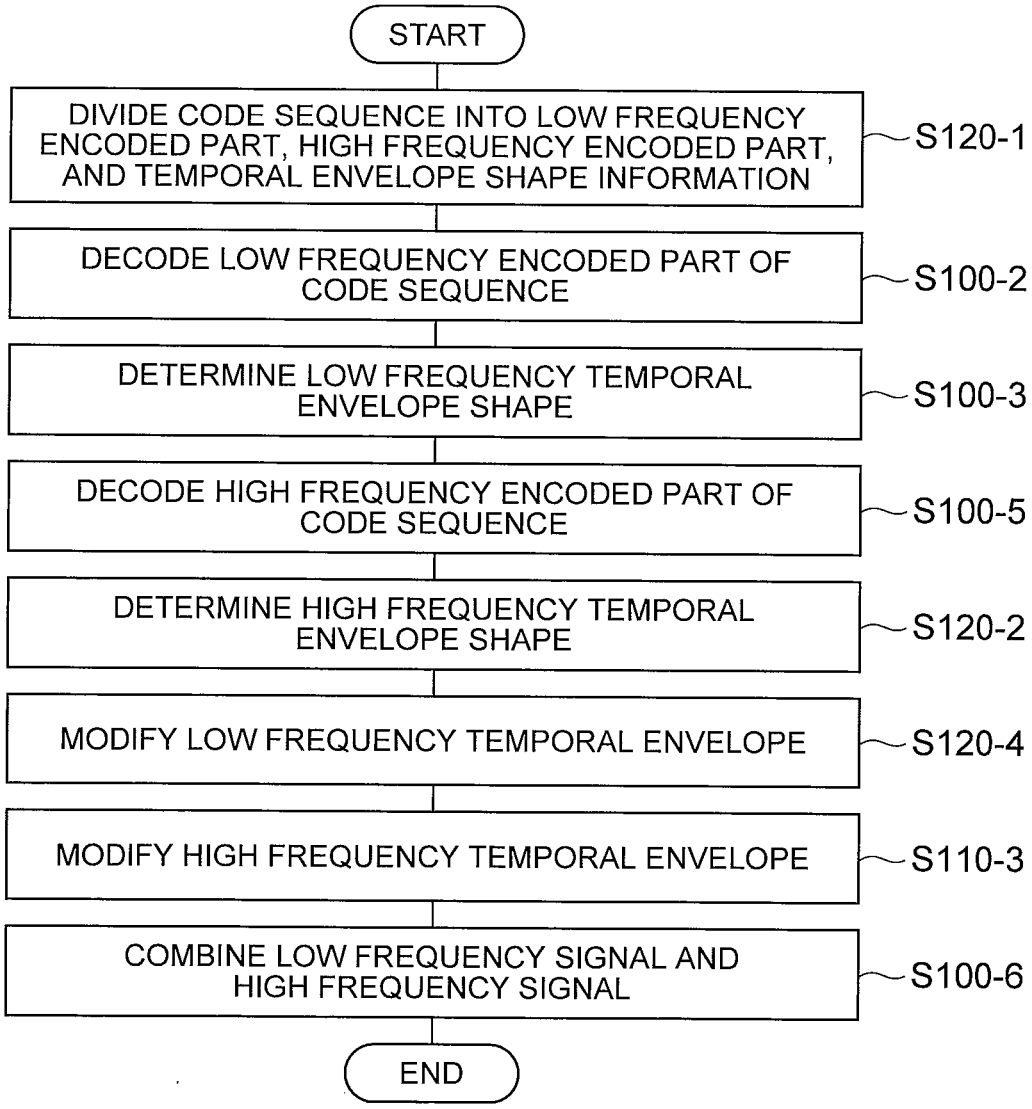
FIG. 27 is a flow chart showing the operation of the 4th modification 120D of the speech decoding device according to the fourth embodiment.

FIG. 27 is a flowchart showing the operation of the fourth modification 120D of the speech decoding device according to the fourth embodiment.

The present modification differs from the speech decoding device 120 according to the fourth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

In the present modification, the high frequency temporal envelope shape determiner 120*b*A differs from the high frequency temporal envelope shape determiner 120*b* in that it also notifies the low frequency temporal envelope modifier 120*e* of the determined temporal envelope shape.

The determination of the temporal envelope shape in the high frequency temporal envelope shape determiner 120*b*A can be based, for example, on the frequency power distribution of the low frequency signal, in addition to the above examples. For example, the frame length in the decoding of the high frequency signal obtained from the code sequence demultiplexer 120*a* can be used. For example, it can be determined that the shape is flat if the frame length is long, and it can be determined that the shape is onset or offset if the frame length is short. The high frequency temporal envelope shape determiner 120*b* can also determine in the same manner.

The low frequency temporal envelope modifier 120*e* differs from the low frequency temporal envelope modifier 100*d* in that the shape of the temporal envelope of the low frequency signal output from the low frequency decoder 100*b* is modified, based on at least one of the temporal envelope shape determined by the low frequency temporal envelope shape determiner 100*c* and the temporal envelope shape determined by the high frequency temporal envelope shape determiner 120*b*A (S120-4).

For example, if the high frequency temporal envelope shape determiner 120*b*A determines that the temporal envelope shape is flat, the temporal envelope of the low frequency signal output from the low frequency decoder 100*b* is modified into a flat shape, irrespective of the temporal envelope shape determined by the low frequency temporal envelope shape determiner 100*c*. For example, if the high frequency temporal envelope shape determiner 120*b*A determines that the temporal envelope shape is flat, the temporal envelope of the low frequency signal output from the low frequency decoder 100*b* is not modified into a flat shape, irrespective of the temporal envelope shape determined by the low frequency temporal envelope shape determiner 100*c*. This is applicable to the cases of onset and offset and is not limited to any specific temporal envelope shape.

Fifth Modification of Speech Decoding Device of Fourth Embodiment

Figure 28:
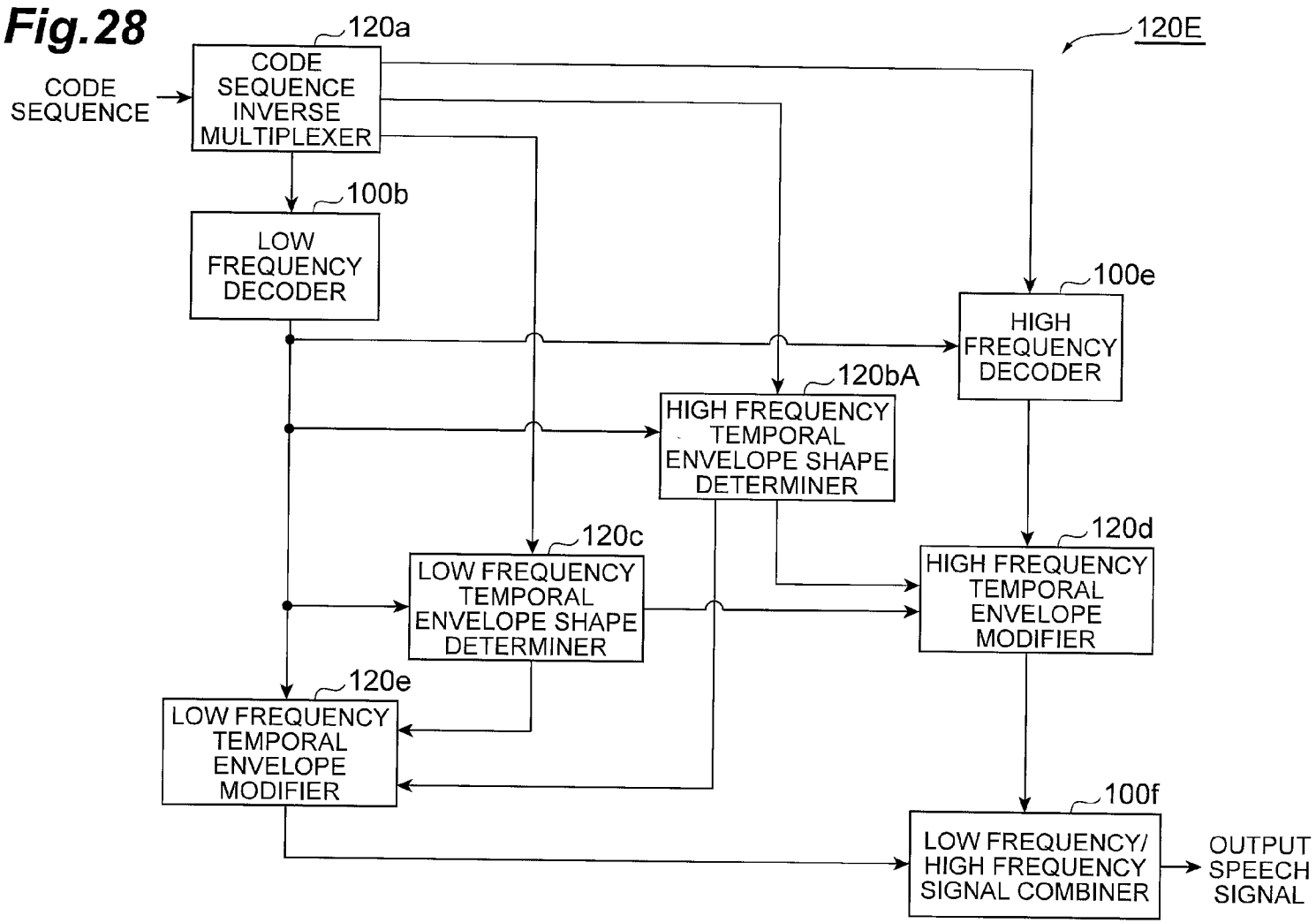
FIG. 28 is a figure showing the configuration of the fifth modification 120E of the speech decoding device according to the fourth embodiment.

FIG. 28 is a diagram showing the configuration of a fifth modification 120E of the speech decoding device according to the fourth embodiment.

Figure 29:
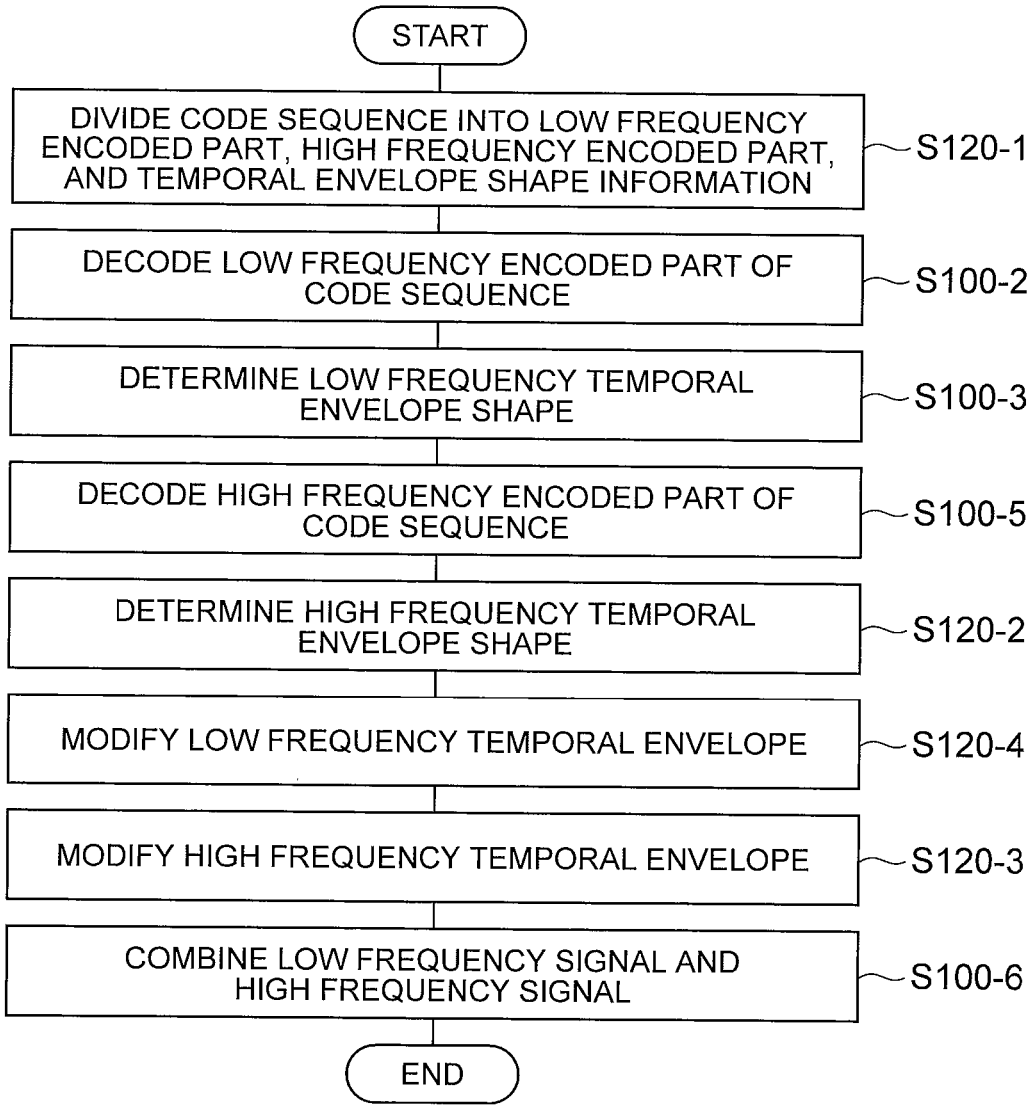
FIG. 29 is a flow chart showing the operation of the fifth modification 120E of the speech decoding device according to the fourth embodiment.

FIG. 29 is a flowchart showing the operation of the fifth modification 120E of the speech decoding device according to the fourth embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Sixth Modification of Speech Decoding Device of Fourth Embodiment

Figure 30:
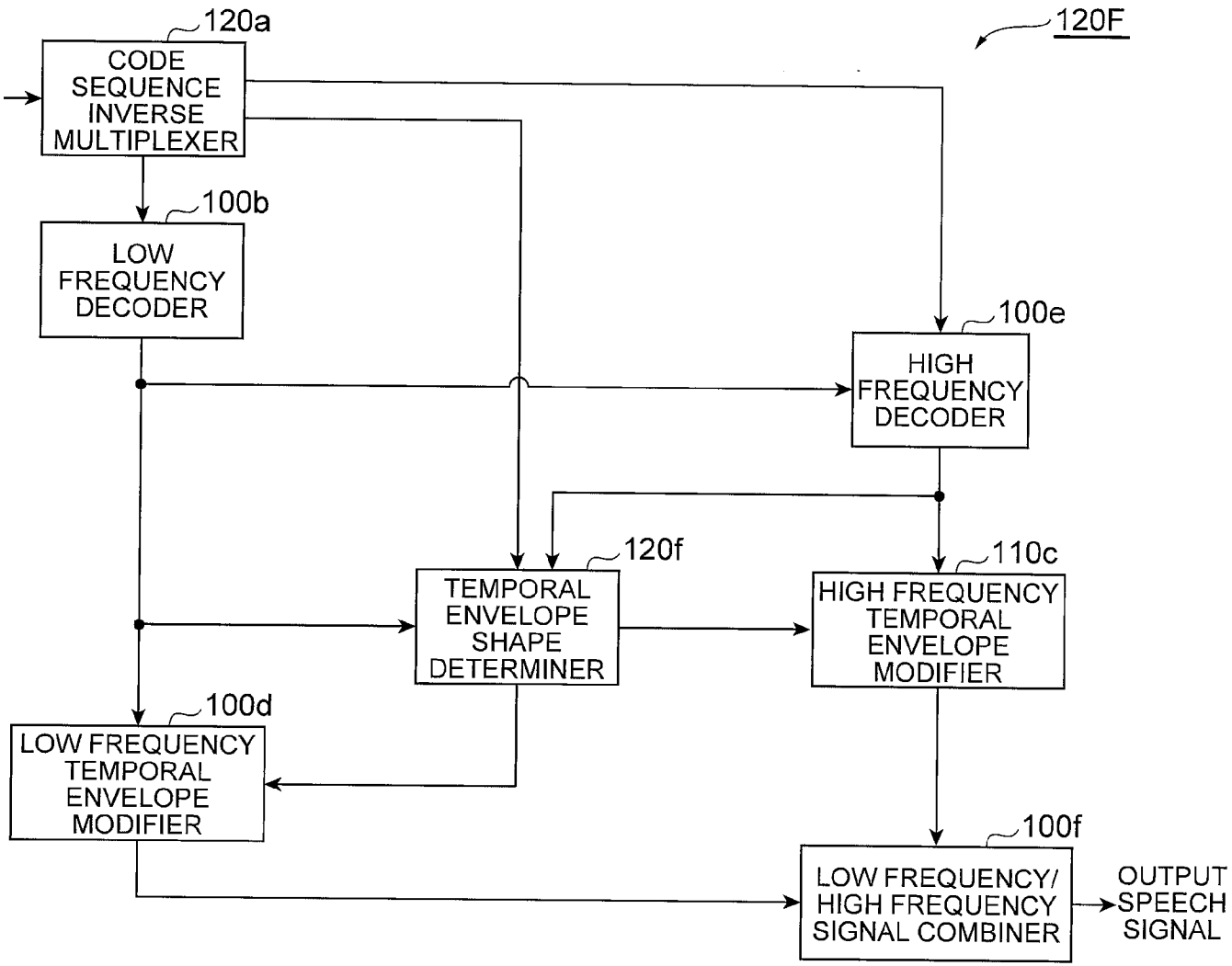
FIG. 30 is a figure showing the configuration of the sixth modification 120F of the speech decoding device according to the fourth embodiment.

FIG. 30 is a diagram showing the configuration of a sixth modification 120F of the speech decoding device according to the fourth embodiment.

Figure 31:
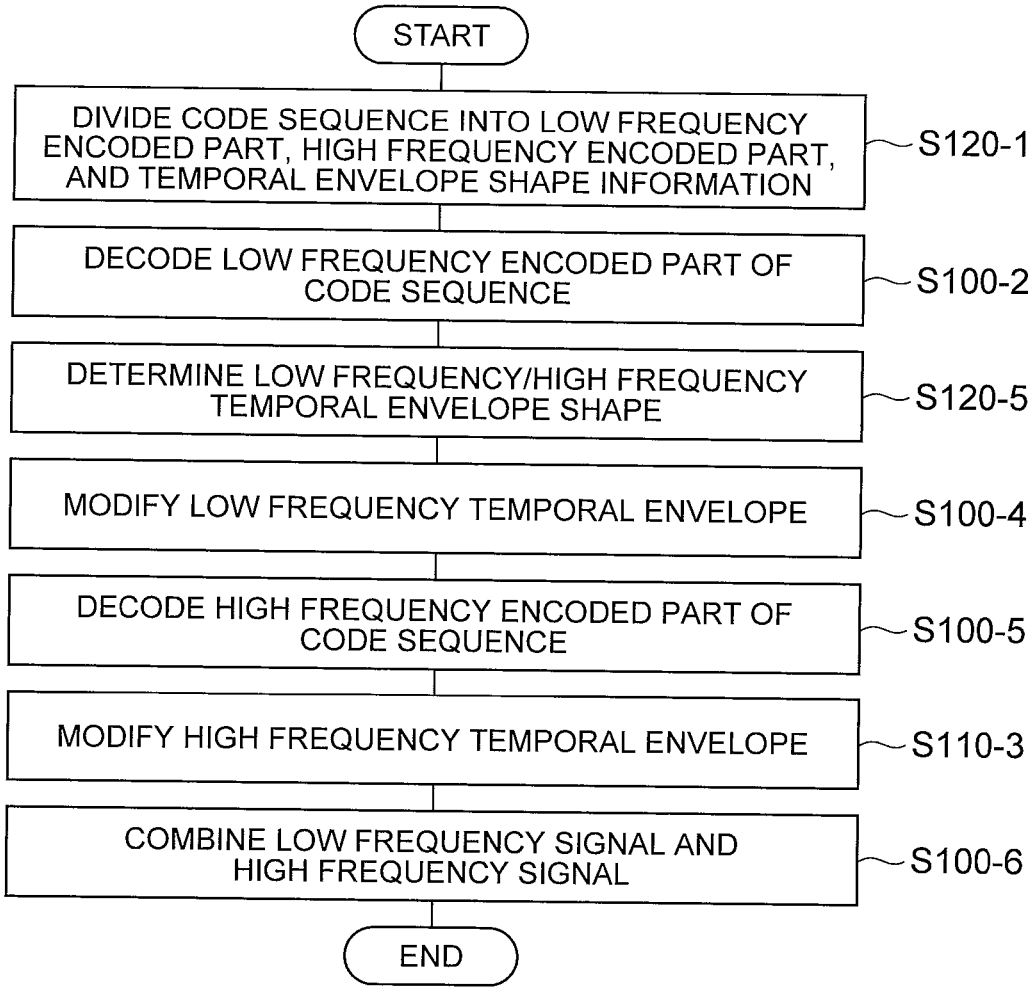
FIG. 31 is a flow chart showing the operation of the sixth modification 120F of the speech decoding device according to the fourth embodiment.

FIG. 31 is a flowchart showing the operation of the sixth modification 120F of the speech decoding device according to the fourth embodiment.

The present modification differs from the speech decoding device 120 according to the fourth embodiment in that it includes a temporal envelope shape determiner 120*f* in place of the low frequency temporal envelope shape determiner 100*c* and the high frequency temporal envelope shape determiner 120*b*.

The temporal envelope shape determiner 120*f* determines the temporal envelope shape, based on at least one of information about the low frequency temporal envelope shape from the code sequence demultiplexer 120*a*, information about the high frequency temporal envelope shape, the low frequency signal from the low frequency decoder 100*b*, and the high frequency signal from the high frequency decoder 100*e* (S120-5). The low frequency temporal envelope modifier 100*d* and the high frequency temporal envelope modifier 110*c* are notified of the determined temporal envelope shape.

For example, it may be determined that the temporal envelope shape is flat. For example, it may be determined that the temporal envelope shape is onset. For example, it may be determined that the temporal envelope shape is offset. The determined temporal envelope shape is not limited to the above examples.

The temporal envelope shape determiner 120*f* can determine the temporal envelope shape, for example, as performed by the low frequency temporal envelope shape determiners 100*c* and 120*c*, and the high frequency temporal envelope shape determiners 120*b* and 120*b*A. The method of determining the temporal envelope shape is not limited to the above examples.

Seventh Modification of Speech Decoding Device of Fourth Embodiment

Figure 32:
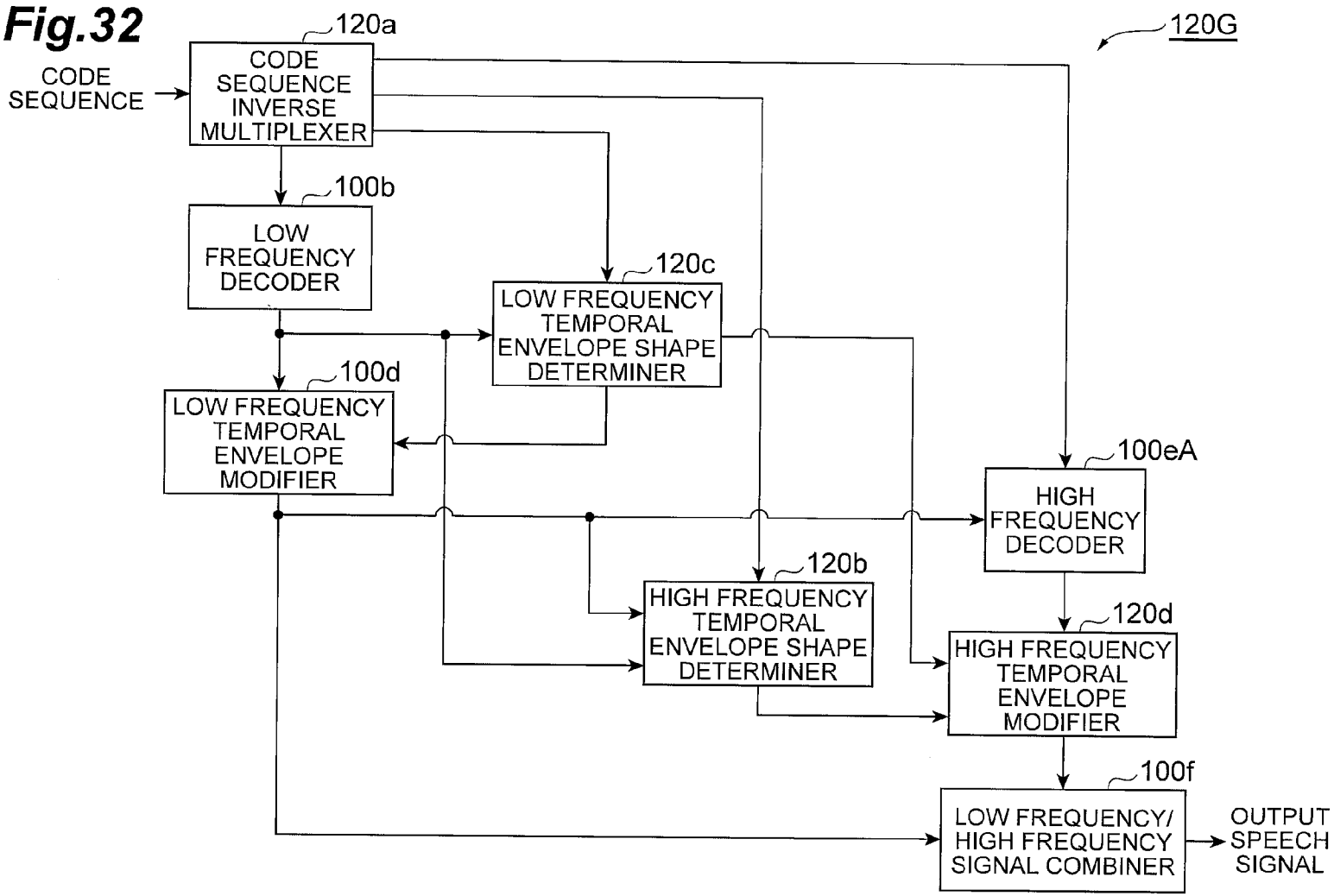
FIG. 32 is a figure showing the configuration of the seventh modification 120G of the speech decoding device according to the fourth embodiment.

FIG. 32 is a diagram showing the configuration of a seventh modification 120G of the speech decoding device according to the fourth embodiment.

Figure 33:
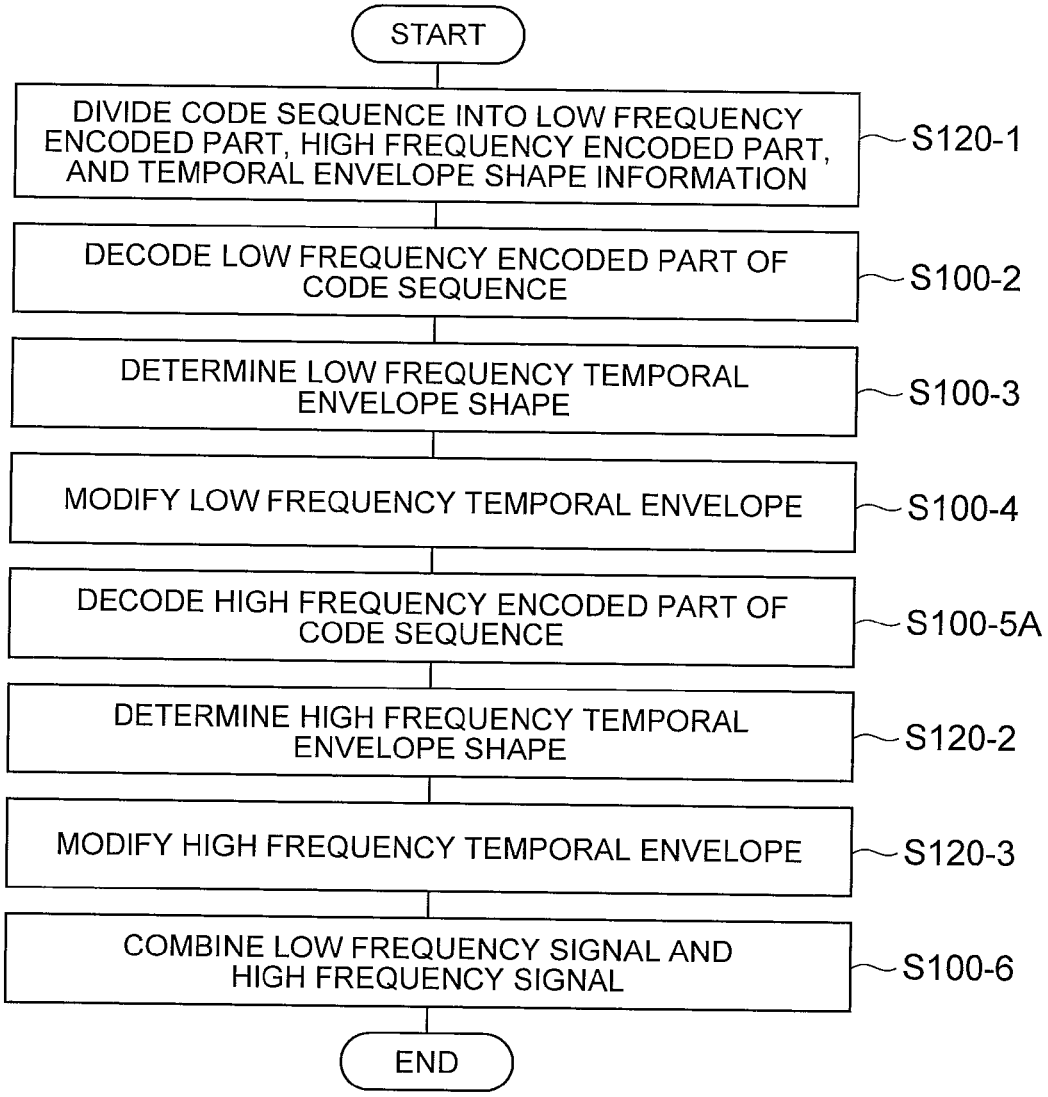
FIG. 33 is a flow chart showing the operation of the seventh modification 120G of the speech decoding device according to the fourth embodiment.

FIG. 33 is a flowchart showing the operation of the seventh modification 120G of the speech decoding device according to the fourth embodiment.

The present modification differs from the first modification 120A of the speech decoding device according to the fourth embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

Eighth Modification of Speech Decoding Device of Fourth Embodiment

Figure 34:
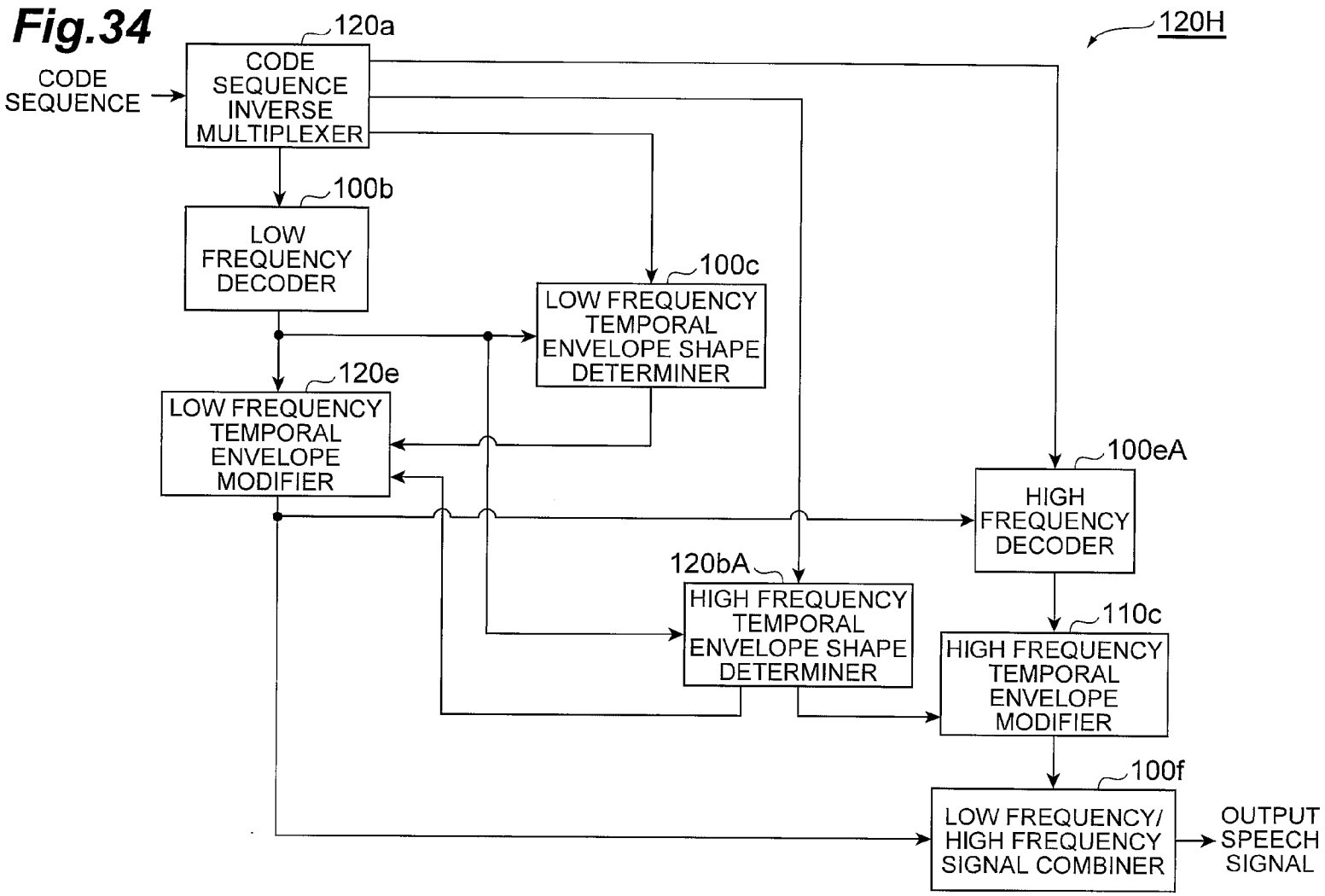
FIG. 34 is a figure showing the configuration of the eighth modification 120H of the speech decoding device according to the fourth embodiment.

FIG. 34 is a diagram showing the configuration of an eighth modification 120H of the speech decoding device according to the fourth embodiment.

Figure 35:
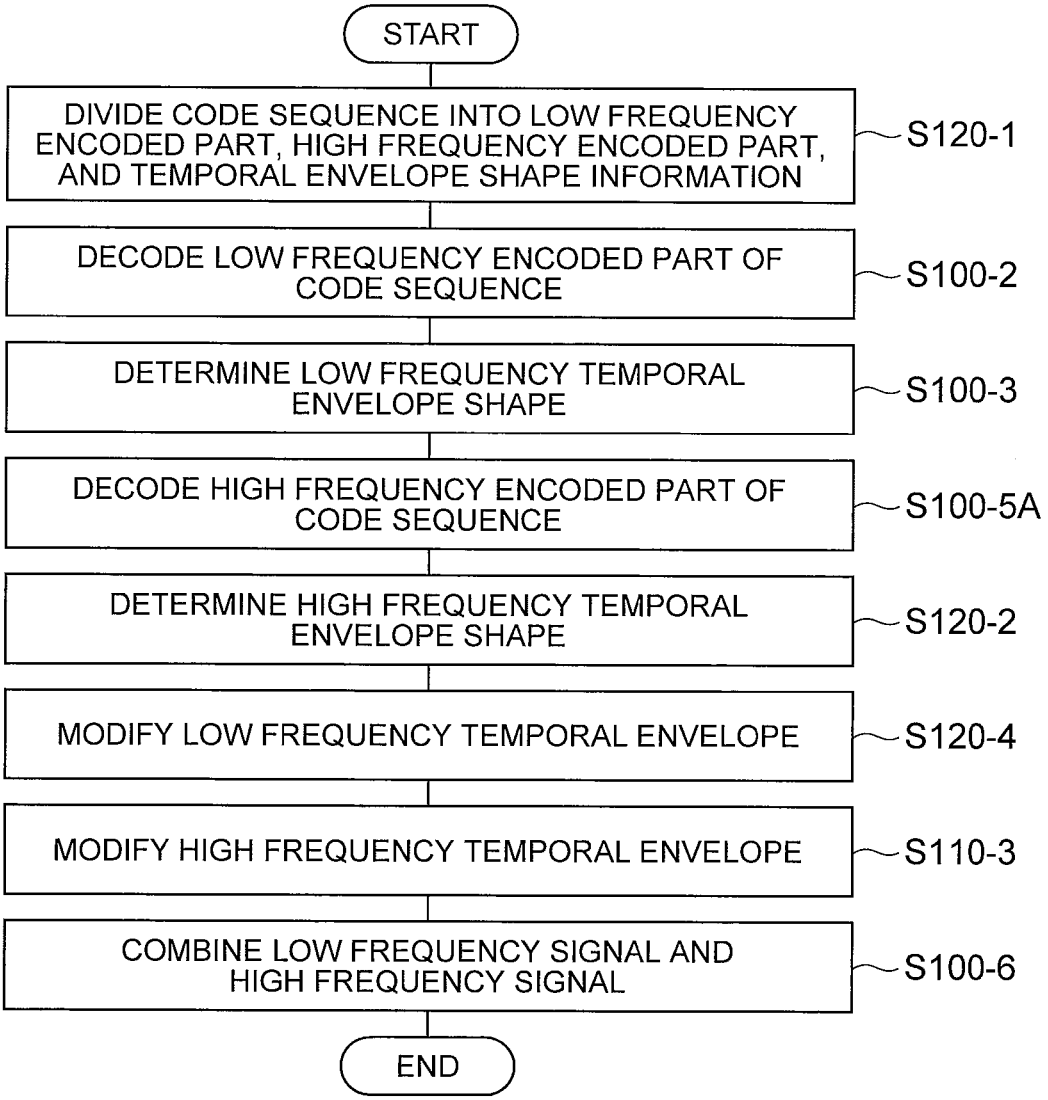
FIG. 35 is a flow chart showing the operation of the eighth modification 120H of the speech decoding device according to the fourth embodiment.

FIG. 35 is a flowchart showing the operation of the eighth modification 120H of the speech decoding device according to the fourth embodiment.

The present modification differs from the first modification 120A of the speech decoding device according to the fourth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Ninth Modification of Speech Decoding Device of Fourth Embodiment

Figure 36:
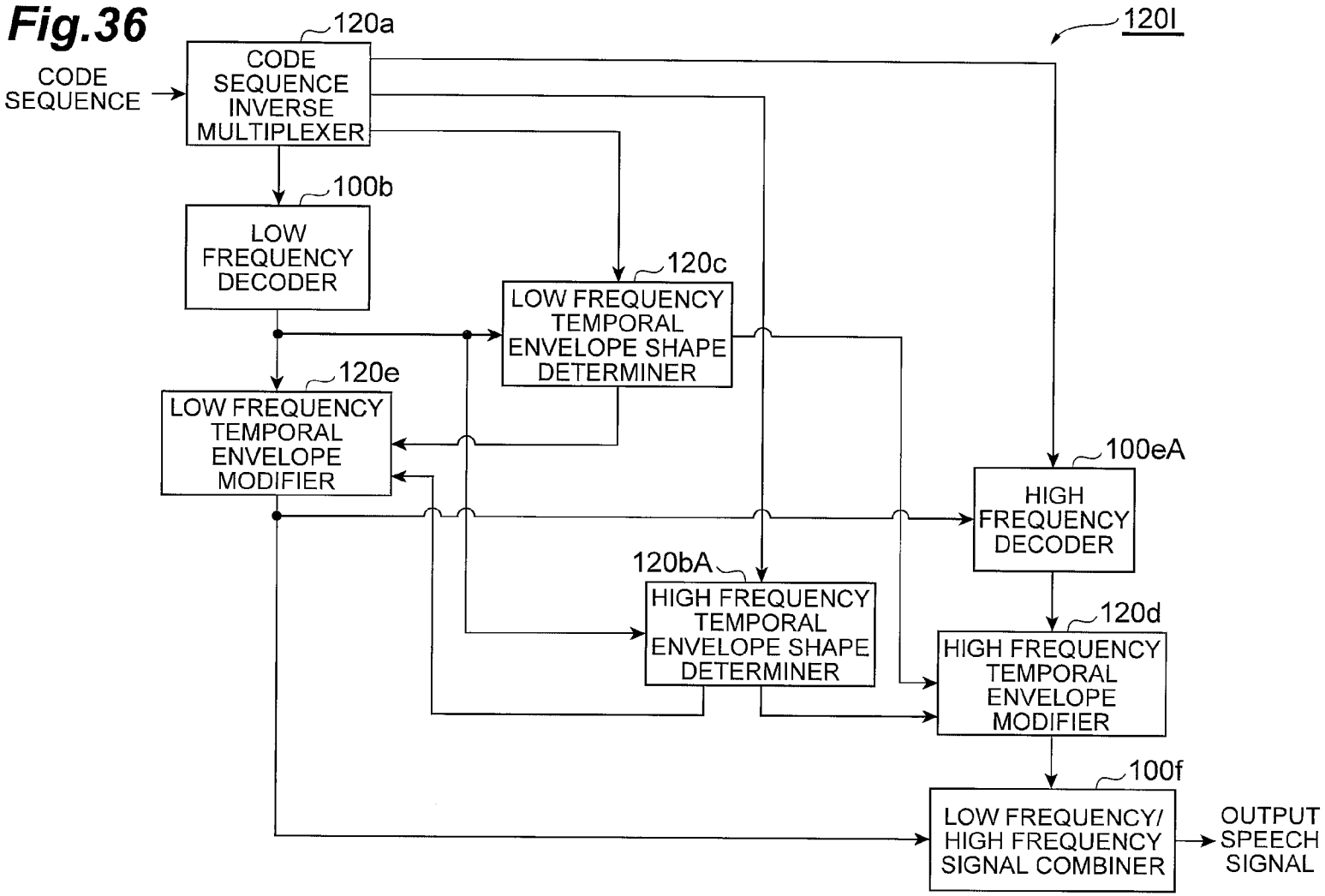
FIG. 36 is a figure showing the configuration of the ninth modification 120I of the speech decoding device according to the fourth embodiment.

FIG. 36 is a diagram showing the configuration of a ninth modification 120I of the speech decoding device according to the fourth embodiment.

Figure 37:
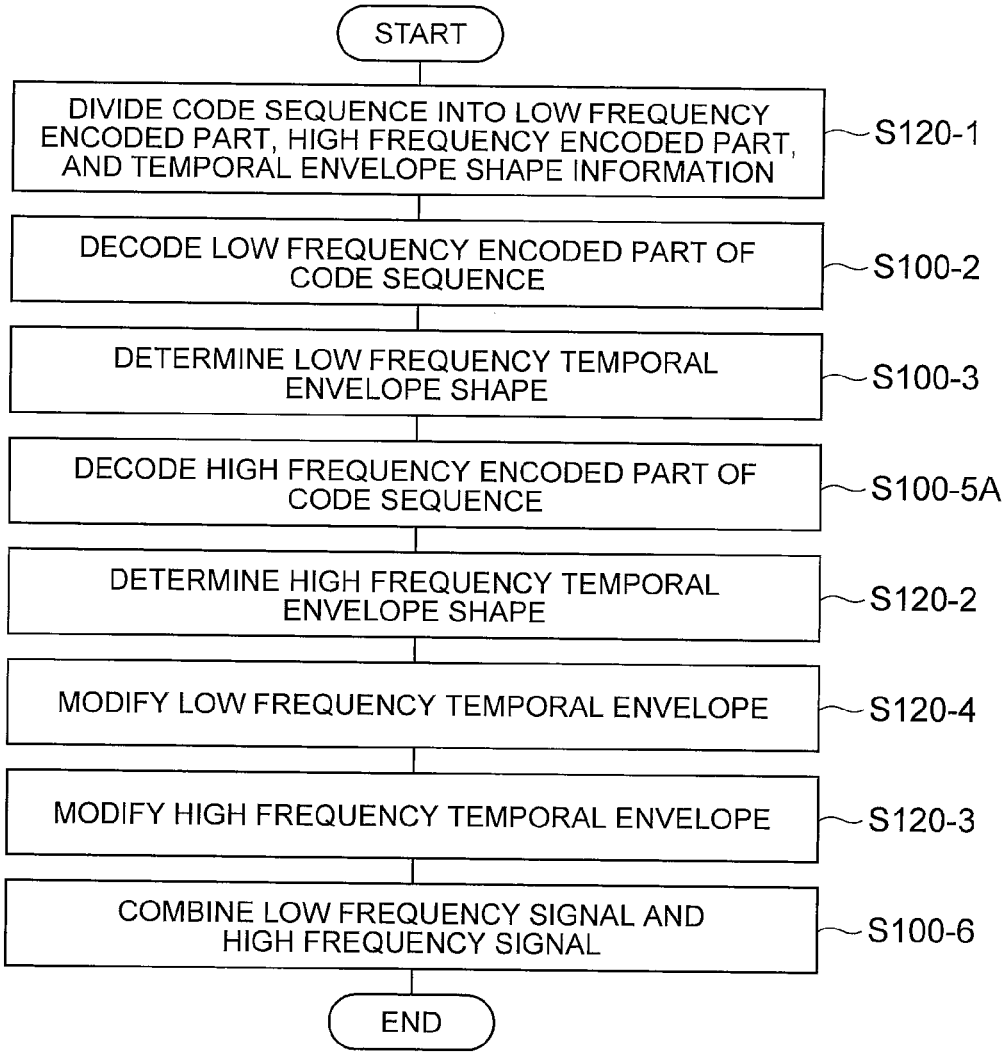
FIG. 37 is a flow chart showing the operation of the ninth modification 120I of the speech decoding device according to the fourth embodiment.

FIG. 37 is a flowchart showing the operation of the ninth modification 120I of the speech decoding device according to the fourth embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Tenth Modification of Speech Decoding Device of Fourth Embodiment

Figure 38:
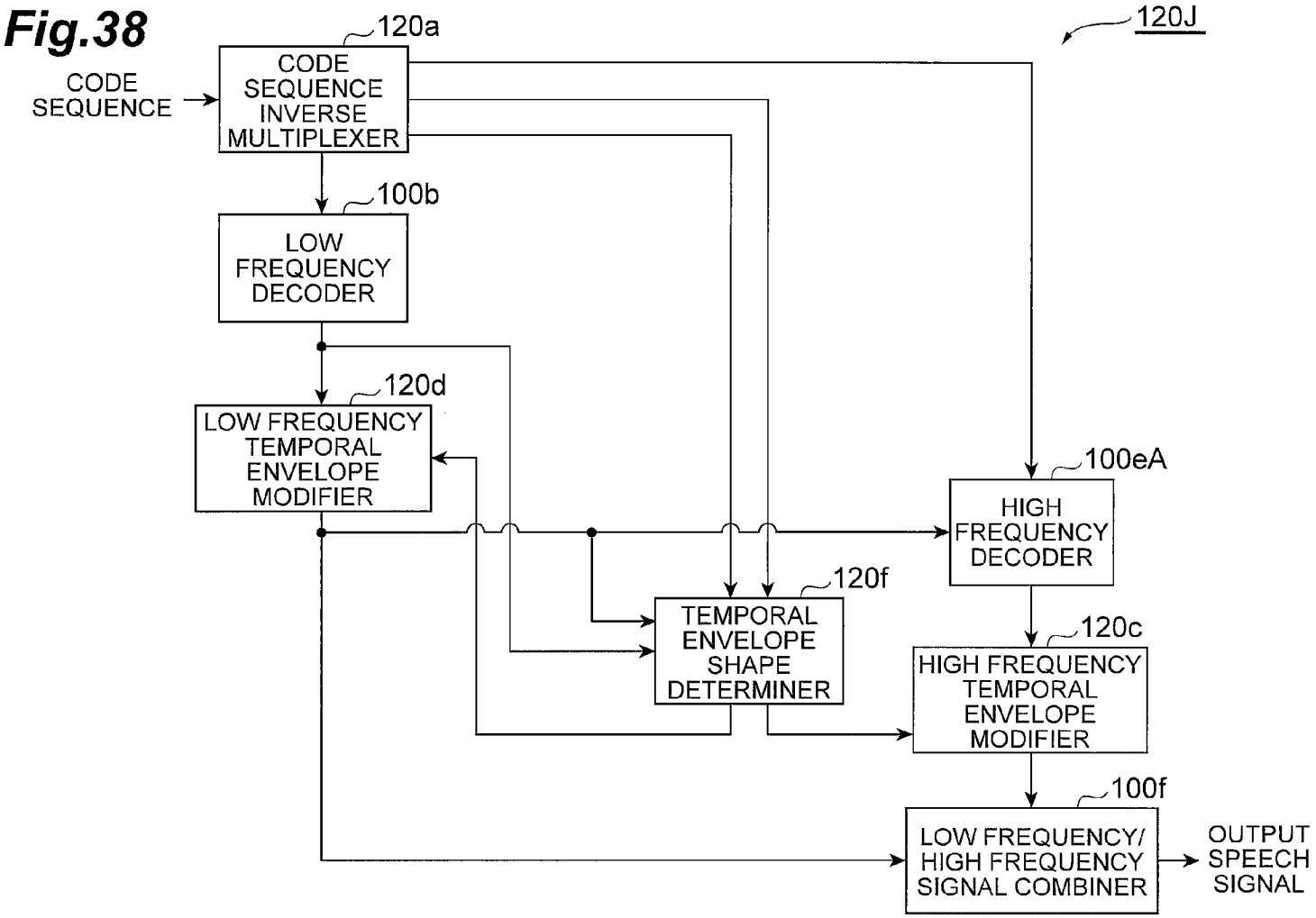
FIG. 38 is a figure showing the configuration of the tenth modification 120J of the speech decoding device according to the fourth embodiment.

FIG. 38 is a diagram showing the configuration of a tenth modification 120J of the speech decoding device according to the fourth embodiment.

Figure 39:
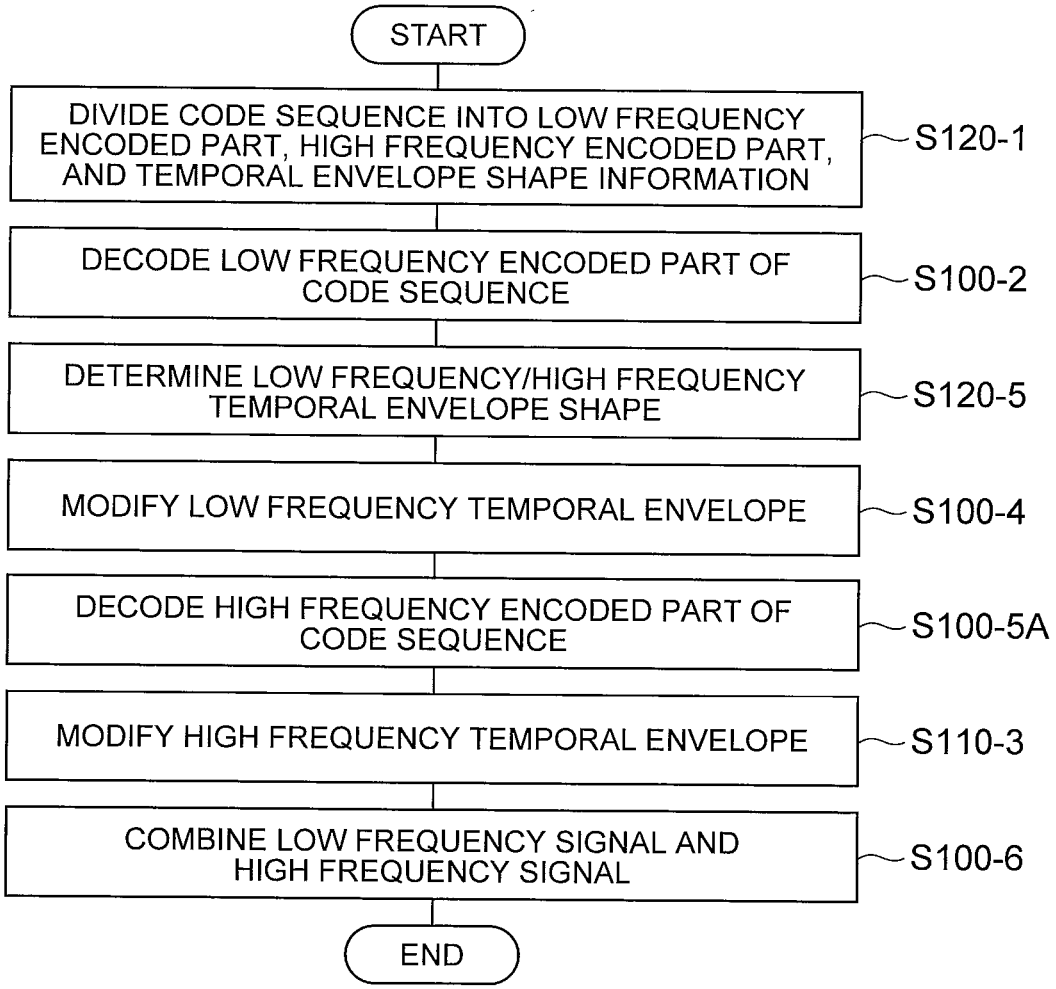
FIG. 39 is a flow chart showing the operation of the tenth modification 120J of the speech decoding device according to the fourth embodiment.

FIG. 39 is a flowchart showing the operation of the tenth modification 120J of the speech decoding device according to the fourth embodiment.

The present modification differs from the first modification 120A of the speech decoding device according to the fourth embodiment in that it includes a temporal envelope shape determiner 120*f* in place of the low frequency temporal envelope shape determiner 100*c* and the high frequency temporal envelope shape determiner 120*b*.

Eleventh Modification of Speech Decoding Device of Fourth Embodiment

Figure 40:
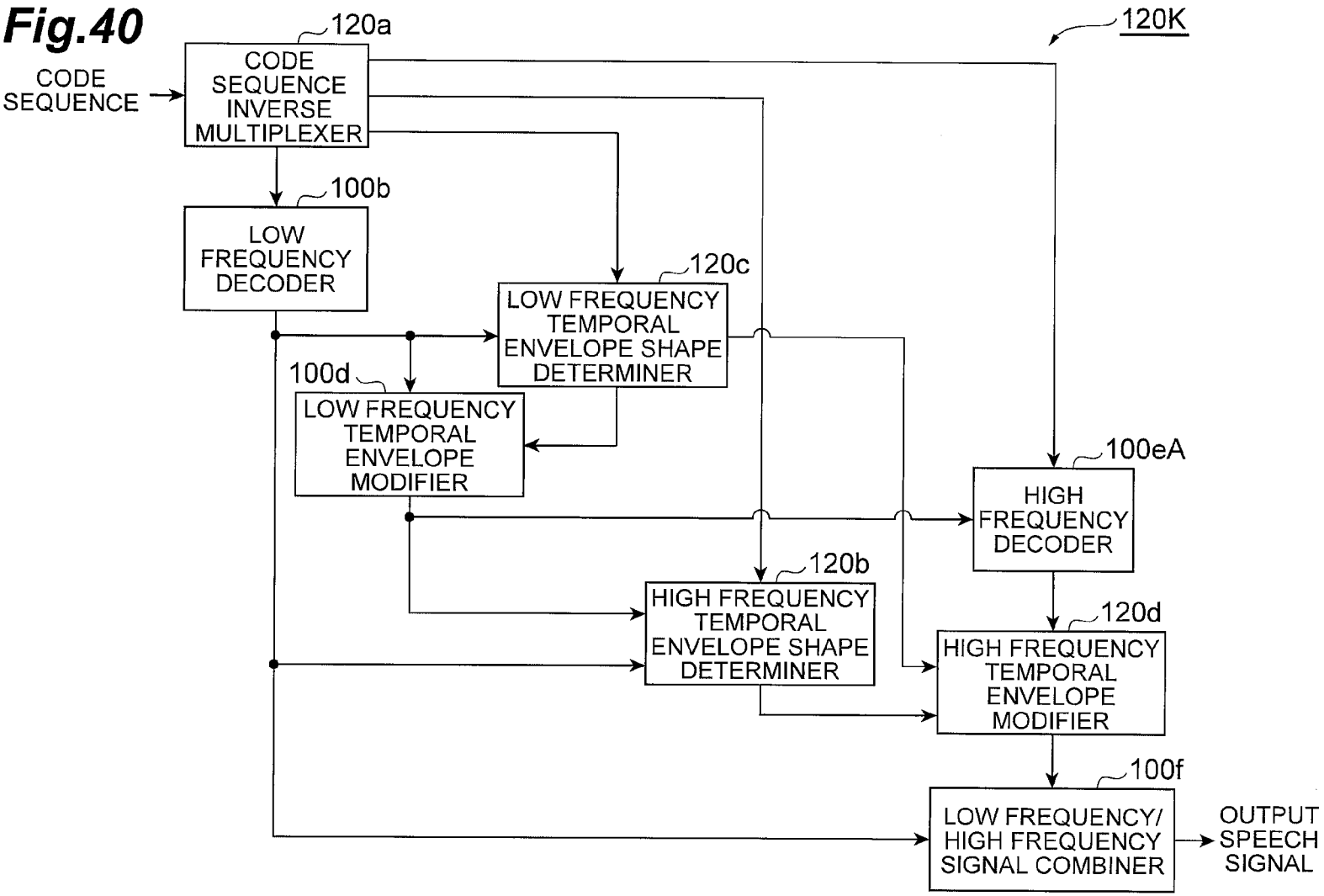
FIG. 40 is a figure showing the configuration of the 11th modification 120K of the speech decoding device according to the fourth embodiment.

FIG. 40 is a diagram showing the configuration of an eleventh modification 120K of the speech decoding device according to the fourth embodiment.

Figure 41:
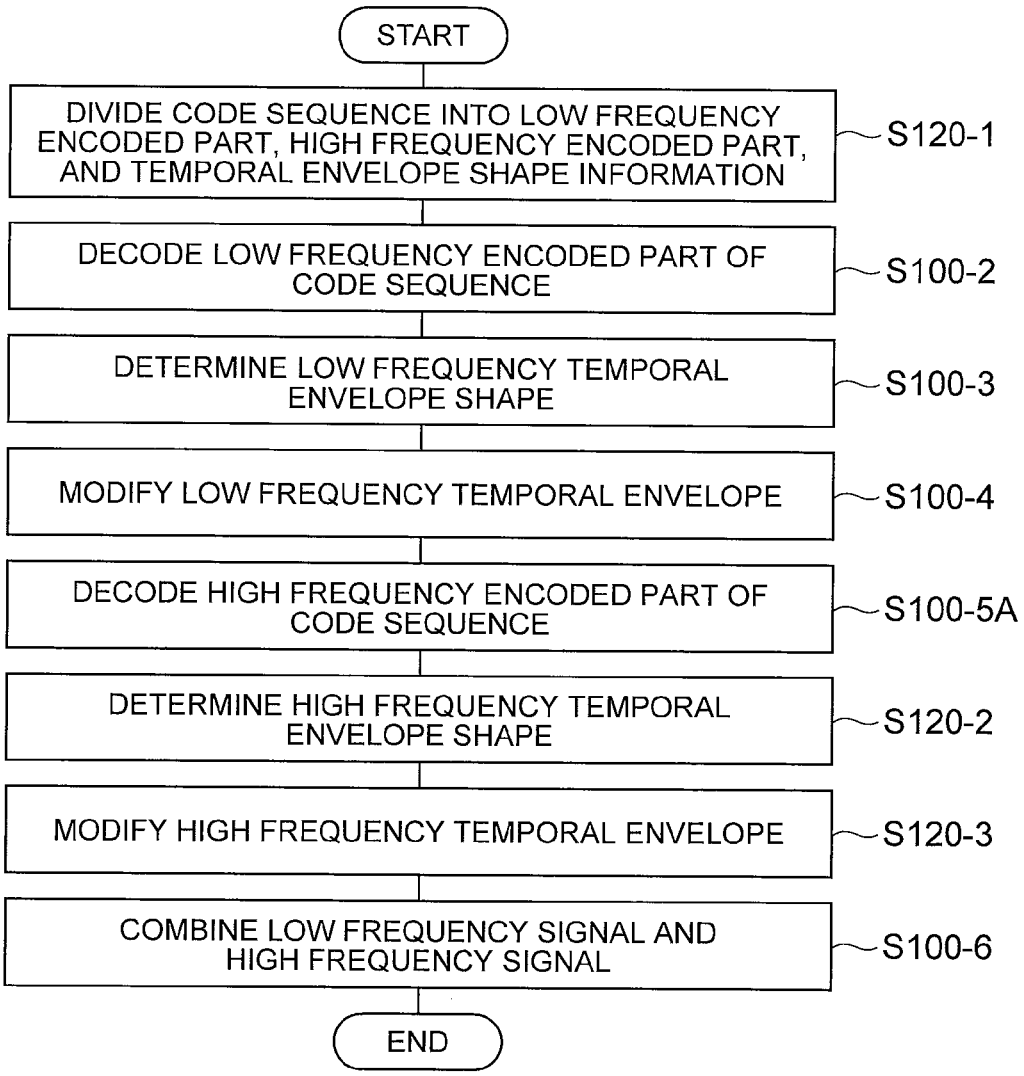
FIG. 41 is a flow chart showing the operation of the 11th modification 120K of the speech decoding device according to the fourth embodiment.

FIG. 41 is a flowchart showing the operation of the eleventh modification 120K of the speech decoding device according to the fourth embodiment.

The present modification differs from the second modification 120B of the speech decoding device according to the fourth embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

Twelfth Modification of Speech Decoding Device of Fourth Embodiment

Figure 42:
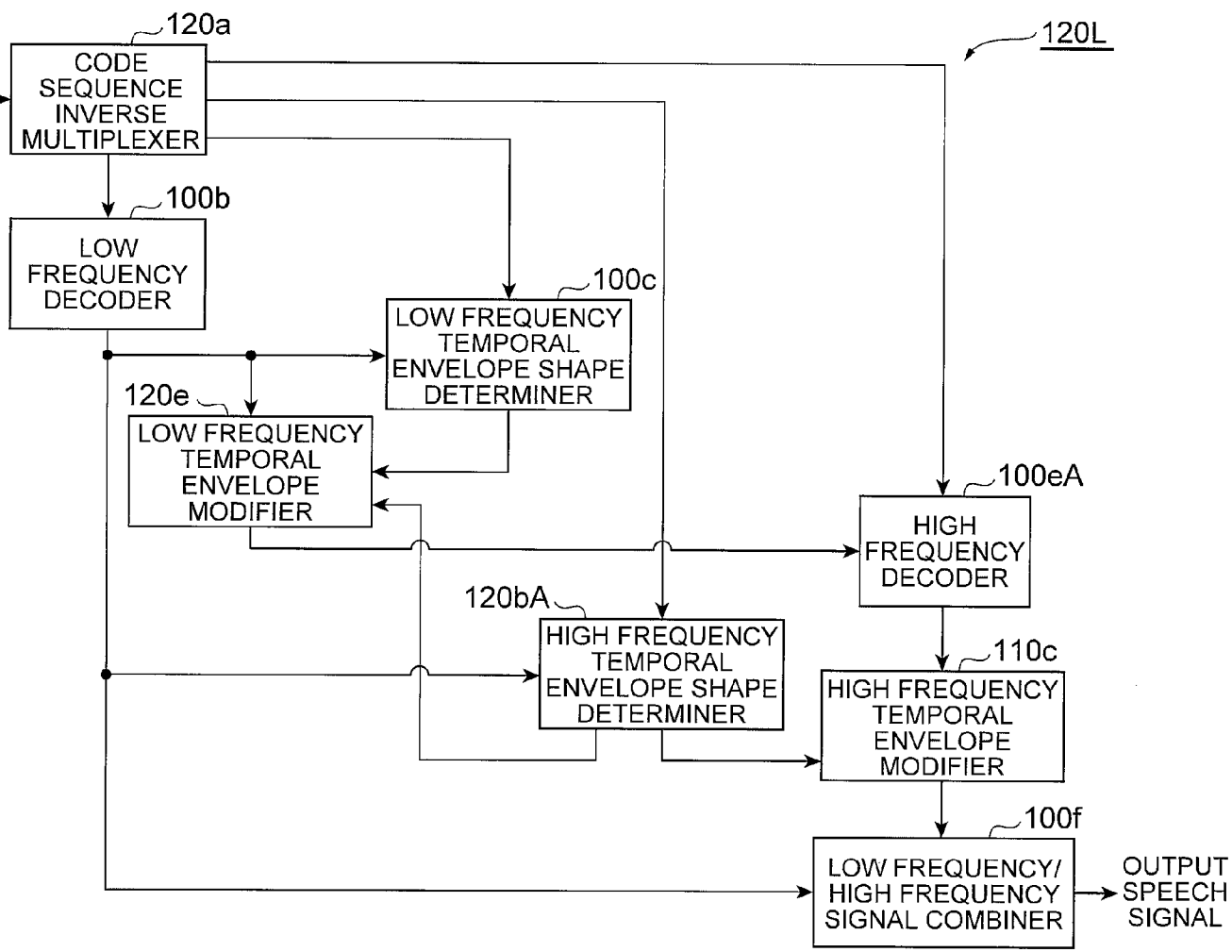
FIG. 42 is a figure showing the configuration of the 12th modification 120L of the speech decoding device according to the fourth embodiment.

FIG. 42 is a diagram showing the configuration of a twelfth modification 120L of the speech decoding device according to the fourth embodiment.

Figure 43:
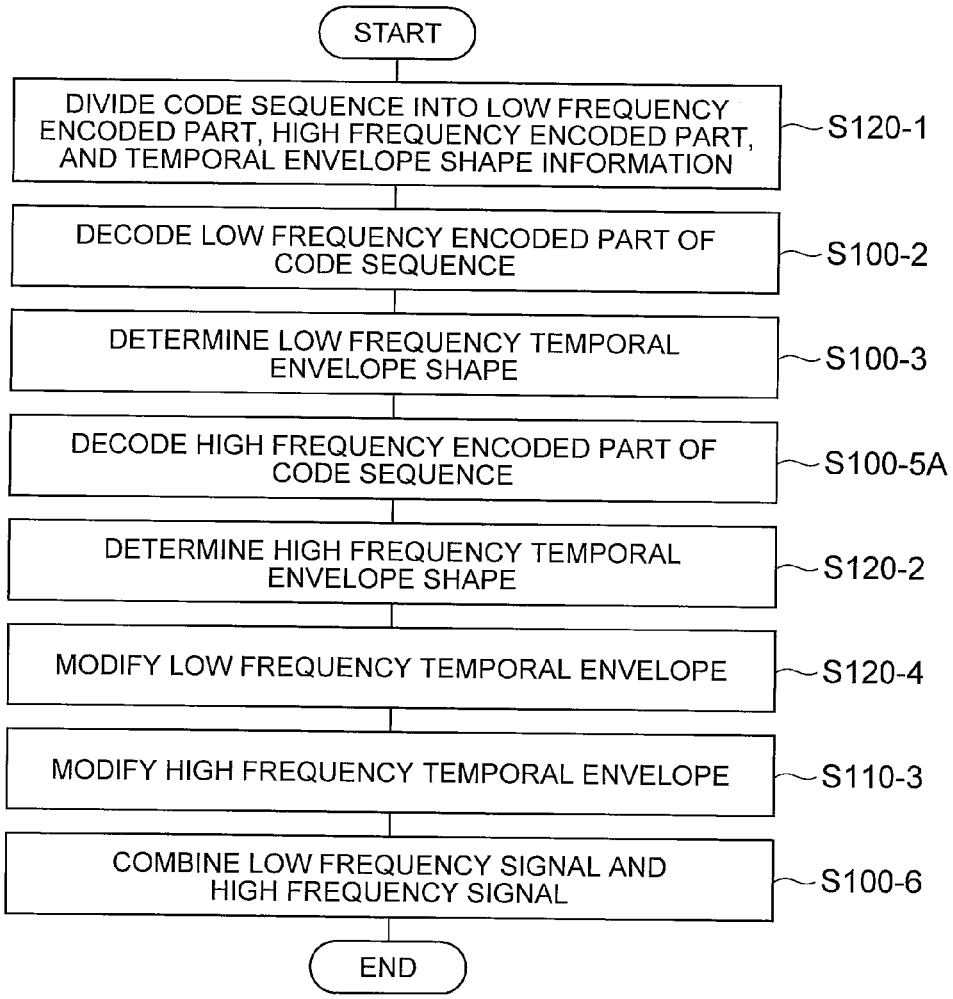
FIG. 43 is a flow chart showing the operation of the 12th modification 120L of the speech decoding device according to the fourth embodiment.

FIG. 43 is a flowchart showing the operation of the twelfth modification 120L of the speech decoding device according to the fourth embodiment.

The present modification differs from the second modification 120B of the speech decoding device according to the fourth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Thirteenth Modification of Speech Decoding Device of Fourth Embodiment

Figure 44:
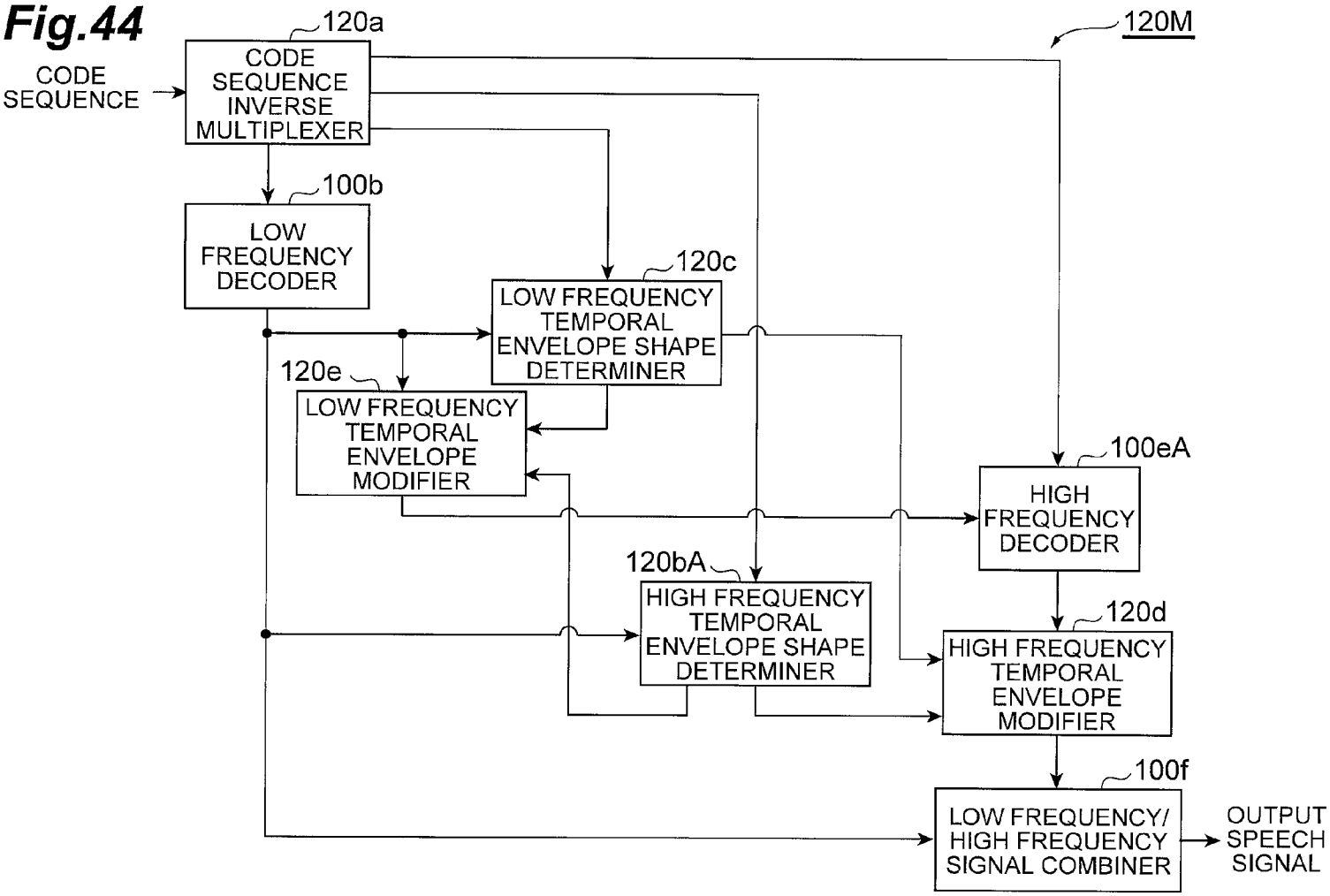
FIG. 44 is a figure showing the configuration of the 13th modification 120M of the speech decoding device according to the fourth embodiment.

FIG. 44 is a diagram showing the configuration of a thirteenth modification 120M of the speech decoding device according to the fourth embodiment.

Figure 45:
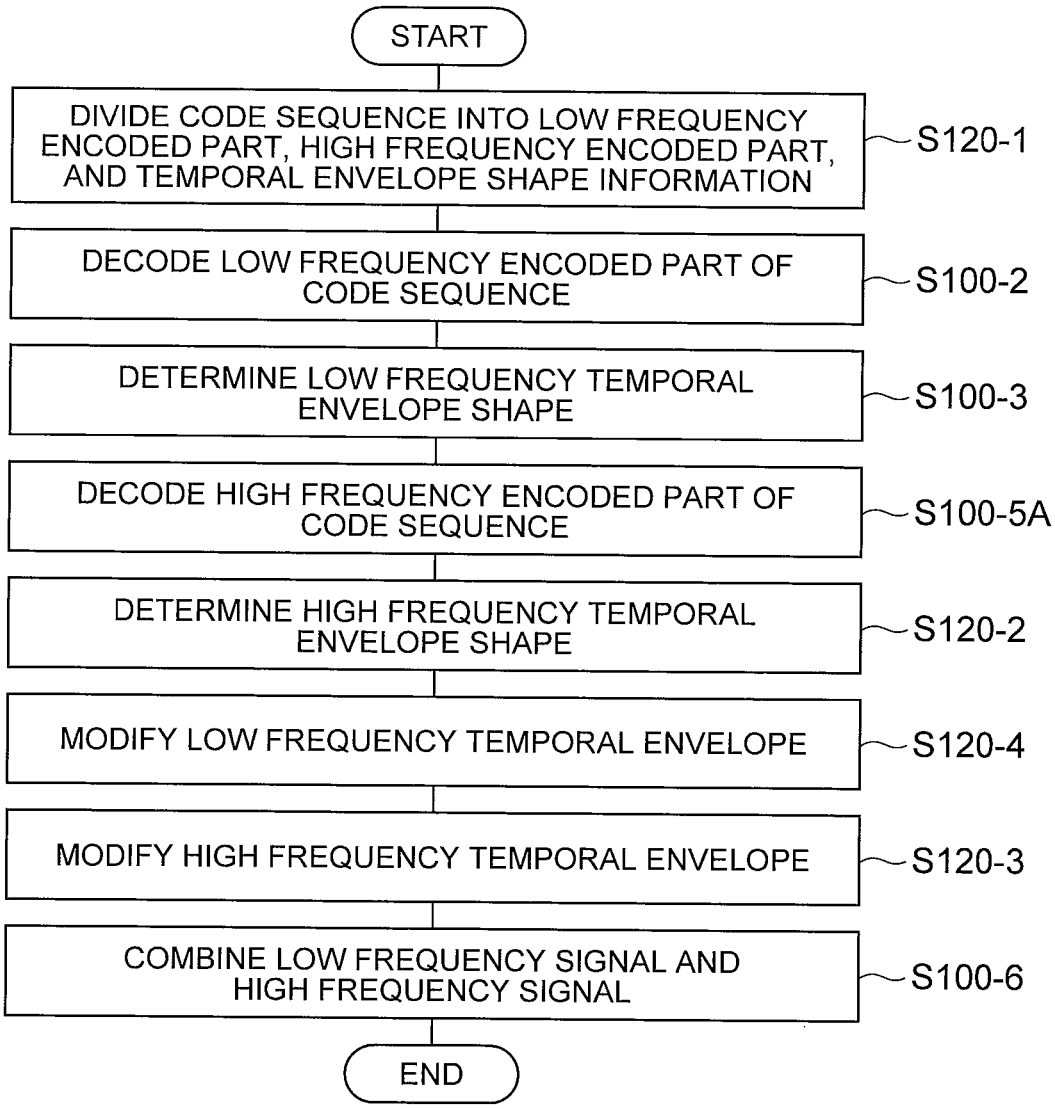
FIG. 45 is a flow chart showing the operation of the 13th modification 120M of the speech decoding device according to the fourth embodiment.

FIG. 45 is a flowchart showing the operation of the thirteenth modification 120M of the speech decoding device according to the fourth embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Fourteenth Modification of Speech Decoding Device of Fourth Embodiment

Figure 46:
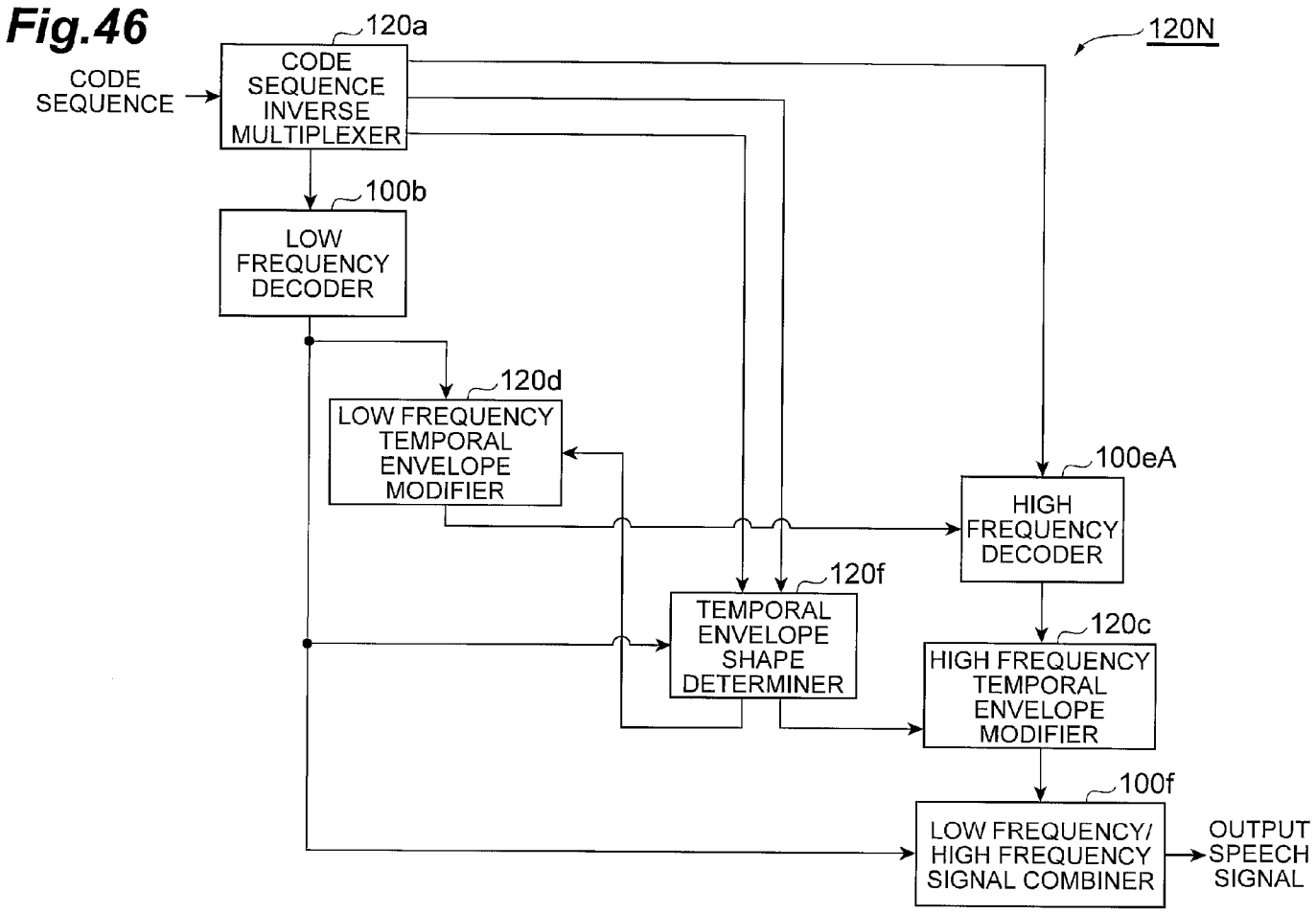
FIG. 46 is a figure showing the configuration of the 14th modification 120N of the speech decoding device according to the fourth embodiment.

FIG. 46 is a diagram showing the configuration of a fourteenth modification 120N of the speech decoding device according to the fourth embodiment.

Figure 47:
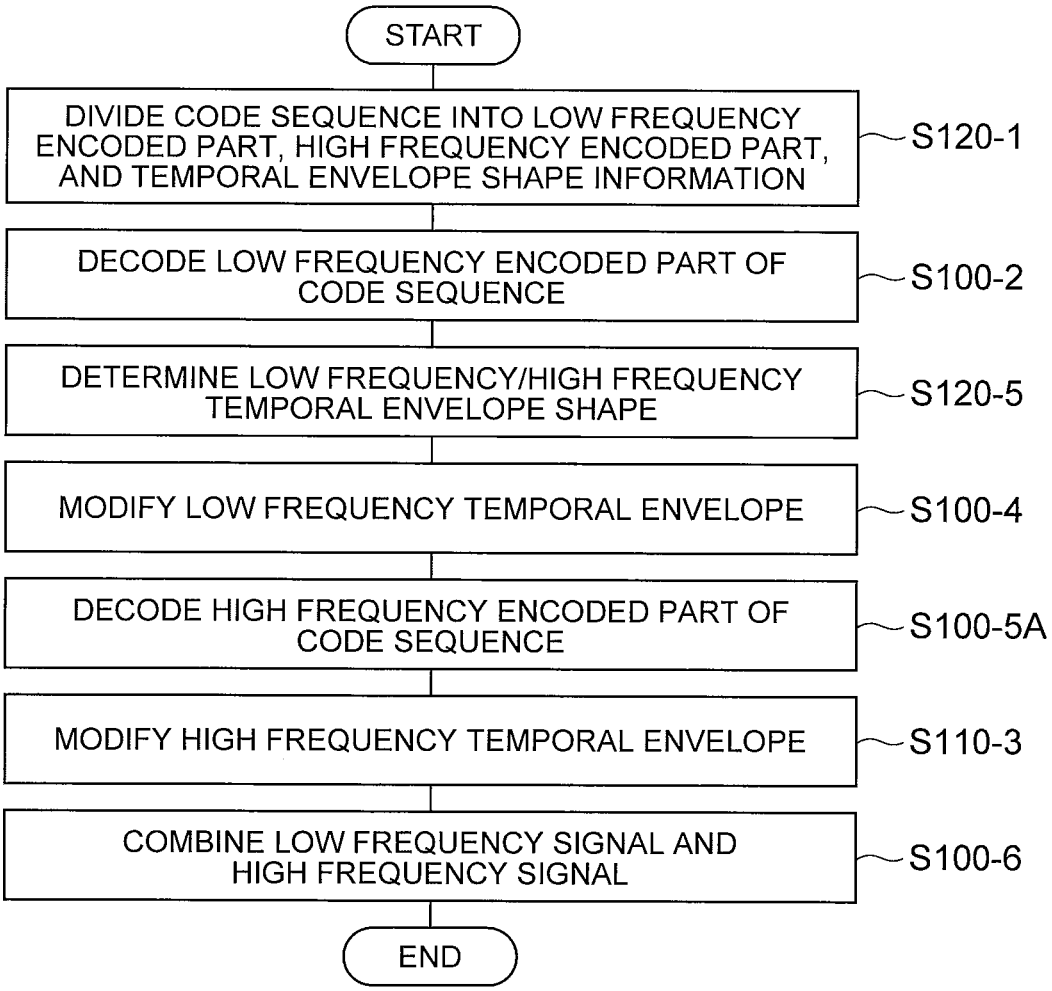
FIG. 47 is a flow chart showing the operation of the 14th modification 120N of the speech decoding device according to the fourth embodiment.

FIG. 47 is a flowchart showing the operation of the fourteenth modification 120N of the speech decoding device according to the fourth embodiment.

The present modification differs from the second modification 120B of the speech decoding device according to the fourth embodiment in that it includes a temporal envelope shape determiner 120*f* in place of the low frequency temporal envelope shape determiner 100*c* and the high frequency temporal envelope shape determiner 120*b*.

Fifth Embodiment

Figure 48:
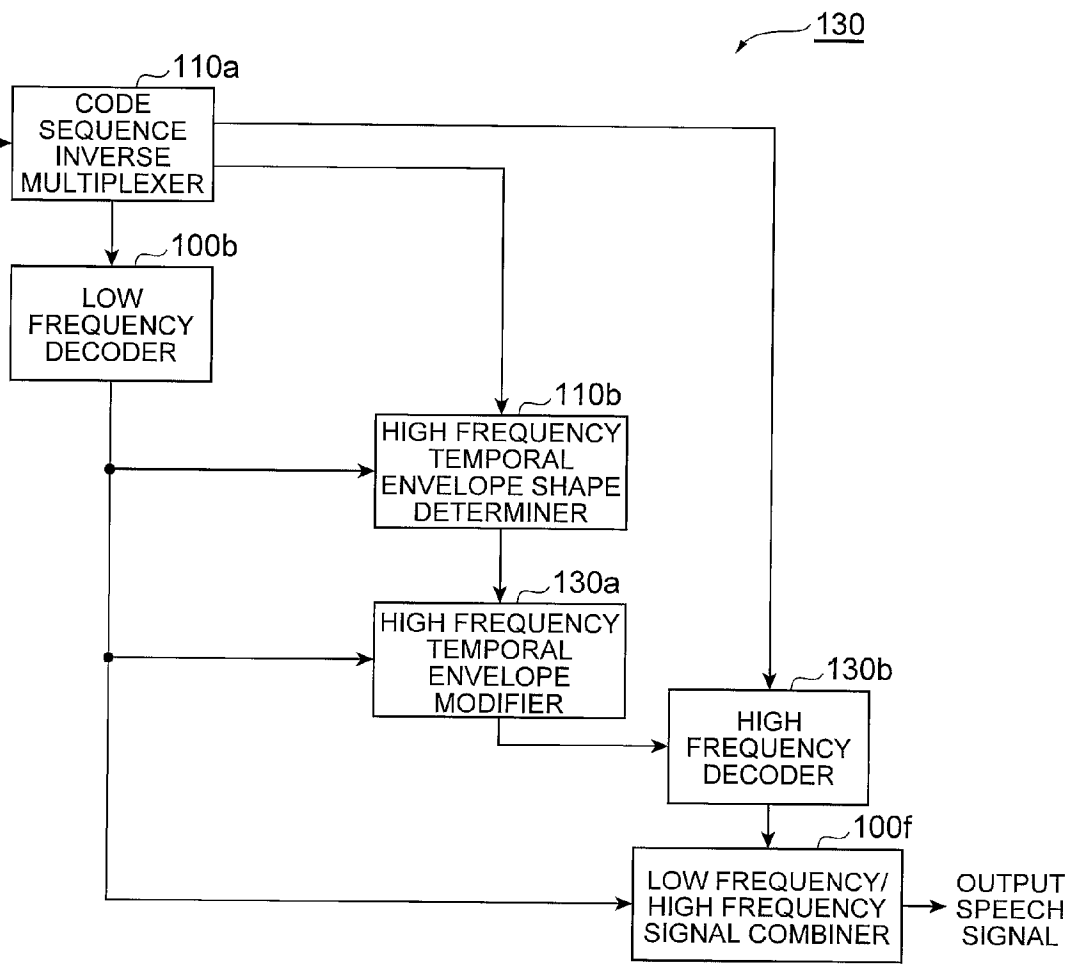
FIG. 48 is a figure showing the configuration of the speech decoding device 130 according to a fifth embodiment.

FIG. 48 is a diagram showing the configuration of a speech decoding device 130 according to a fifth embodiment. A communication device of the speech decoding device 130 receives a multiplexed code sequence output from a speech encoding device 230 described below and outputs a decoded speech signal to the outside. As shown in FIG. 48, the speech decoding device 130 functionally includes a code sequence demultiplexer 110*a*, a low frequency decoder 100*b*, a high frequency temporal envelope shape determiner 110*b*, a high frequency temporal envelope modifier 130*a*, a high frequency decoder 130*b*, and a low frequency/high frequency signal combiner 100*f*.

Figure 49:
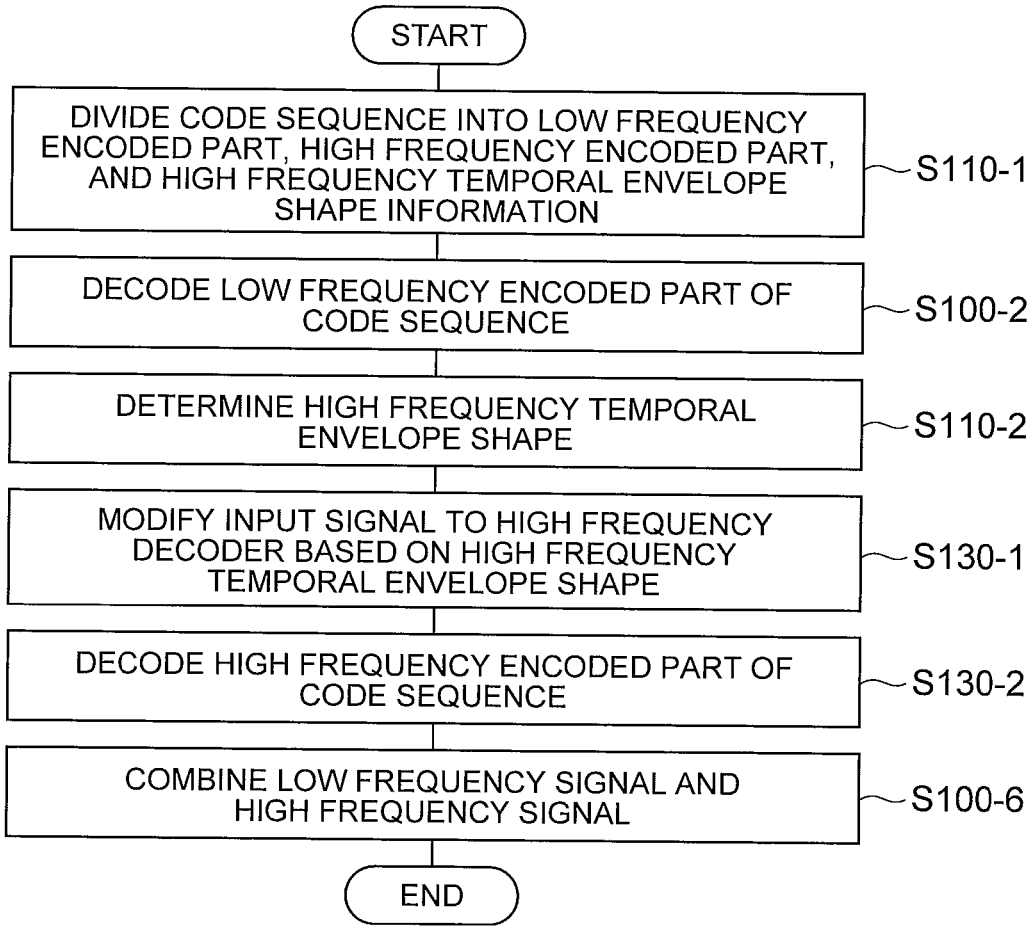
FIG. 49 is a flow chart showing the operation of the speech decoding device according to the fifth embodiment.

FIG. 49 is a flowchart showing the operation of the speech decoding device according to the fourth embodiment.

The high frequency temporal envelope modifier 130*a* modifies the shape of the temporal envelope of the low frequency signal input to the high frequency decoder 130*b*, based on the temporal envelope shape determined by the high frequency temporal envelope shape determiner 110*b* (step S130-1). The modification of the temporal envelope shape in the high frequency temporal envelope modifier 130*a* is performed, for example, in the process of modifying the temporal envelope shape of the decoded signal in the temporal envelope modifier 1*d* in which the decoded signal obtained by the speech decoder 1*b* is replaced with the low frequency signal obtained by the low frequency decoder 100*b*.

The high frequency decoder 130*b* decodes the high frequency encoded part divided by the code sequence demultiplexer 100*a* to obtain a high frequency signal (step S130-2).

The high frequency decoder 130*b* differs from the high frequency decoder 100*e* in that the low frequency signal having the temporal envelope shape modified by the high frequency temporal envelope modifier 130*a* is used when the low frequency decoded signal obtained by the low frequency decoder is used in decoding the high frequency signal.

Figure 50:
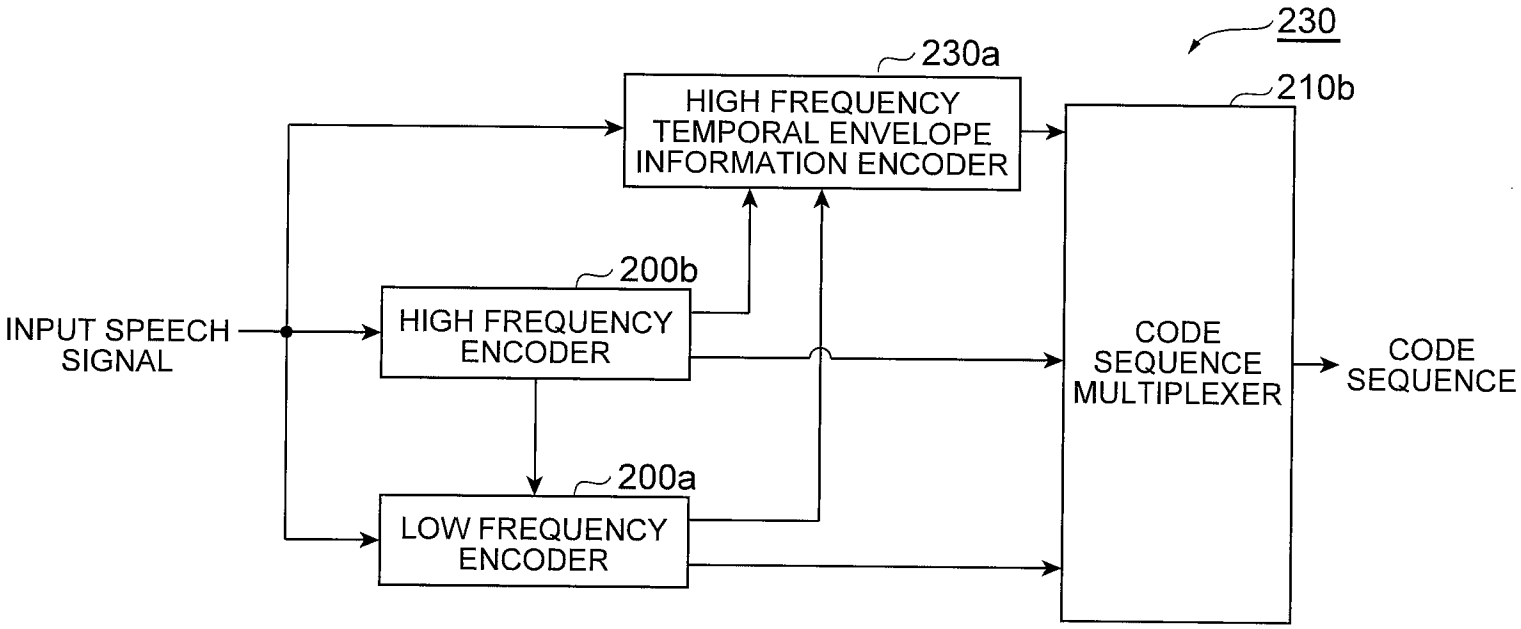
FIG. 50 is a figure showing the configuration of the speech to digital converter 230 according to the fifth embodiment.

FIG. 50 is a diagram showing the configuration of the speech encoding device 230 according to the fifth embodiment. A communication device of the speech encoding device 230 receives a speech signal to be encoded from the outside and outputs the encoded code sequence to the outside. As shown in FIG. 50, the speech encoding device 230 functionally includes a low frequency encoder 200*a*, a high frequency encoder 200*b*, a high frequency temporal envelope information encoder 230*a*, and a code sequence multiplexer 210*b*.

Figure 51:
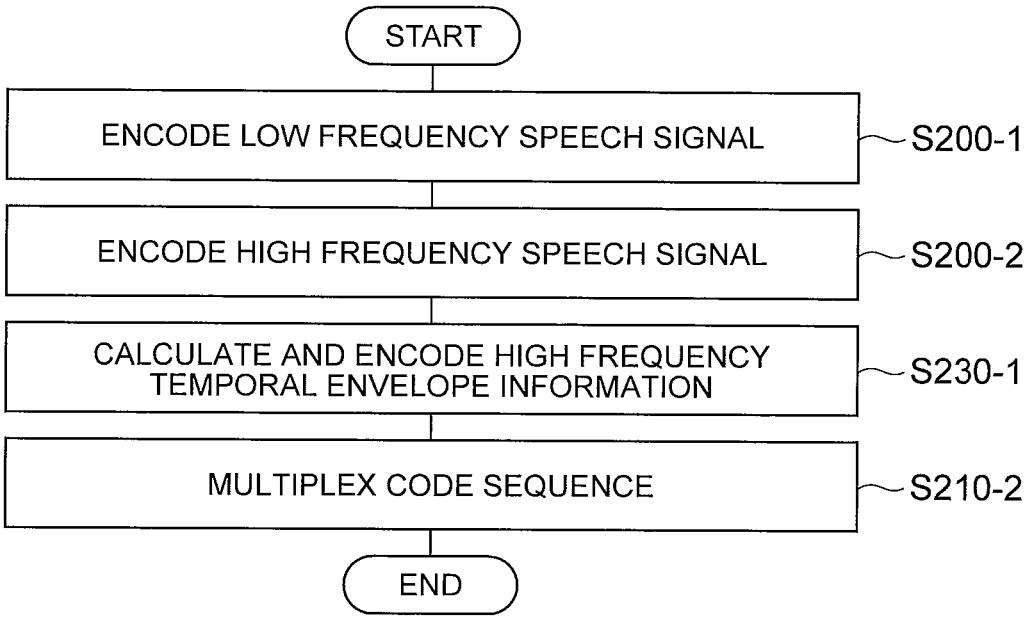
FIG. 51 is a flow chart showing the operation of the speech to digital converter 230 according to the fifth embodiment.

FIG. 51 is a flowchart showing the operation of the speech encoding device 230 according to the fifth embodiment.

The high frequency temporal envelope information encoder 230*a* calculates and encodes the high frequency temporal envelope shape information, based on at least one of the input speech signal, information obtained in the encoding process including the encoding result of the input speech signal in the low frequency encoder 200*a*, and information obtained in the encoding process including the encoding result of the input speech signal in the high frequency encoder 200*b* (step S230-1).

Calculating and encoding high frequency temporal envelope shape information can be performed, for example, in the process, by the low frequency temporal envelope information encoder 200*c*, of calculating and encoding the temporal envelope information on the low frequency signal. However, the process of calculating and encoding high frequency temporal envelope shape information differs from the process of calculating and encoding the temporal envelope information on the low frequency signal using the low frequency decoded signal of the input speech signal in that the information obtained in the encoding process including the encoding result of the input speech signal in the high frequency encoder 200*b* can be additionally used.

Sixth Embodiment

Figure 52:
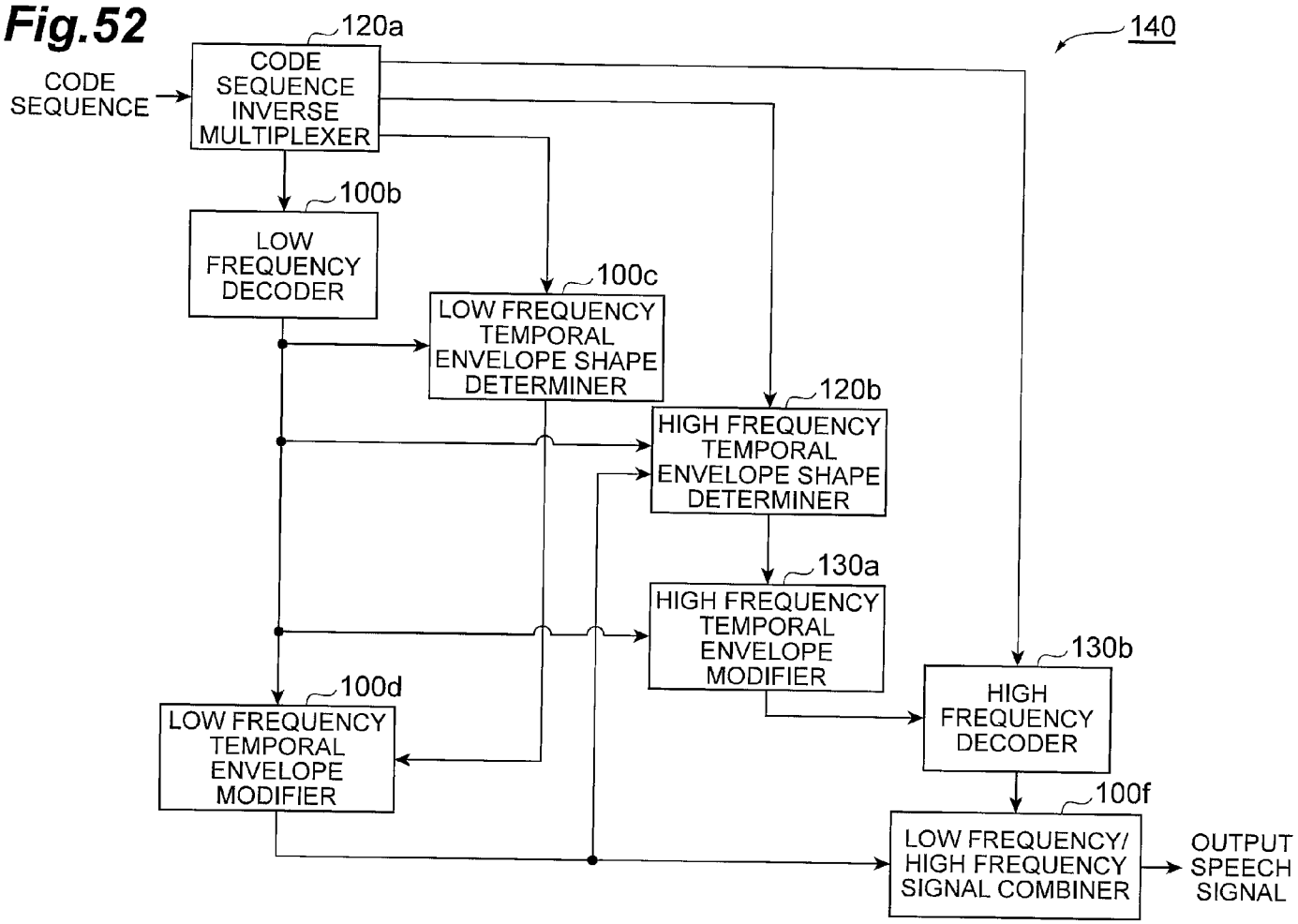
FIG. 52 is a figure showing the configuration of the speech decoding device 140 according to the sixth embodiment.

FIG. 52 is a diagram showing the configuration of a speech decoding device 140 according to a sixth embodiment. A communication device of the speech decoding device 140 receives a multiplexed code sequence output from a speech encoding device 240 described below and outputs a decoded speech signal to the outside. As shown in FIG. 52, the speech decoding device 140 functionally includes a code sequence demultiplexer 120*a*, a low frequency decoder 100*b*, a low frequency temporal envelope shape determiner 100*c*, a low frequency temporal envelope modifier 100*d*, a high frequency temporal envelope shape determiner 120*b*, a high frequency temporal envelope modifier 130*a*, a high frequency decoder 130*b*, and a low frequency/high frequency signal combiner 100*f*.

Figure 53:
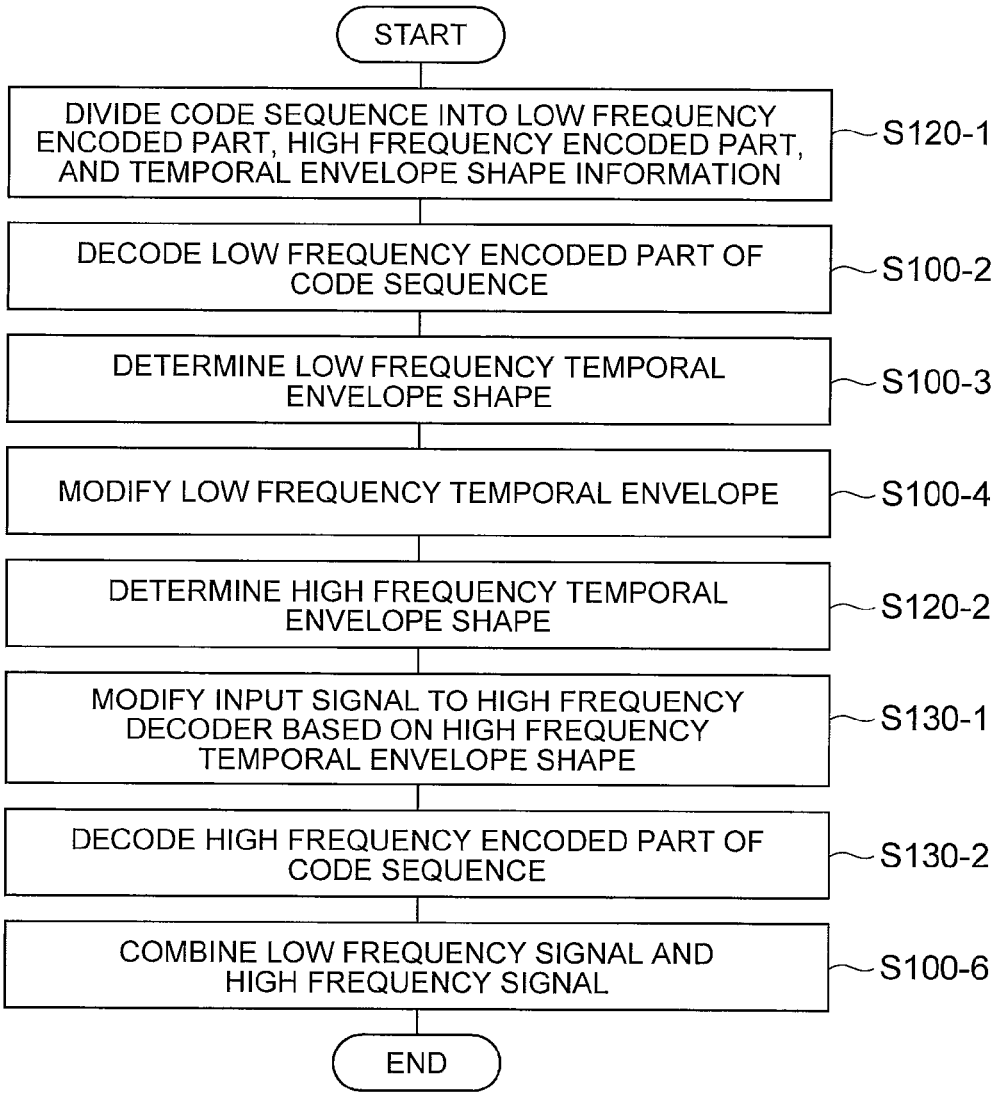
FIG. 53 is a flow chart showing the operation of the speech decoding device according to the sixth embodiment.

FIG. 53 is a flowchart showing the operation of the speech decoding device according to the sixth embodiment. The code sequence demultiplexer 120*a* and the high frequency temporal envelope shape determiner 120*b* perform the same operation as the code sequence demultiplexer 120*a* and the high frequency temporal envelope shape determiner 120*b* in the fourth embodiment (steps S120-1, S120-2). The high frequency temporal envelope modifier 130*a* and the high frequency decoder 130*b* perform the same operation as the high frequency temporal envelope modifier 130*a* and the high frequency decoder 130*b* in the fifth embodiment (steps S130-1, S130-2).

Figure 54:
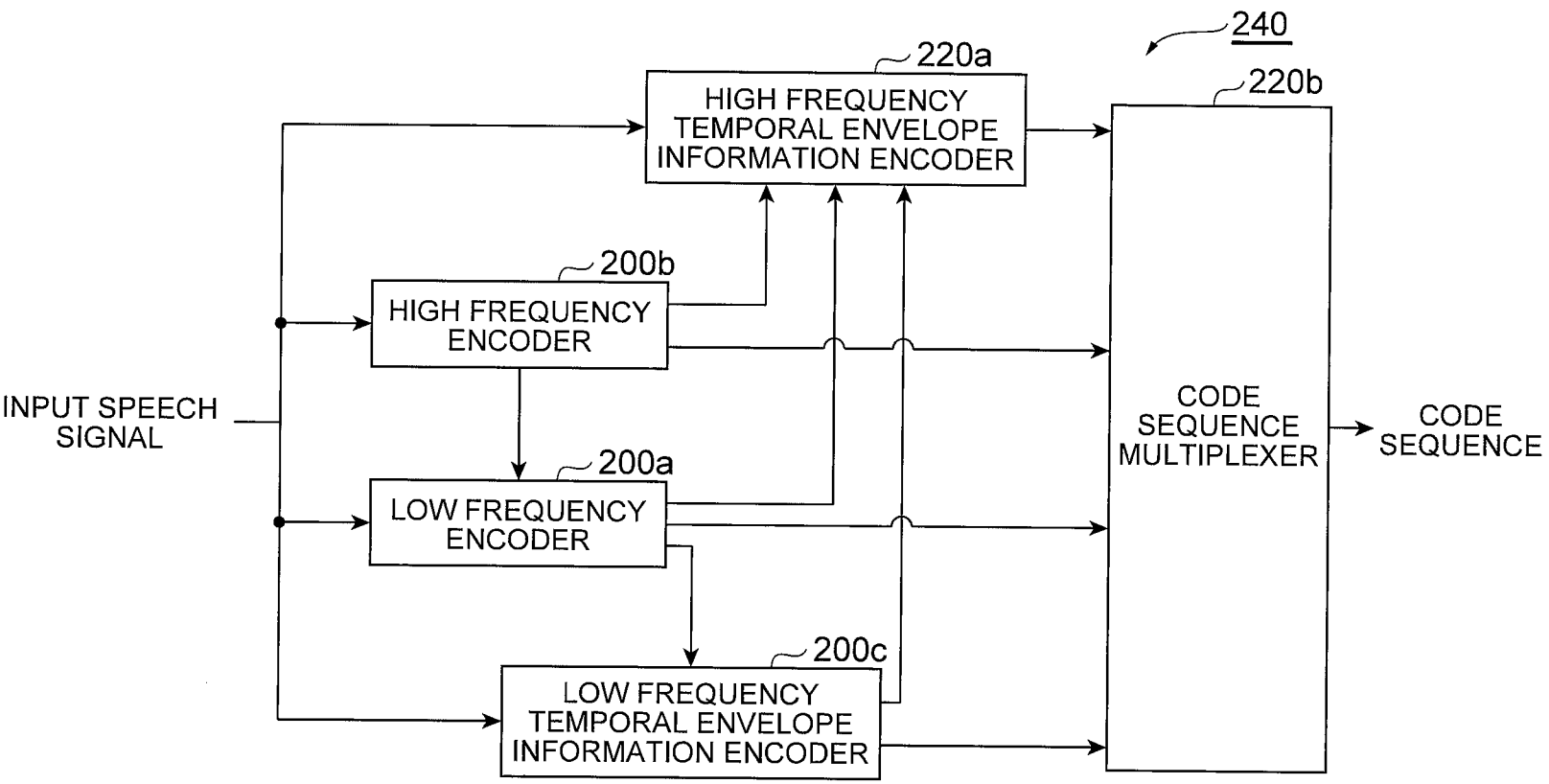
FIG. 54 is a figure showing the configuration of the speech to digital converter 240 according to the sixth embodiment.

FIG. 54 is a diagram showing the configuration of the speech encoding device 240 according to the sixth embodiment. A communication device of the speech encoding device 240 receives a speech signal to be encoded from the outside and outputs the encoded code sequence to the outside. As shown in FIG. 54, the speech encoding device 240 functionally includes a low frequency encoder 200*a*, a high frequency encoder 200*b*, a low frequency temporal envelope information encoder 200*c*, a high frequency temporal envelope information encoder 220*a*, and a code sequence multiplexer 220*b*.

Figure 55:
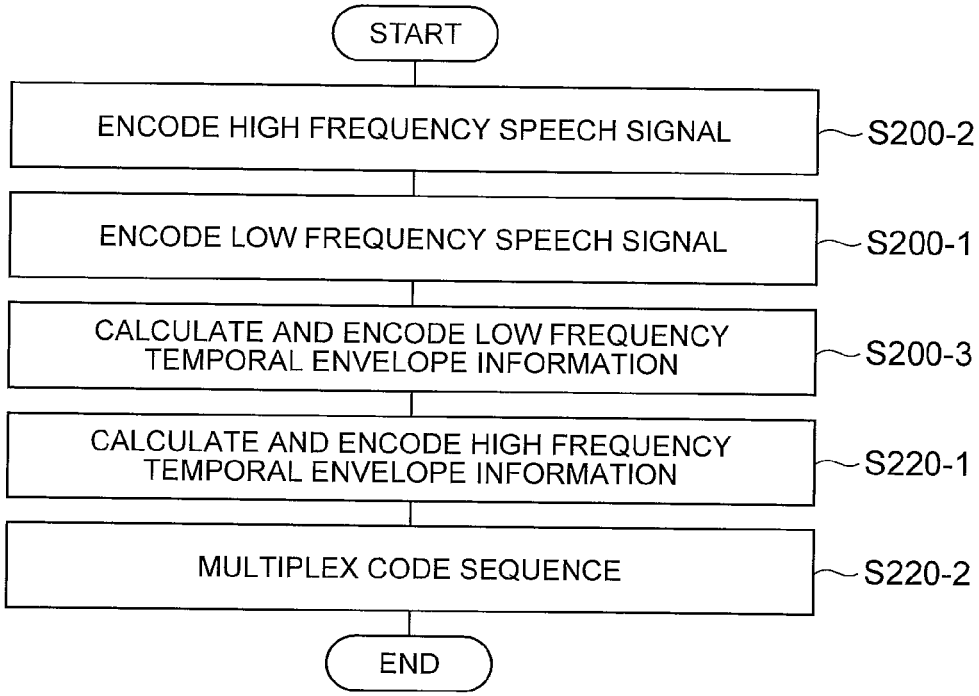
FIG. 55 is a flow chart showing the operation of the speech to digital converter 240 according to the sixth embodiment.

FIG. 55 is a flowchart showing the operation of the speech encoding device 240 according to the sixth embodiment.

First Modification of Speech Decoding Device of Sixth Embodiment

Figure 56:
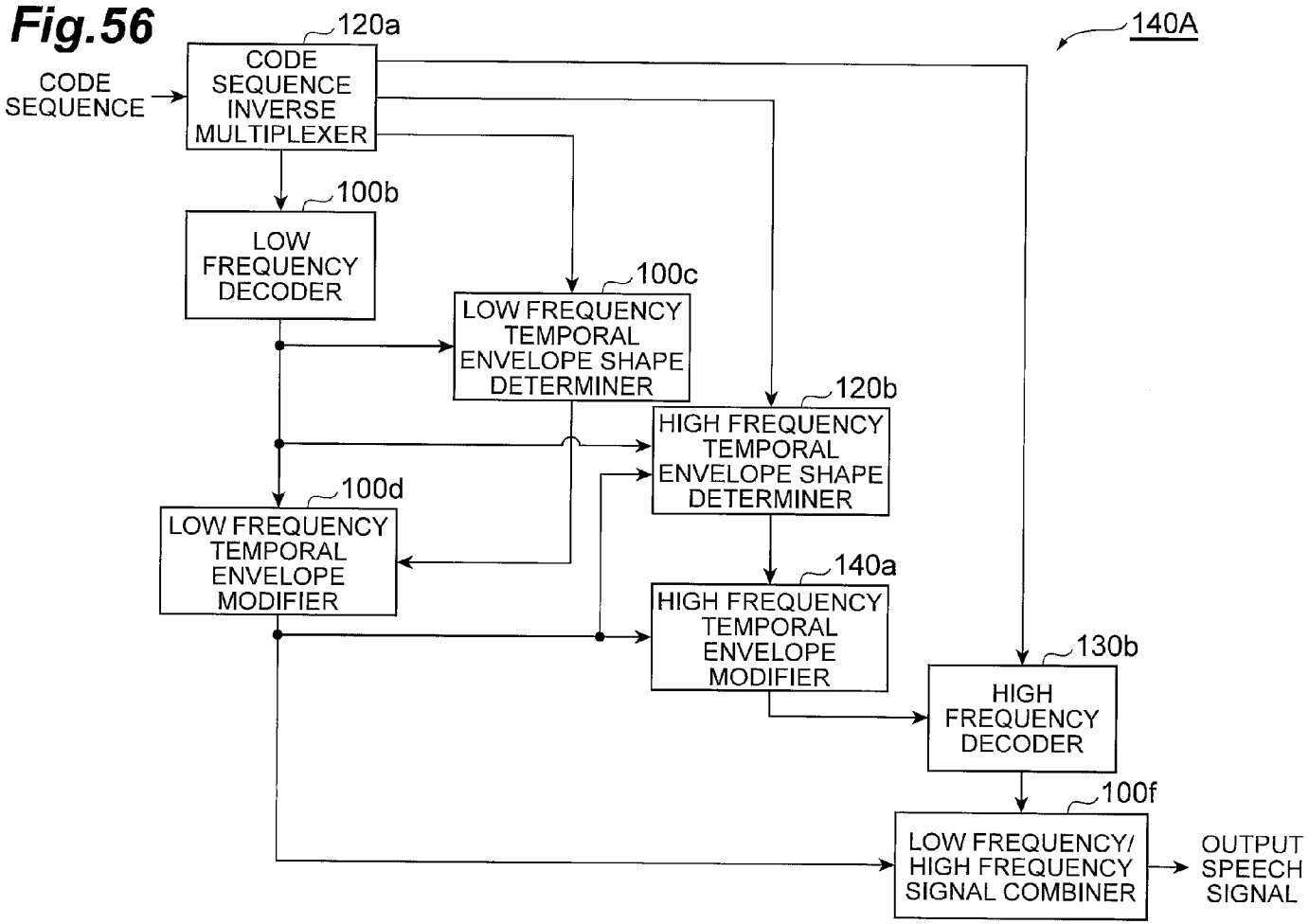
FIG. 56 is a figure showing the configuration of the first modification 140A of the speech decoding device according to the sixth embodiment.

FIG. 56 is a diagram showing the configuration of a first modification 140A of the speech decoding device according to the sixth embodiment.

Figure 57:
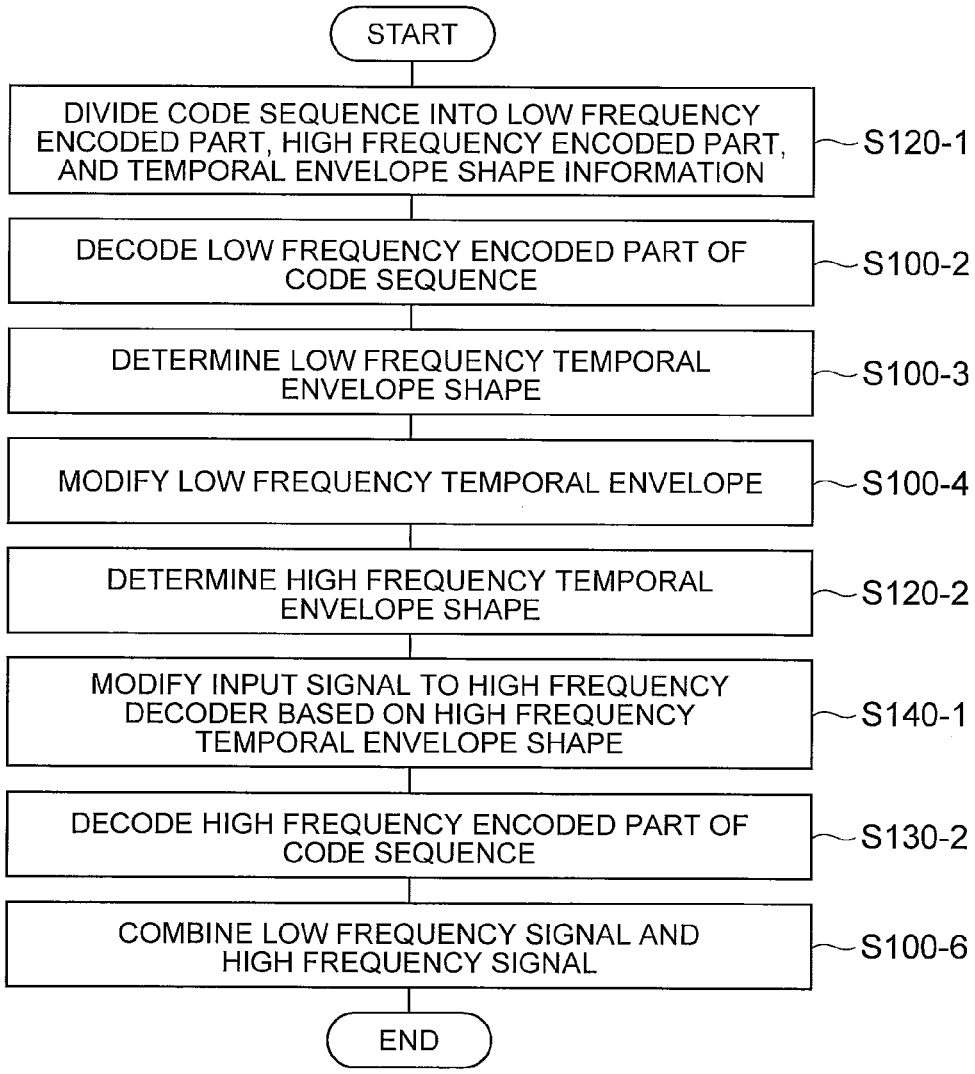
FIG. 57 is a flow chart showing the operation of the first modification 140A of the speech decoding device according to the sixth embodiment.

FIG. 57 is a flowchart showing the operation of the first modification 140A of the speech decoding device according to the sixth embodiment.

A high frequency temporal envelope modifier 140*a* modifies the shape of the temporal envelope of the low frequency signal having the temporal envelope shape modified by the low frequency temporal envelope modifier 100*d*, based on the temporal envelope shape determined by the high frequency temporal envelope shape determiner 120*b* (step S140-1). The difference from the high frequency temporal envelope modifier 130*a* is that the input signal is the low frequency signal having the temporal envelope shape modified by the low frequency temporal envelope modifier 100*d*.

Second Modification of Speech Decoding Device of Sixth Embodiment

Figure 58:
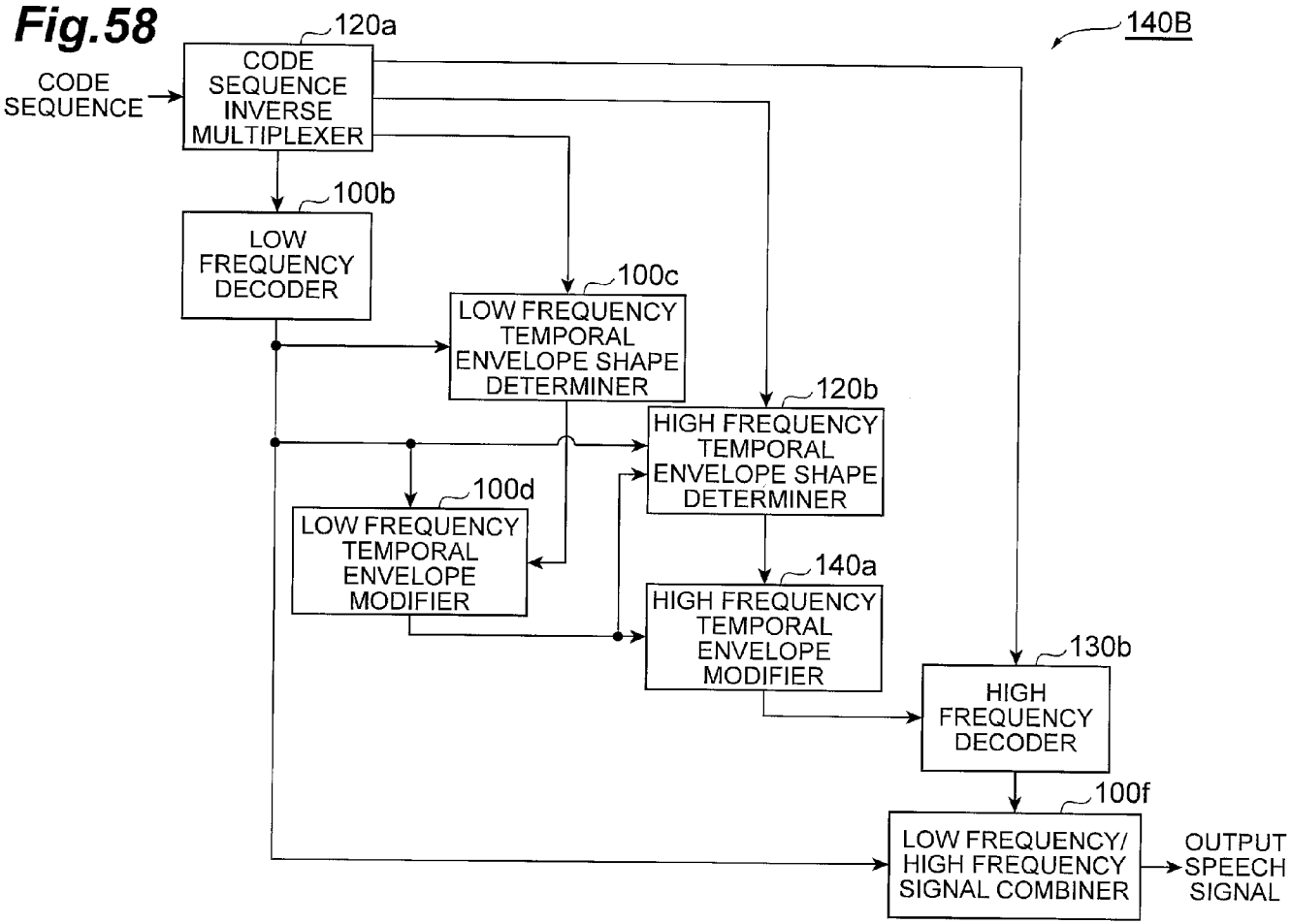
FIG. 58 is a figure showing the configuration of the second modification 140B of the speech decoding device according to the sixth embodiment.

FIG. 58 is a diagram showing the configuration of a second modification 140B of the speech encoding device according to the sixth embodiment.

The difference from the first modification of the speech decoding device in the present embodiment is that the low frequency signal to be used in the combining process by the low frequency/high frequency signal combiner 100*f* is not the low frequency signal having the temporal envelope shape modified by the low frequency temporal envelope modifier 100*d* but the low frequency signal decoded by the low frequency decoder 100*b*.

Third Modification of Speech Decoding Device of Sixth Embodiment

Figure 59:
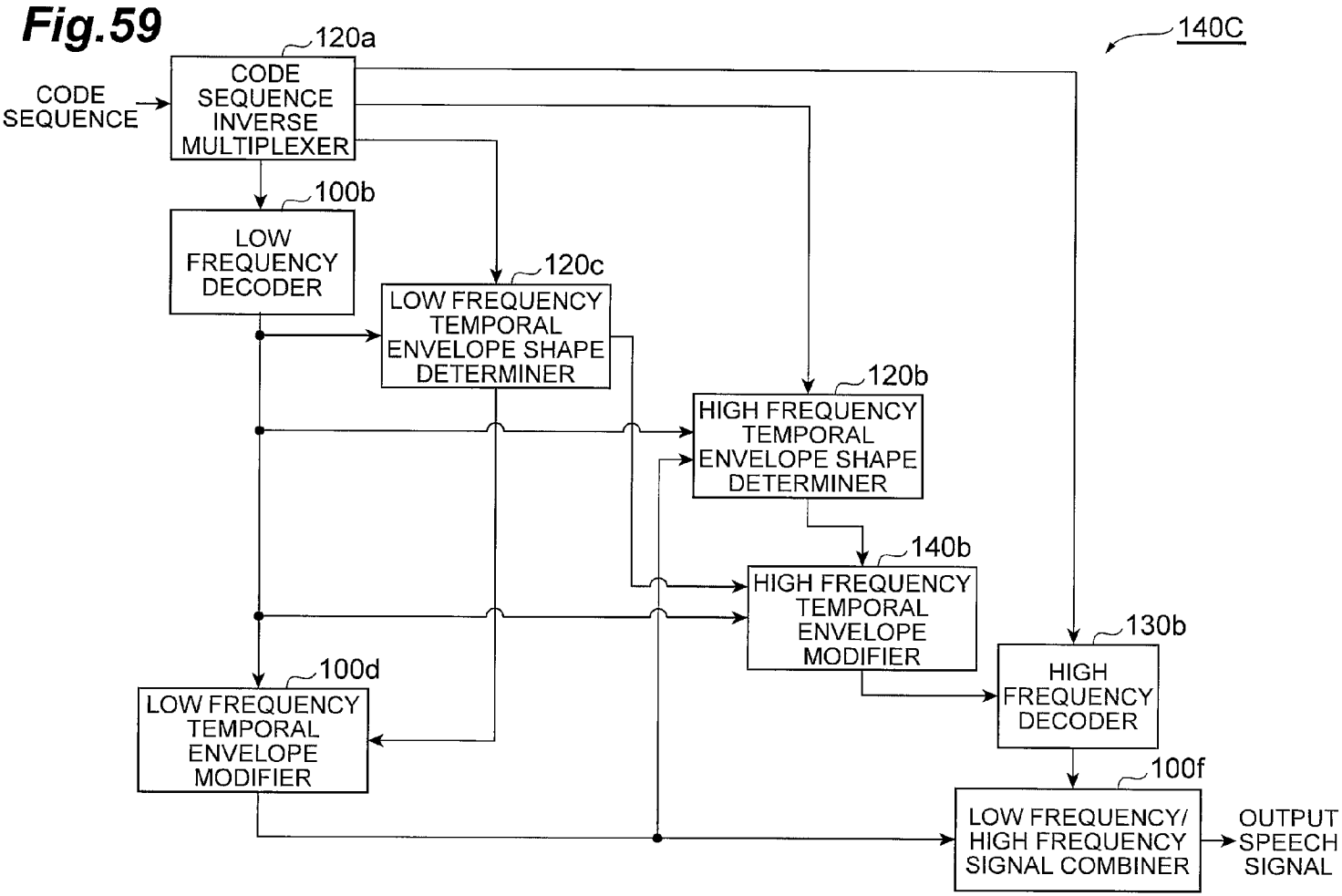
FIG. 59 is a figure showing the configuration of the 3rd modification 140C of the speech decoding device according to the sixth embodiment.

FIG. 59 is a diagram showing the configuration of a third modification 140C of the speech decoding device according to the sixth embodiment.

Figure 60:
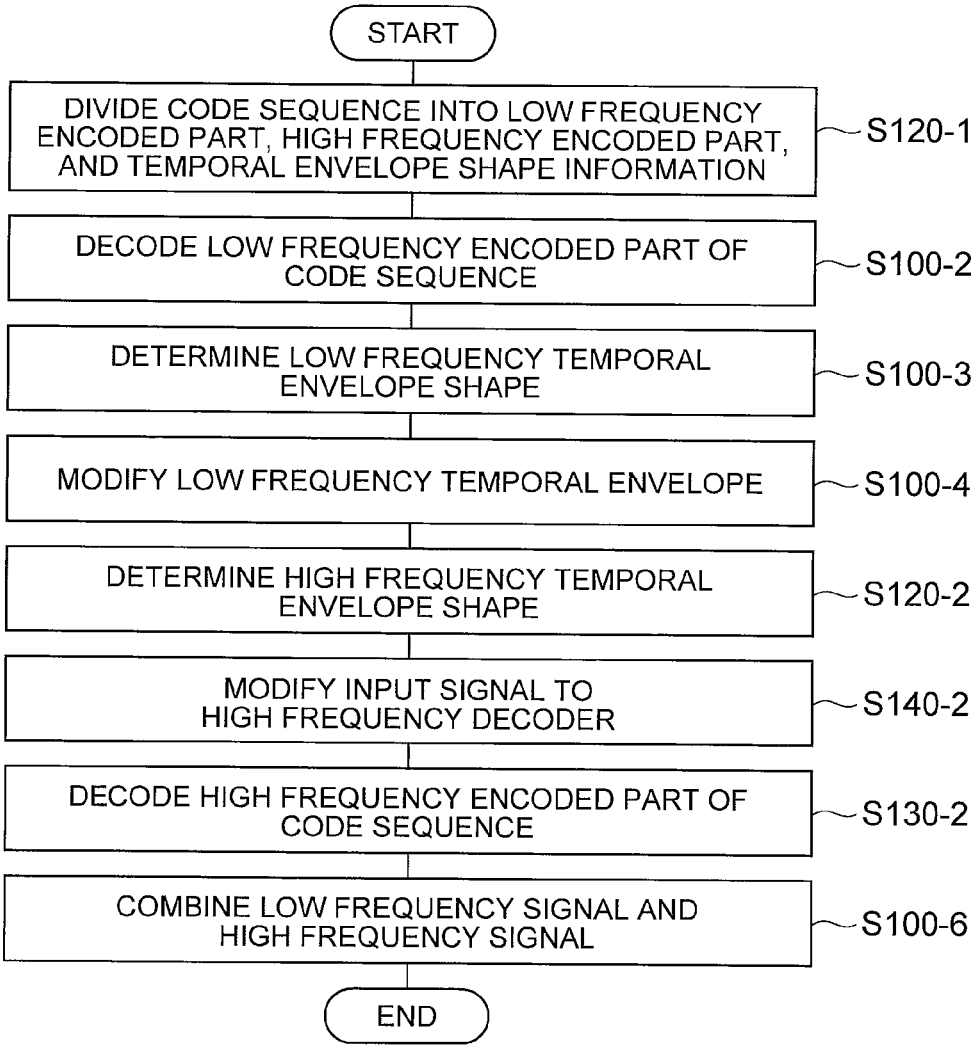
FIG. 60 is a flow chart showing the operation of the 3rd modification 140C of the speech decoding device according to the sixth embodiment.

FIG. 60 is a flowchart showing the operation of the third modification 140C of the speech decoding device according to the sixth embodiment.

The present modification differs from the speech decoding device 140 according to the sixth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 130*a*.

The high frequency temporal envelope modifier 140*b* differs from the high frequency temporal envelope modifier 130*a* in that the shape of the temporal envelope of the low frequency signal input to the high frequency decoder 130*b* is modified based on at least one of the temporal envelope shape determined by the high frequency temporal envelope shape determiner 120*b* and the temporal envelope shape determined by the low frequency temporal envelope shape determiner 120*c* (S140-2).

For example, if the low frequency temporal envelope shape determiner 120*c* determines that the temporal envelope shape is flat, the temporal envelope of the low frequency signal input to the high frequency decoder 130*b* is modified into a flat shape, irrespective of the temporal envelope shape determined by the high frequency temporal envelope shape determiner 120*b*. For example, if the low frequency temporal envelope shape determiner 120*c* determines that the temporal envelope shape is not flat, the temporal envelope of the low frequency signal input to the high frequency decoder 130*b* is not modified into a flat shape, irrespective of the temporal envelope shape determined by the high frequency temporal envelope shape determiner 120*b*. This is applicable to the cases of onset and offset and is not limited to any specific temporal envelope shape.

Fourth Modification of Speech Decoding Device of Sixth Embodiment

Figure 61:
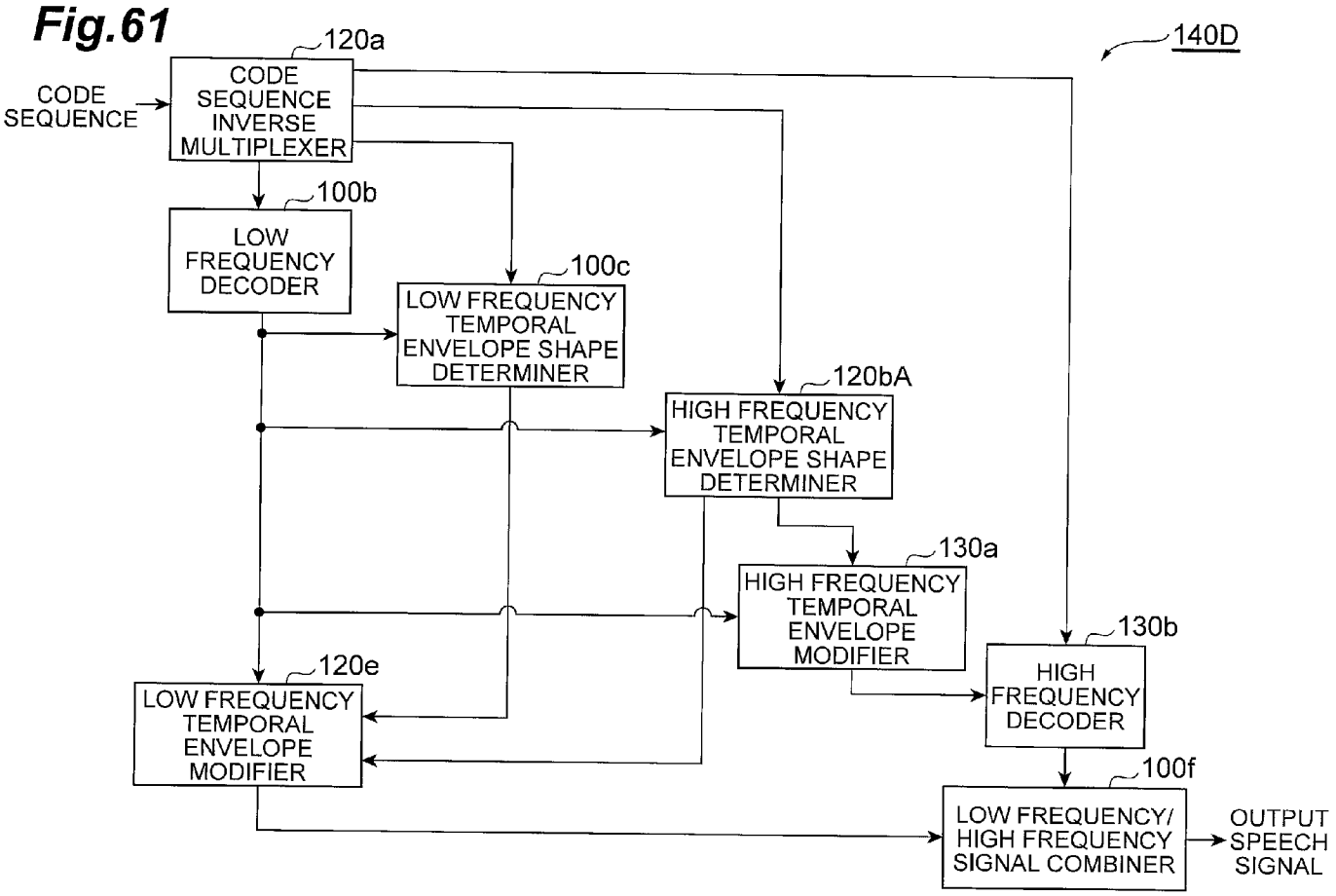
FIG. 61 is a figure showing the configuration of the 4th modification 140D of the speech decoding device according to the sixth embodiment.

FIG. 61 is a diagram showing the configuration of a fourth modification 140D of the speech decoding device according to the sixth embodiment.

Figure 62:
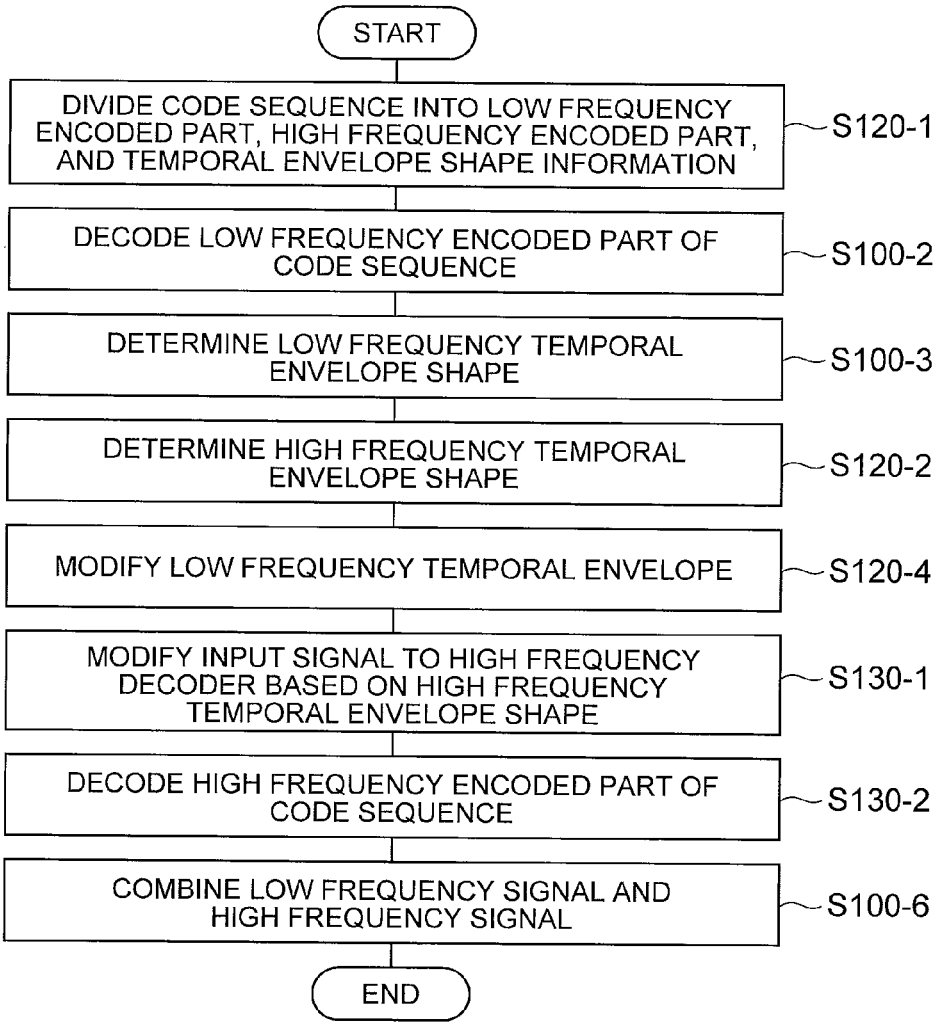
FIG. 62 is a flow chart showing the operation of the 4th modification 140D of the speech decoding device according to the sixth embodiment.

FIG. 62 is a flowchart showing the operation of the fourth modification 140D of the speech decoding device according to the sixth embodiment.

The present modification differs from the speech decoding device 140 according to the sixth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Fifth Modification of Speech Decoding Device of Sixth Embodiment

Figure 63:
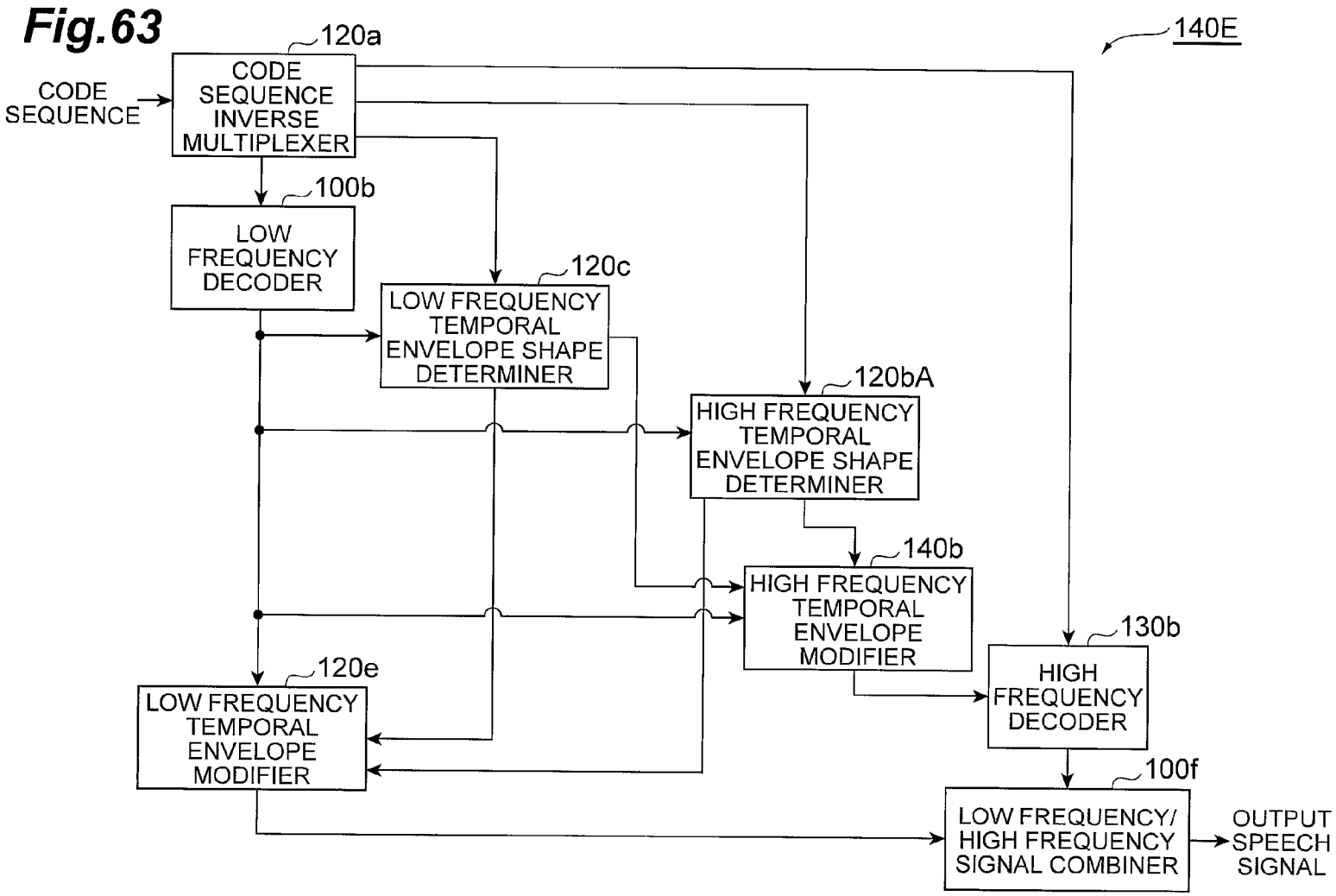
FIG. 63 is a figure showing the configuration of the fifth modification 140E of the speech decoding device according to the sixth embodiment.

FIG. 63 is a diagram showing the configuration of a fifth modification 140E of the speech decoding device according to the sixth embodiment.

Figure 64:
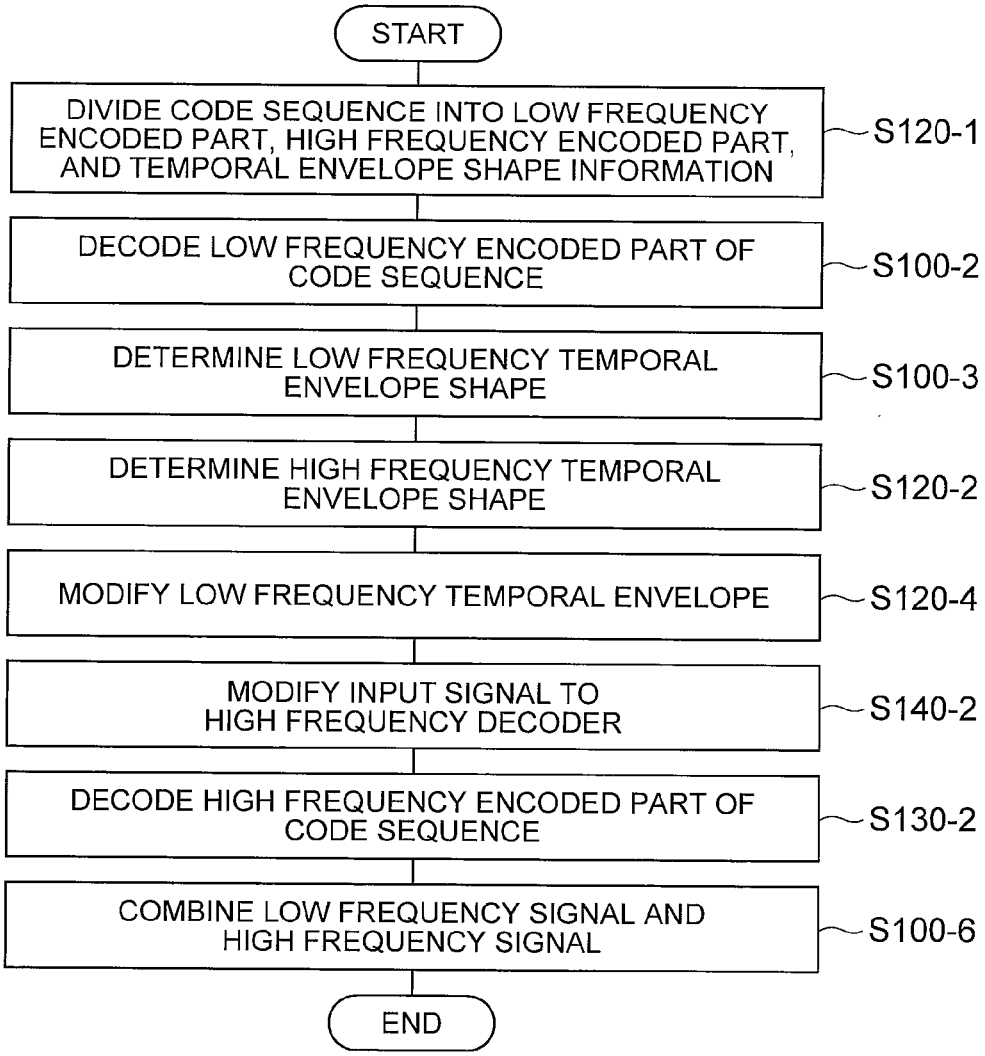
FIG. 64 is a flow chart showing the operation of the fifth modification 140E of the speech decoding device according to the sixth embodiment.

FIG. 64 is a flowchart showing the operation of the fifth modification 140E of the speech decoding device according to the sixth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Sixth Modification of Speech Decoding Device of Sixth Embodiment

Figure 65:
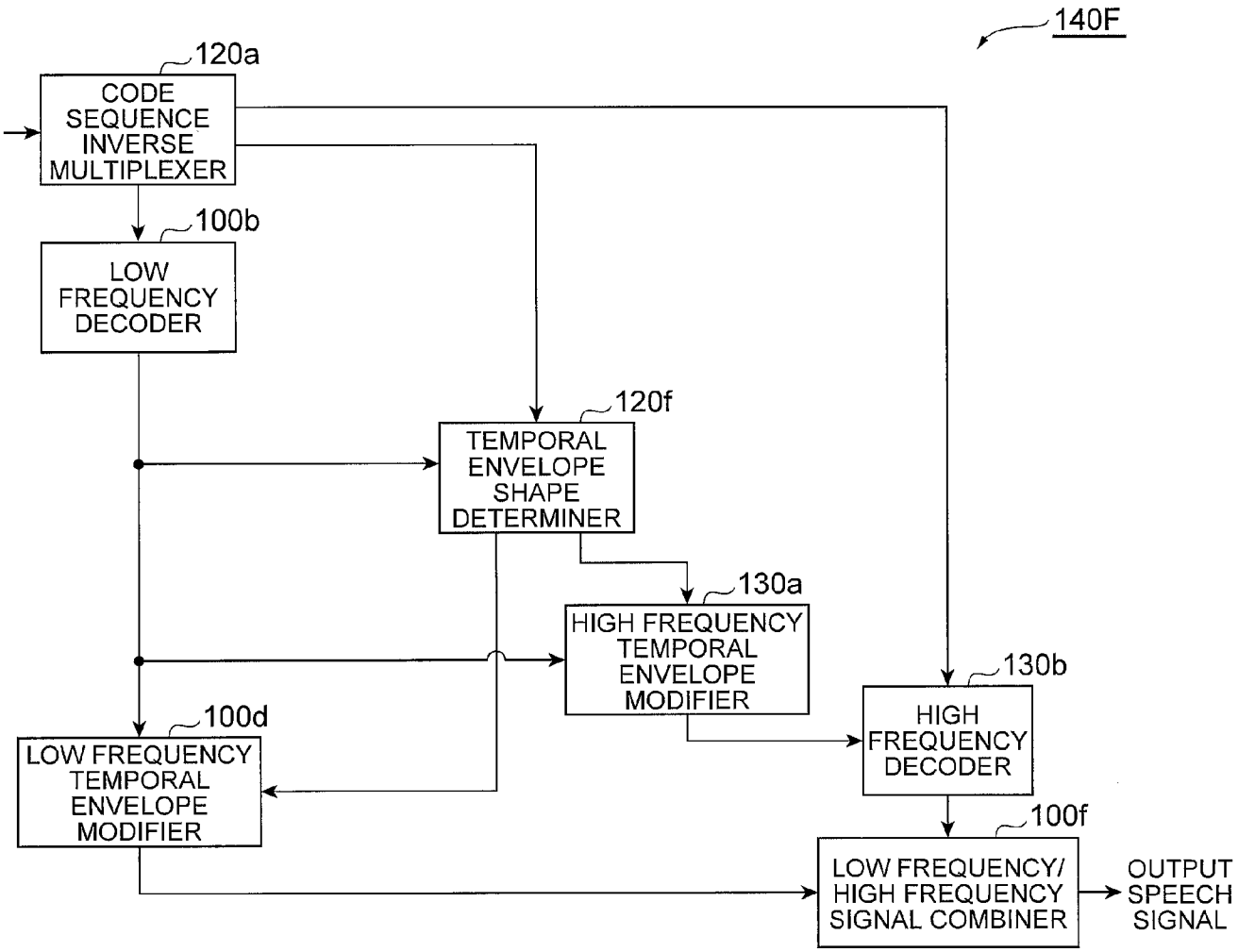
FIG. 65 is a figure showing the configuration of the sixth modification 140F of the speech decoding device according to the sixth embodiment.

FIG. 65 is a diagram showing the configuration of a sixth modification 140F of the speech decoding device according to the sixth embodiment.

Figure 66:
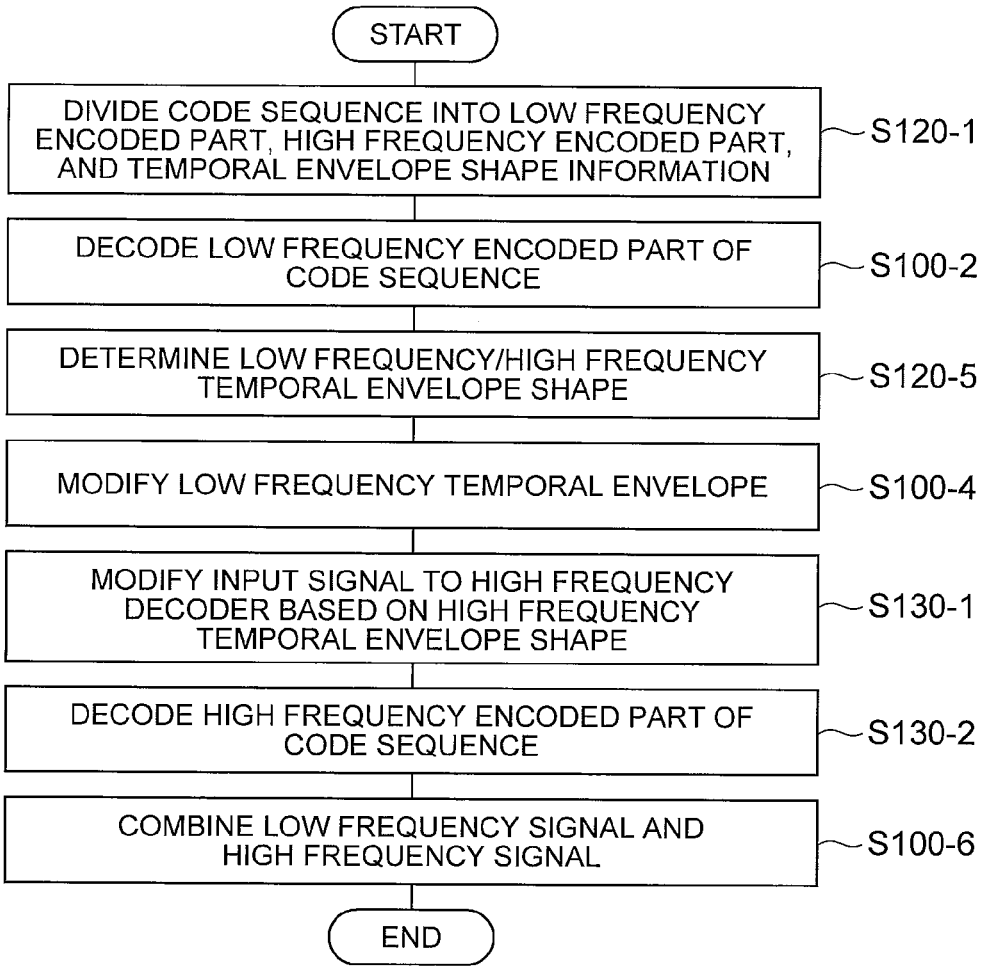
FIG. 66 is a flow chart showing the operation of the sixth modification 140F of the speech decoding device according to the sixth embodiment.

FIG. 66 is a flowchart showing the operation of the sixth modification 140F of the speech decoding device according to the sixth embodiment.

The present modification differs from the speech decoding device 140 according to the sixth embodiment in that it includes a temporal envelope shape determiner 120*f* in place of the low frequency temporal envelope shape determiner 100*c* and the high frequency temporal envelope shape determiner 120*b*.

Seventh Modification of Speech Decoding Device of Sixth Embodiment

Figure 67:
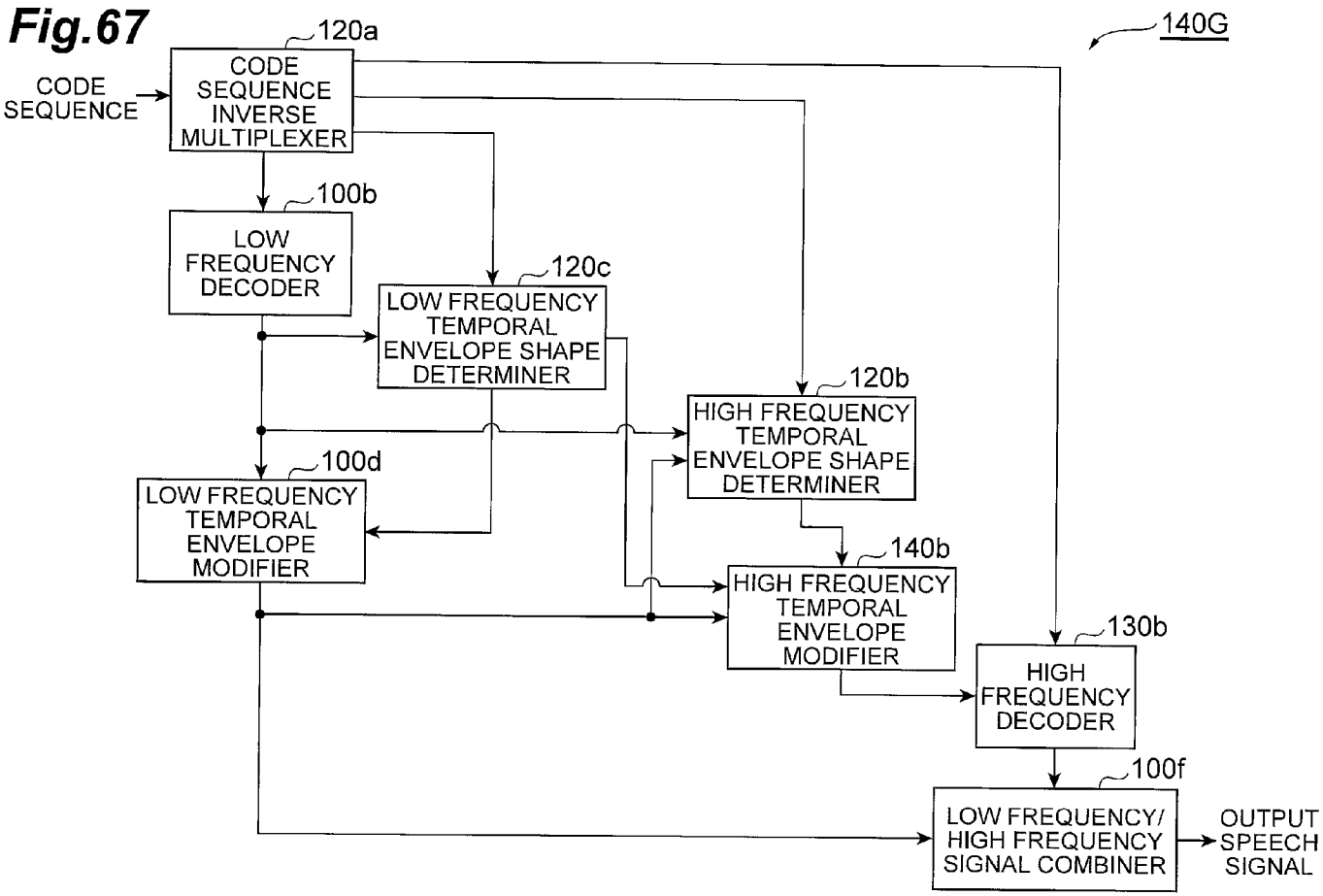
FIG. 67 is a figure showing the configuration of the seventh modification 140G of the speech decoding device according to the sixth embodiment.

FIG. 67 is a diagram showing the configuration of a seventh modification 140G of the speech decoding device according to the sixth embodiment.

Figure 68:
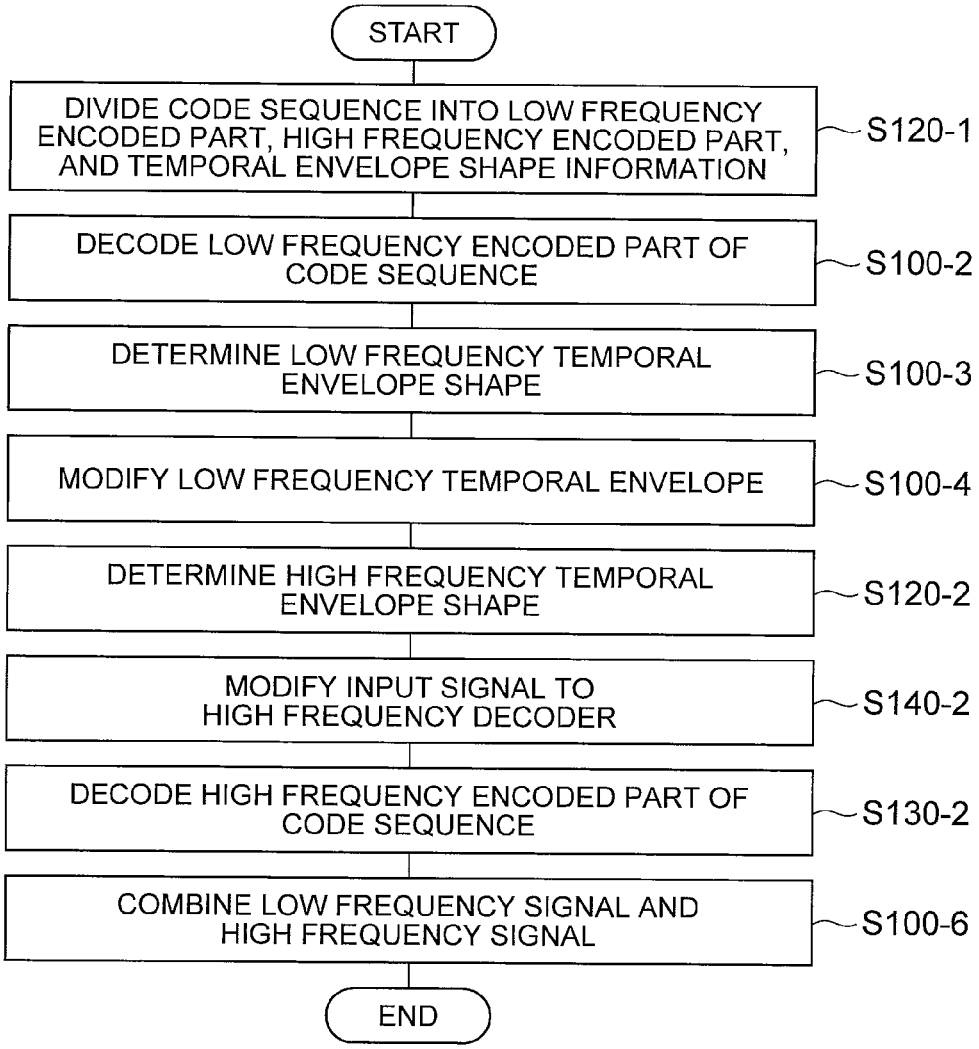
FIG. 68 is a flow chart showing the operation of the seventh modification 140G of the speech decoding device according to the sixth embodiment.

FIG. 68 is a flowchart showing the operation of the seventh modification 140G of the speech decoding device according to the sixth embodiment.

The present modification differs from the first modification 140A of the speech decoding device according to the sixth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 140*a*.

In the present modification, the high frequency temporal envelope modifier 140*b* modifies the shape of the temporal envelope of the low frequency signal having the temporal envelope shape modified to be input to the high frequency decoder 130*b*, based on at least one of the temporal envelope shape determined by the high frequency temporal envelope shape determiner 120*b* and the temporal envelope shape determined by the low frequency temporal envelope shape determiner 120*c* (S140-2).

Eighth Modification of Speech Decoding Device of Sixth Embodiment

Figure 69:
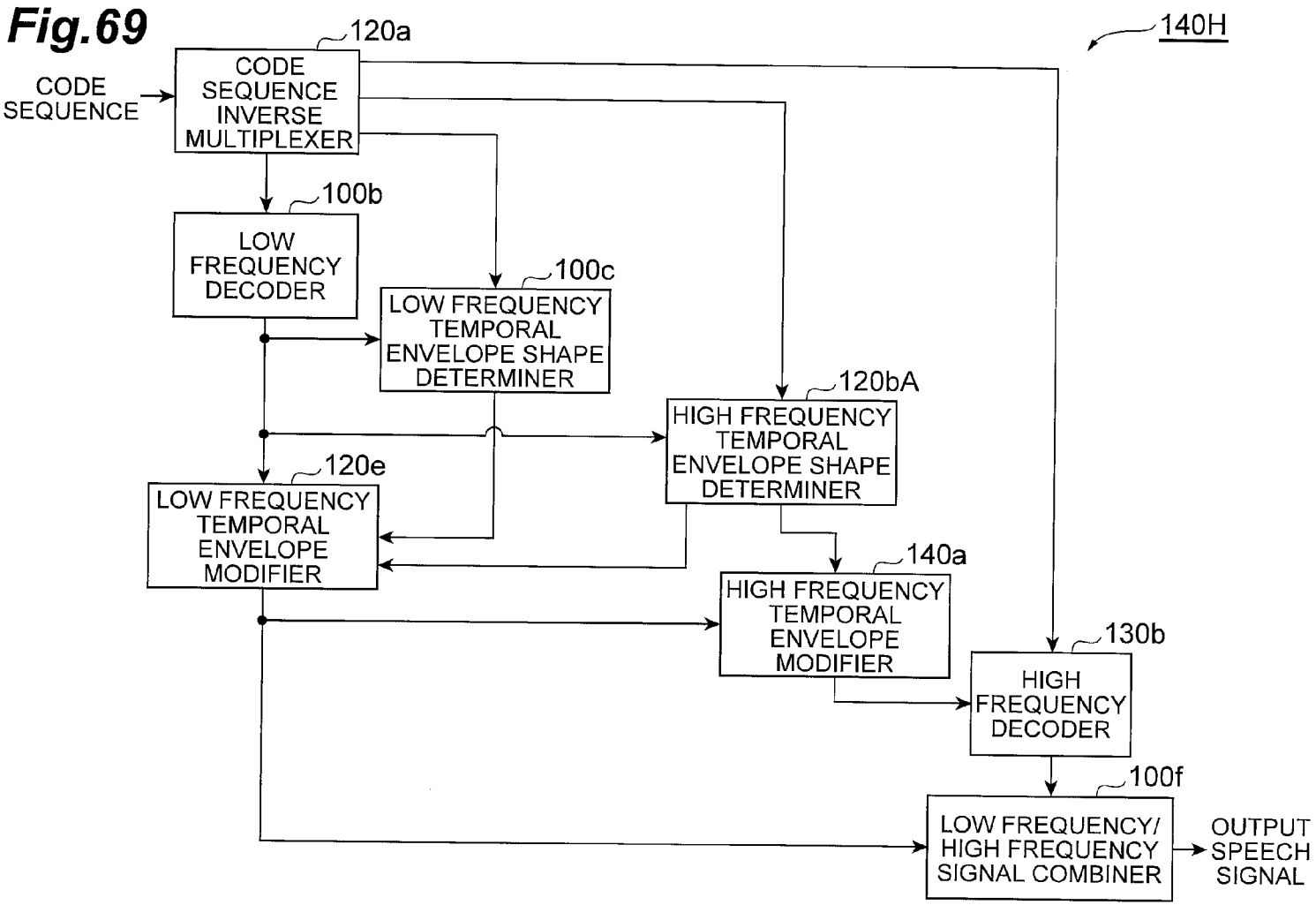
FIG. 69 is a figure showing the configuration of the eighth modification 140H of the speech decoding device according to the sixth embodiment.

FIG. 69 is a diagram showing the configuration of an eighth modification 140H of the speech decoding device according to the sixth embodiment.

Figure 70:
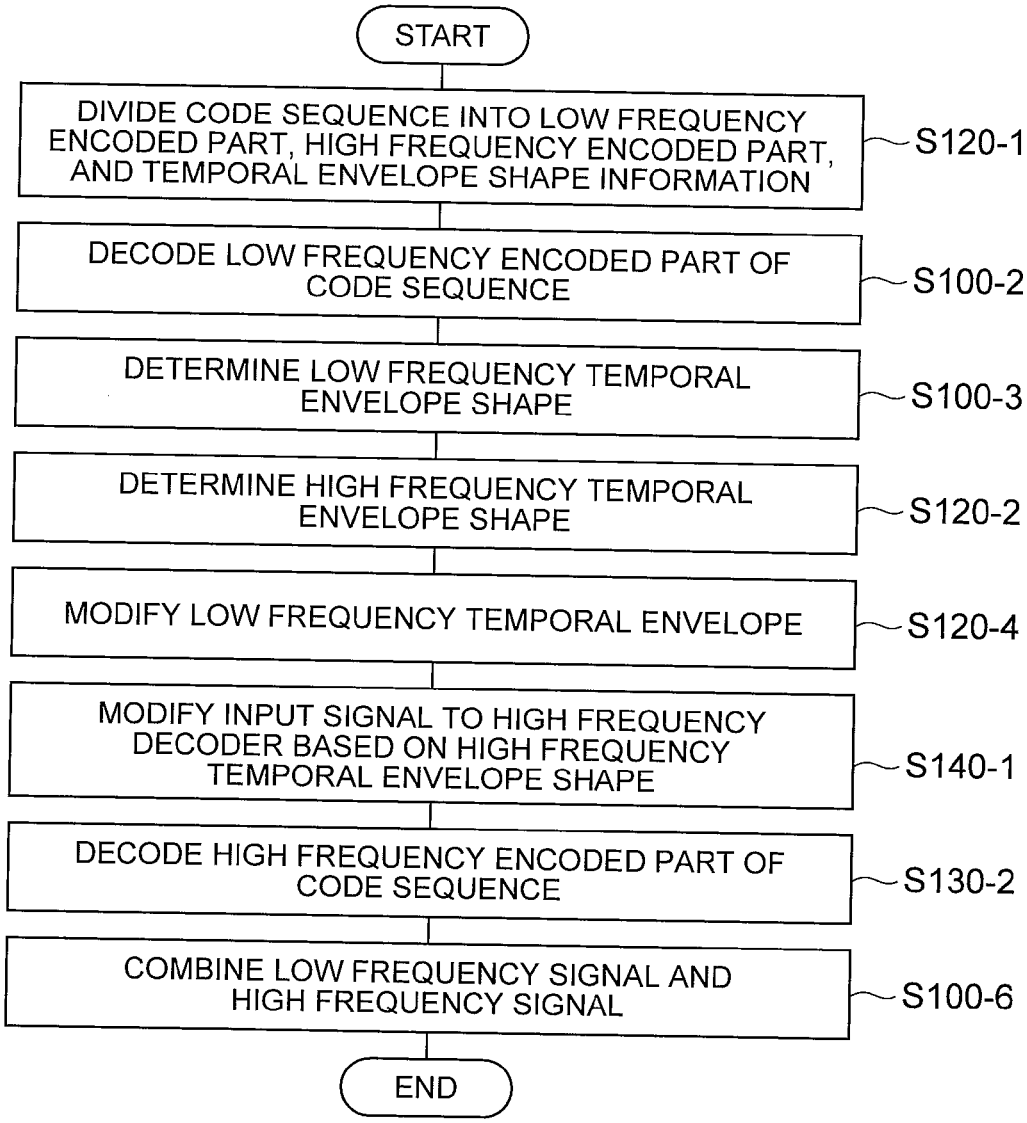
FIG. 70 is a flow chart showing the operation of the eighth modification 140H of the speech decoding device according to the sixth embodiment.

FIG. 70 is a flowchart showing the operation of the eighth modification 140H of the speech decoding device according to the sixth embodiment.

The present modification differs from the first modification 140A of the speech decoding device according to the sixth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Ninth Modification of Speech Decoding Device of Sixth Embodiment

Figure 71:
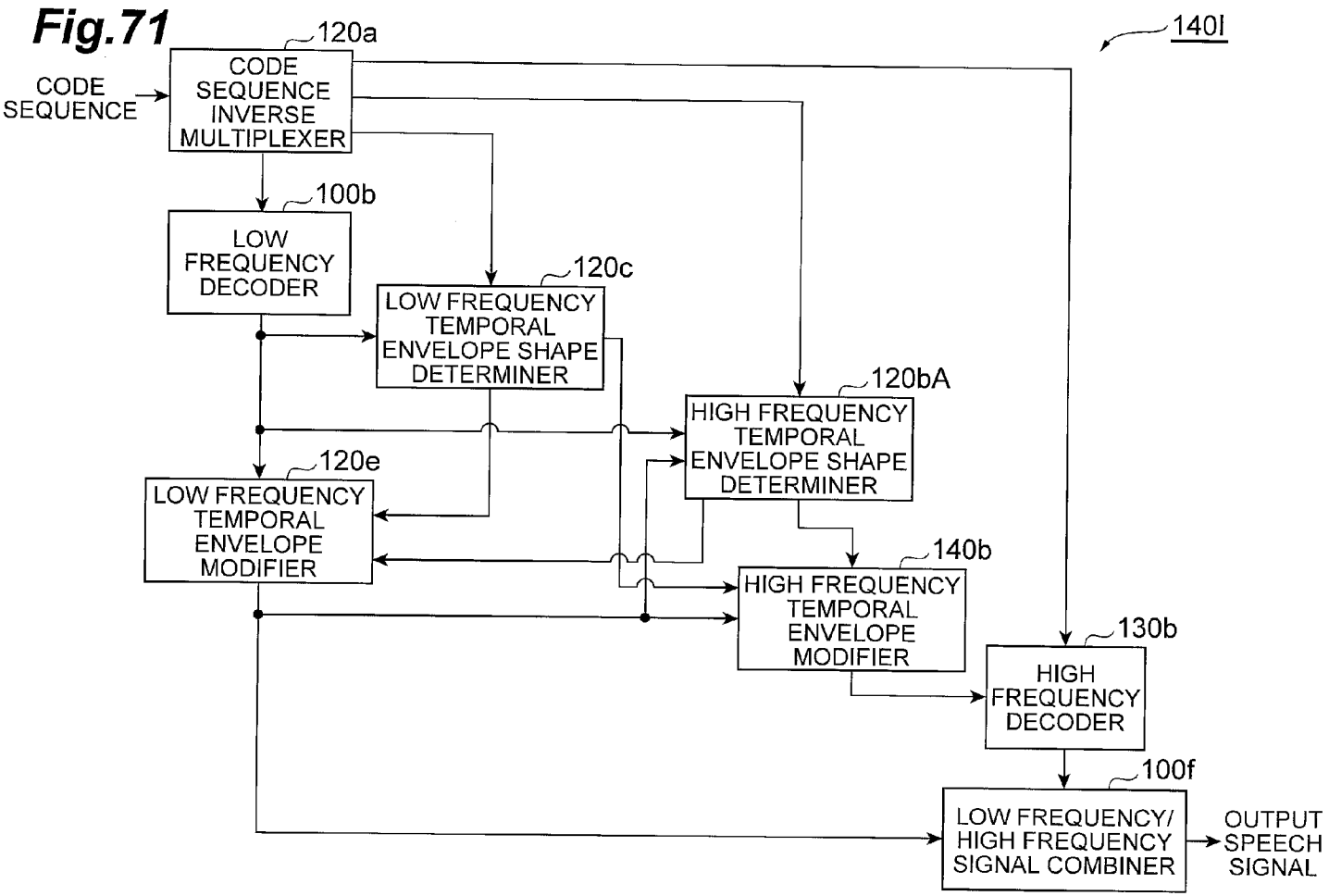
FIG. 71 is a figure showing the configuration of the ninth modification 140I of the speech decoding device according to the sixth embodiment.

FIG. 71 is a diagram showing the configuration of a ninth modification 140I of the speech decoding device according to the sixth embodiment.

Figure 72:
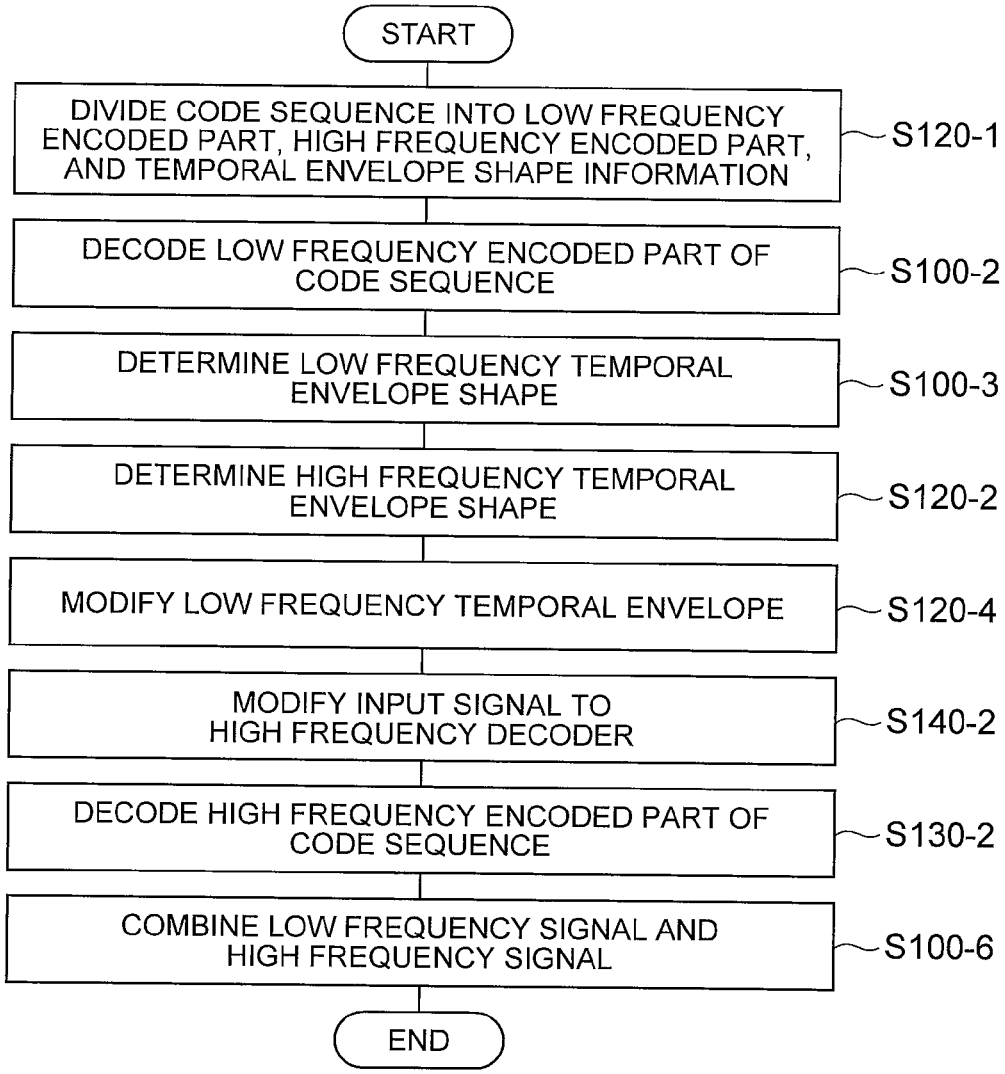
FIG. 72 is a flow chart showing the operation of the ninth modification 140I of the speech decoding device according to the sixth embodiment.

FIG. 72 is a flowchart showing the operation of the ninth modification 140I of the speech decoding device according to the sixth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Tenth Modification of Speech Decoding Device of Sixth Embodiment

Figure 73:
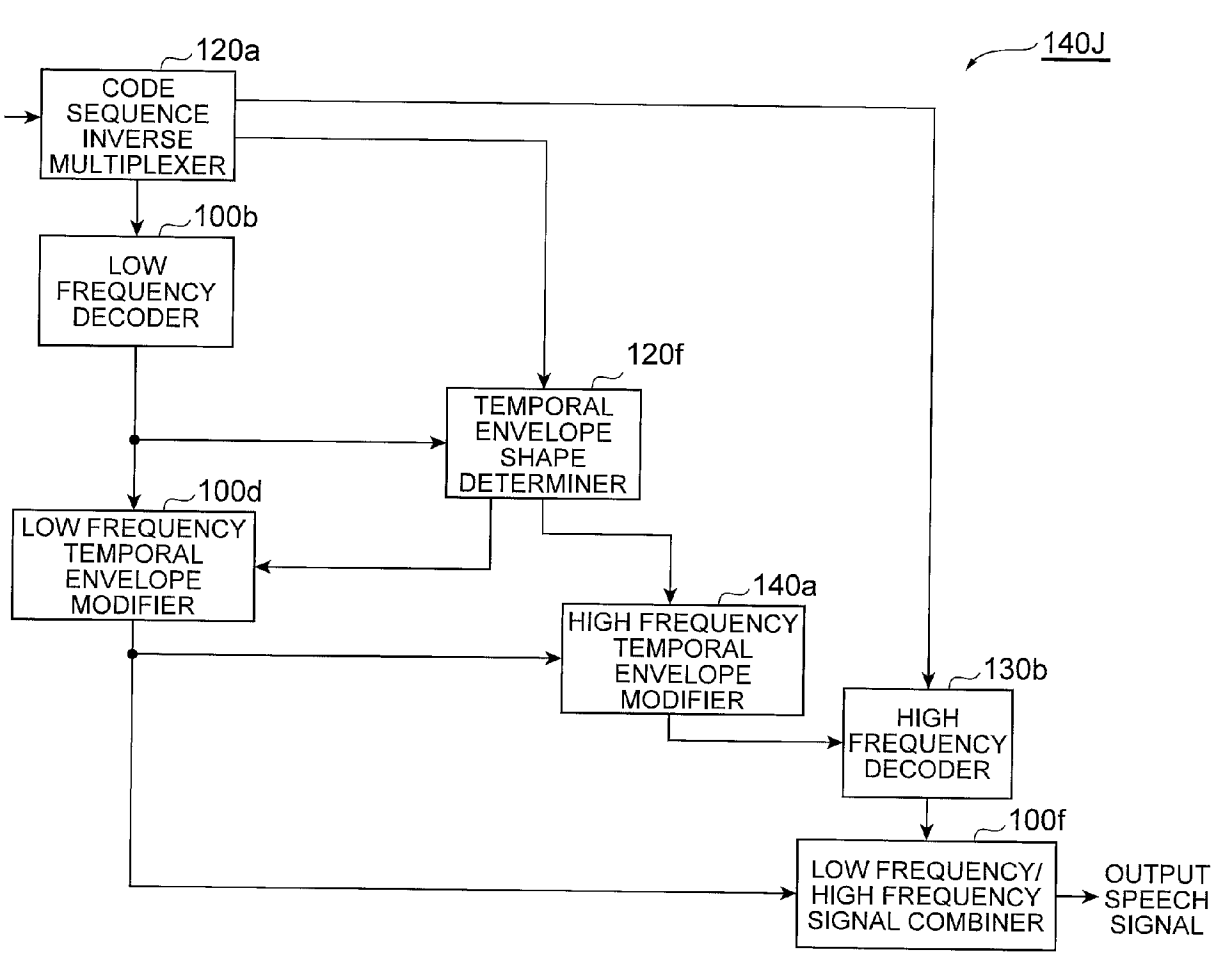
FIG. 73 is a figure showing the configuration of the tenth modification 140J of the speech decoding device according to the sixth embodiment.

FIG. 73 is a diagram showing the configuration of a tenth modification 140J of the speech decoding device according to the sixth embodiment.

Figure 74:
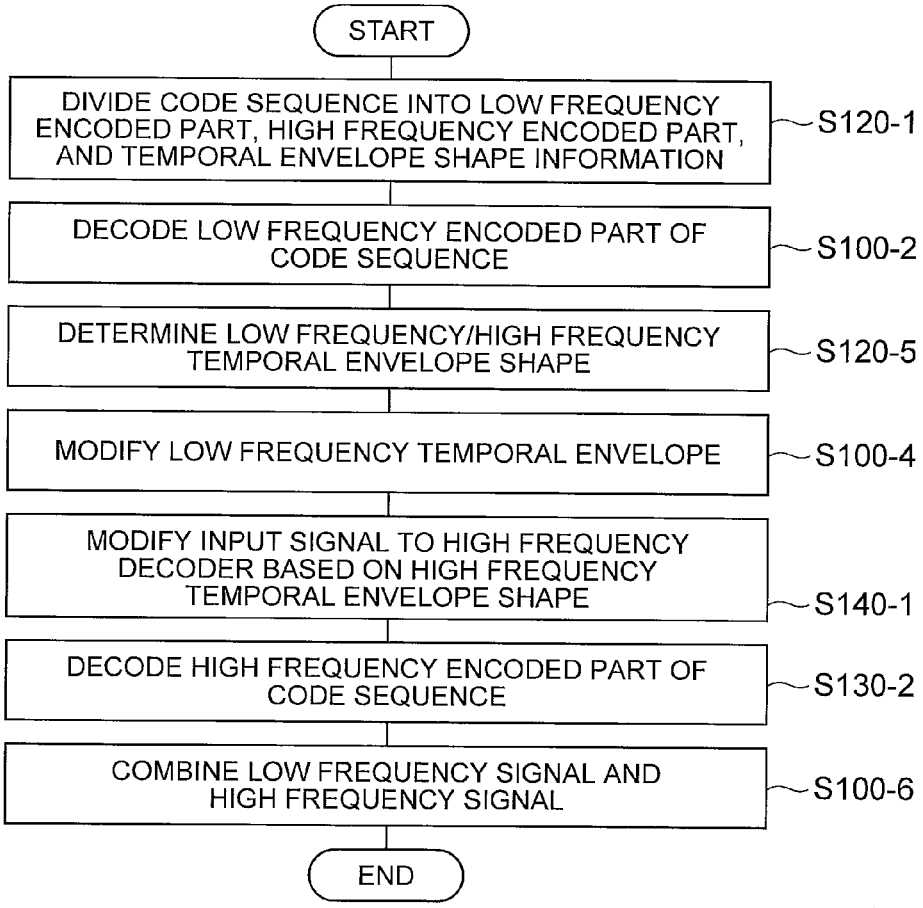
FIG. 74 is a flow chart showing the operation of the tenth modification 140J of the speech decoding device according to the sixth embodiment.

FIG. 74 is a flowchart showing the operation of the tenth modification 140J of the speech decoding device according to the sixth embodiment.

The present modification differs from the first modification 140A of the speech decoding device according to the sixth embodiment in that it includes a temporal envelope shape determiner 120*f* in place of the low frequency temporal envelope shape determiner 100*c* and the high frequency temporal envelope shape determiner 120*b*.

Eleventh Modification of Speech Decoding Device of Sixth Embodiment

Figure 75:
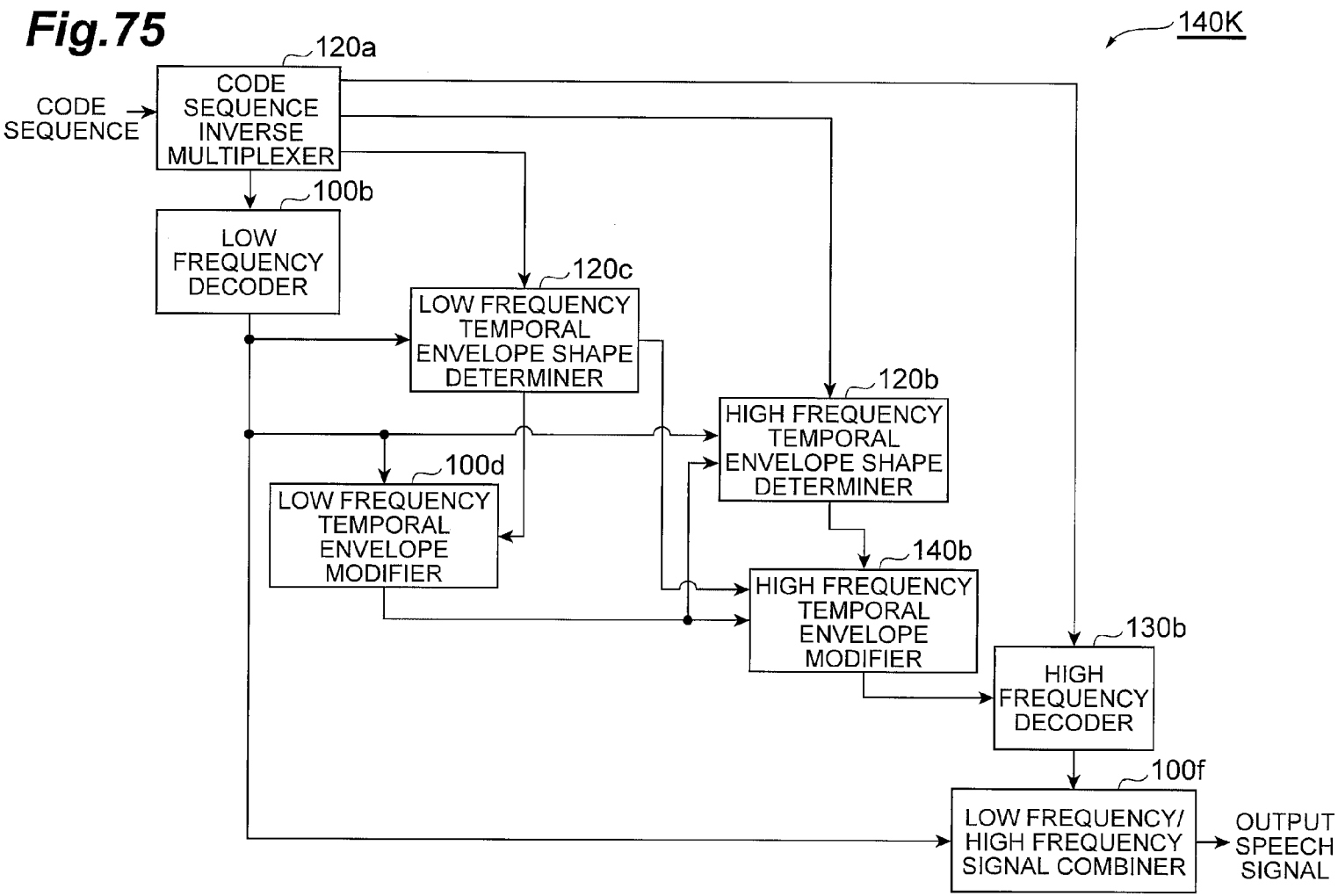
FIG. 75 is a figure showing the configuration of the 11th modification 140K of the speech decoding device according to the sixth embodiment.

FIG. 75 is a diagram showing the configuration of an eleventh modification 140K of the speech decoding device according to the sixth embodiment.

Figure 76:
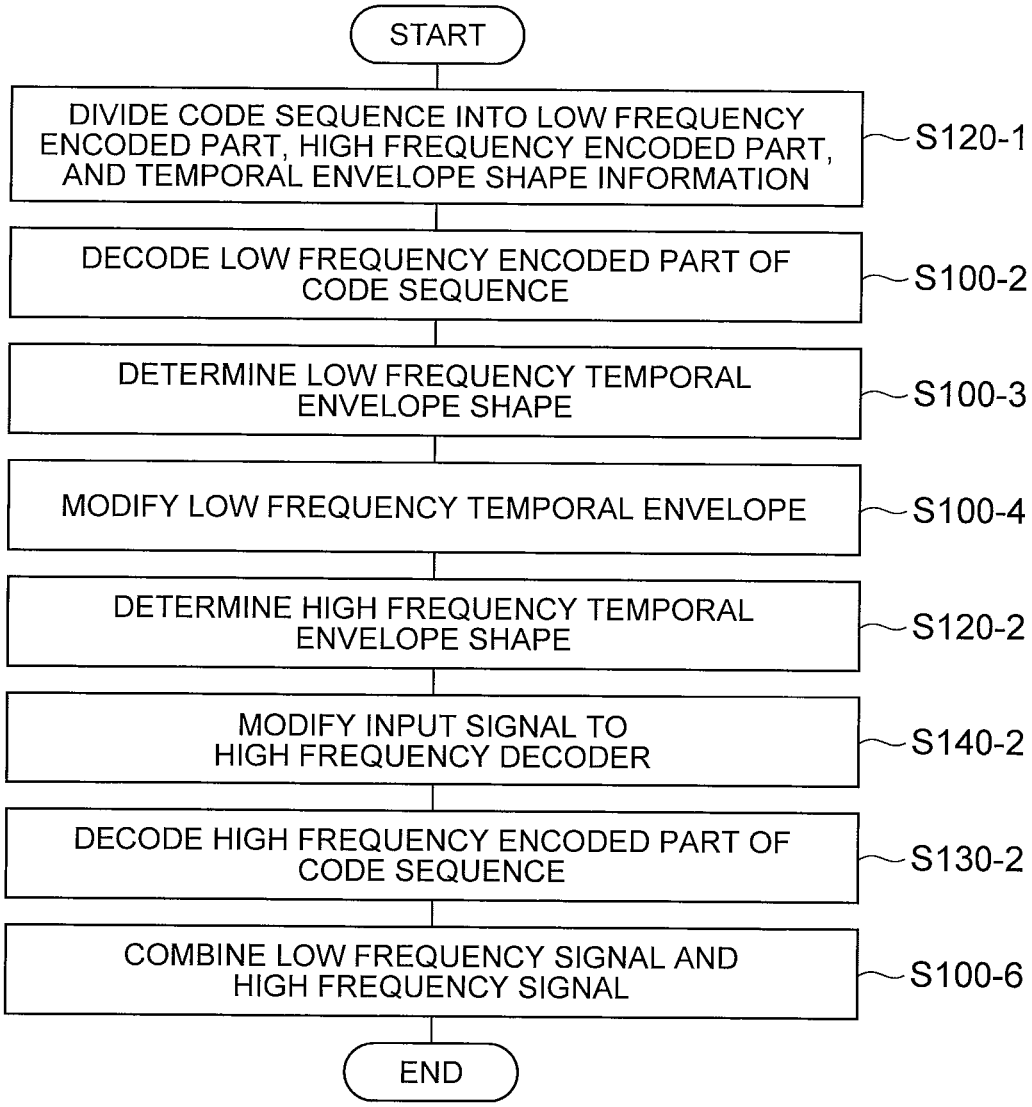
FIG. 76 is a flow chart showing the operation of the 11th modification 140K of the speech decoding device according to the sixth embodiment.

FIG. 76 is a flowchart showing the operation of the eleventh modification 140K of the speech decoding device according to the sixth embodiment.

The present modification differs from the second modification 140B of the speech decoding device according to the sixth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 140*a*.

Twelfth Modification of Speech Decoding Device of Sixth Embodiment

Figure 77:
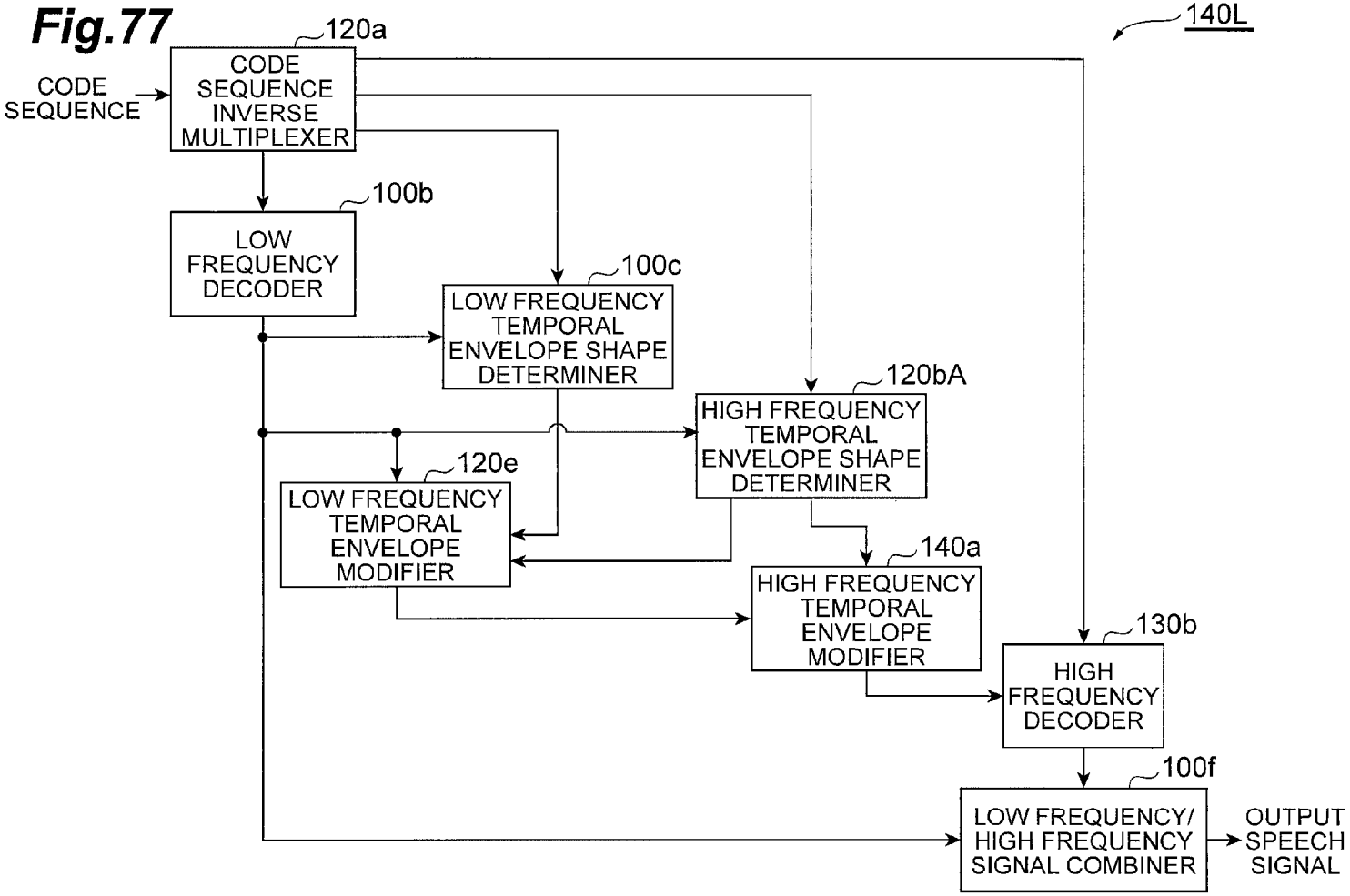
FIG. 77 is a figure showing the configuration of the 12th modification 140L of the speech decoding device according to the sixth embodiment.

FIG. 77 is a diagram showing the configuration of a twelfth modification 140L of the speech decoding device according to the sixth embodiment.

Figure 78:
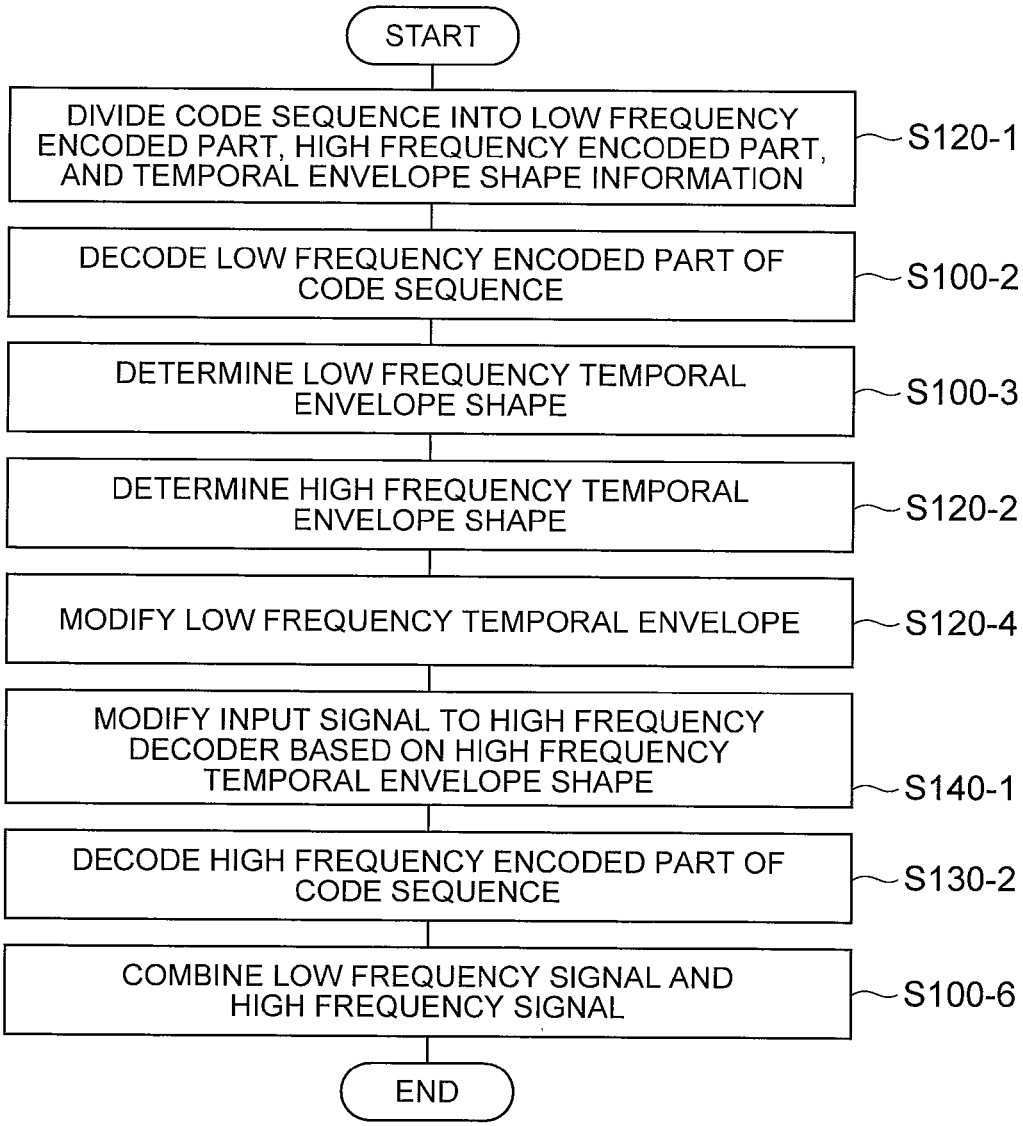
FIG. 78 is a flow chart showing the operation of the 12th modification 140L of the speech decoding device according to the sixth embodiment.

FIG. 78 is a flowchart showing the operation of the twelfth modification 140L of the speech decoding device according to the sixth embodiment.

The present modification differs from the second modification 140B of the speech decoding device according to the sixth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Thirteenth Modification of Speech Decoding Device of Sixth Embodiment

Figure 79:
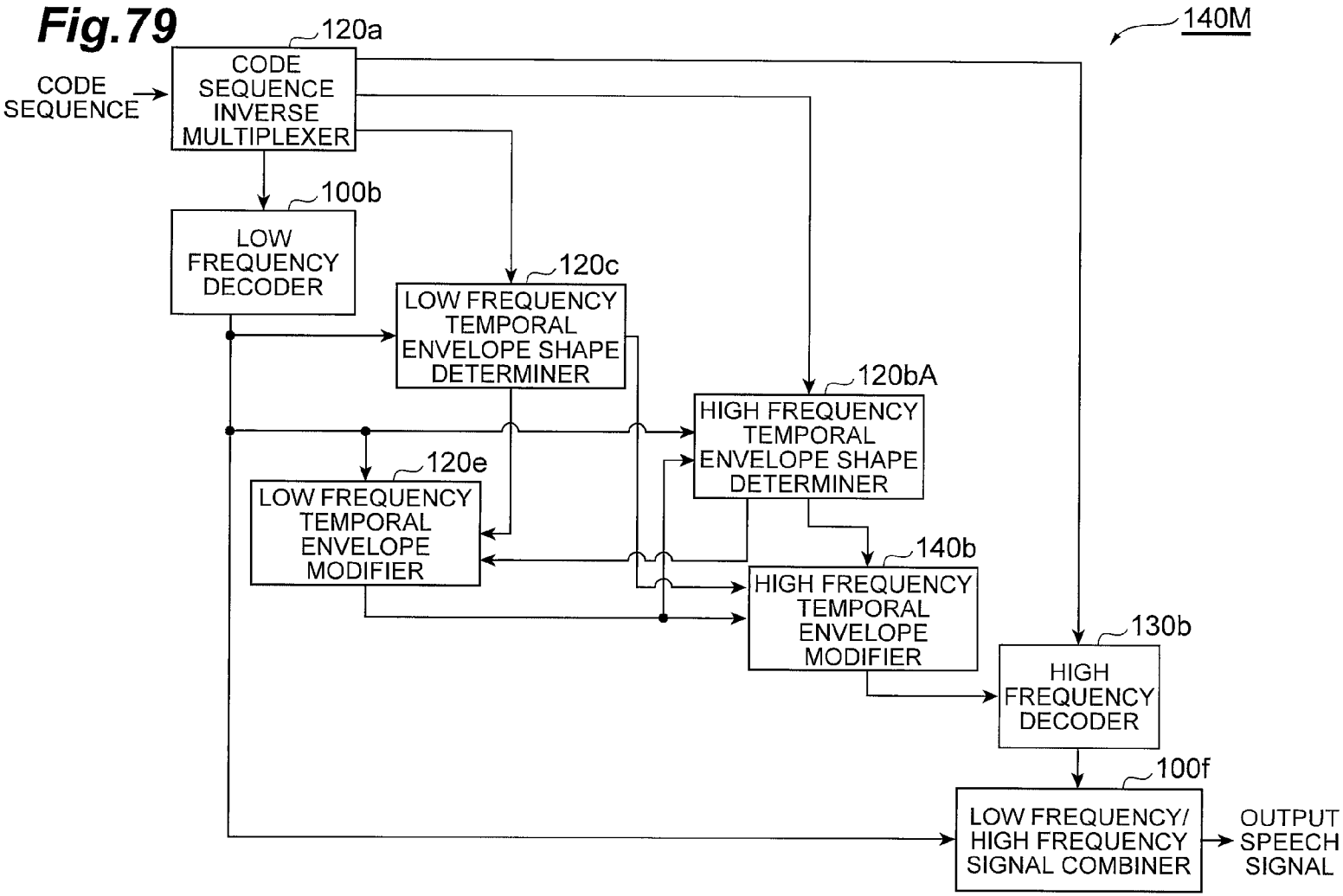
FIG. 79 is a figure showing the configuration of the 13th modification 140M of the speech decoding device according to the sixth.

FIG. 79 is a diagram showing the configuration of a thirteenth modification 140M of the speech decoding device according to the sixth embodiment.

Figure 80:
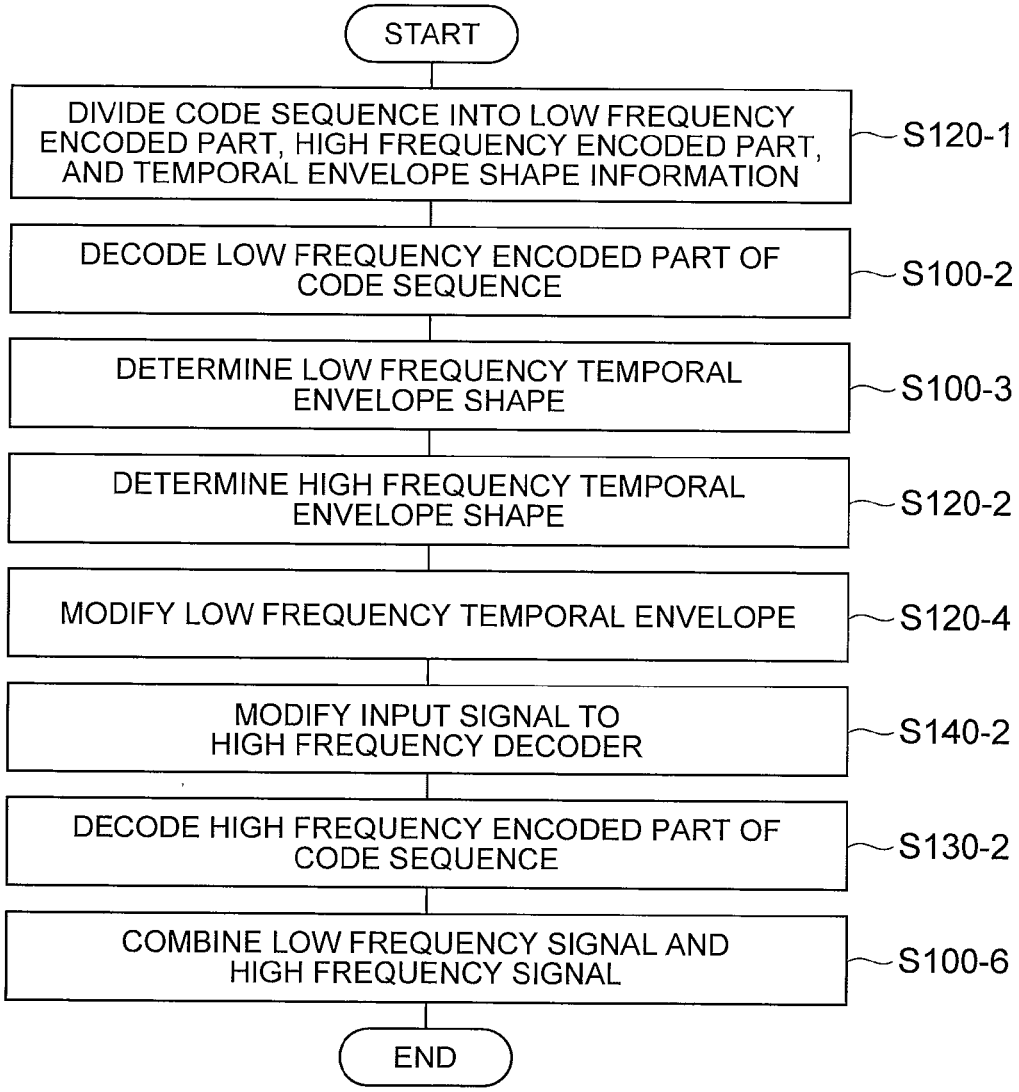
FIG. 80 is a flow chart showing the operation of the 13th modification 140M of the speech decoding device according to the sixth embodiment.

FIG. 80 is a flowchart showing the operation of the thirteenth modification 140M of the speech decoding device according to the sixth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Fourteenth Modification of Speech Decoding Device of Sixth Embodiment

Figure 81:
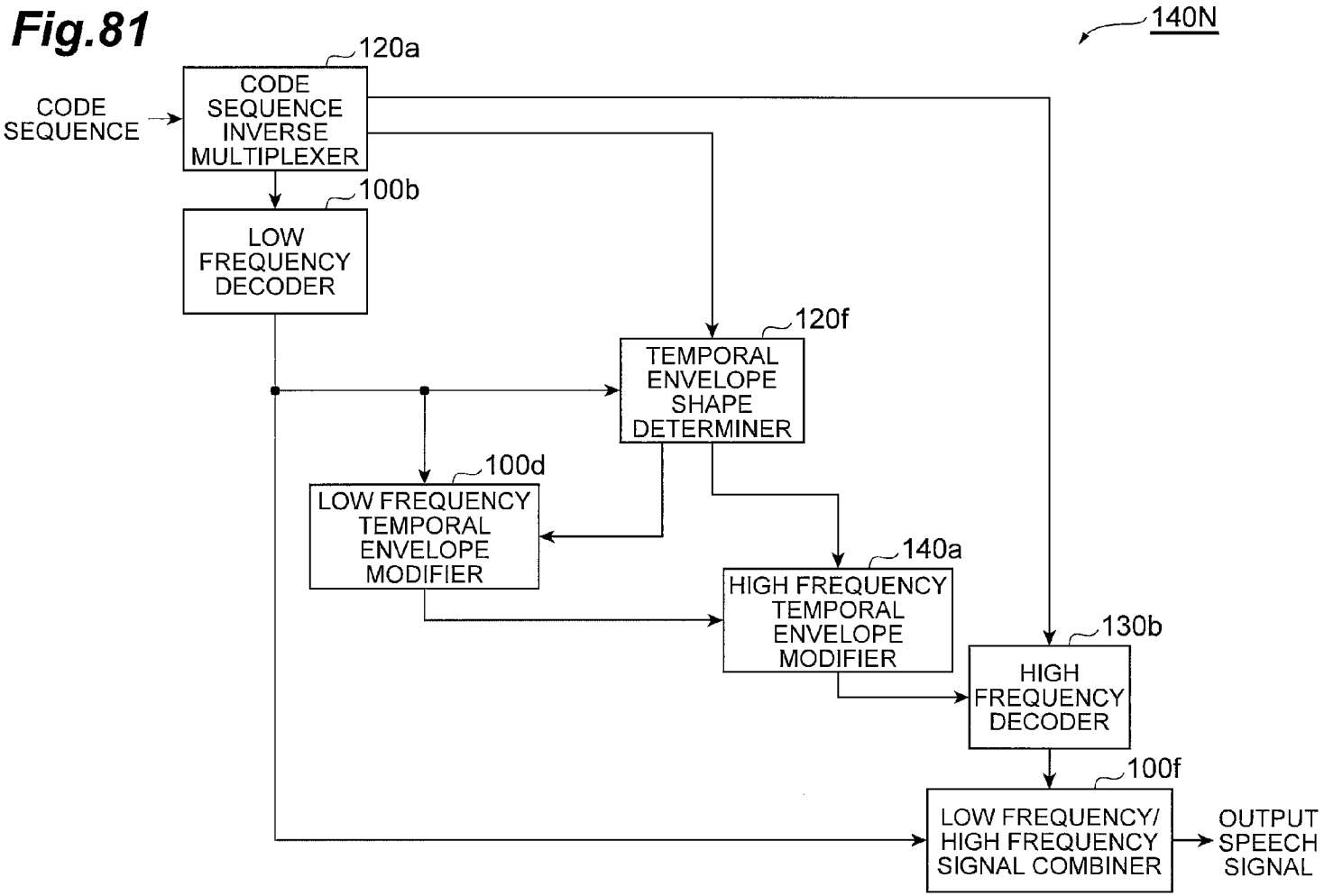
FIG. 81 is a figure showing the configuration of the 14th modification 140N of the speech decoding device according to the sixth embodiment.

FIG. 81 is a diagram showing the configuration of a fourteenth modification 140N of the speech decoding device according to the sixth embodiment.

Figure 82:
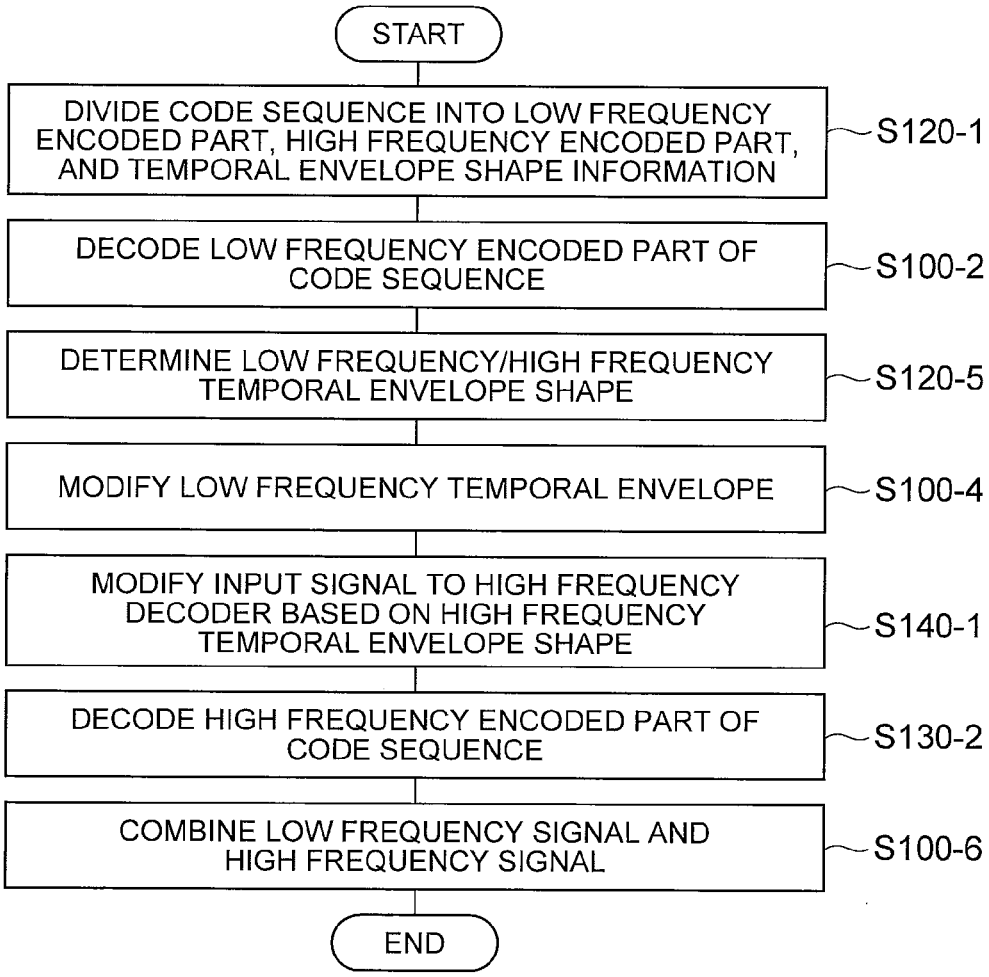
FIG. 82 is a flow chart showing the operation of the 14th modification 140N of the speech decoding device according to the sixth embodiment.

FIG. 82 is a flowchart showing the operation of the fourteenth modification 140N of the speech decoding device according to the sixth embodiment.

The present modification differs from the second modification 140B of the speech decoding device according to the sixth embodiment in that it includes a temporal envelope shape determiner 120*f* in place of the low frequency temporal envelope shape determiner 100*c* and the high frequency temporal envelope shape determiner 120*b*.

Seventh Embodiment

Figure 83:
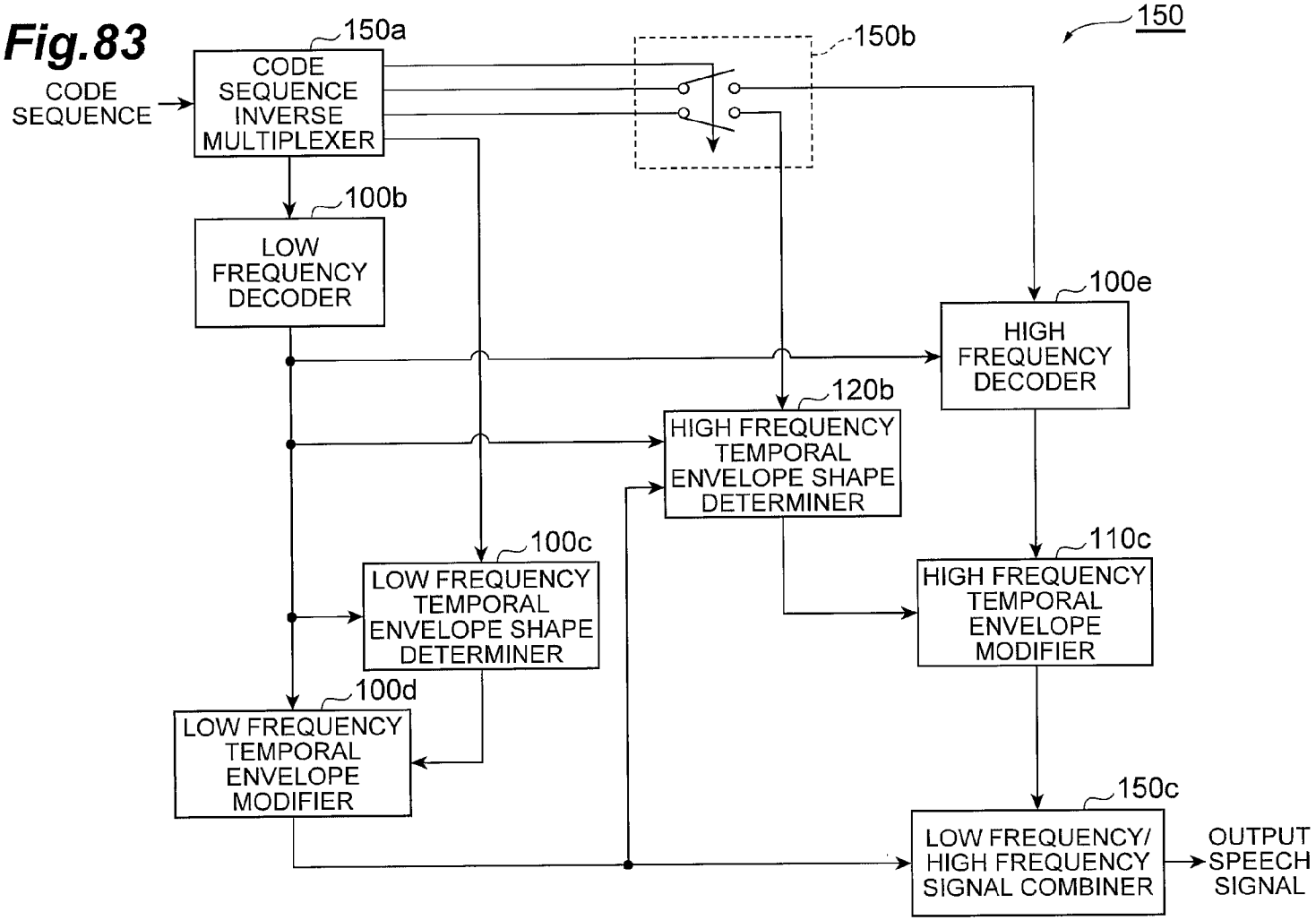
FIG. 83 is a figure showing the configuration of the speech decoding device 150 according to a seventh embodiment.

FIG. 83 is a diagram showing the configuration of a speech decoding device 150 according to a seventh embodiment. A communication device of the speech decoding device 150 receives a multiplexed code sequence output from a speech encoding device 250 described below and outputs a decoded speech signal to the outside. As shown in FIG. 83, the speech decoding device 150 functionally includes a code sequence demultiplexer 150*a*, switches 150*b*, a low frequency decoder 100*b*, a low frequency temporal envelope shape determiner 100*c*, a low frequency temporal envelope modifier 100*d*, a high frequency decoder 100*e*, a high frequency temporal envelope shape determiner 120*b*, a high frequency temporal envelope modifier 110*c*, and a low frequency/high frequency signal combiner 150*c*.

Figure 84:
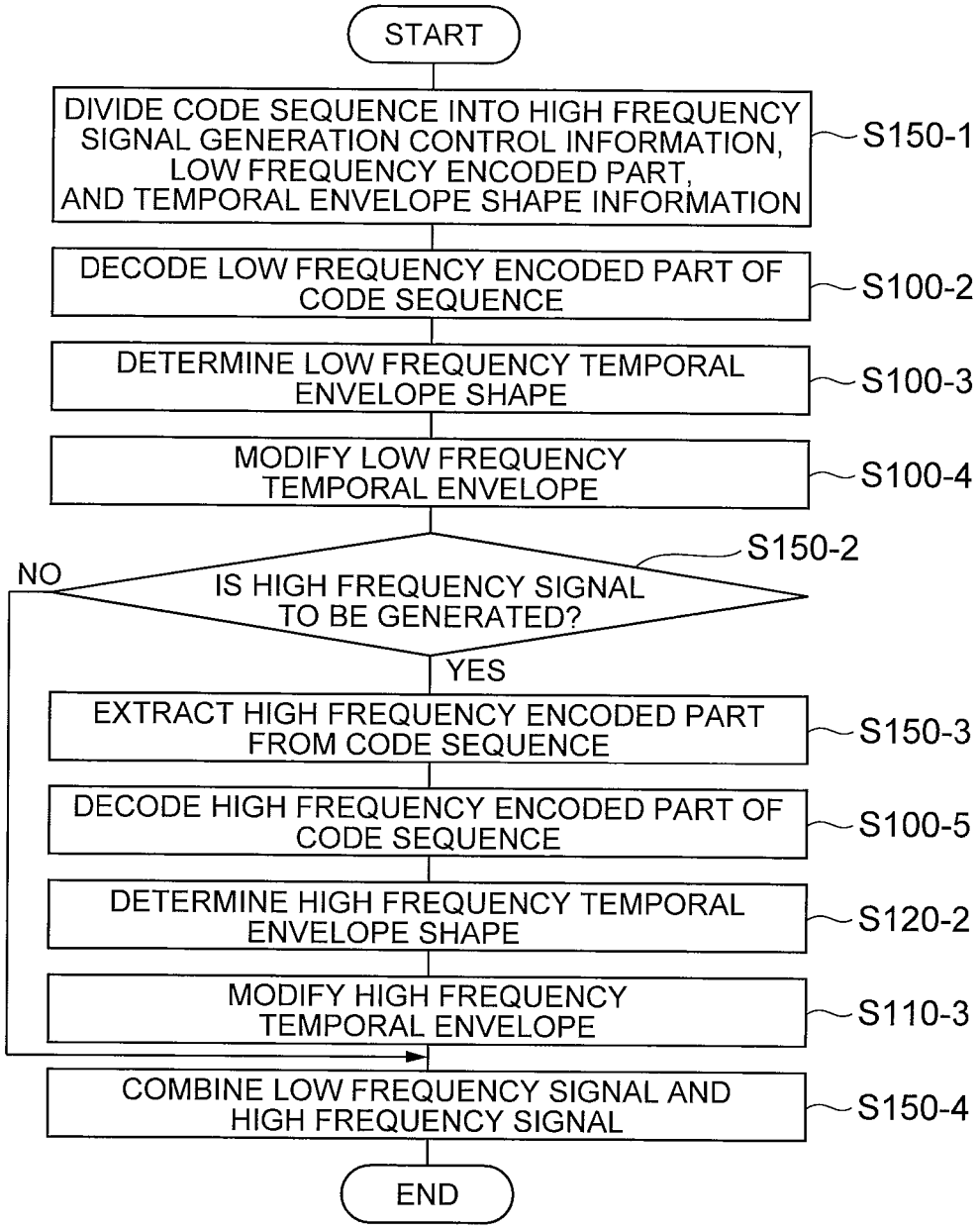
FIG. 84 is a flow chart showing the operation of the speech decoding device according to the seventh embodiment.

FIG. 84 is a flowchart showing the operation of the speech decoding device according to the seventh embodiment.

The code sequence demultiplexer 150*a* divides a code sequence into high frequency signal generation control information, a low frequency encoded part, and information about the temporal envelope shape (step S150-1).

It is determined whether to generate a high frequency signal, based on the high frequency signal generation control information obtained in the code sequence demultiplexer 150*a* (step S150-2).

If a high frequency signal is to be generated, the code sequence demultiplexer 150*a* extracts a high frequency encoded part from the code sequence (step S150-3). A high frequency signal is then generated using the high frequency encoded part of the code sequence, the temporal envelope shape of the high frequency signal is determined, and the temporal envelope shape of the high frequency signal is modified.

The order in which the processing in step S150-2 and S150-3 is performed is not limited to the order illustrated in the flowchart in FIG. 84 as long as it is before the determination of the high frequency temporal envelope shape and the decoding of the high frequency encoded part.

If it is determined to generate a high frequency signal based on the high frequency signal generation information, the low frequency/high frequency signal combiner 150*c* synthesizes an output speech signal from the low frequency signal whose temporal envelope shape is modified and the high frequency signal whose temporal envelope shape is modified. If it is determined not to generate a high frequency signal based on the high frequency signal generation information, the low frequency/high frequency signal combiner 150*c* synthesizes an output speech signal from the low frequency signal whose temporal envelope shape is modified (step S150-4). However, even when it is determined not to generate a high frequency signal, if the low frequency signal, whose temporal envelope shape is modified, is input in a state ready for output to low frequency/high frequency signal combiner 150*c*, the input low frequency signal can be optionally output as it is.

Figure 85:
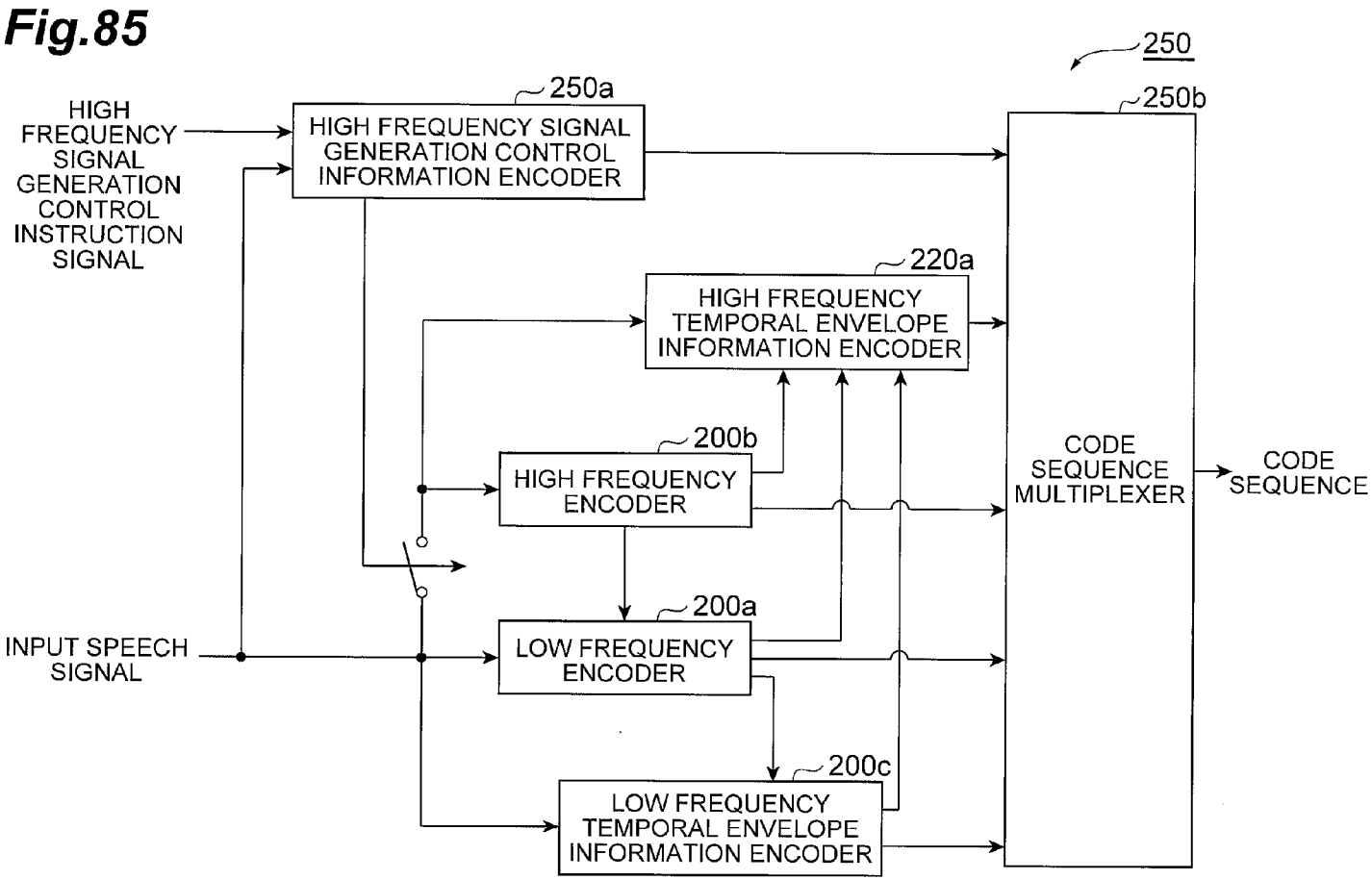
FIG. 85 is a figure showing the configuration of the speech to digital converter 250 according to the seventh embodiment.

FIG. 85 is a diagram showing the configuration of the speech encoding device 250 according to the seventh embodiment. A communication device of the speech encoding device 250 receives a speech signal to be encoded from the outside and outputs the encoded code sequence to the outside. As shown in FIG. 85, the speech encoding device 250 functionally includes a high frequency signal generation control information encoder 250*a*, a low frequency encoder 200*a*, a high frequency encoder 200*b*, a low frequency temporal envelope information encoder 200*c*, a high frequency temporal envelope information encoder 220*a*, and a code sequence multiplexer 250*b*.

Figure 86:
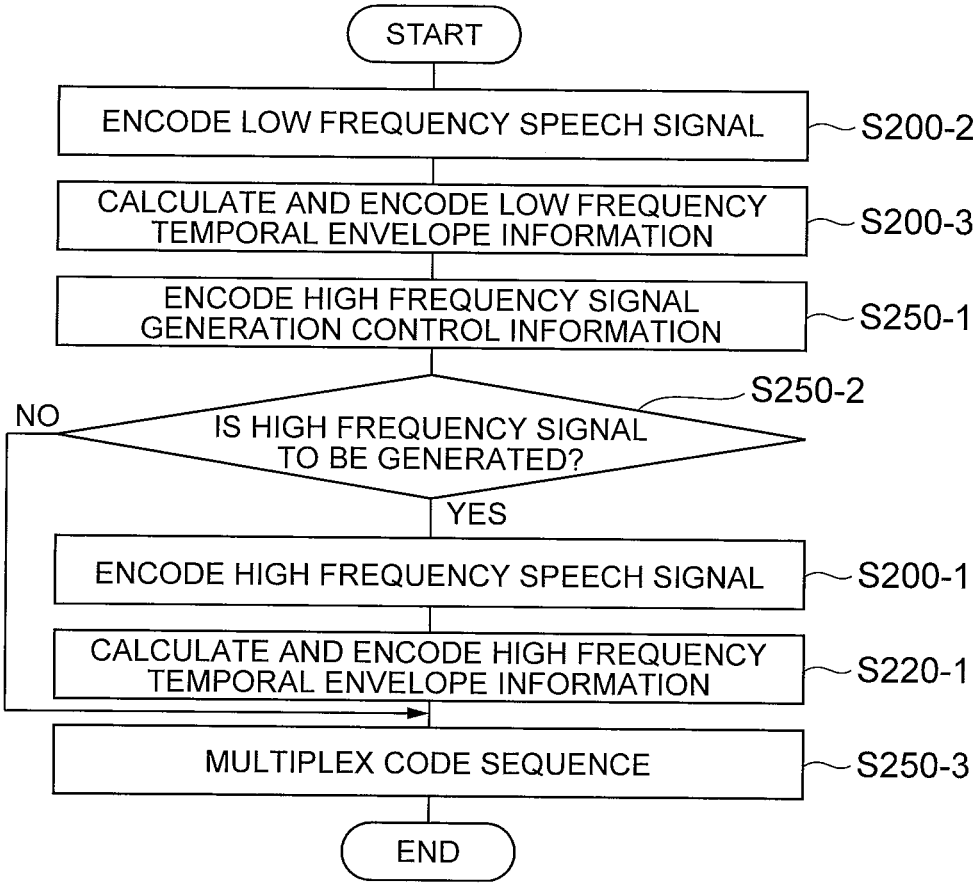
FIG. 86 is a flow chart showing the operation of the speech to digital converter 250 according to the seventh embodiment.

FIG. 86 is a flowchart showing the operation of the speech encoding device 250 according to the seventh embodiment.

The high frequency signal generation control information encoder 250*a* determines whether to generate a high frequency signal based on at least one of an input speech signal and a high frequency signal generation control instruction signal and encodes high frequency signal generation control information (step S250-1). For example, if the input speech signal includes a signal in a frequency band to be encoded by the high frequency encoder 200*b*, it can be determined to generate a high frequency signal. For example, if the high frequency signal generation control instruction signal instructs to generate a high frequency signal, it can be determined to generate a high frequency signal. For example, these two methods can be combined, and, for example, if at least one of these two methods decides to generate a high frequency signal, it can be determined to generate a high frequency signal.

The high frequency signal generation control information can be encoded, for example, by one bit representing whether to generate a high frequency signal.

The method of determining whether to generate a high frequency signal and the method of encoding the high frequency signal generation control information are not limited.

If the high frequency signal generation control information encoder 250*a* determines to generate a high frequency signal, the high frequency encoder 200*b* encodes a high frequency signal corresponding to the high frequency component of the input speech signal, and the high frequency temporal envelope information encoder 220*a* calculates and encodes high frequency temporal envelope shape information. By contrast, if the high frequency signal generation control information encoder 250*a* determines not to generate a high frequency signal, the encoding of the high frequency signal and the calculation and encoding of high frequency temporal envelope shape information are not carried out (step S250-2).

The code sequence multiplexer 250*c* receives the encoded high frequency signal generation control information from the high frequency signal generation control information encoder 250*a*, receives the code sequence of the low frequency speech signal from the low frequency encoder 200*a*, receives the encoded low frequency temporal envelope shape information from the low frequency temporal envelope information encoder 200*c*, additionally receives the code sequence of the high frequency speech signal from the high frequency encoder 200*b* and the encoded high frequency temporal envelope shape information from the high frequency temporal envelope information encoder 210*a* if the high frequency signal generation control information encoder 250*a* determines to generate a high frequency signal, and outputs a multiplexed code sequence (step S250-3).

If the high frequency signal generation control information encoder 250*a* determines to generate a high frequency signal, when encoding of the information about the low frequency temporal envelope shape and the information about the high frequency temporal envelope shape, for example, separately encoded information about the low frequency temporal envelope shape and information about the high frequency temporal envelope shape may be received, or unitedly encoded information about the low frequency temporal envelope shape and information about the high frequency temporal envelope shape may be received. For example, information about the low frequency temporal envelope shape and information about the high frequency temporal envelope shape, both being represented by a single piece of information and encoded, may be received.

First Modification of Speech Decoding Device of Seventh Embodiment

Figure 87:
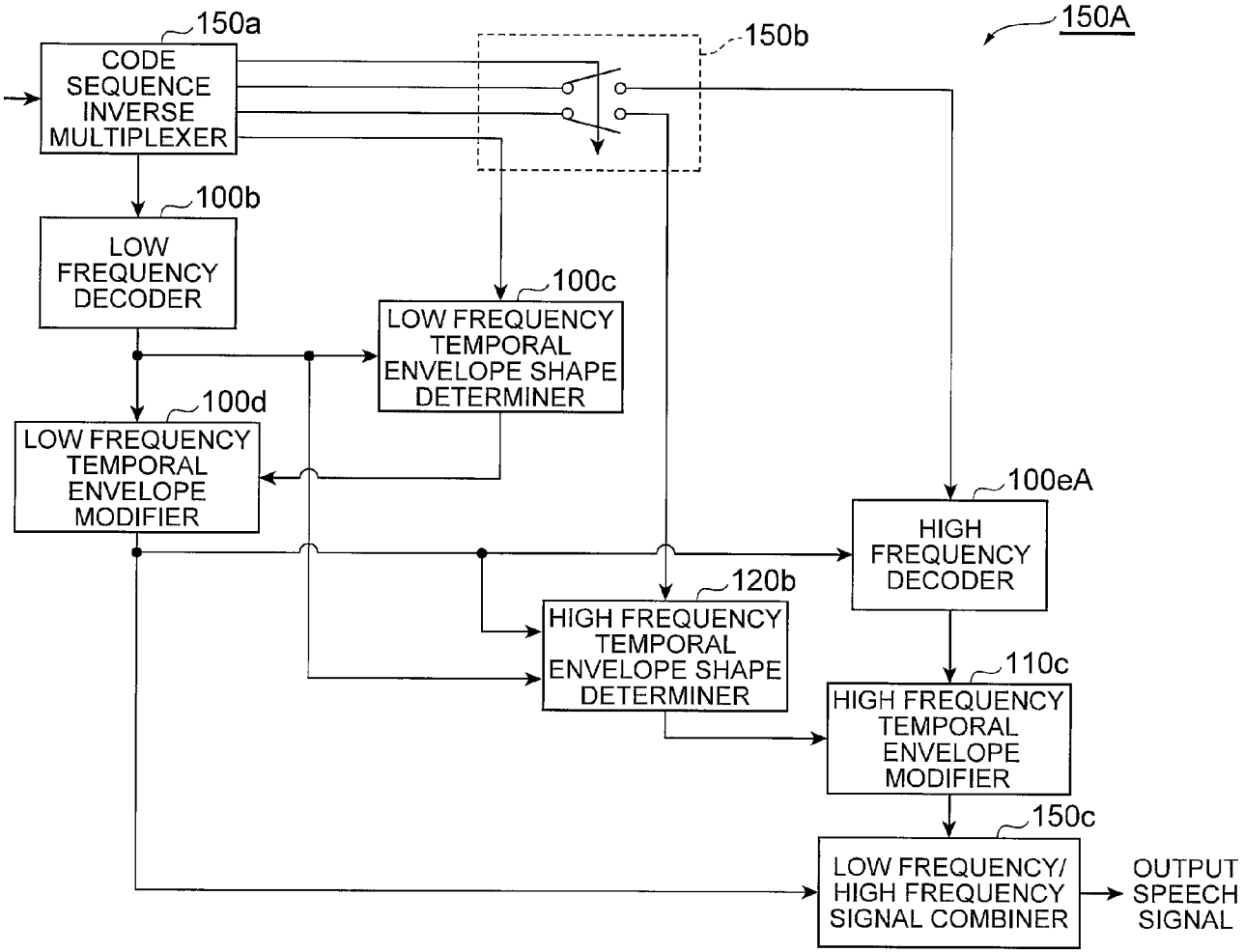
FIG. 87 is a figure showing the configuration of the first modification 150A of the speech decoding device according to the seventh embodiment.

FIG. 87 is a diagram showing the configuration of a first modification 150A of the speech decoding device according to the seventh embodiment.

Figure 88:
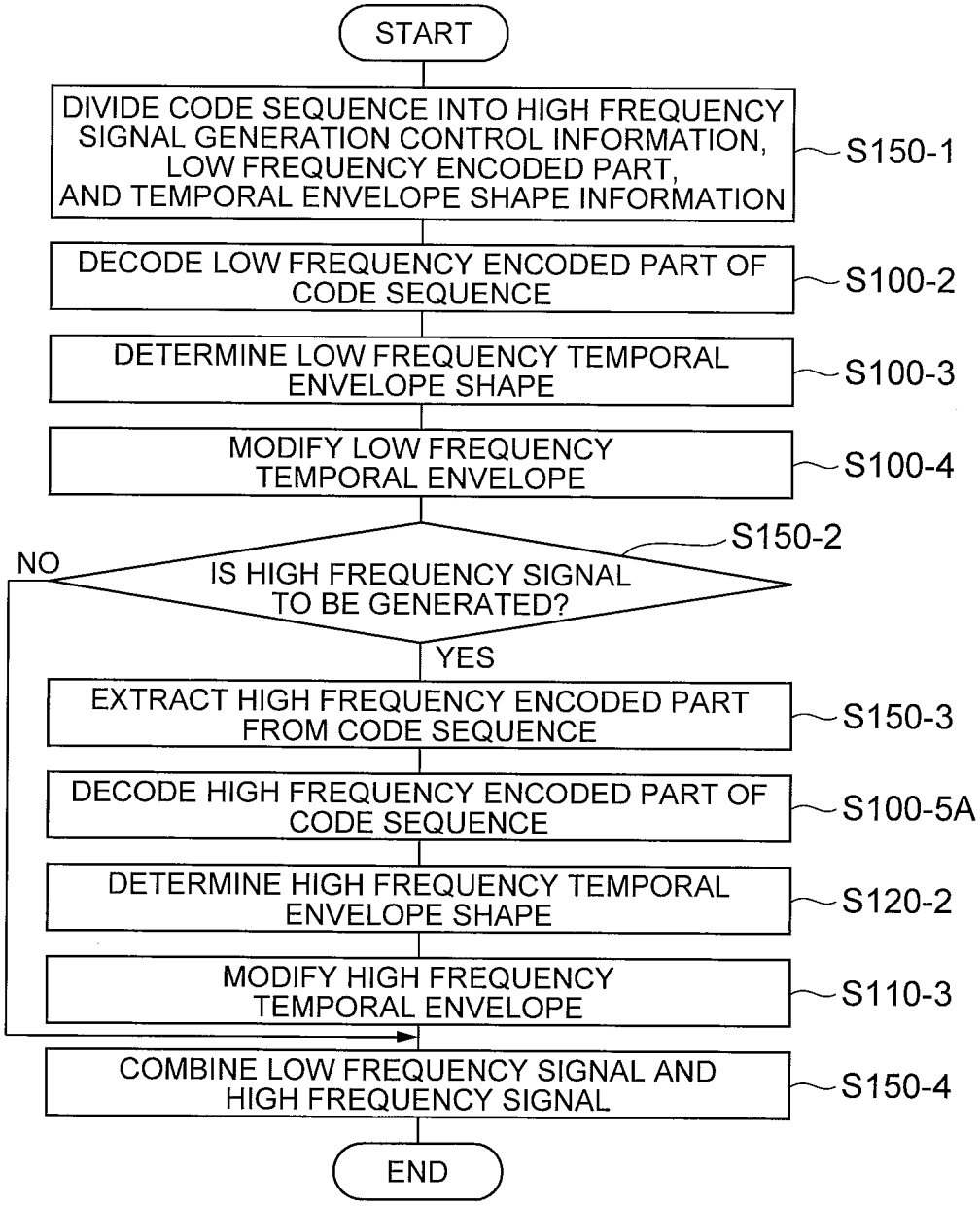
FIG. 88 is a flow chart showing the operation of the first modification 150A of the speech decoding device according to the seventh embodiment.

FIG. 88 is a flowchart showing the operation of the first modification 150A of the speech decoding device according to the seventh embodiment. The difference from the speech decoding device 150 in the seventh embodiment is that the low frequency signal having the temporal envelope shape modified by the low frequency temporal envelope modifier 100*d* is used in decoding a high frequency signal by the high frequency decoder 100*e*A. In step 100-5A in FIG. 88, when the low frequency decoded signal obtained by the low frequency decoder 100*b* is used in decoding a high frequency signal, the low frequency signal having the temporal envelope shape modified by the low frequency temporal envelope modifier 100*d* is used.

The order in which the processing in step S150-2 and S150-3 is performed is not limited to the order illustrated in the flowchart in FIG. 88 as long as it is before the determination of the high frequency temporal envelope shape and the decoding of the high frequency encoded part.

Second Modification of Speech Decoding Device of Seventh Embodiment

Figure 89:
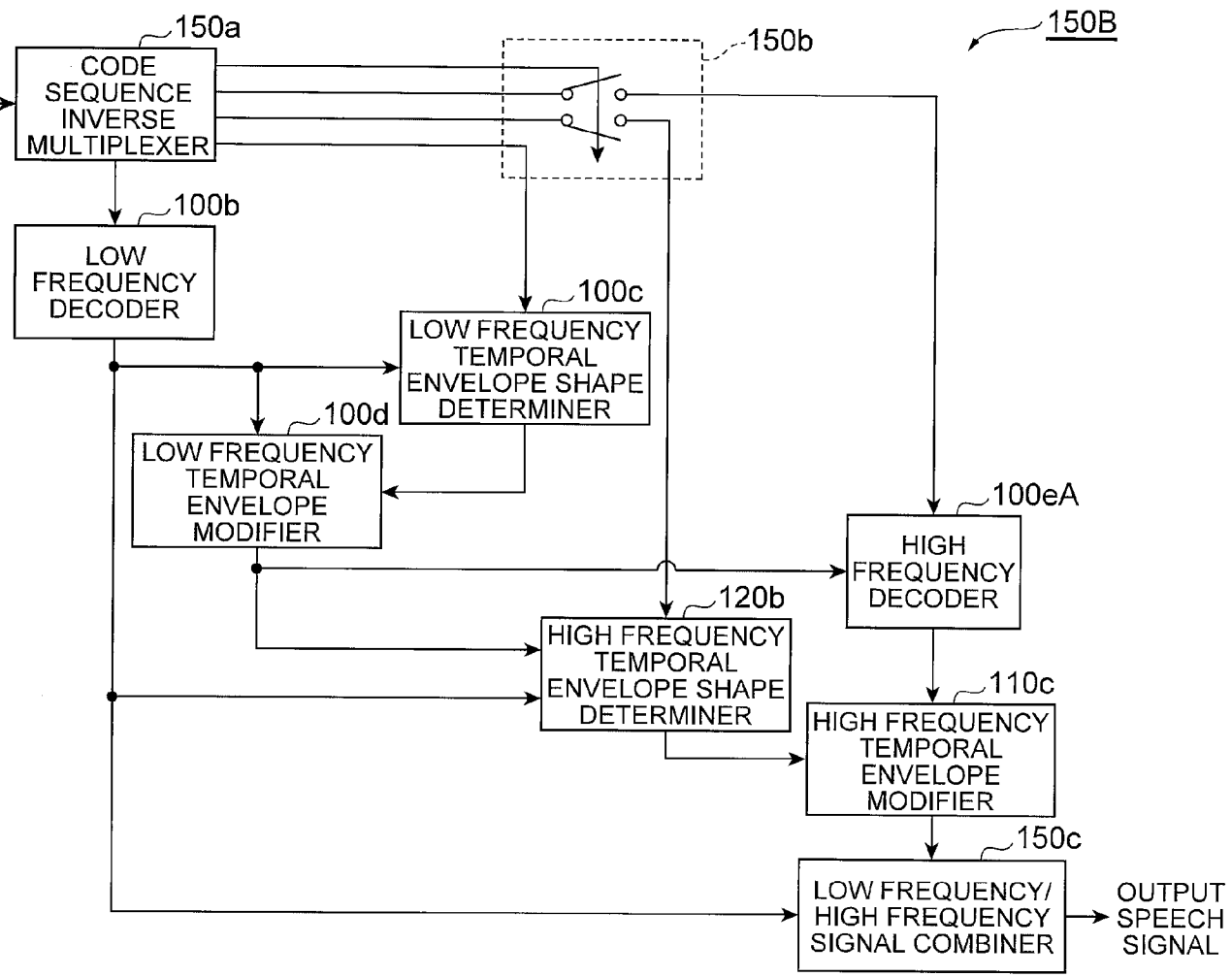
FIG. 89 is a figure showing the configuration of the second modification 150B of the speech decoding device according to the seventh embodiment.

FIG. 89 is a diagram showing the configuration of a second modification 150B of the speech decoding device according to the seventh embodiment. The difference from the first modification of the speech decoding device in the seventh embodiment is that the low frequency signal input to the low frequency/high frequency signal combiner 150*c* is not output from the low frequency temporal envelope modifier 100*d* but output from the low frequency decoder 100*b*.

Third Modification of Speech Decoding Device of Seventh Embodiment

Figure 90:
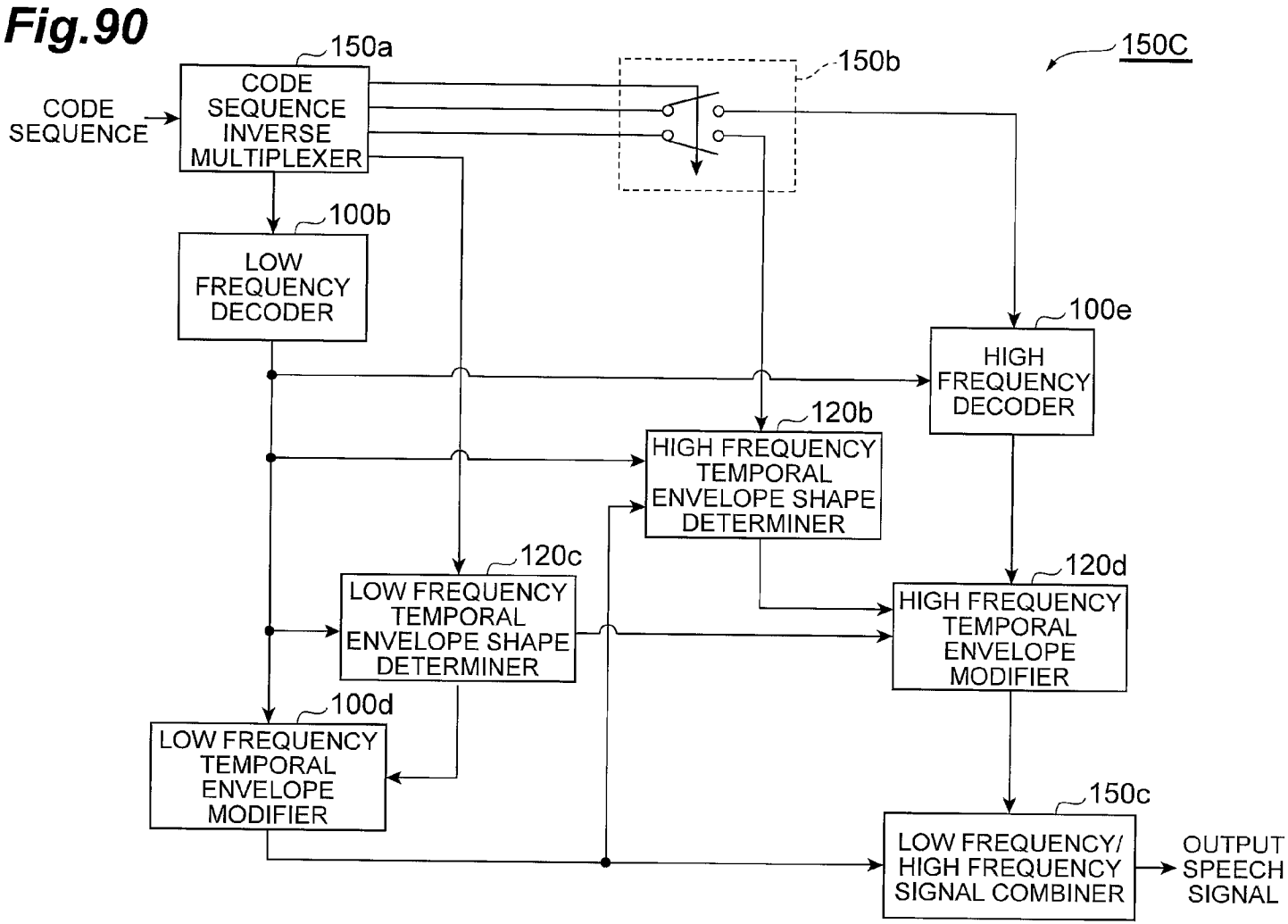
FIG. 90 is a figure showing the configuration of the 3rd modification 150C of the speech decoding device according to the seventh embodiment.

FIG. 90 is a diagram showing the configuration of a third modification 150C of the speech decoding device according to the seventh embodiment.

Figure 91:
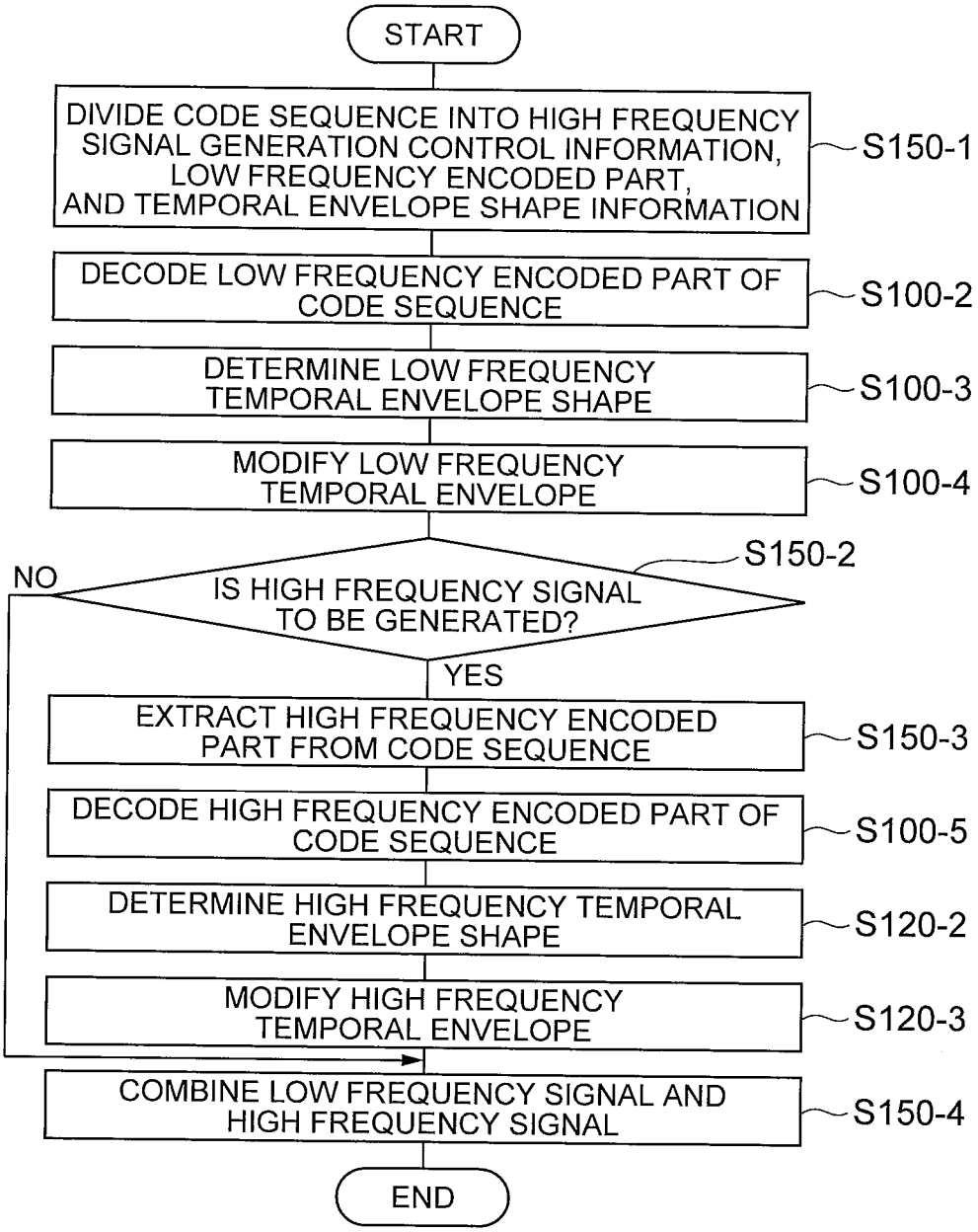
FIG. 91 is a flow chart showing the operation of the 3rd modification 150C of the speech decoding device according to the seventh embodiment.

FIG. 91 is a flowchart showing the operation of the third modification 150C of the speech decoding device according to the seventh embodiment.

The present modification differs from the speech decoding device 150 according to the seventh embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

Fourth Modification of Speech Decoding Device of Seventh Embodiment

Figure 92:
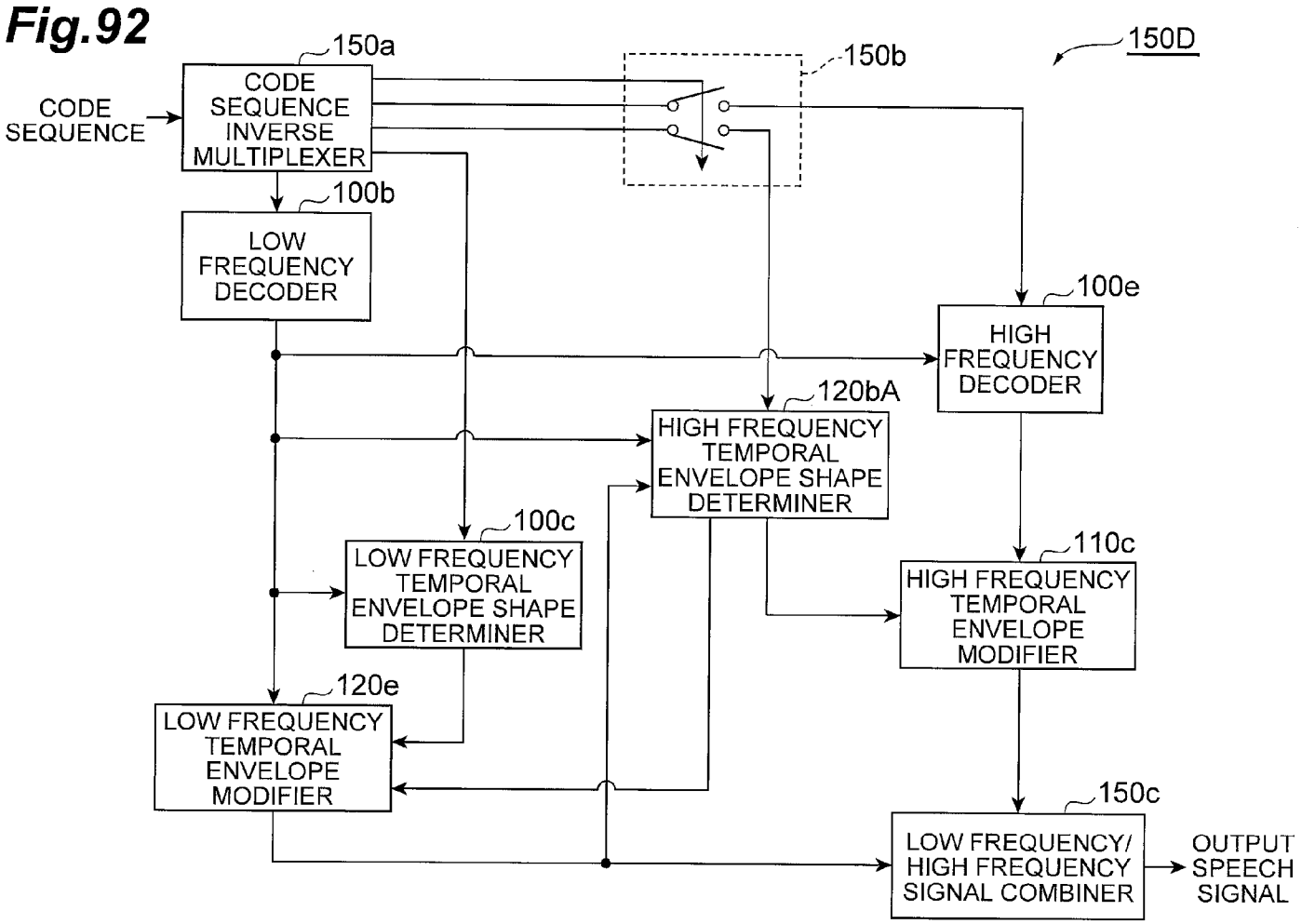
FIG. 92 is a figure showing the configuration of the 4th modification 150D of the speech decoding device according to the seventh embodiment.

FIG. 92 is a diagram showing the configuration of a fourth modification 150D of the speech decoding device according to the seventh embodiment.

Figure 93:
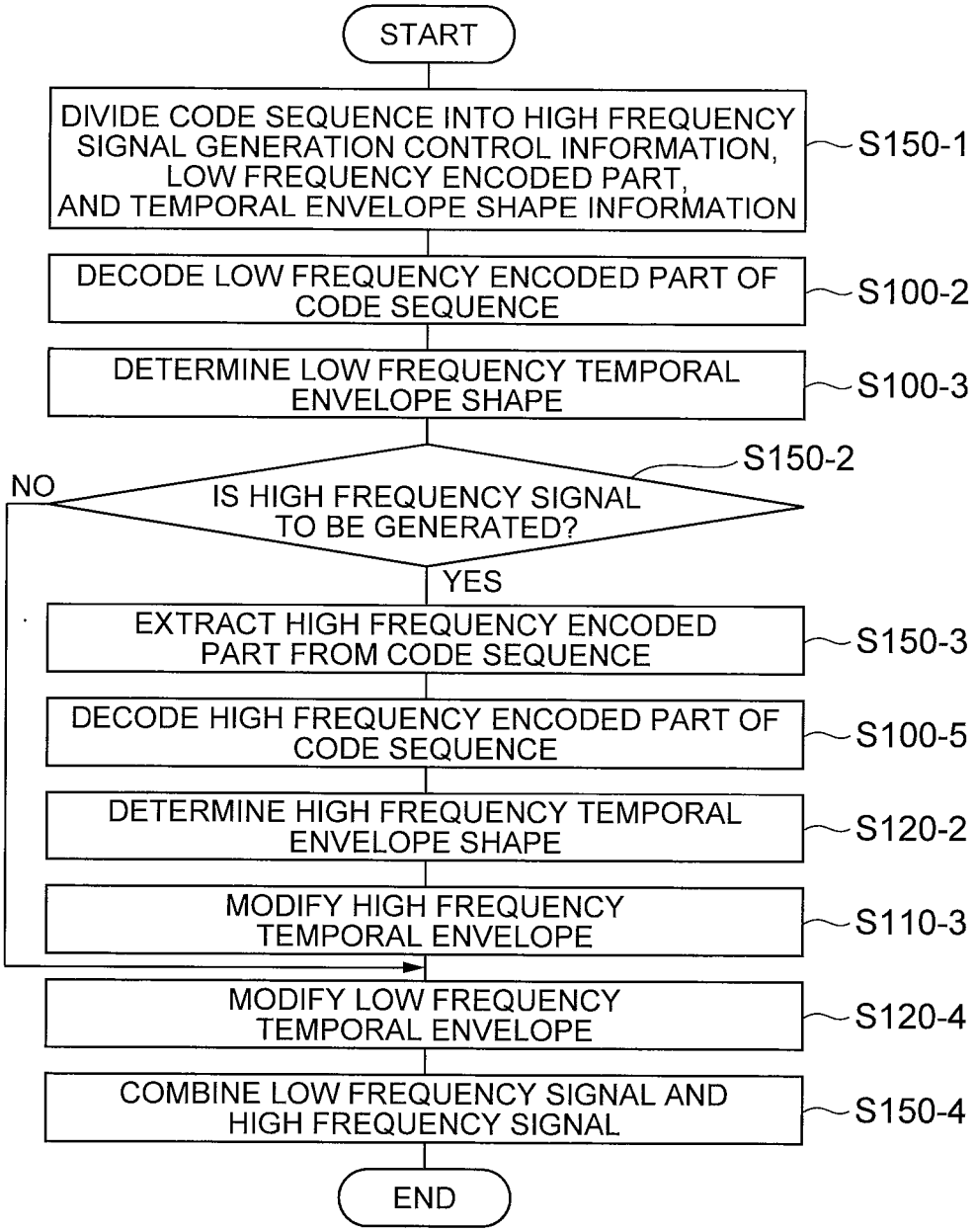
FIG. 93 is a flow chart showing the operation of the 4th modification 150D of the speech decoding device according to the seventh embodiment.

FIG. 93 is a flowchart showing the operation of the fourth modification 150D of the speech decoding device according to the seventh embodiment.

The present modification differs from the speech decoding device 150 according to the seventh embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Fifth Modification of Speech Decoding Device of Seventh Embodiment

Figure 94:
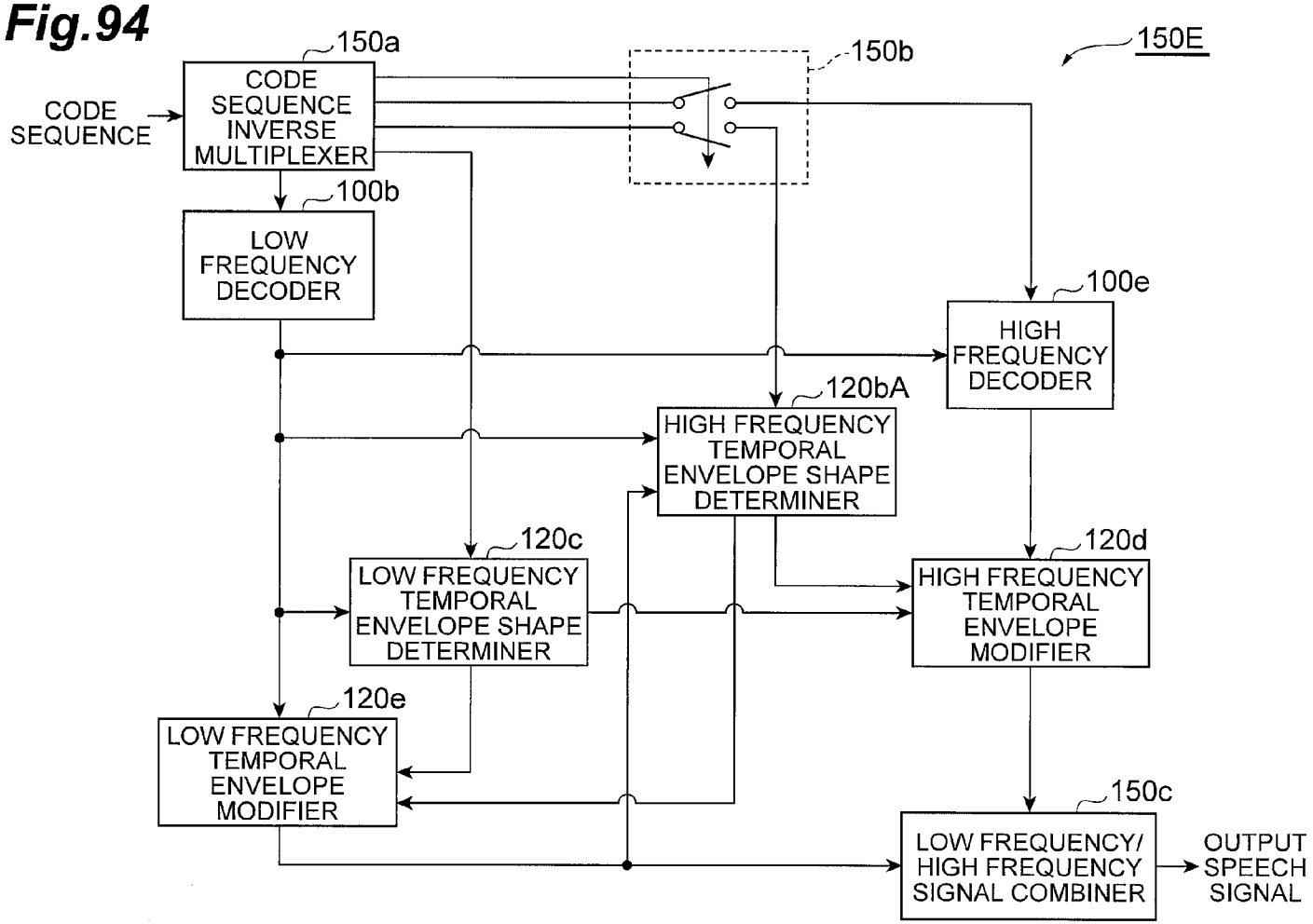
FIG. 94 is a figure showing the configuration of the fifth modification 150E of the speech decoding device according to the seventh embodiment.

FIG. 94 is a diagram showing the configuration of a fifth modification 150E of the speech decoding device according to the seventh embodiment.

Figure 95:
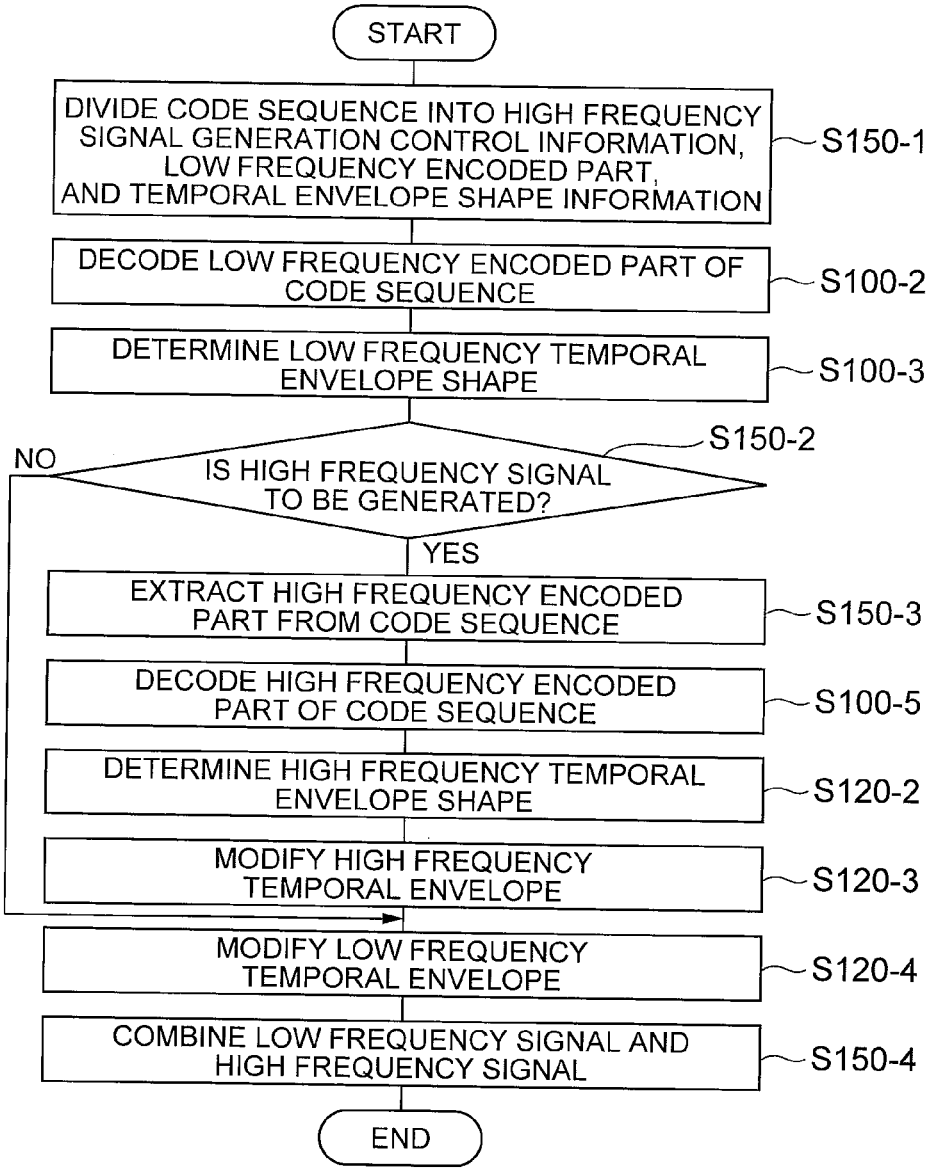
FIG. 95 is a flow chart showing the operation of the fifth modification 150E of the speech decoding device according to the seventh embodiment.

FIG. 95 is a flowchart showing the operation of the fifth modification 150E of the speech decoding device according to the seventh embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Sixth Modification of Speech Decoding Device of Seventh Embodiment

Figure 96:
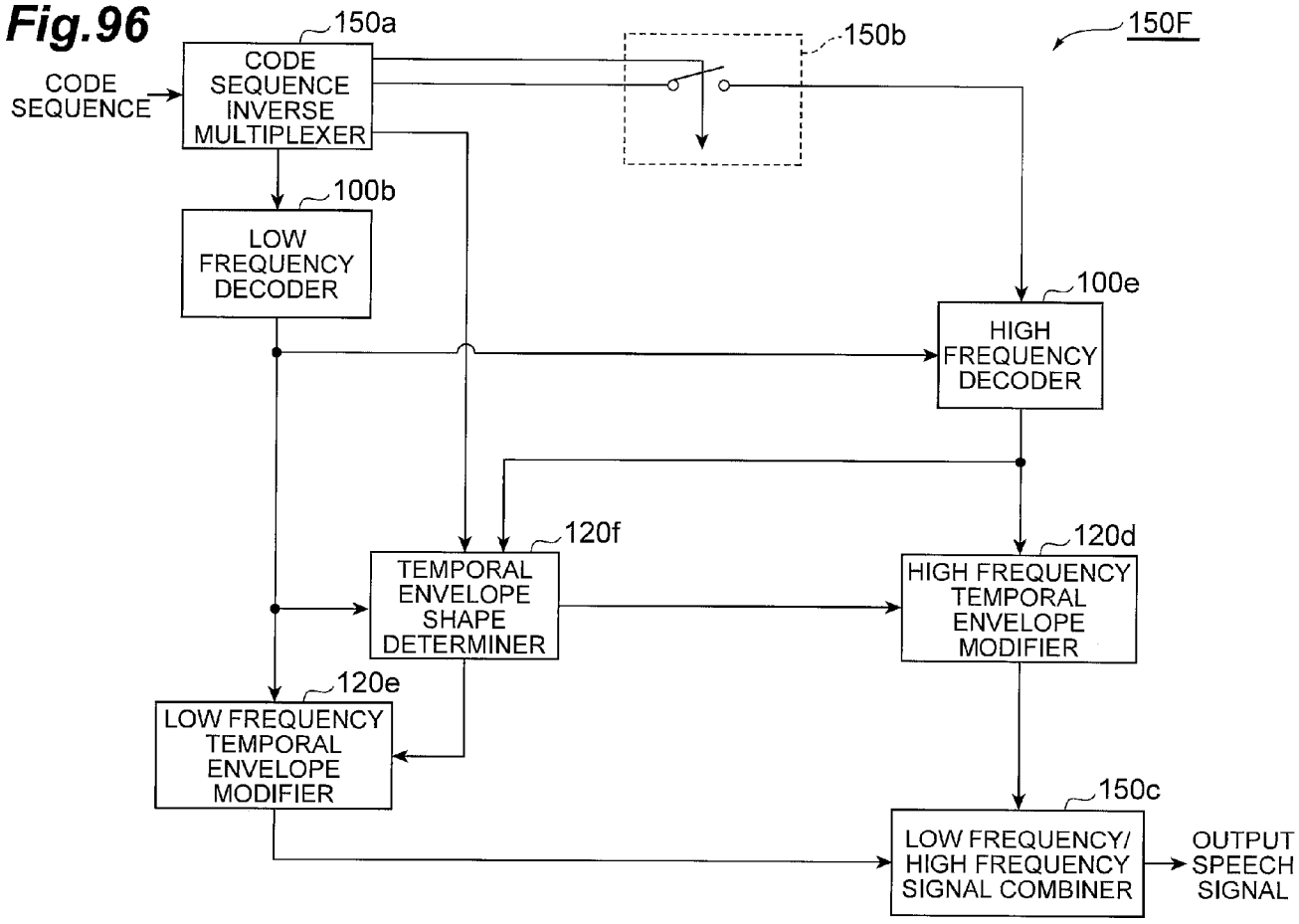
FIG. 96 is a figure showing the configuration of the sixth modification 150F of the speech decoding device according to the seventh embodiment.

FIG. 96 is a diagram showing the configuration of a sixth modification 150F of the speech decoding device according to the seventh embodiment.

Figure 97:
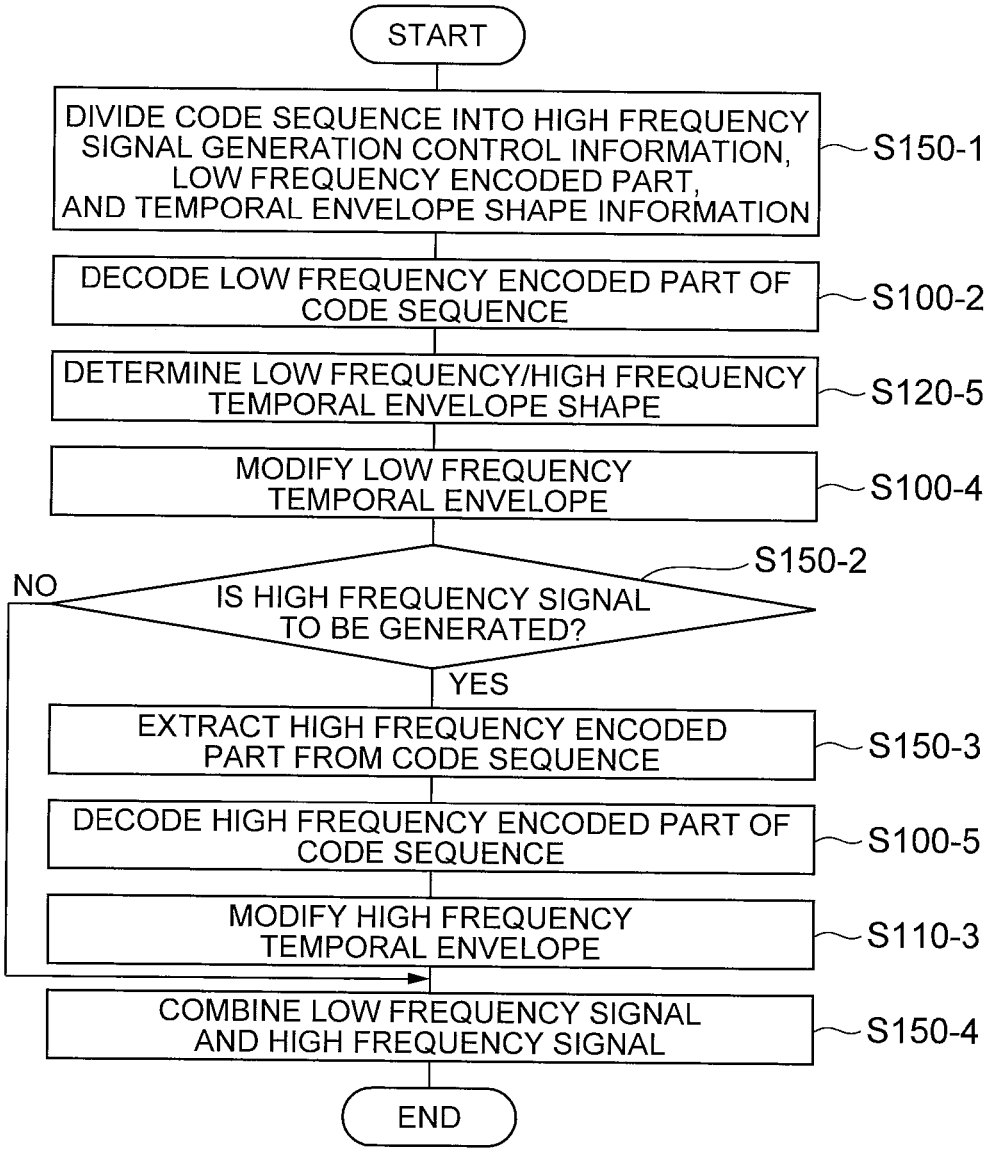
FIG. 97 is a flow chart showing the operation of the sixth modification 150F of the speech decoding device according to the seventh embodiment.

FIG. 97 is a flowchart showing the operation of the sixth modification 150F of the speech decoding device according to the seventh embodiment.

The present modification differs from the speech decoding device 150 according to the seventh embodiment in that it includes a temporal envelope shape determiner 120*f* in place of the low frequency temporal envelope shape determiner 100*c* and the high frequency temporal envelope shape determiner 120*b*.

Seventh Modification of Speech Decoding Device of Seventh Embodiment

Figure 98:
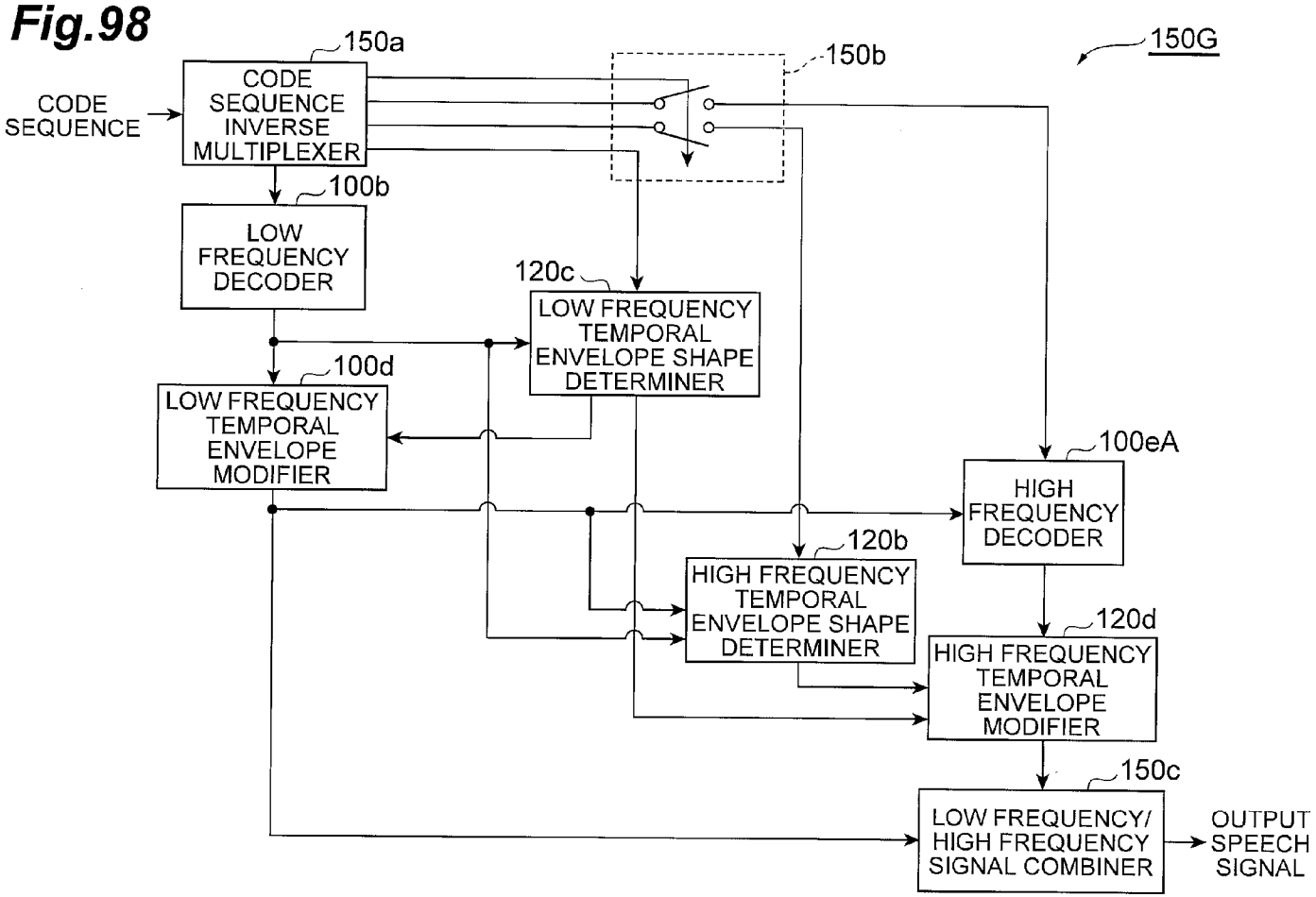
FIG. 98 is a figure showing the configuration of the seventh modification 150G of the speech decoding device according to the seventh embodiment.

FIG. 98 is a diagram showing the configuration of a seventh modification 150G of the speech decoding device according to the seventh embodiment.

Figure 99:
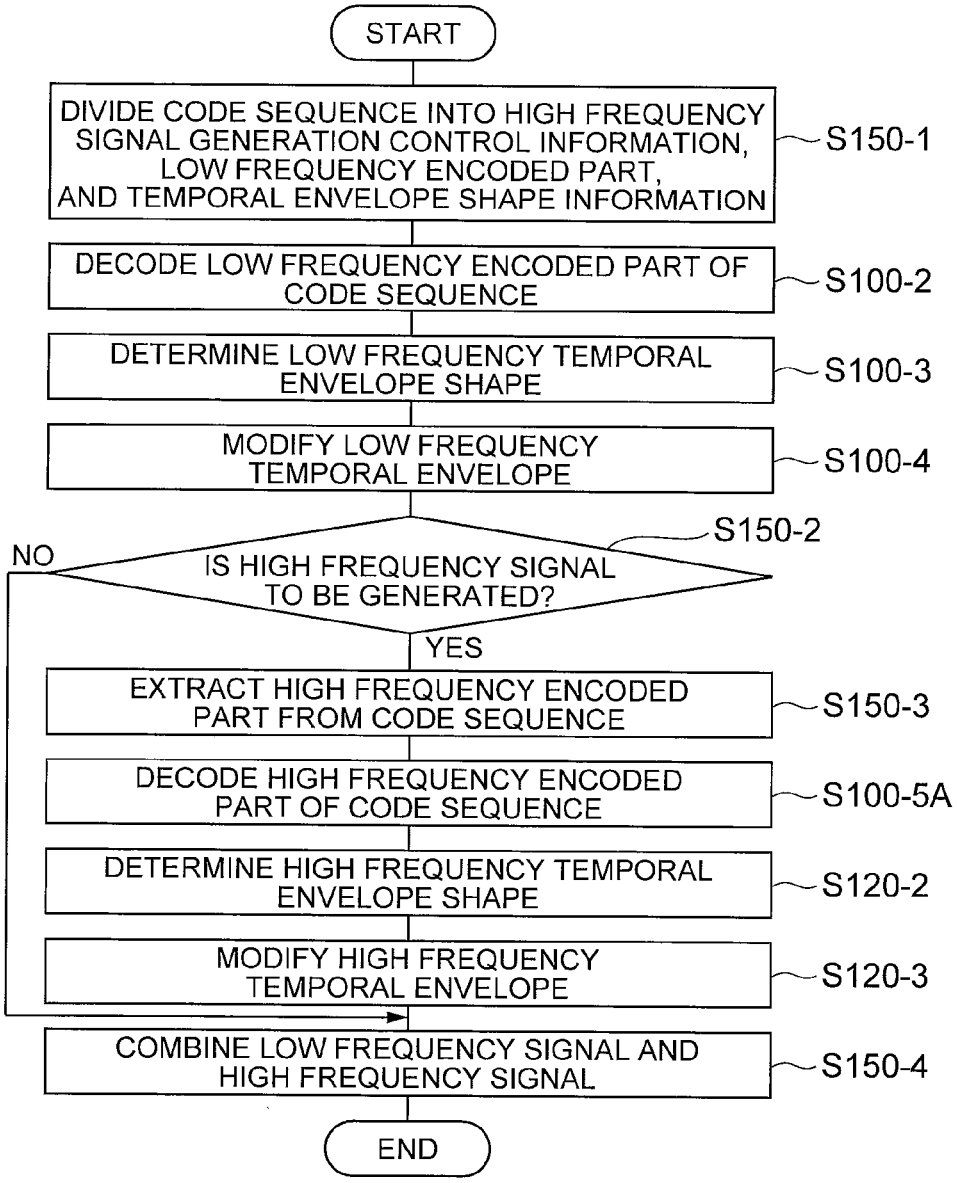
FIG. 99 is a flow chart showing the operation of the seventh modification 150G of the speech decoding device according to the seventh embodiment.

FIG. 99 is a flowchart showing the operation of the seventh modification 150G of the speech decoding device according to the seventh embodiment.

The present modification differs from the first modification 150A of the speech decoding device according to the seventh embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

Eighth Modification of Speech Decoding Device of Seventh Embodiment

Figure 100:
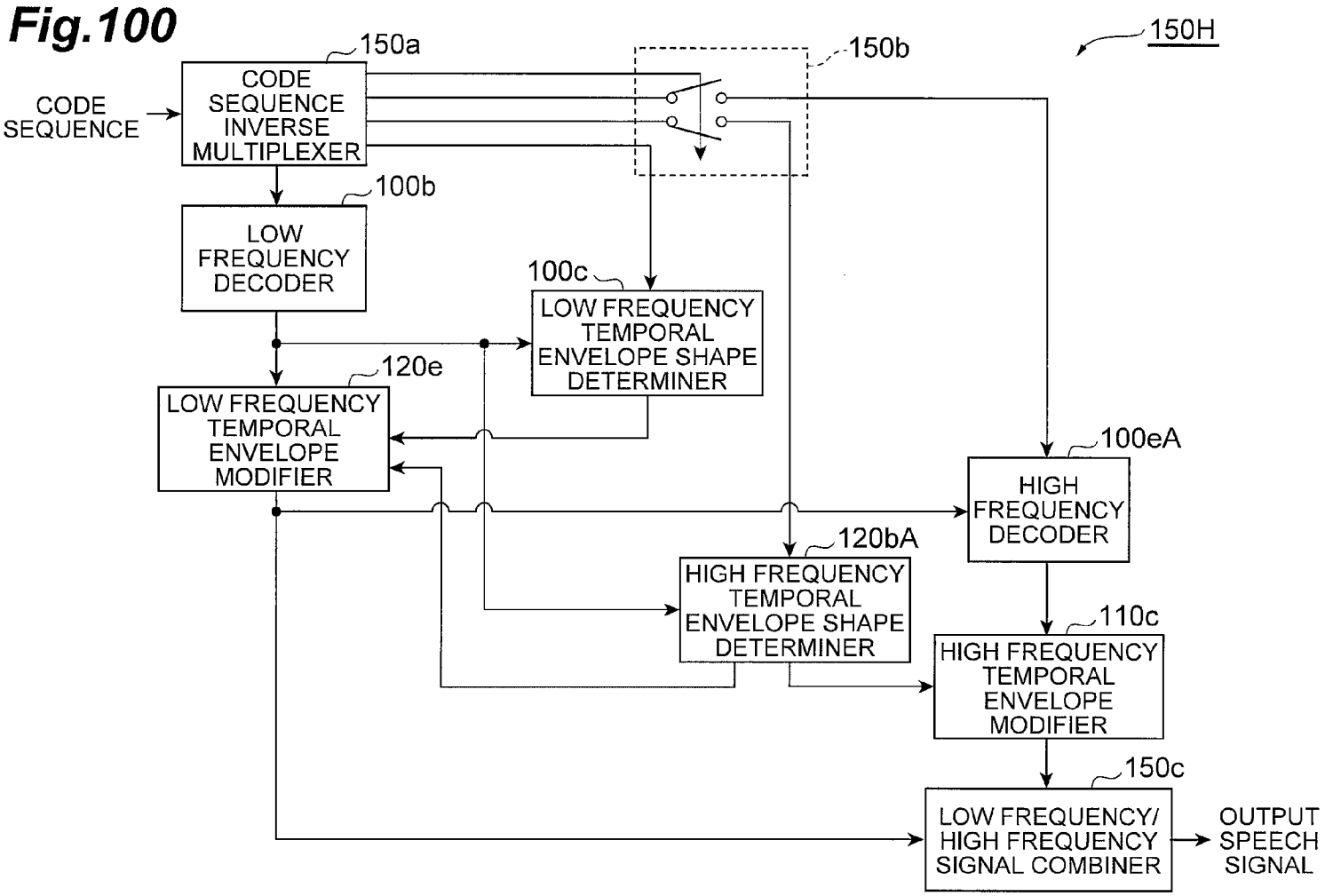
FIG. 100 is a figure showing the configuration of the eighth modification 150H of the speech decoding device according to the seventh embodiment.

FIG. 100 is a diagram showing the configuration of an eighth modification 150H of the speech decoding device according to the seventh embodiment.

Figure 101:
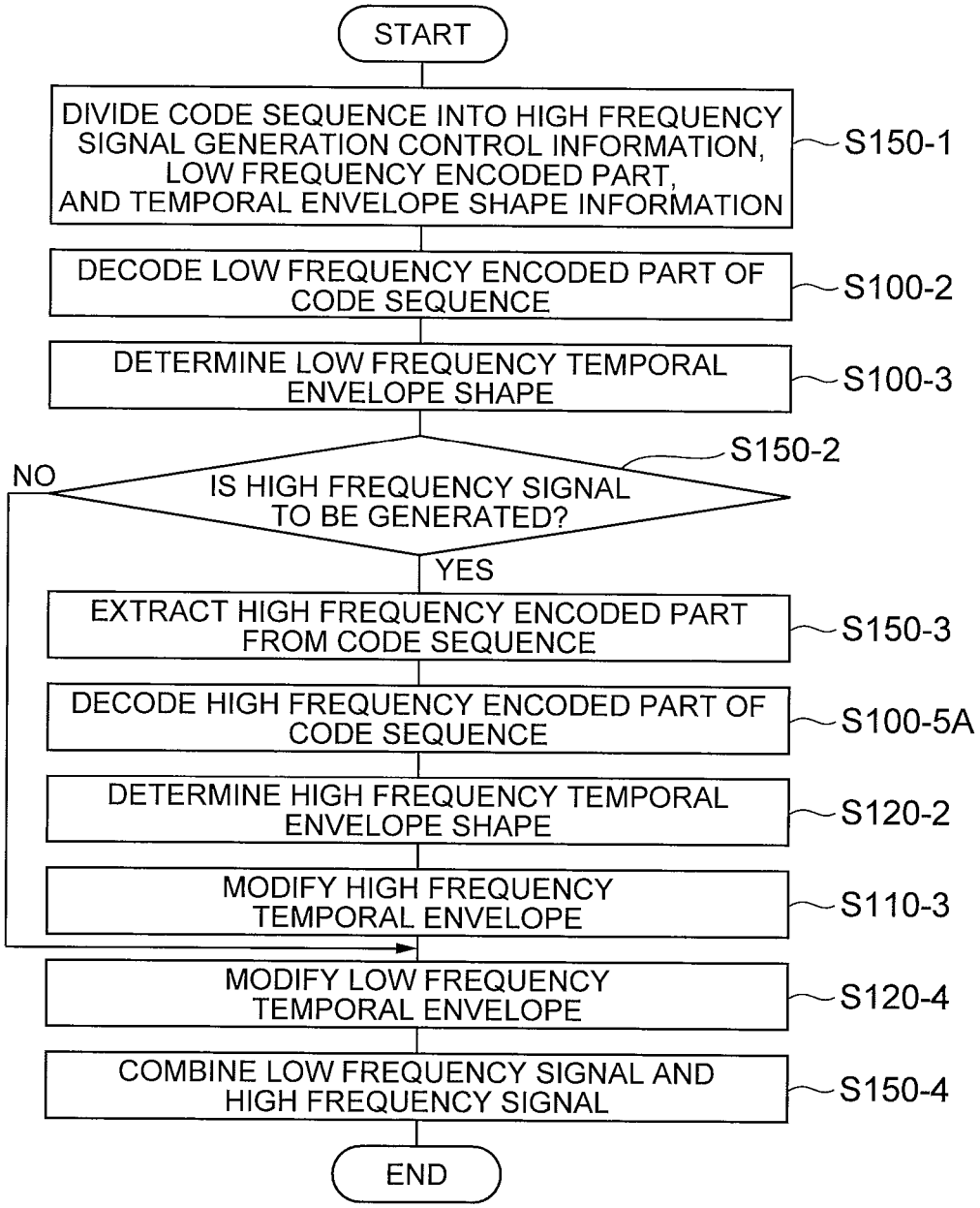
FIG. 101 is a flow chart showing the operation of the eighth modification 150H of the speech decoding device according to the seventh embodiment.

FIG. 101 is a flowchart showing the operation of the eighth modification 150H of the speech decoding device according to the seventh embodiment.

The present modification differs from the first modification 150A of the speech decoding device according to the seventh embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Ninth Modification of Speech Decoding Device of Seventh Embodiment

Figure 102:
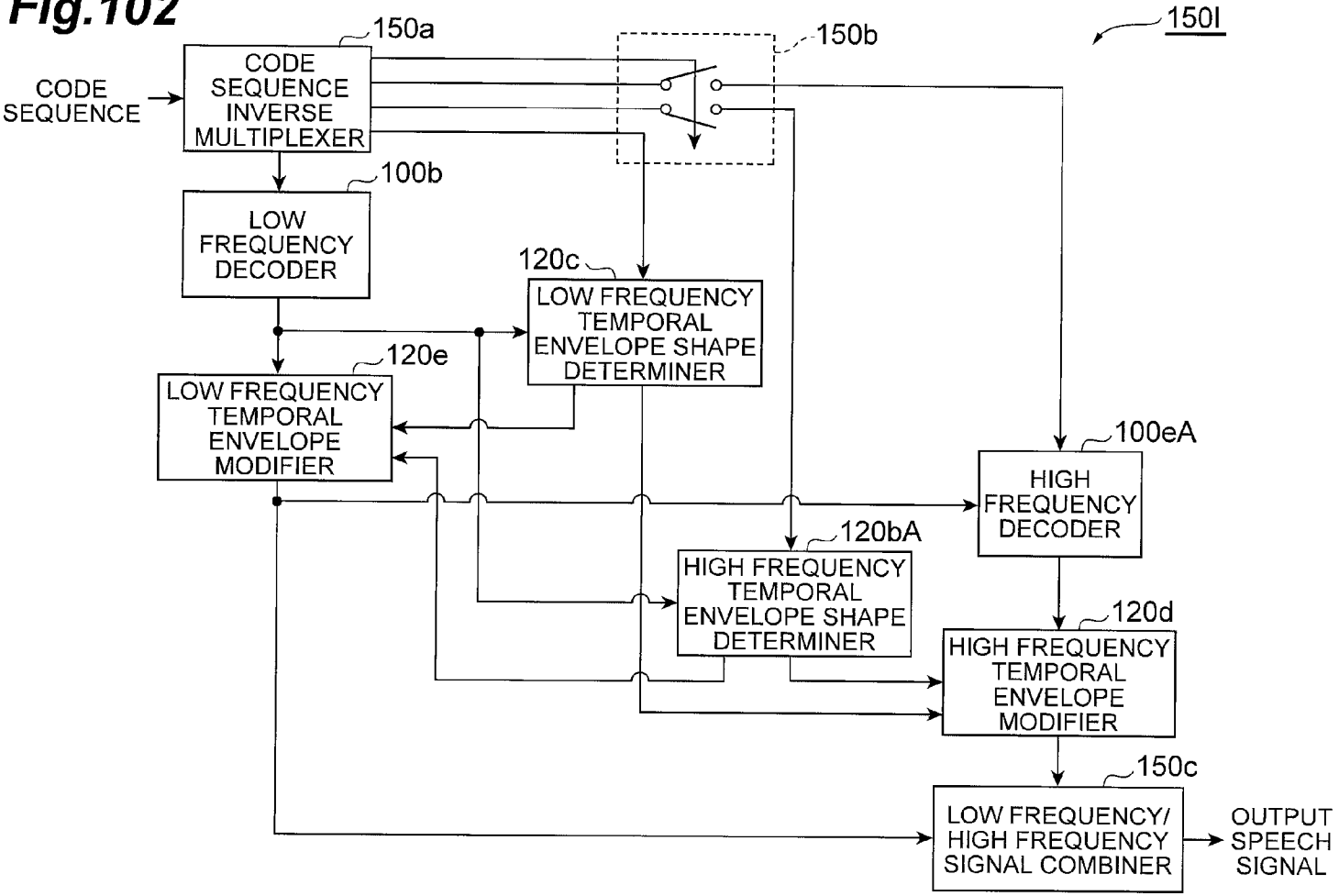
FIG. 102 is a figure showing the configuration of the ninth modification 150I of the speech decoding device according to the seventh embodiment.

FIG. 102 is a diagram showing the configuration of a ninth modification 150I of the speech decoding device according to the seventh embodiment.

Figure 103:
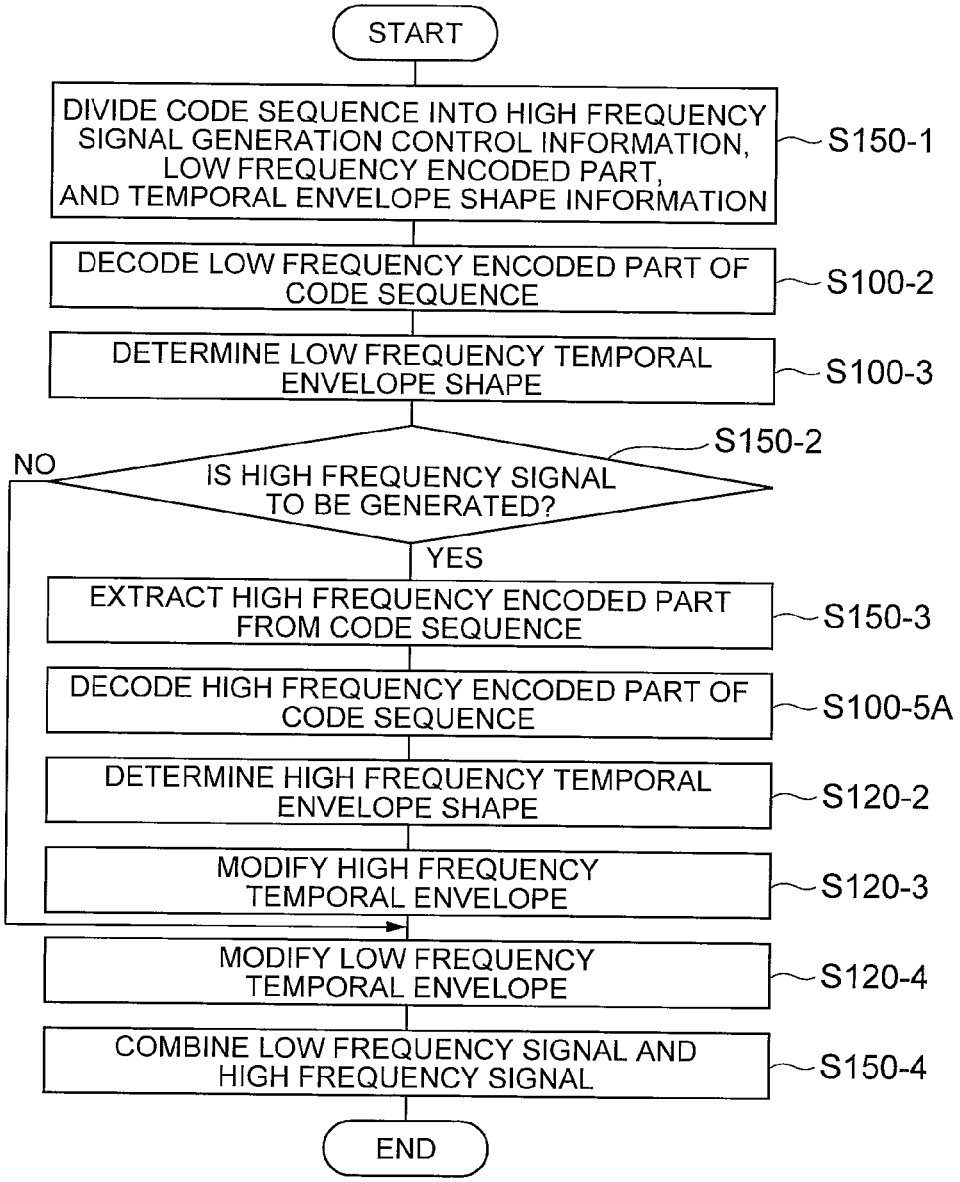
FIG. 103 is a flow chart showing the operation of the ninth modification 150I of the speech decoding device according to the seventh embodiment.

FIG. 103 is a flowchart showing the operation of the ninth modification 150I of the speech decoding device according to the seventh embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Tenth Modification of Speech Decoding Device of Seventh Embodiment

Figure 104:
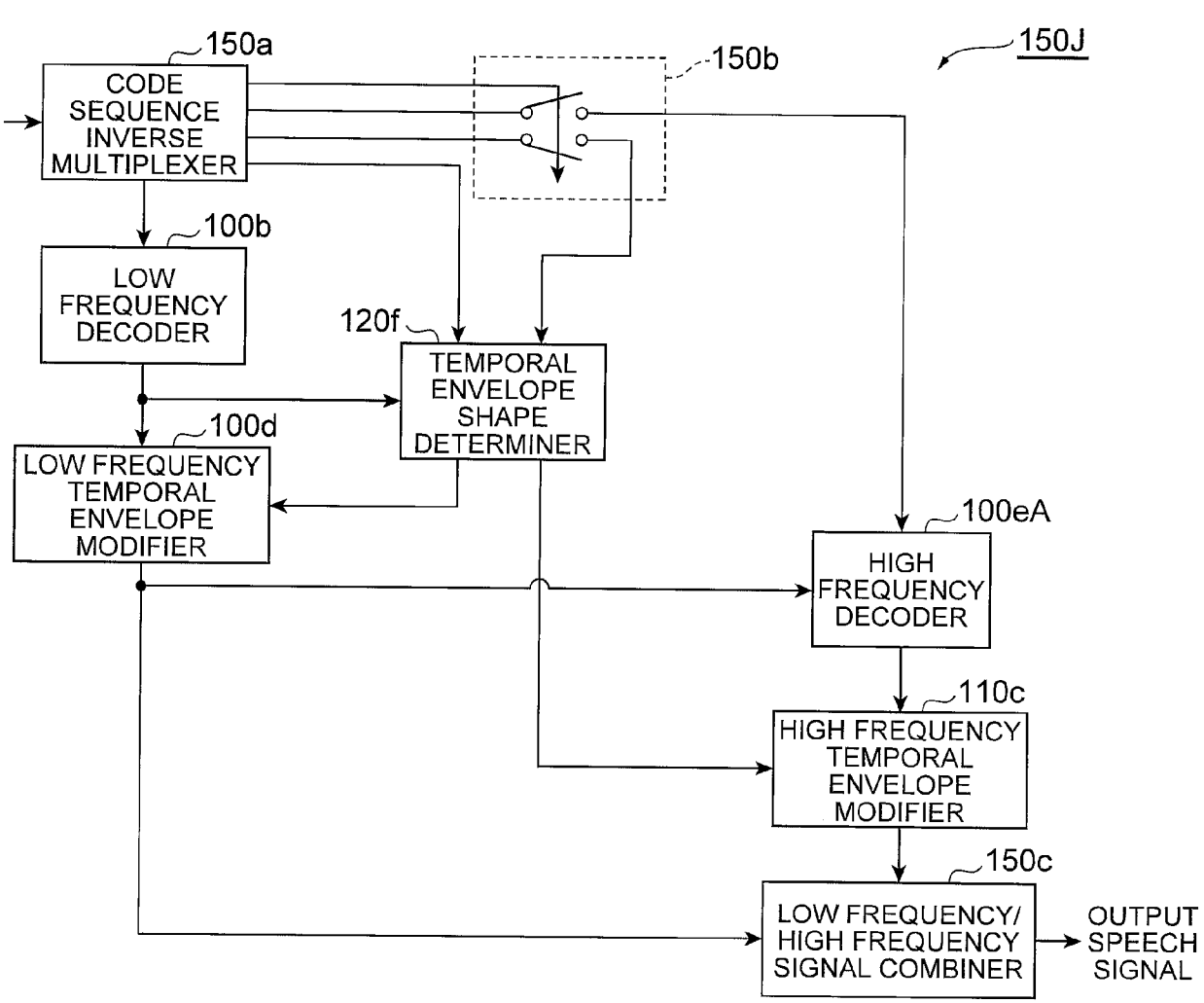
FIG. 104 is a figure showing the configuration of the tenth modification 150J of the speech decoding device according to the seventh embodiment.

FIG. 104 is a diagram showing the configuration of a tenth modification 150J of the speech decoding device according to the seventh embodiment.

Figure 105:
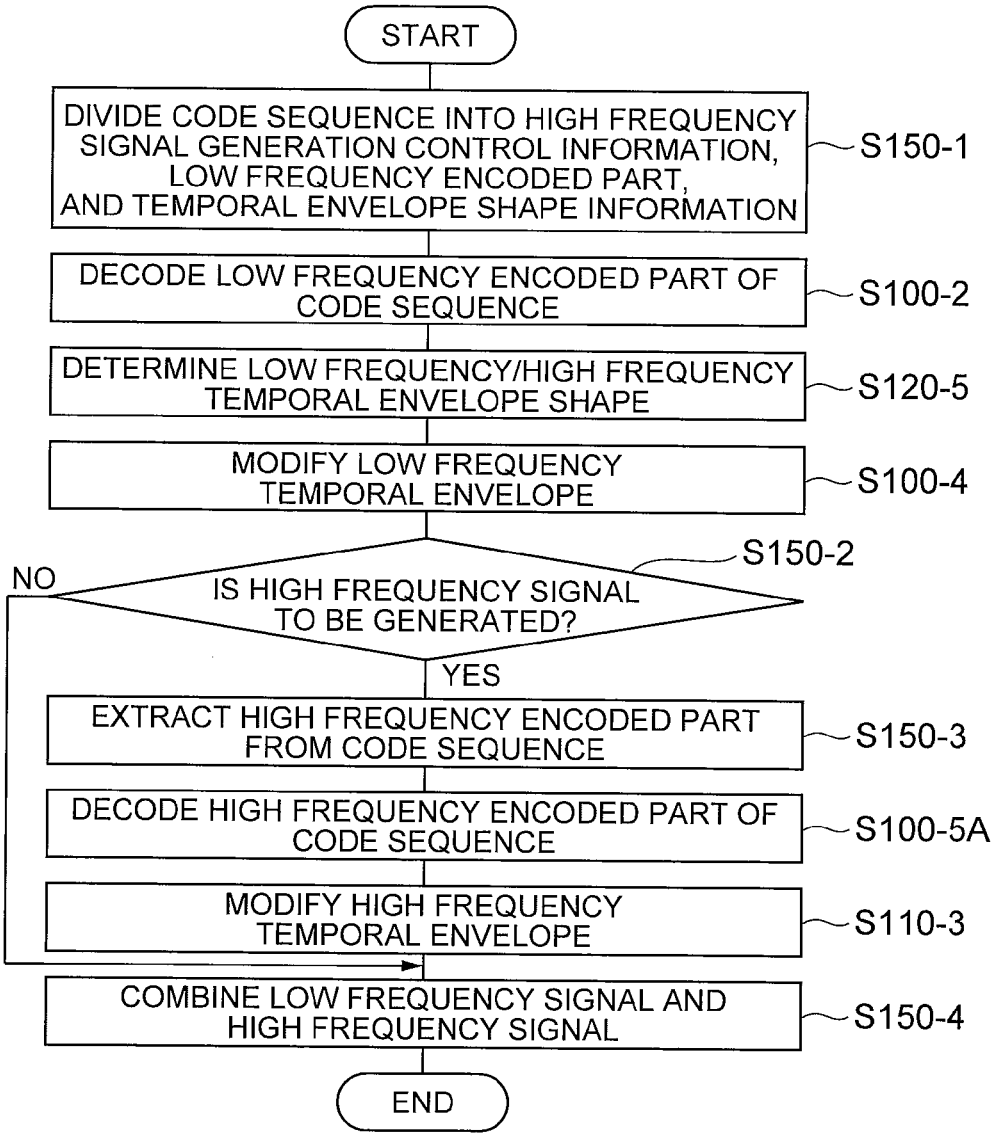
FIG. 105 is a flow chart showing the operation of the tenth modification 150J of the speech decoding device according to the seventh embodiment.

FIG. 105 is a flowchart showing the operation of the tenth modification 150J of the speech decoding device according to the seventh embodiment.

The present modification differs from the first modification 150A of the speech decoding device according to the seventh embodiment in that it includes a temporal envelope shape determiner 120*f* in place of the low frequency temporal envelope shape determiner 100*c* and the high frequency temporal envelope shape determiner 120*b*.

Eleventh Modification of Speech Decoding Device of Seventh Embodiment

Figure 106:
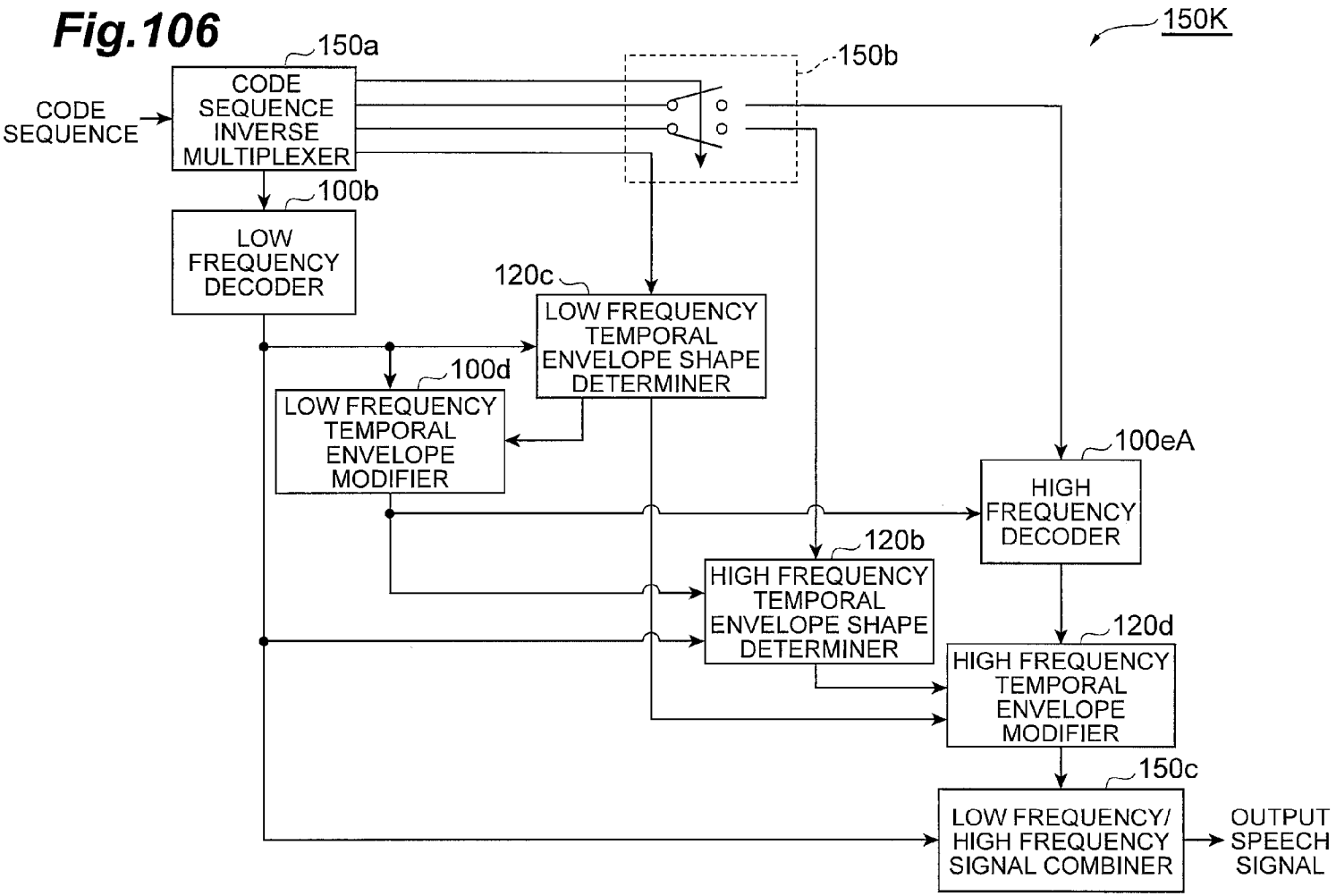
FIG. 106 is a figure showing the configuration of the 11th modification 150K of the speech decoding device according to the seventh embodiment.

FIG. 106 is a diagram showing the configuration of an eleventh modification 150K of the speech decoding device according to the seventh embodiment.

Figure 107:
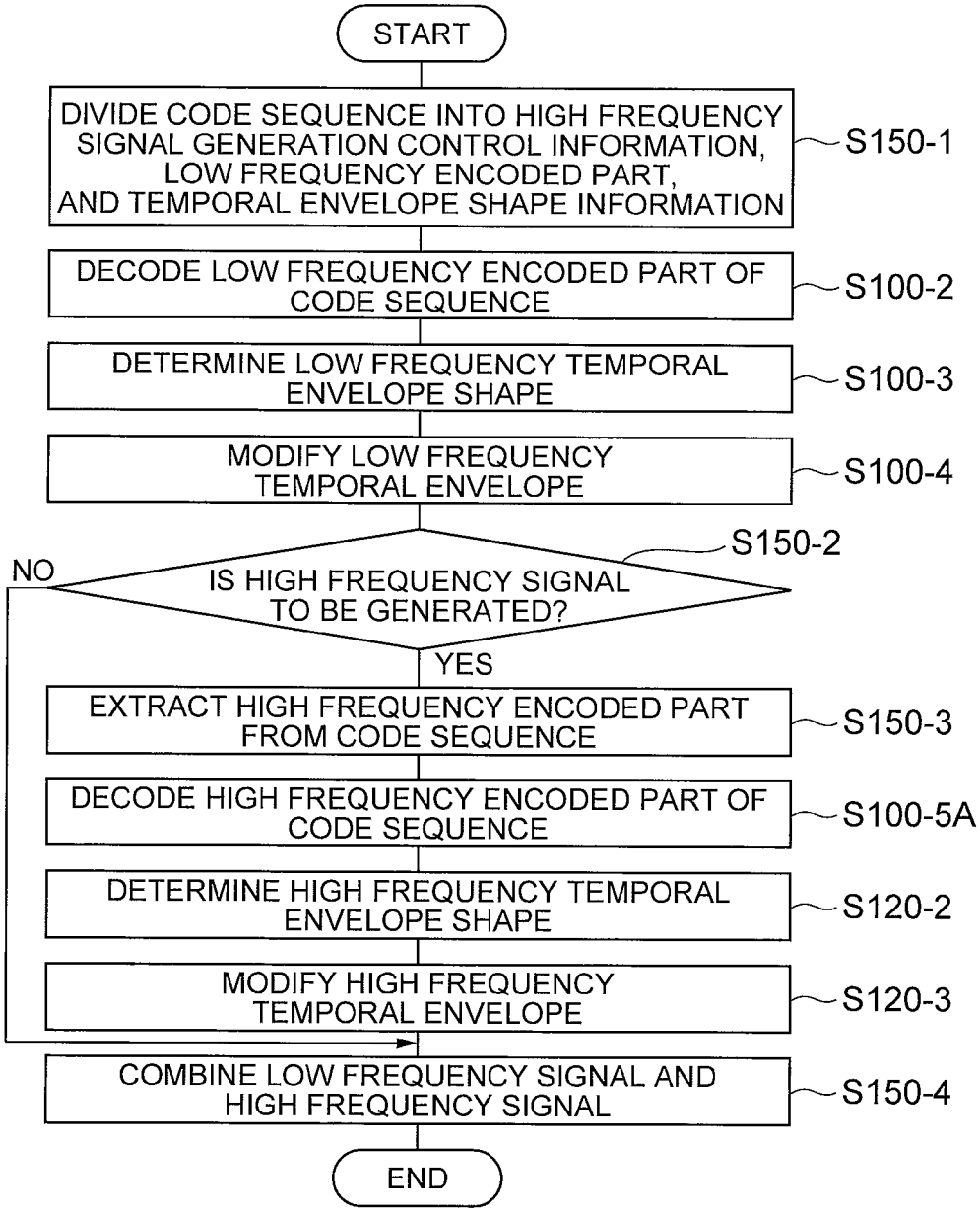
FIG. 107 is a flow chart showing the operation of the 11th modification 150K of the speech decoding device according to the seventh embodiment.

FIG. 107 is a flowchart showing the operation of the eleventh modification 150K of the speech decoding device according to the seventh embodiment.

The present modification differs from the second modification 150B of the speech decoding device according to the seventh embodiment in that it includes a low frequency temporal envelope shape determiner 120*c* and a high frequency temporal envelope modifier 120*d* in place of the low frequency temporal envelope shape determiner 100*c* and the high frequency temporal envelope modifier 110*c*.

Twelfth Modification of Speech Decoding Device of Seventh Embodiment

Figure 108:
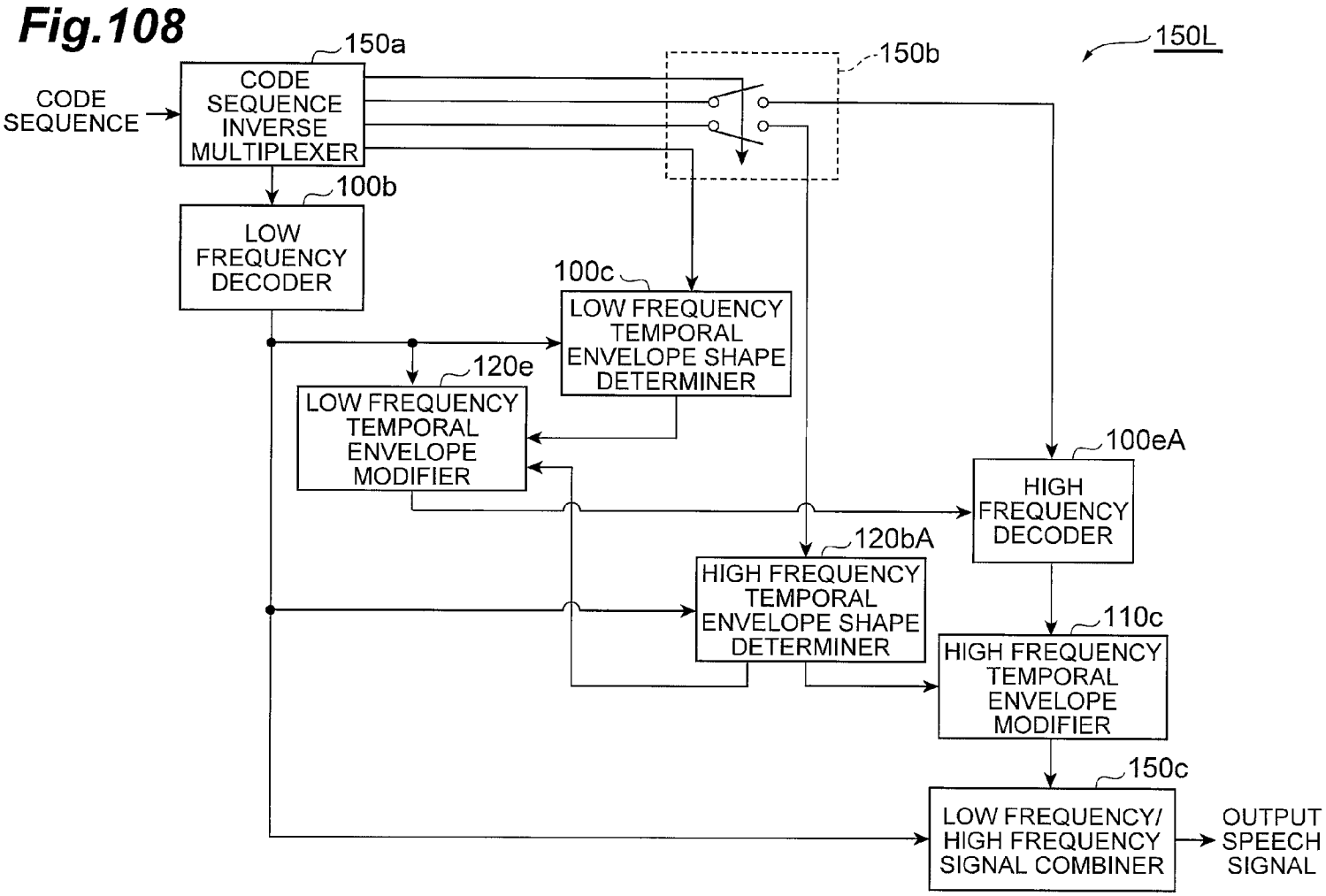
FIG. 108 is a figure showing the configuration of the 12th modification 150L of the speech decoding device according to the seventh embodiment.

FIG. 108 is a diagram showing the configuration of a twelfth modification 150L of the speech decoding device according to the seventh embodiment.

Figure 109:
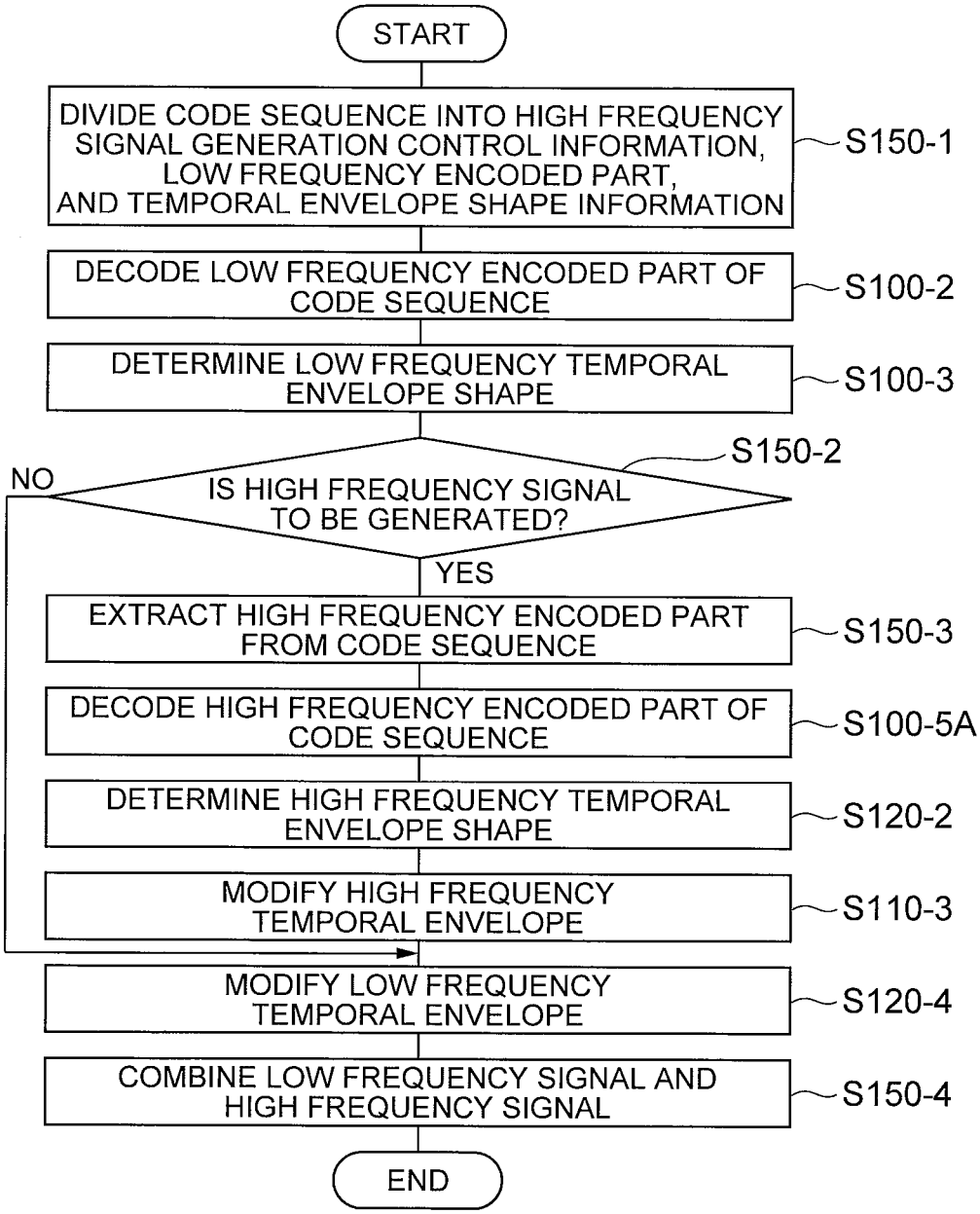
FIG. 109 is a flow chart showing the operation of the 12th modification 150L of the speech decoding device according to the seventh embodiment.

FIG. 109 is a flowchart showing the operation of the twelfth modification 150L of the speech decoding device according to the seventh embodiment.

The present modification differs from the second modification 150B of the speech decoding device according to the seventh embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Thirteenth Modification of Speech Decoding Device of Seventh Embodiment

Figure 110:
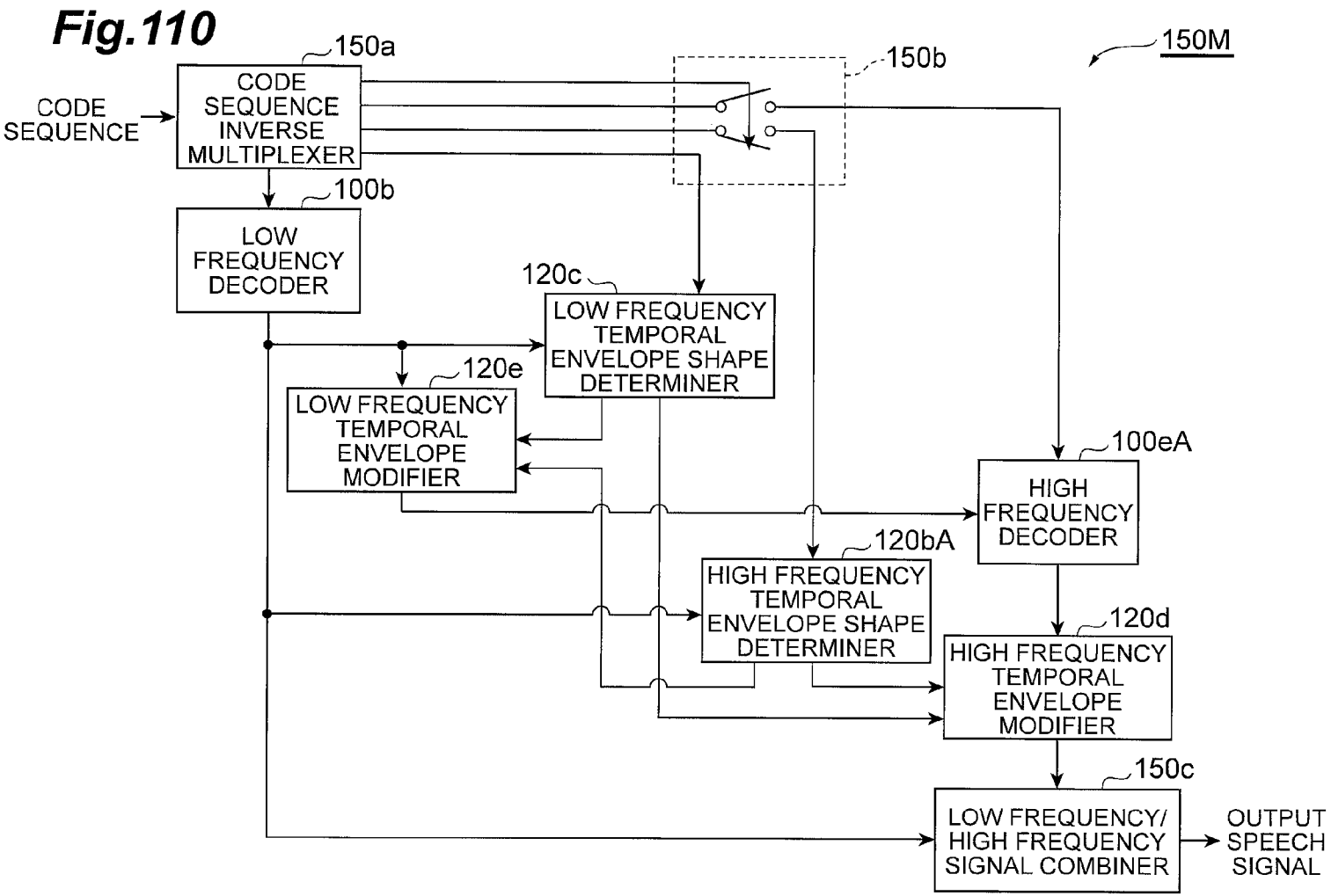
FIG. 110 is a figure showing the configuration of the 13th modification 150M of the speech decoding device according to the seventh embodiment.

FIG. 110 is a diagram showing the configuration of a thirteenth modification 150M of the speech decoding device according to the seventh embodiment.

Figure 111:
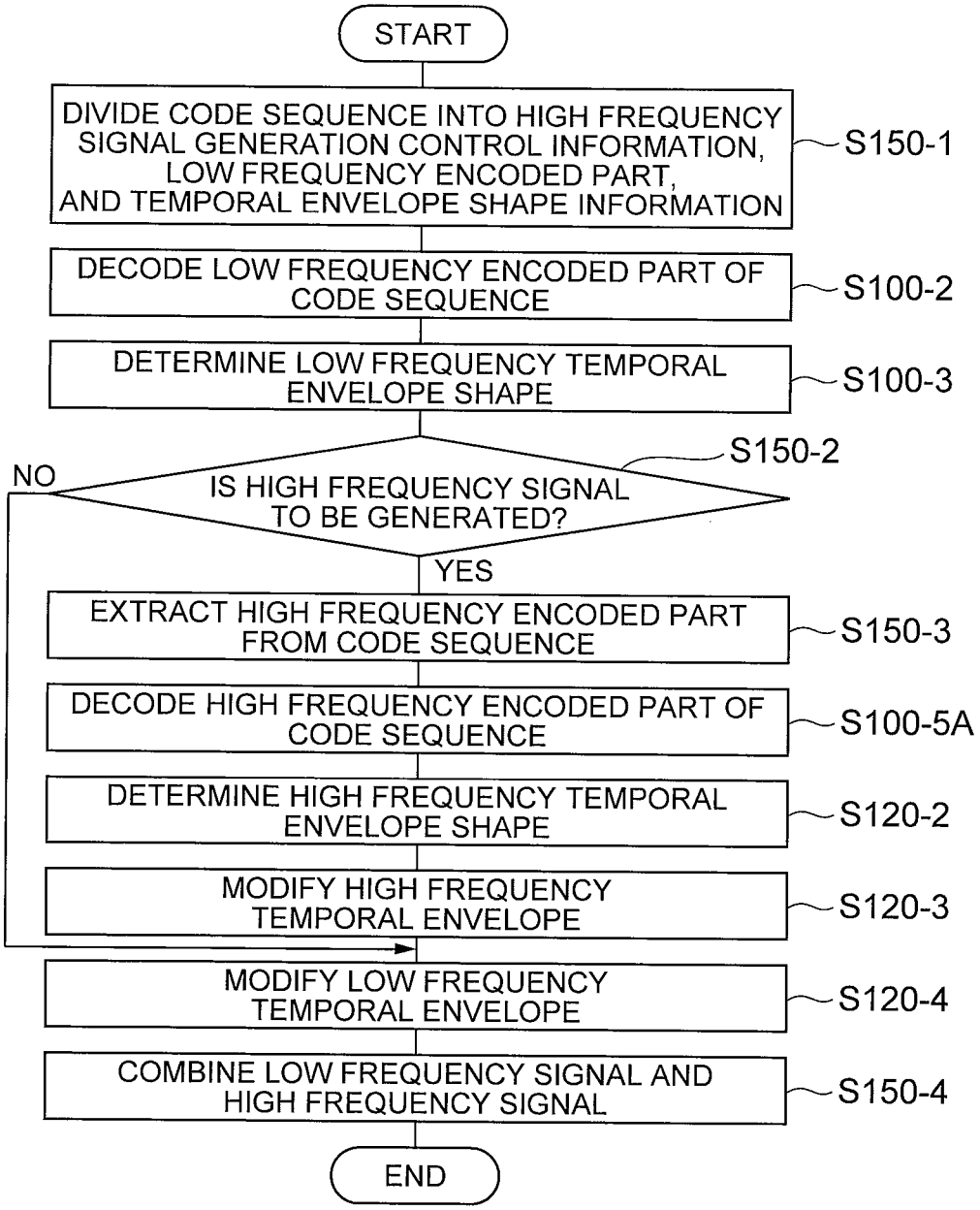
FIG. 111 is a flow chart showing the operation of the 13th modification 150M of the speech decoding device according to the seventh embodiment.

FIG. 111 is a flowchart showing the operation of the thirteenth modification 150M of the speech decoding device according to the seventh embodiment.

The present modification includes the low frequency temporal envelope shape determiner 120*c*, the high frequency temporal envelope modifier 120*d*, the high frequency temporal envelope shape determiner 120*b*A, and the low frequency temporal envelope modifier 120*e*.

Fourteenth Modification of Speech Decoding Device of Seventh Embodiment

Figure 112:
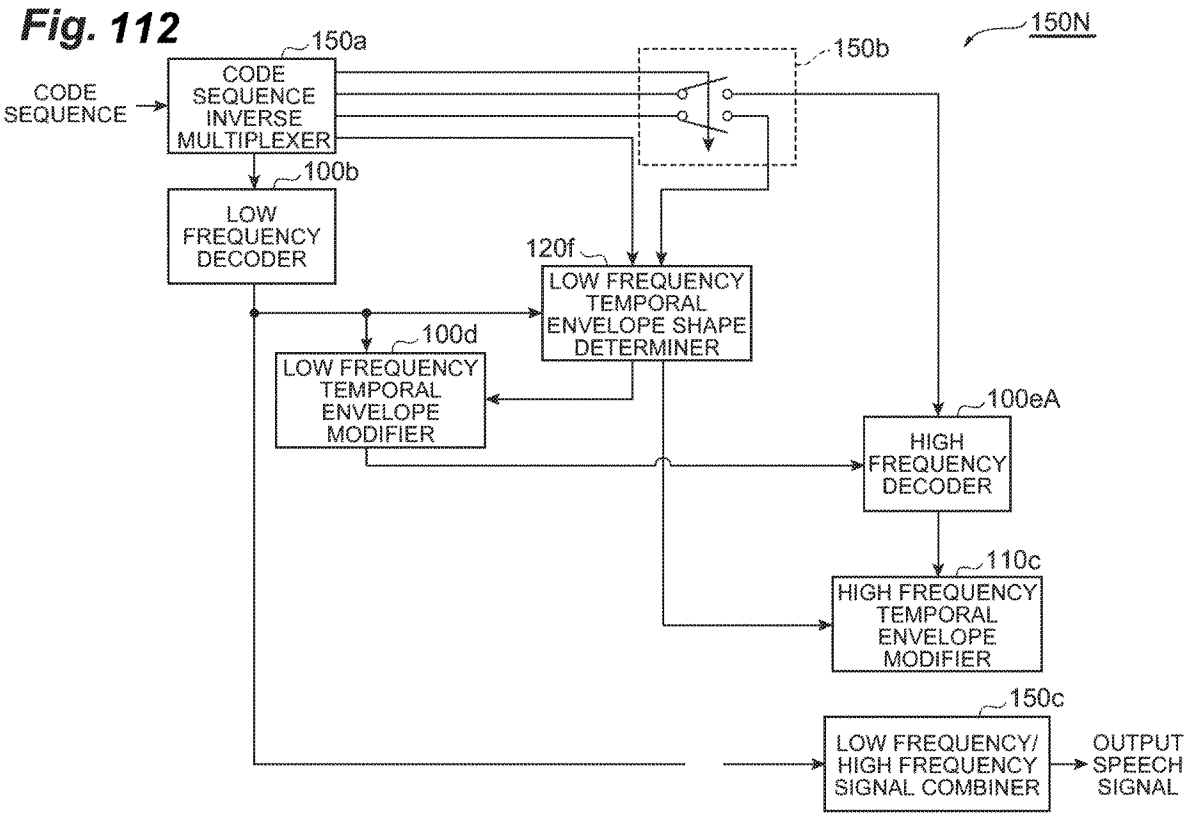
FIG. 112 is a figure showing the configuration of the 14th modification 150N of the speech decoding device according to the seventh embodiment.

FIG. 112 is a diagram showing the configuration of a fourteenth modification 150N of the speech decoding device according to the seventh embodiment.

Figure 113:
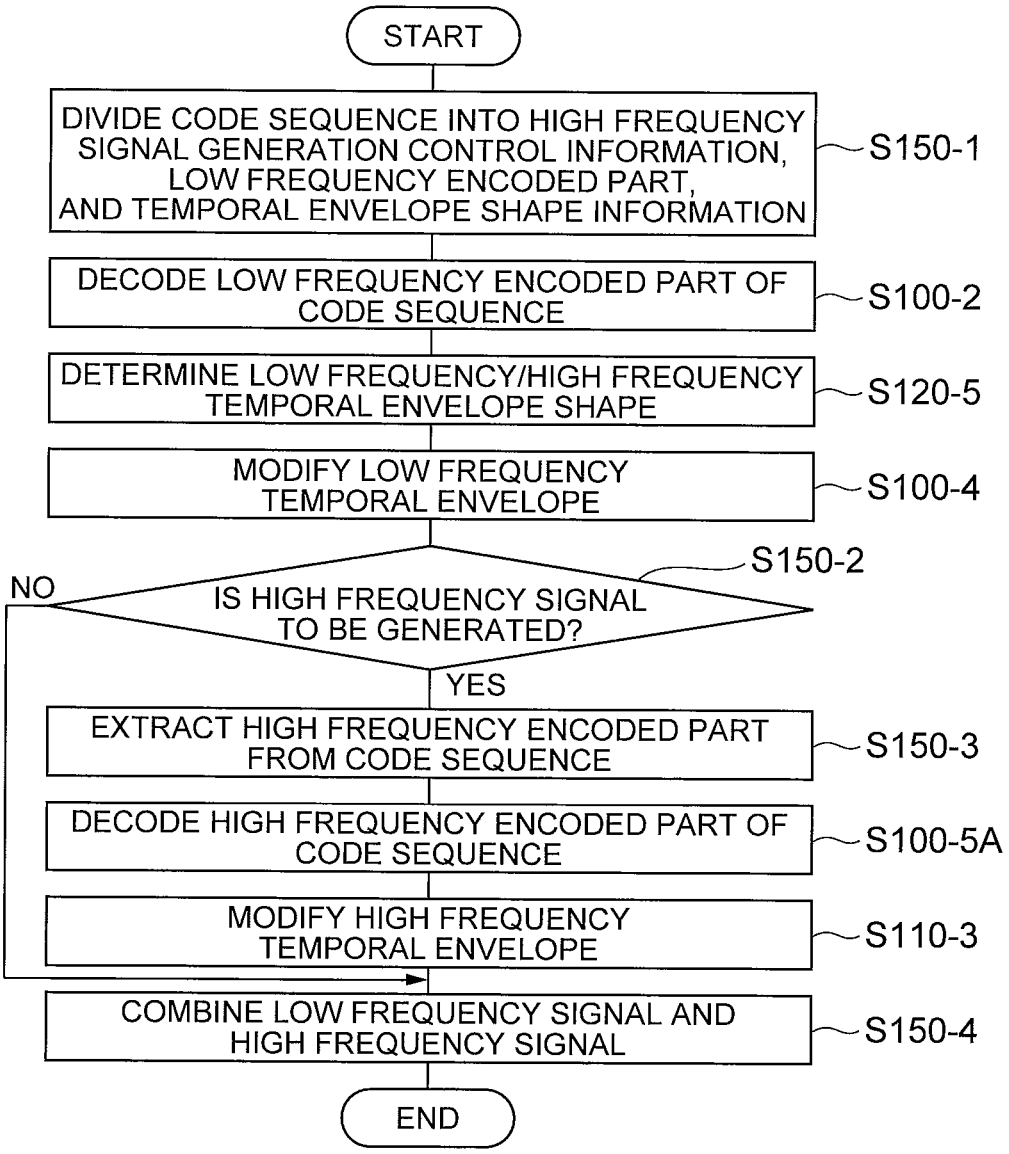
FIG. 113 is a flow chart showing the operation of the 14th modification 150N of the speech decoding device according to the seventh embodiment.

FIG. 113 is a flowchart showing the operation of the fourteenth modification 150N of the speech decoding device according to the seventh embodiment.

The present modification differs from the second modification 150B of the speech decoding device according to the seventh embodiment in that it includes a temporal envelope shape determiner 120*f* in place of the low frequency temporal envelope shape determiner 100*c* and the high frequency temporal envelope shape determiner 120*b*.

Eighth Embodiment

Figure 114:
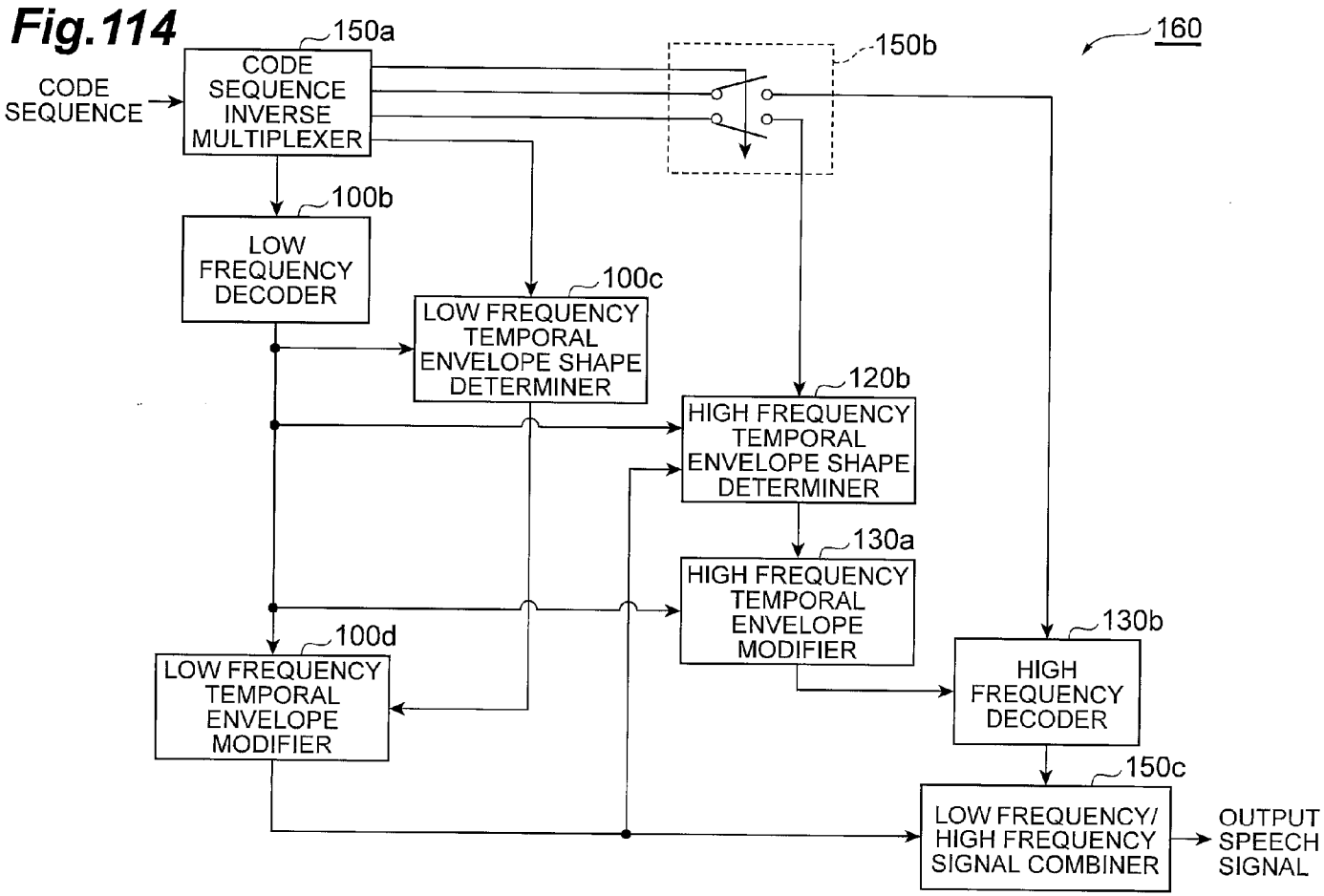
FIG. 114 is a figure showing the configuration of the speech decoding device 160 according to an eighth embodiment.

FIG. 114 is a diagram showing the configuration of a speech decoding device 160 according to an eighth embodiment. A communication device of the speech decoding device 160 receives a multiplexed code sequence output from a speech encoding device 260 described below and outputs a decoded speech signal to the outside. As shown in FIG. 114, the speech decoding device 160 functionally includes a code sequence demultiplexer 150*a*, switches 150*b*, a low frequency decoder 100*b*, a low frequency temporal envelope shape determiner 100*c*, a low frequency temporal envelope modifier 100*d*, a high frequency temporal envelope shape determiner 120*b*, a high frequency temporal envelope modifier 130*a*, a high frequency decoder 130*b*, and a low frequency/high frequency signal combiner 150*c*.

Figure 115:
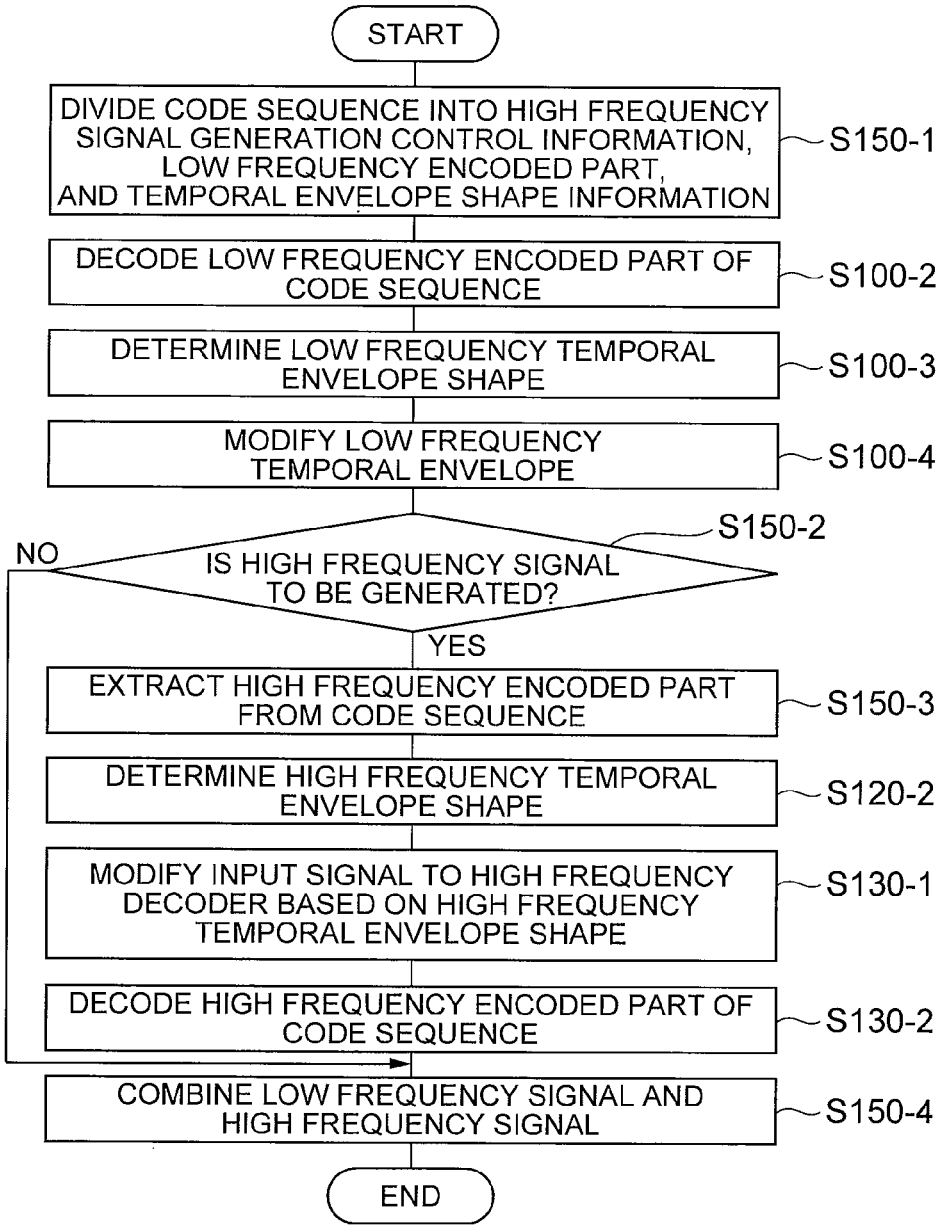
FIG. 115 is a flow chart showing the operation of the speech decoding device according to the eighth embodiment.

FIG. 115 is a flowchart showing the operation of the speech decoding device according to the eighth embodiment. The order in which the processing in step S150-2 and S150-3 is performed is not limited to the order illustrated in the flowchart in FIG. 115 as long as it is before the determination of the high frequency temporal envelope shape and the decoding of the high frequency encoded part.

Figure 116:
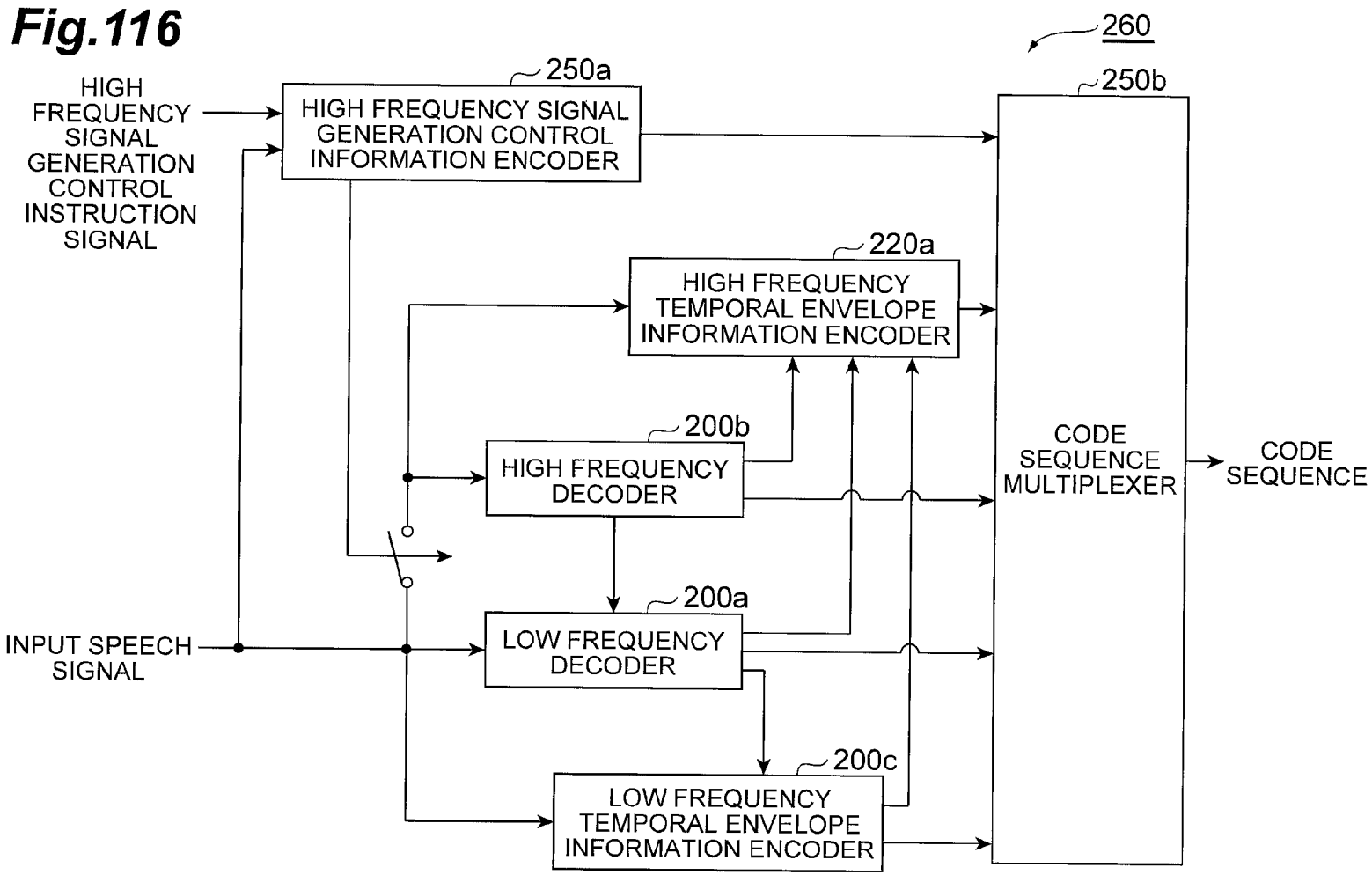
FIG. 116 is a figure showing the configuration of the speech to digital converter 260 according to the eighth embodiment.

FIG. 116 is a diagram showing the configuration of the speech encoding device 260 according to the eighth embodiment. A communication device of the speech encoding device 260 receives a speech signal to be encoded from the outside and outputs the encoded code sequence to the outside. As shown in FIG. 116, the speech encoding device 260 functionally includes a high frequency signal generation control information encoder 250*a*, a low frequency encoder 200*a*, a high frequency encoder 200*b*, a low frequency temporal envelope information encoder 200*c*, a high frequency temporal envelope information encoder 220*a*, and a code sequence multiplexer 250*b*.

Figure 117:
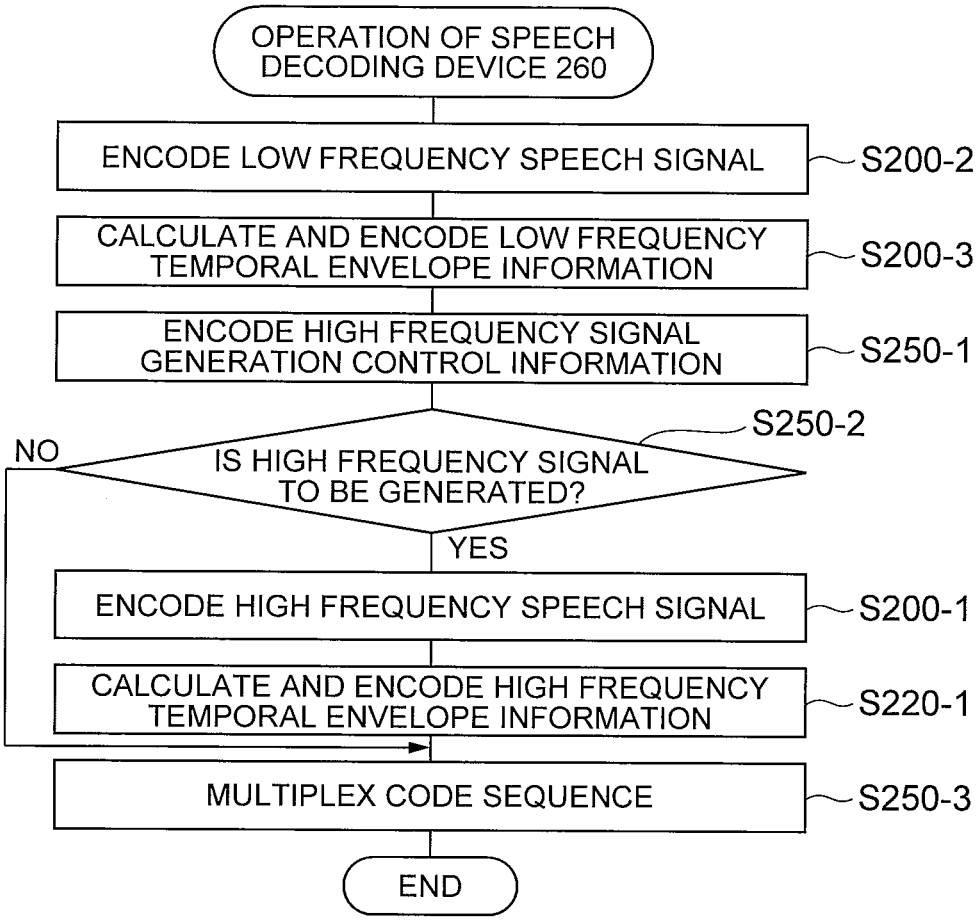
FIG. 117 is a flow chart showing the operation of the speech to digital converter 260 according to the eighth embodiment.

FIG. 117 is a flowchart showing the operation of the speech encoding device 260 according to the eighth embodiment.

First Modification of Speech Decoding Device of Eighth Embodiment

Figure 118:
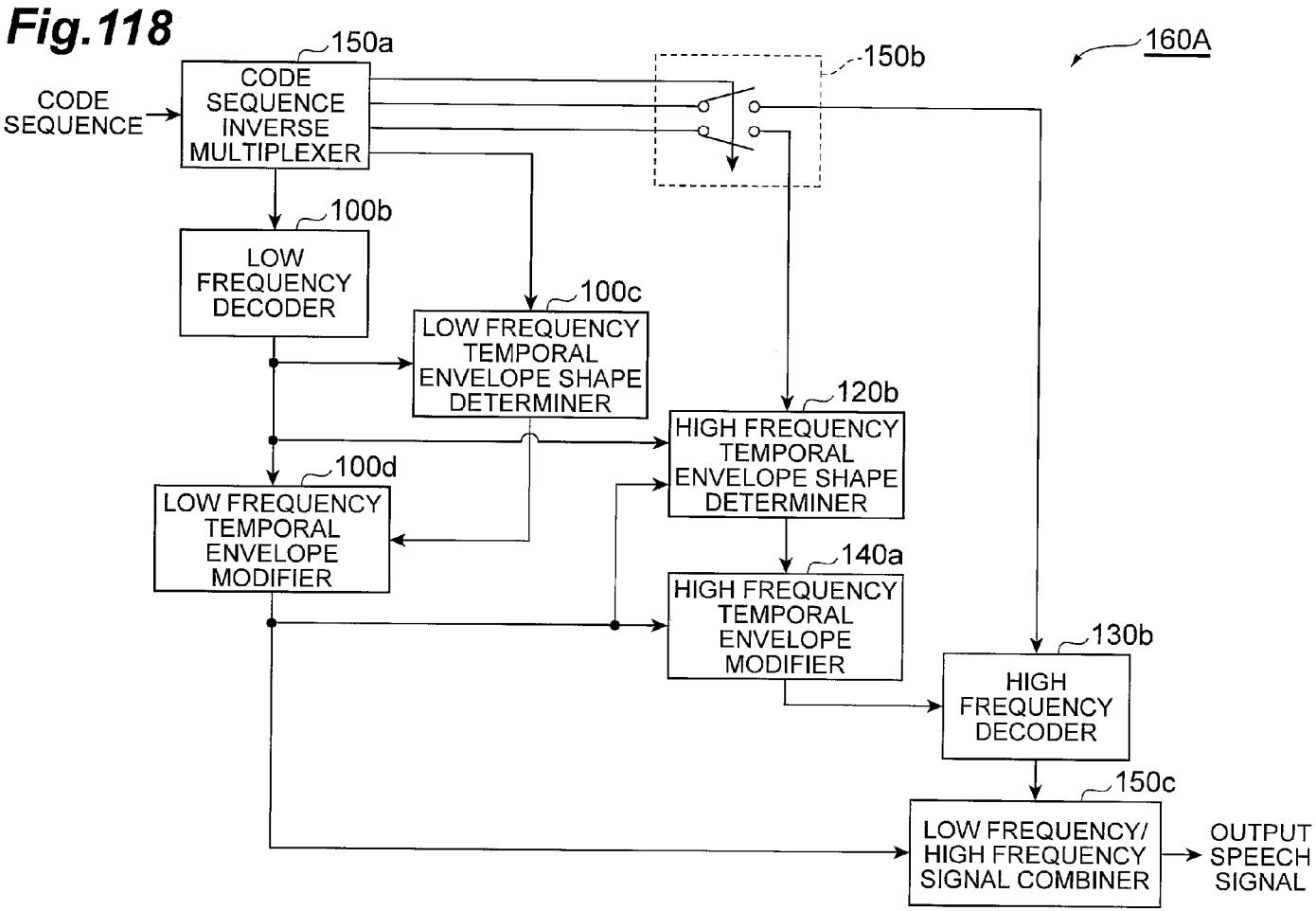
FIG. 118 is a figure showing the configuration of the first modification 160A of the speech decoding device according to the eighth embodiment.

FIG. 118 is a diagram showing the configuration of a first modification 160A of the speech decoding device according to the eighth embodiment.

Figure 119:
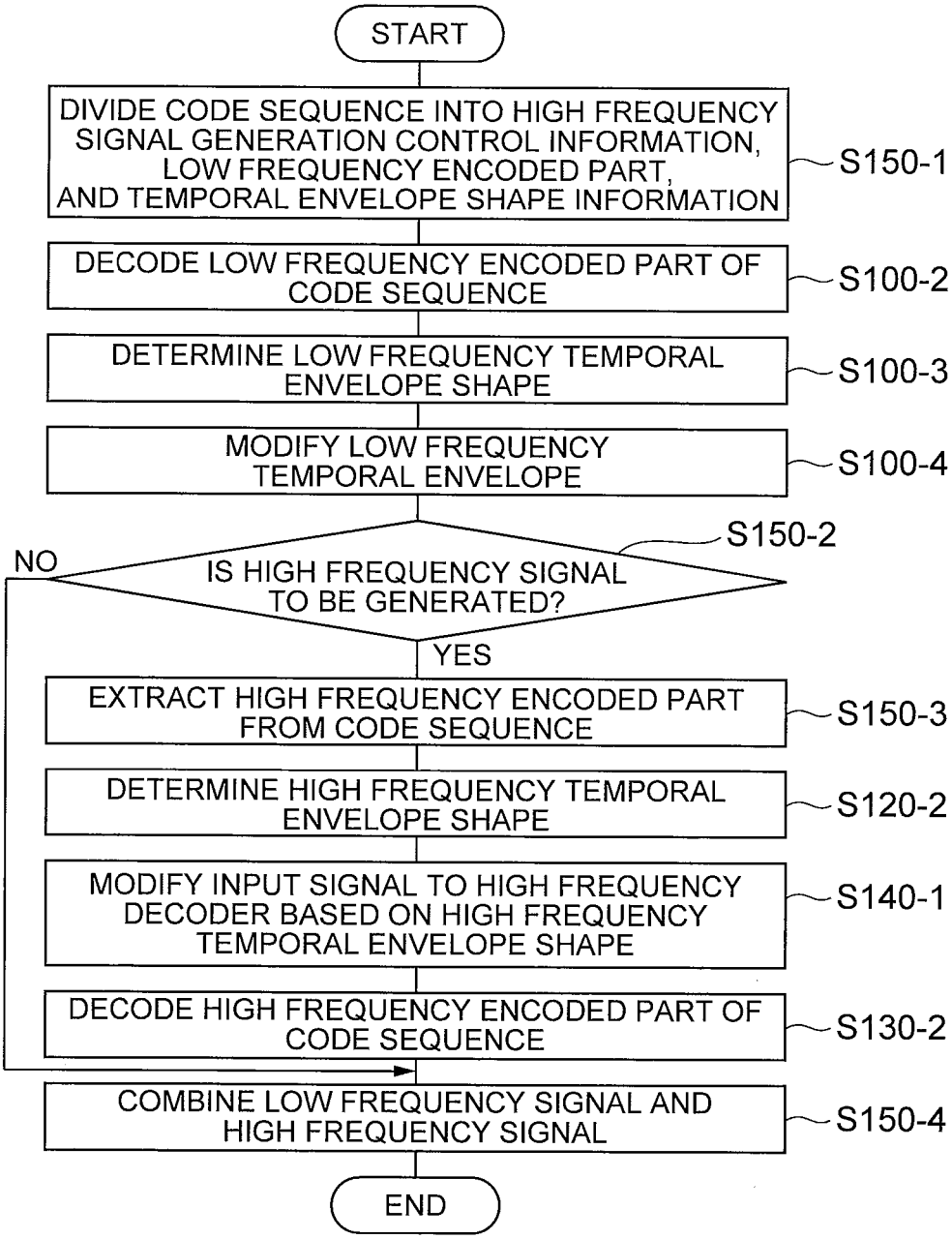
FIG. 119 is a flow chart showing the operation of the first modification 160A of the speech decoding device according to the eighth embodiment.

FIG. 119 is a flowchart showing the operation of the first modification 160A of the speech decoding device according to the eighth embodiment.

The difference from the speech decoding device 160 of the present embodiment is that the high frequency temporal envelope modifier 140*a* described in the first modification of the speech decoding device in the sixth embodiment is used in place of the high frequency temporal envelope modifier 130*a*.

The order in which the processing in step S150-2 and S150-3 is performed is not limited to the order illustrated in the flowchart in FIG. 119 as long as it is before the determination of the high frequency temporal envelope shape and the decoding of the high frequency encoded part.

Second Modification of Speech Decoding Device of Eighth Embodiment

Figure 120:
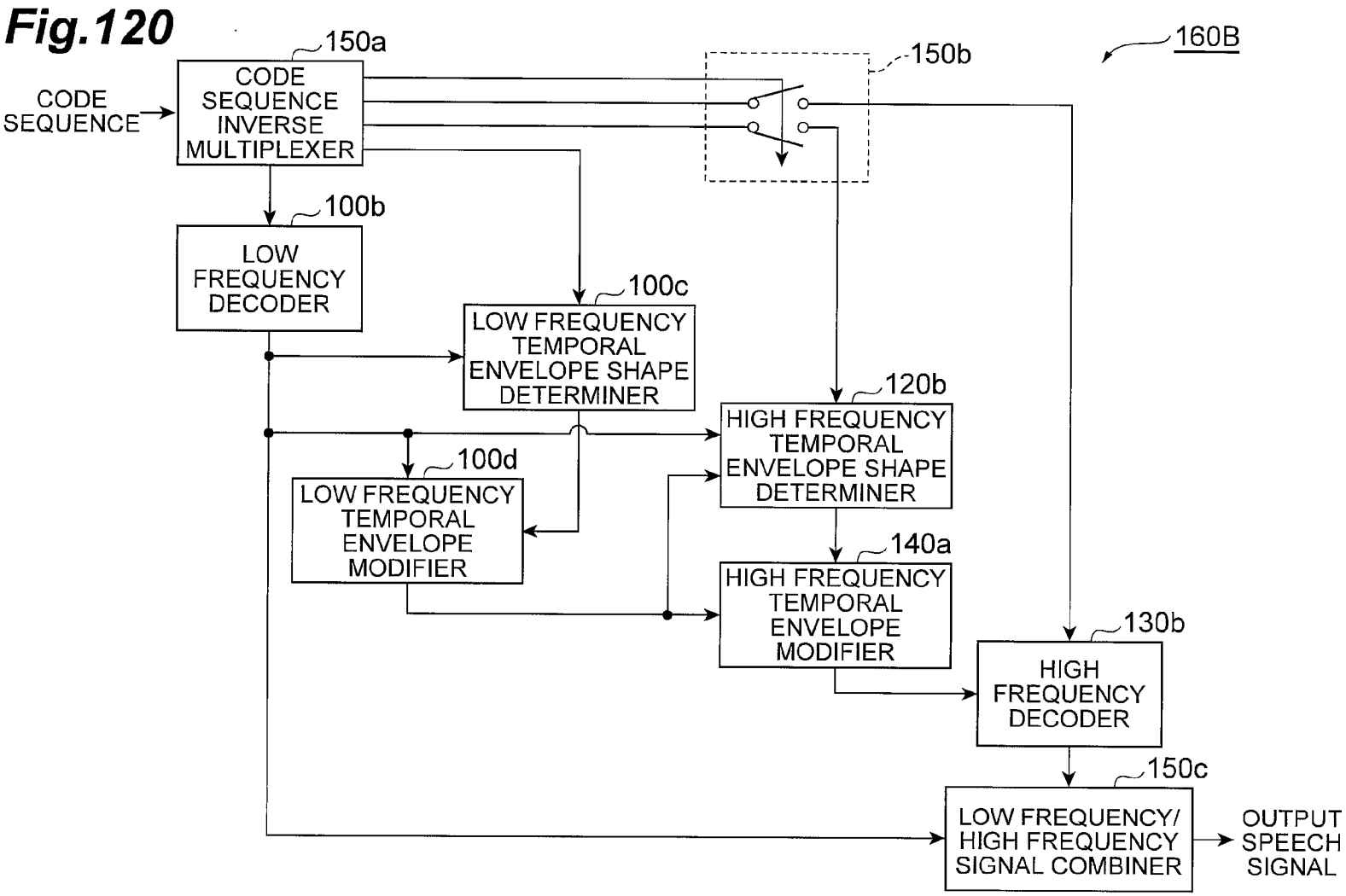

FIG. 120 is a diagram showing the configuration of a second modification 170B of the speech decoding device according to the eighth embodiment.

The difference from the first modification 160A of the speech decoding device of the present embodiment is that the low frequency signal to be used in the combining process by the low frequency/high frequency signal combiner 150*c* is the low frequency signal decoded by the low frequency decoder 100*b*, not the low frequency signal having the temporal envelope shape modified by the low frequency temporal envelope modifier 100*d*, as in the second modification of the speech decoding device of the sixth embodiment.

Third Modification of Speech Decoding Device of Eighth Embodiment

Figure 121:
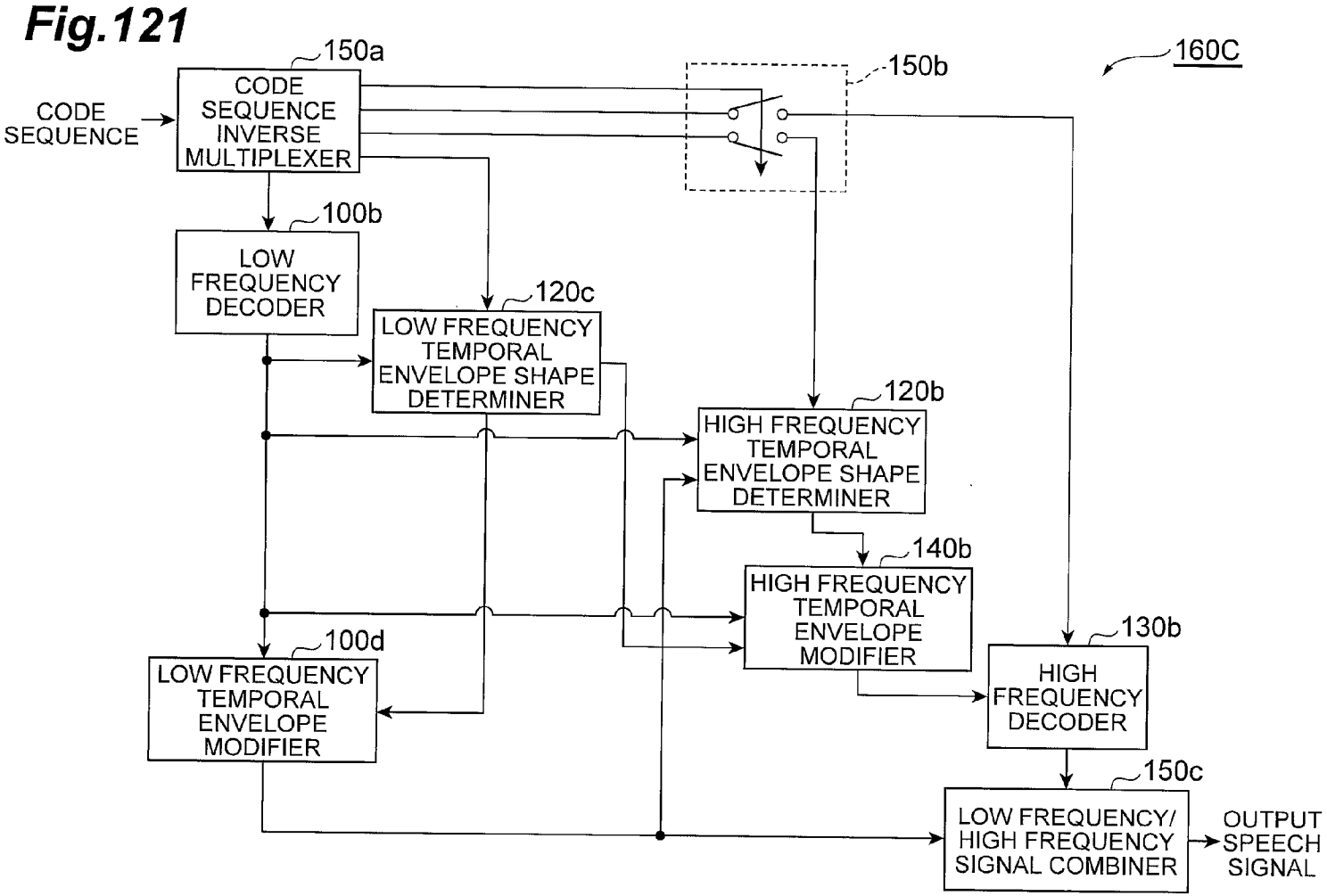

FIG. 121 is a diagram showing the configuration of a third modification 160C of the speech decoding device according to the eighth embodiment.

Figure 122:
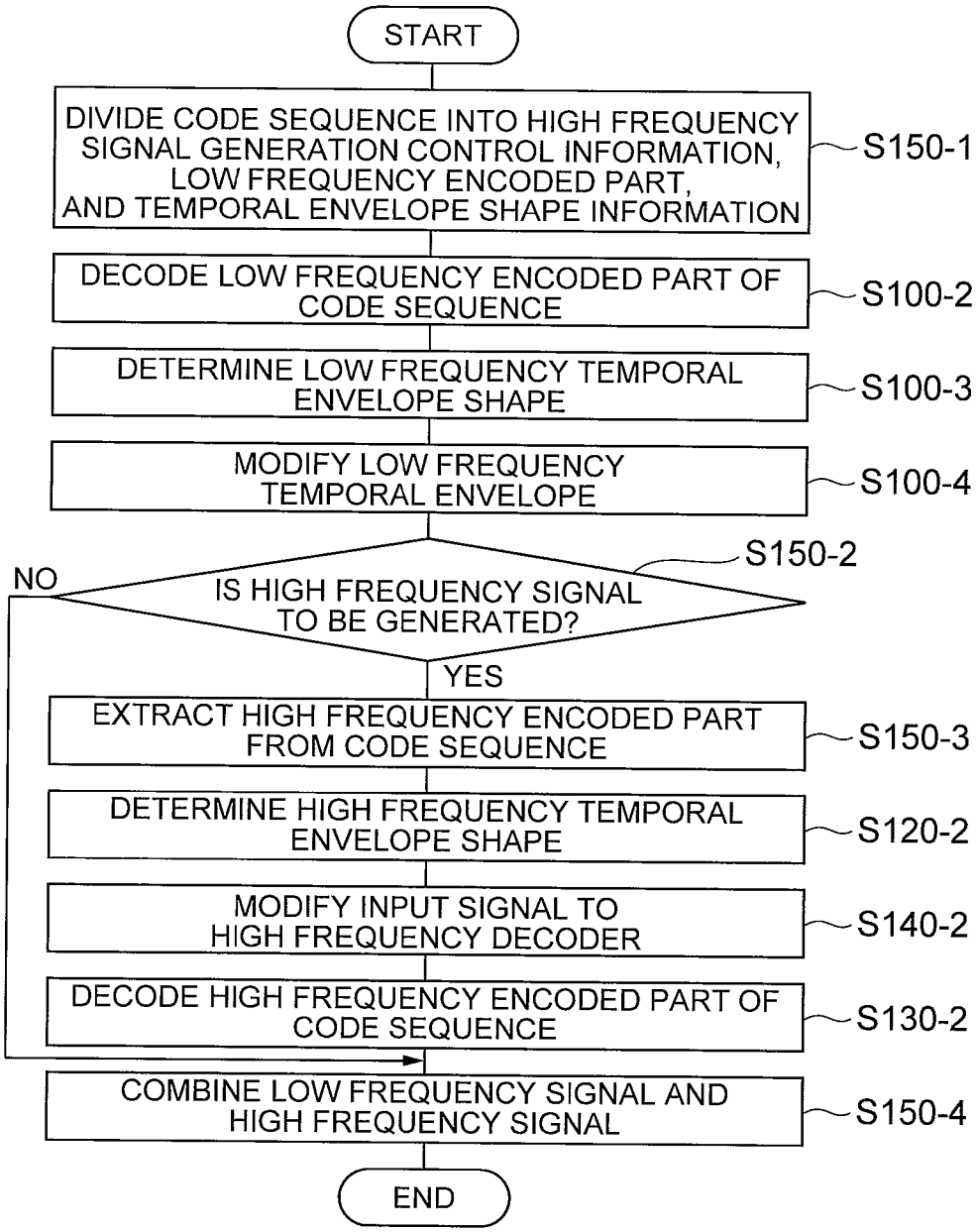

FIG. 122 is a flowchart showing the operation of the third modification 160C of the speech decoding device according to the eighth embodiment.

The present modification differs from the speech decoding device 160 according to the eighth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 130*a*.

Fourth Modification of Speech Decoding Device of Eighth Embodiment

Figure 123:
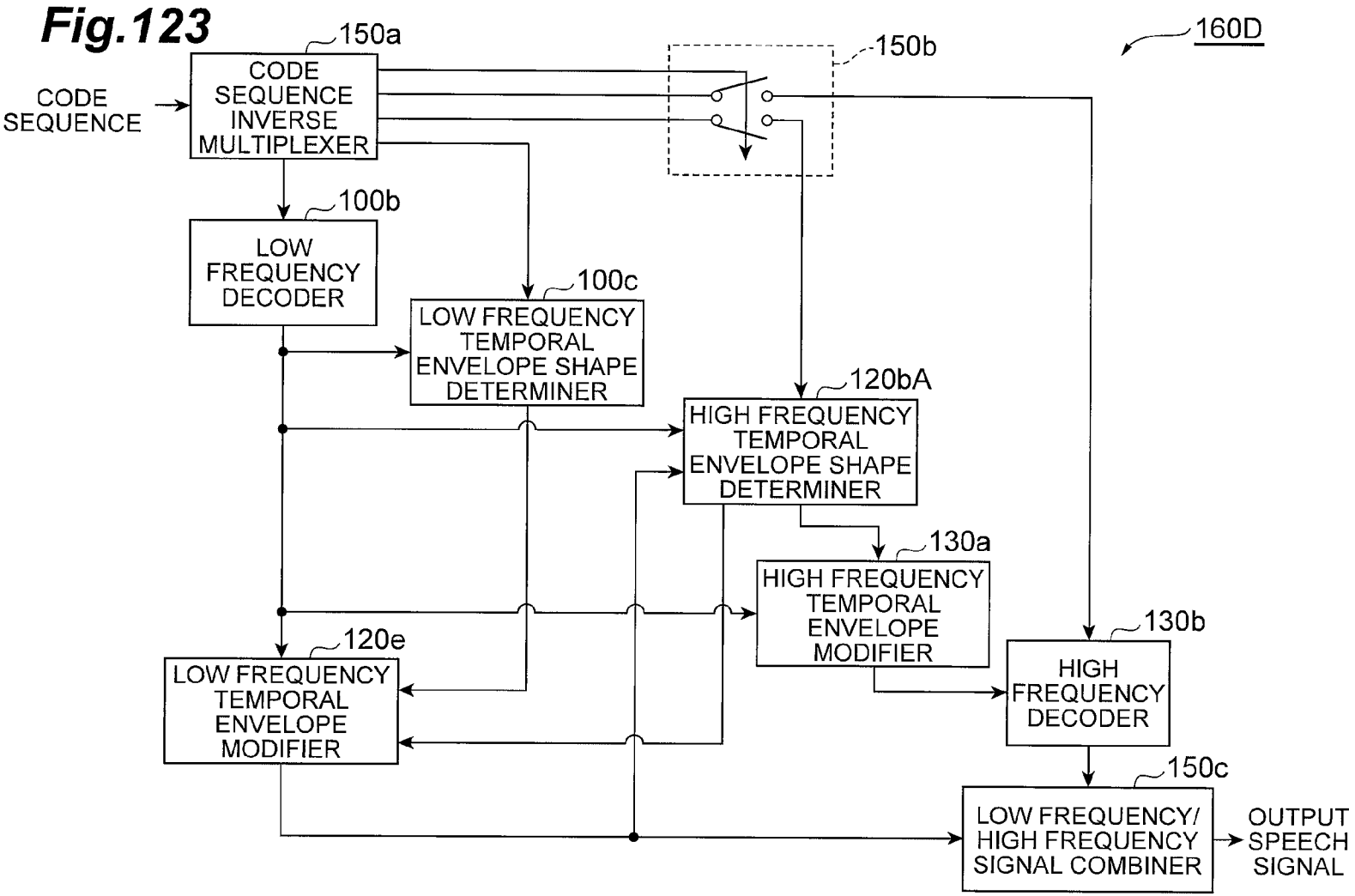

FIG. 123 is a diagram showing the configuration of a fourth modification 160D of the speech decoding device according to the eighth embodiment.

Figure 124:
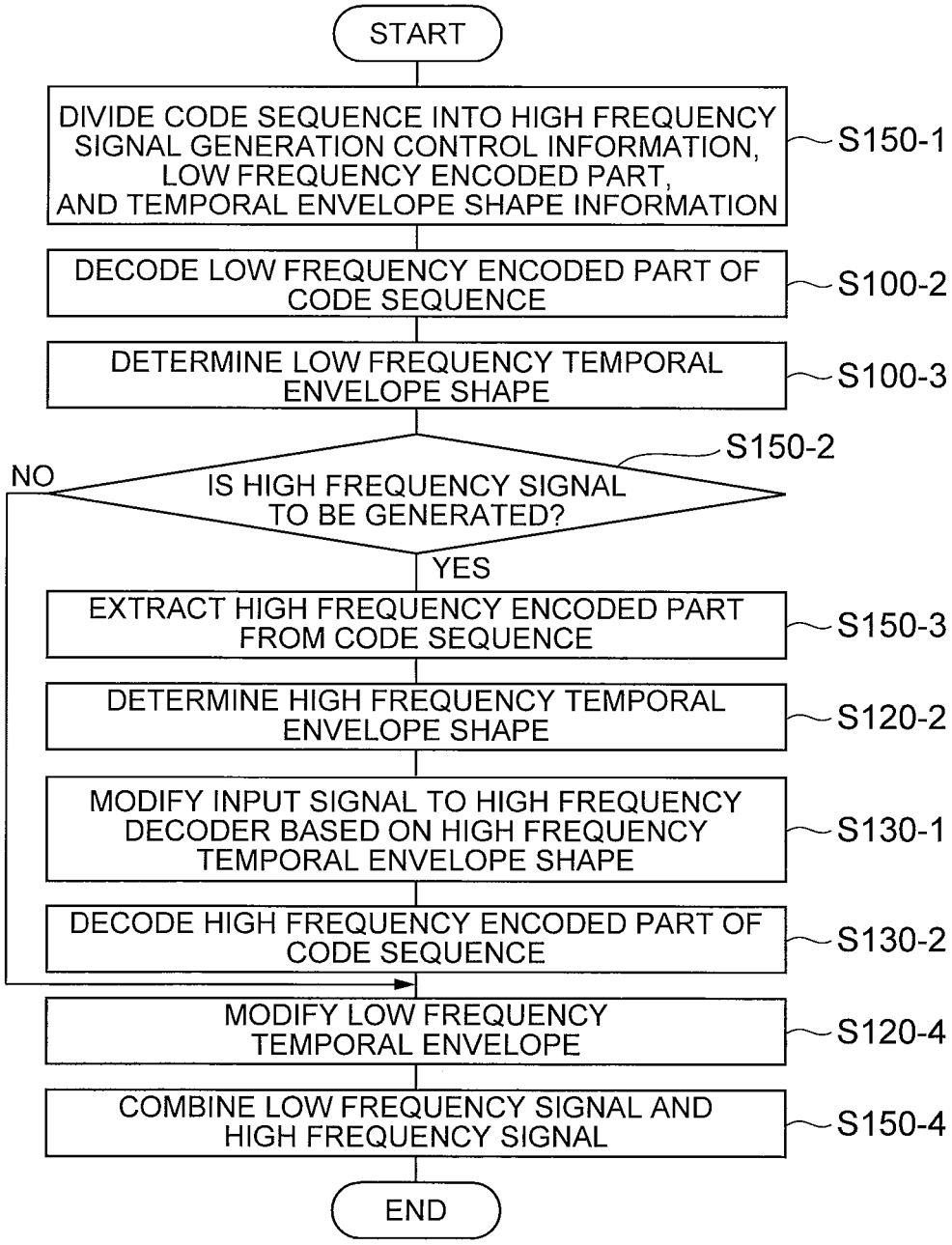

FIG. 124 is a flowchart showing the operation of the fourth modification 160D of the speech decoding device according to the eighth embodiment.

The present modification differs from the speech decoding device 160 according to the eighth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Fifth Modification of Speech Decoding Device of Eighth Embodiment

Figure 125:
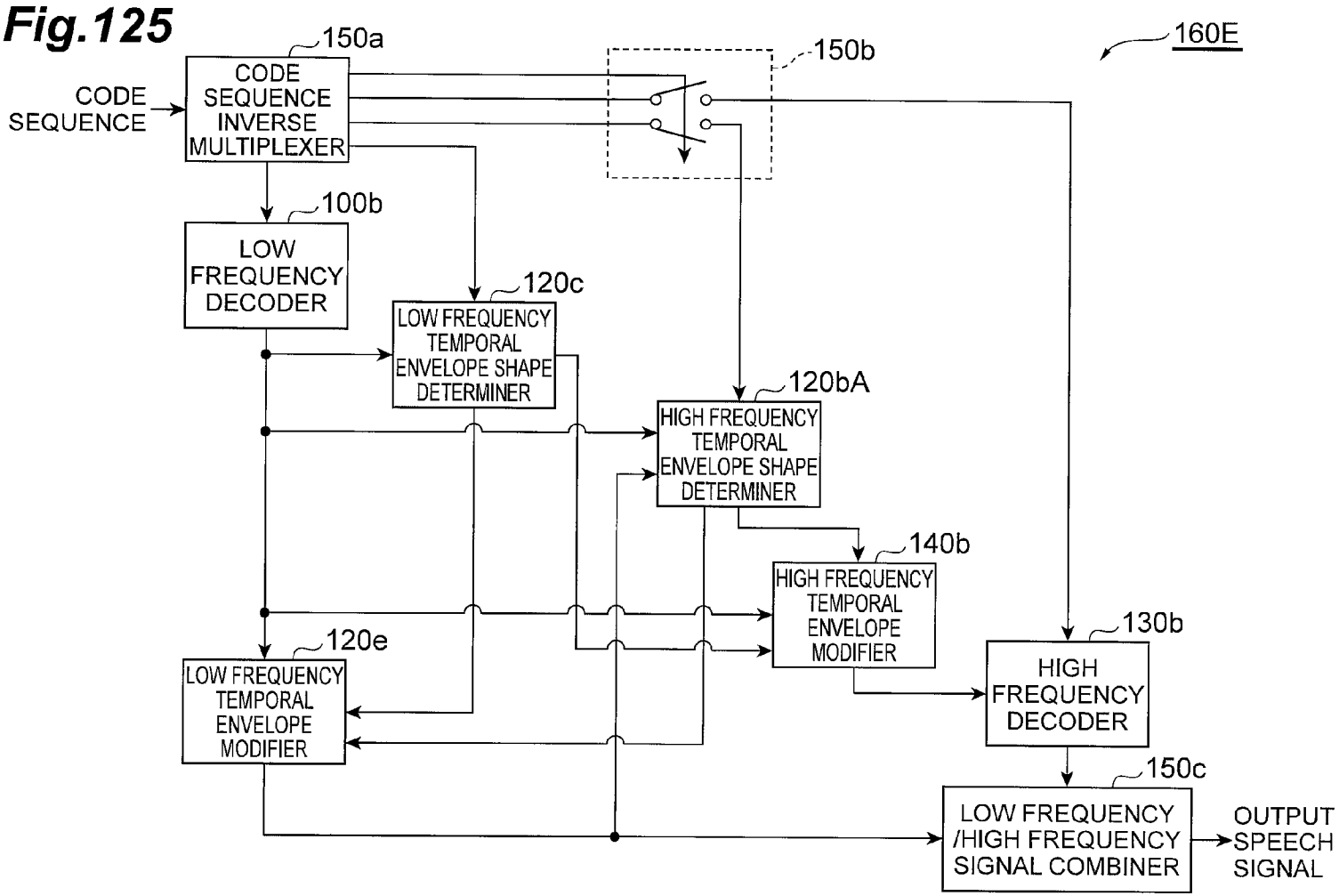

FIG. 125 is a diagram showing the configuration of a fifth modification 160E of the speech decoding device according to the eighth embodiment.

Figure 126:
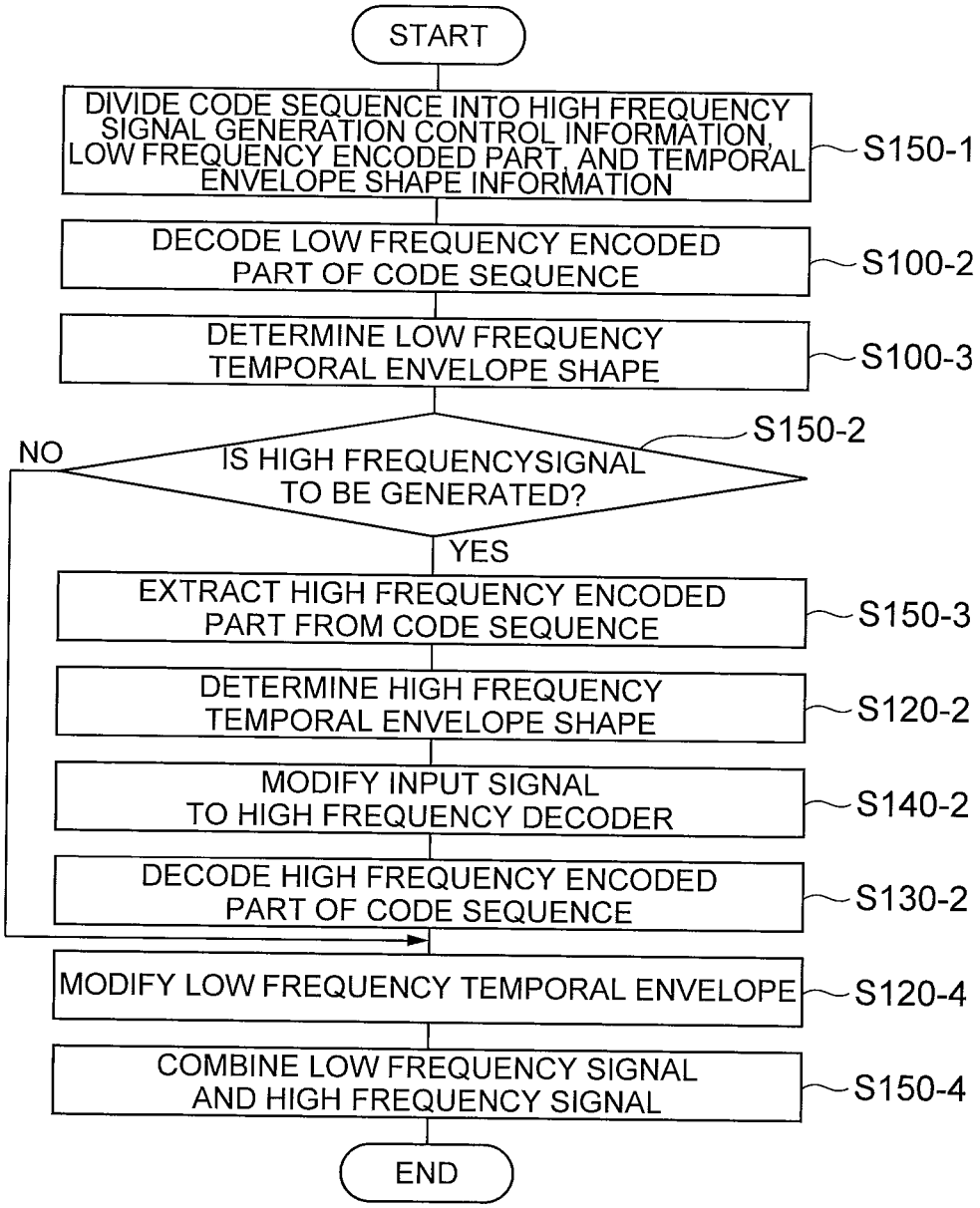

FIG. 126 is a flowchart showing the operation of the fifth modification 160E of the speech decoding device according to the eighth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Sixth Modification of Speech Decoding Device of Eighth Embodiment

Figure 127:
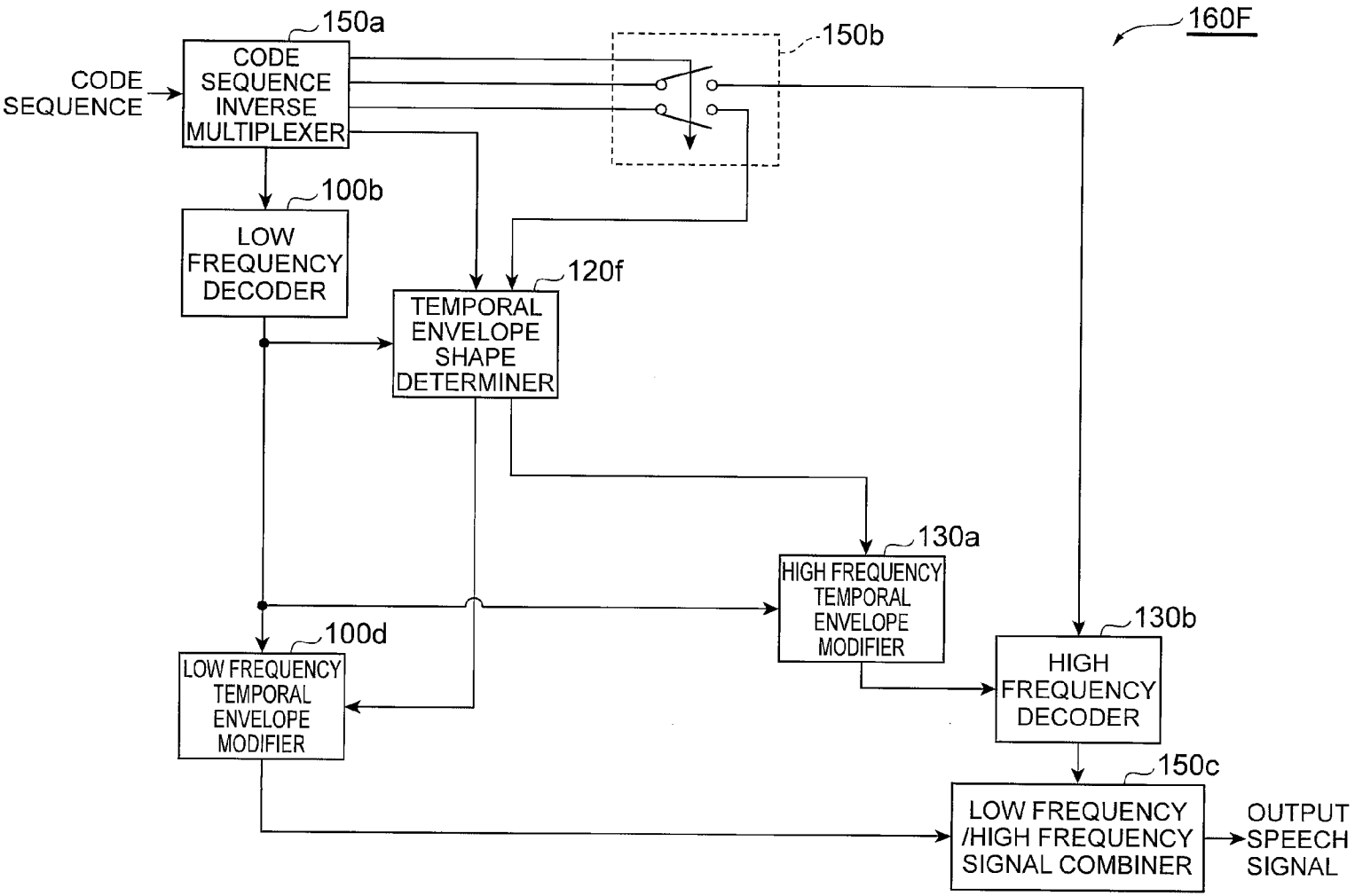

FIG. 127 is a diagram showing the configuration of a sixth modification 160F of the speech decoding device according to the eighth embodiment.

Figure 128:
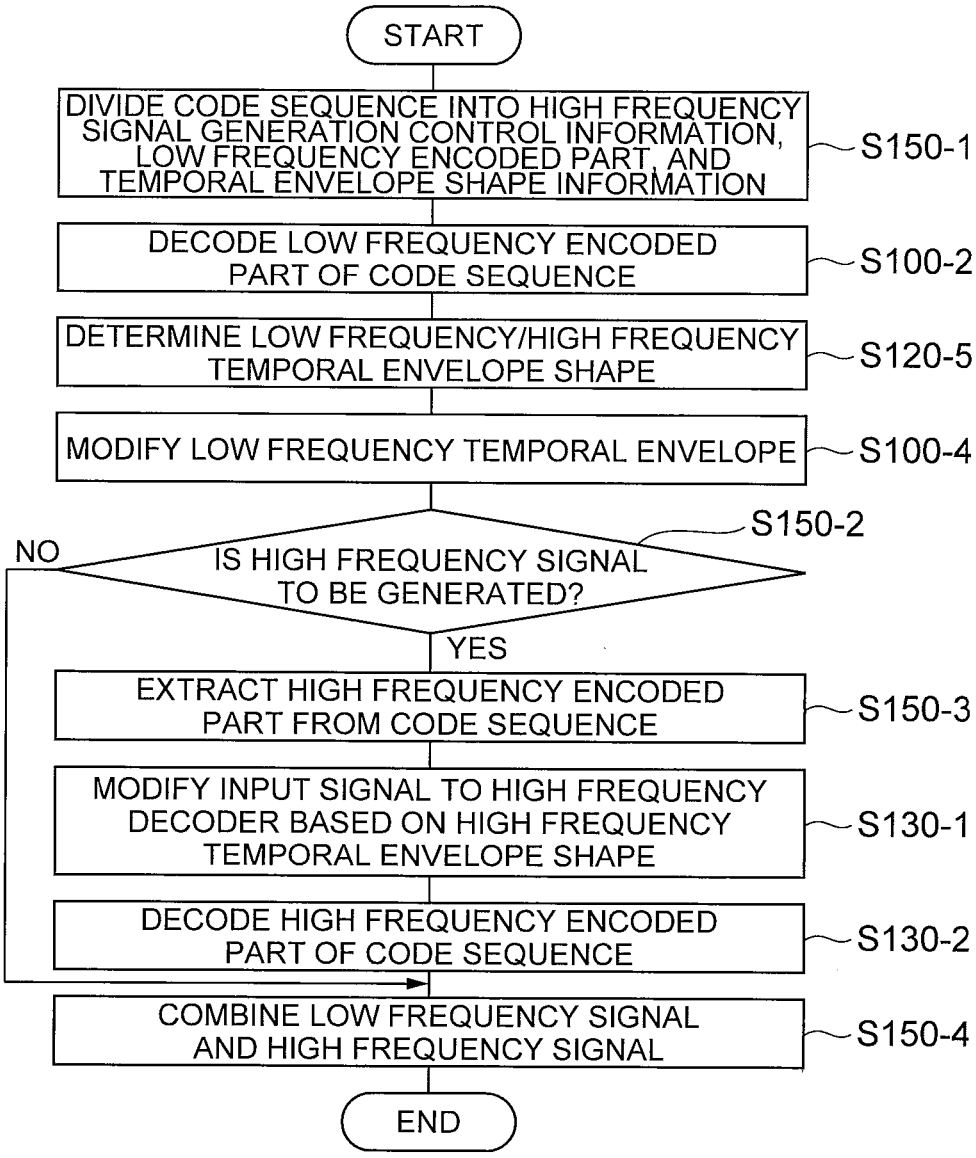

FIG. 128 is a flowchart showing the operation of the sixth modification 160F of the speech decoding device according to the eighth embodiment.

The present modification differs from the speech decoding device 160 according to the eighth embodiment in that it includes a temporal envelope shape determiner 120*f* in place of the low frequency temporal envelope shape determiner 100*c* and the high frequency temporal envelope shape determiner 120*b*.

Seventh Modification of Speech Decoding Device of Eighth Embodiment

Figure 129:
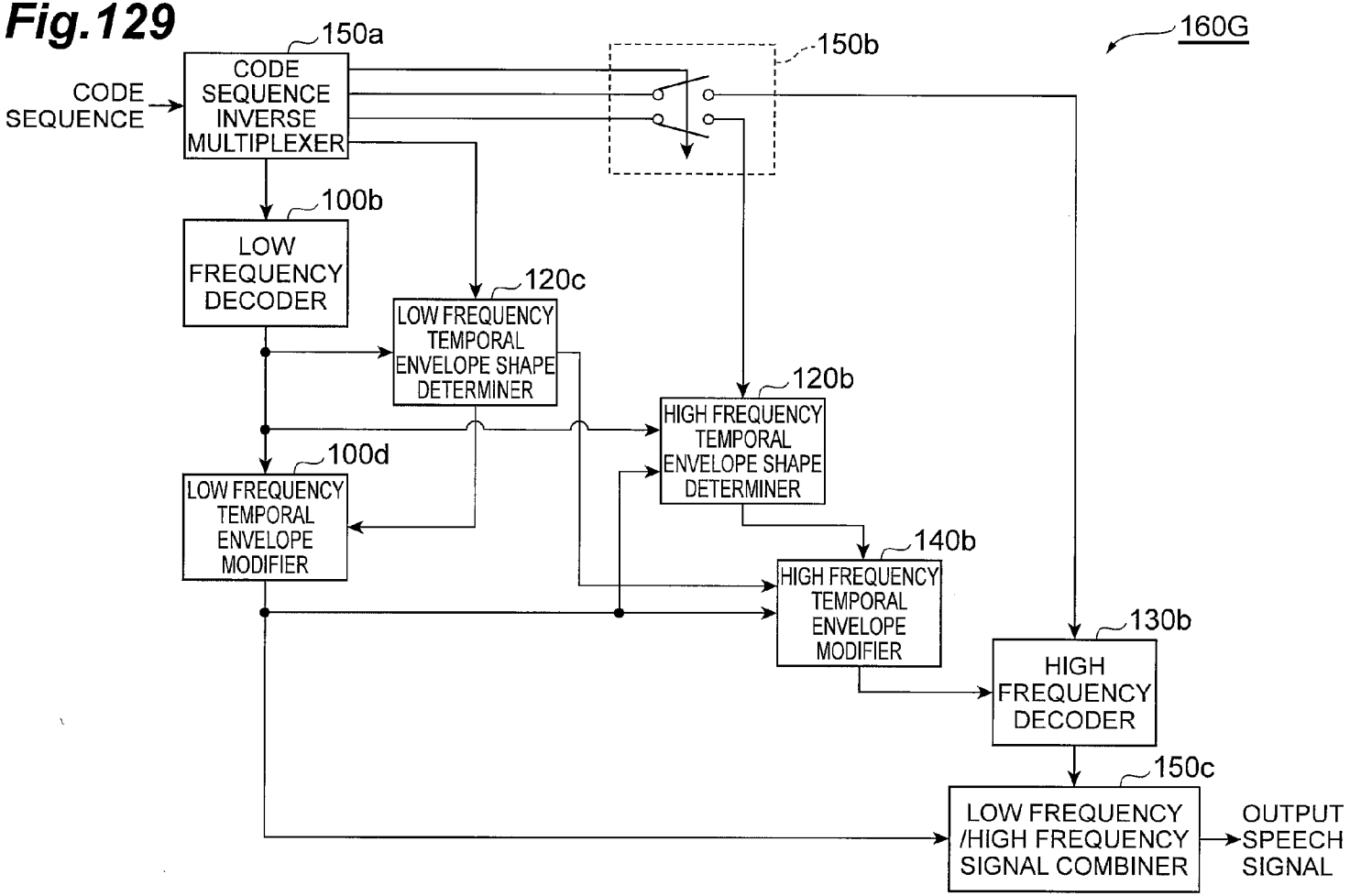

FIG. 129 is a diagram showing the configuration of a seventh modification 160G of the speech decoding device according to the eighth embodiment.

Figure 130:
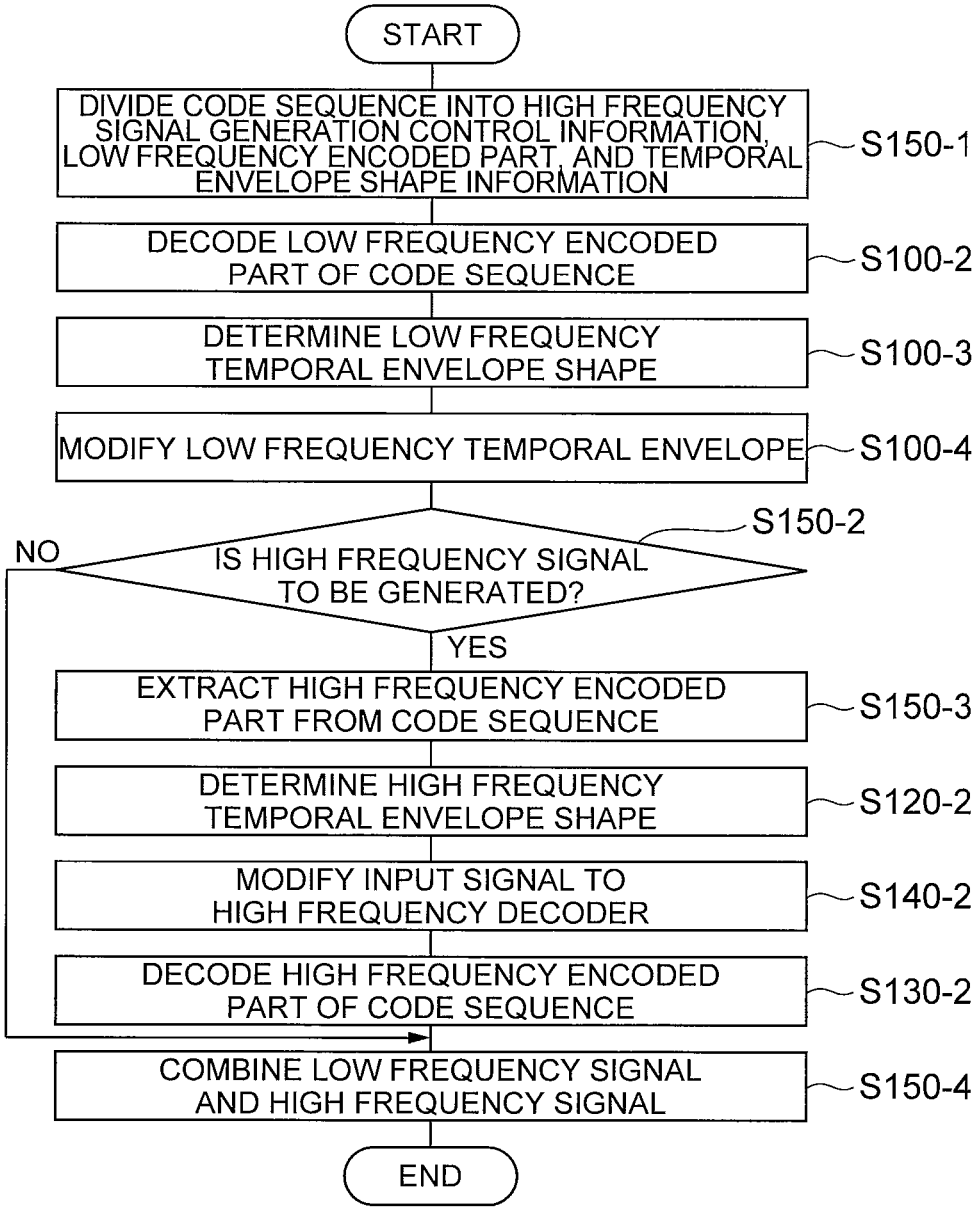

FIG. 130 is a flowchart showing the operation of the seventh modification 160G of the speech decoding device according to the eighth embodiment.

The present modification differs from the first modification 160A of the speech decoding device according to the eighth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 140*a*.

In the present modification, the high frequency temporal envelope modifier 140*b* modifies the shape of the temporal envelope of the low frequency signal having the temporal envelope shape modified to be input to the high frequency decoder 130*b*, based on at least one of the temporal envelope shape determined by the high frequency temporal envelope shape determiner 120*b* and the temporal envelope shape determined by the low frequency temporal envelope shape determiner 120*c* (S140-2).

Eighth Modification of Speech Decoding Device of Eighth Embodiment

Figure 131:
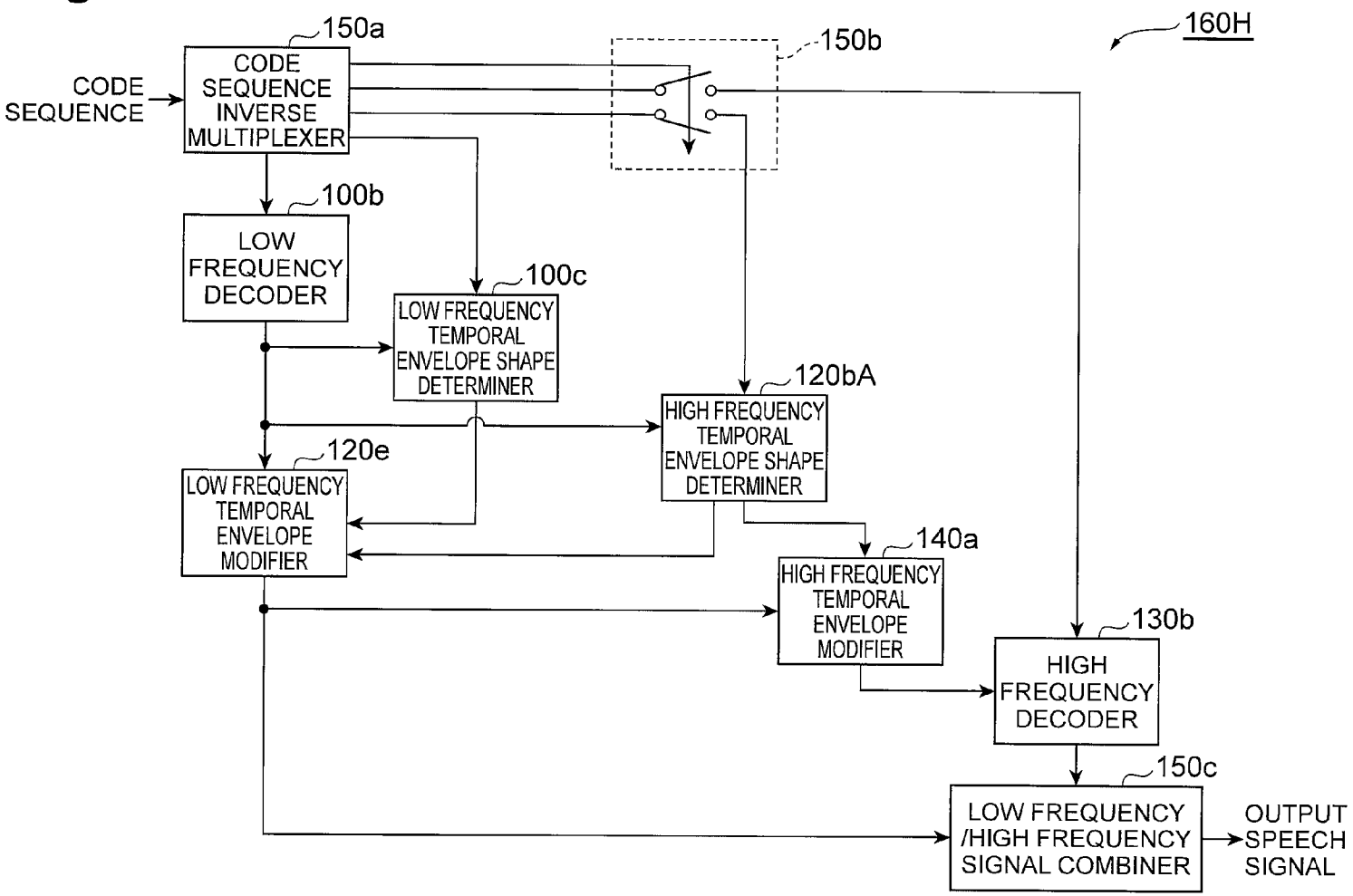

FIG. 131 is a diagram showing the configuration of an eighth modification 160H of the speech decoding device according to the eighth embodiment.

FIG. 132 is a flowchart showing the operation of the eighth modification 160H of the speech decoding device according to the eighth embodiment.

The present modification differs from the first modification 160A of the speech decoding device according to the eighth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Ninth Modification of Speech Decoding Device of Eighth Embodiment

FIG. 133 is a diagram showing the configuration of a ninth modification 160I of the speech decoding device according to the eighth embodiment.

FIG. 134 is a flowchart showing the operation of the ninth modification 160I of the speech decoding device according to the eighth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Tenth Modification of Speech Decoding Device of Eighth Embodiment

FIG. 135 is a diagram showing the configuration of a tenth modification 160J of the speech decoding device according to the eighth embodiment.

FIG. 136 is a flowchart showing the operation of the tenth modification 160J of the speech decoding device according to the eighth embodiment.

The present modification differs from the first modification 160A of the speech decoding device according to the eighth embodiment in that it includes a temporal envelope shape determiner 120*f* in place of the low frequency temporal envelope shape determiner 100*c* and the high frequency temporal envelope shape determiner 120*b*.

Eleventh Modification of Speech Decoding Device of Eighth Embodiment

FIG. 137 is a diagram showing the configuration of an eleventh modification 160K of the speech decoding device according to the eighth embodiment.

FIG. 138 is a flowchart showing the operation of the eleventh modification 160K of the speech decoding device according to the eighth embodiment.

The present modification differs from the second modification 160B of the speech decoding device according to the eighth embodiment in that it includes a low frequency temporal envelope shape determiner 120*c* and a high frequency temporal envelope modifier 140*b* in place of the low frequency temporal envelope shape determiner 100*c* and the high frequency temporal envelope modifier 140*a*.

Twelfth Modification of Speech Decoding Device of Eighth Embodiment

FIG. 139 is a diagram showing the configuration of a twelfth modification 160L of the speech decoding device according to the eighth embodiment.

FIG. 140 is a flowchart showing the operation of the twelfth modification 160L of the speech decoding device according to the eighth embodiment.

The present modification differs from the second modification 160B of the speech decoding device according to the eighth embodiment in that it includes a high frequency temporal envelope shape determiner 120*b*A and a low frequency temporal envelope modifier 120*e* in place of the high frequency temporal envelope shape determiner 120*b* and the low frequency temporal envelope modifier 100*d*.

Thirteenth Modification of Speech Decoding Device of Eighth Embodiment

FIG. 141 is a diagram showing the configuration of a thirteenth modification 160M of the speech decoding device according to the eighth embodiment.

FIG. 142 is a flowchart showing the operation of the thirteenth modification 160M of the speech decoding device according to the eighth embodiment.

The present modification includes the low frequency temporal envelope shape determiner 120*c*, the high frequency temporal envelope modifier 140*b*, the high frequency temporal envelope shape determiner 120*b*A, and the low frequency temporal envelope modifier 120*e*.

Fourteenth Modification of Speech Decoding Device of Eighth Embodiment

FIG. 143 is a diagram showing the configuration of a fourteenth modification 160N of the speech decoding device according to the eighth embodiment.

FIG. 144 is a flowchart showing the operation of the fourteenth modification 160N of the speech decoding device according to the eighth embodiment.

The present modification differs from the second modification 160B of the speech decoding device according to the eighth embodiment in that it includes a temporal envelope shape determiner 120*f* in place of the low frequency temporal envelope shape determiner 100*c* and the high frequency temporal envelope shape determiner 120*b*.

Speech Decoding Device of Ninth Embodiment

FIG. 145 is a diagram showing the configuration of a speech decoding device 380 according to a ninth embodiment.

FIG. 146 is a flowchart showing the operation of the speech decoding device 380 according to the ninth embodiment.

The temporal envelope modifier 380*a* modifies the shape of the temporal envelope of the low frequency signal output from the low frequency decoder 100*b* and the high frequency signal output from the high frequency decoder 100*e*, based on at least one of the temporal envelope shape determined by the low frequency temporal envelope shape determiner 100*c* and the temporal envelope shape determined by the high frequency temporal envelope shape determiner 110*b* (S380-1).

The temporal envelope shape determined by the low frequency temporal envelope shape determiner 100*c* and the temporal envelope shape determined by the high frequency temporal envelope shape determiner 110*b* may be the same or different.

First Modification of Speech Decoding Device of Ninth Embodiment

FIG. 147 is a diagram showing the configuration of a first modification 380A of the speech decoding device according to the ninth embodiment.

FIG. 148 is a flowchart showing the operation of the first modification 380A of the speech decoding device according to the ninth embodiment.

The present modification differs from the speech decoding device 380 according to the ninth embodiment in that it includes a temporal envelope shape determiner 120*f* in place of the low frequency temporal envelope shape determiner 100*c* and the high frequency temporal envelope shape determiner 110*b*, and a temporal envelope modifier 380*a*A in place of the temporal envelope modifier 380*a*.

The temporal envelope modifier 380*a*A modifies the shape of the temporal envelope of the low frequency signal output from the low frequency decoder 100*b* and the high frequency signal output from the high frequency decoder 100*e*, based on the temporal envelope shape determined by the temporal envelope shape determiner 120*f* (S380-1*a*).

Speech Decoding Device of Tenth Embodiment

FIG. 149 is a diagram showing the configuration of a speech decoding device 390 according to a tenth embodiment.

FIG. 150 is a flowchart showing the operation of the speech decoding device 390 according to the tenth embodiment.

In the present modification, the temporal envelope modifier 380*a*A modifies the shape of the temporal envelope of the low frequency signal output from the low frequency decoder 100*b*, based on the temporal envelope shape determined by the temporal envelope shape determiner 120*f*, and, if it is determined to generate a high frequency signal based on the high frequency signal generation information, additionally modifies the shape of the temporal envelope of the high frequency signal output from the high frequency decoder 100*e* (S380-1*a*).

What is claimed is:

1. A speech decoding device that decodes an encoded speech signal, sent from an encoding device, to output a speech signal, the speech decoding device comprising:

a low frequency decoder that receives and decodes a code sequence representative of the encoded speech signal, the code sequence including encoded information of a low frequency signal, which is decoded to obtain the low frequency signal;

a high frequency decoder that receives first information from the low frequency decoder and generates a high frequency signal based on the first information;

a high frequency temporal envelope shape determiner that determines a temporal envelope shape of the generated high frequency signal based on second information sent from the encoding device regarding a temporal envelop of the high frequency signal;

a high frequency temporal envelope modifier that modifies the temporal envelope shape of the generated high frequency signal based on the temporal envelope shape determined by the high frequency temporal envelope shape determiner and outputs the modified high frequency signal; and a low frequency/high frequency signal combiner that receives the low frequency signal from the low frequency decoder, receives the high frequency signal, whose temporal envelope shape is modified, from the high frequency temporal envelope modifier and combines the low frequency signal and the high frequency signal, whose temporal envelope shape is modified, to obtain a speech signal to be output, wherein the high frequency temporal envelope modifier modifies the temporal envelope shape using a function that comprises a square root of a summation of a squared high frequency signal in each of a plurality of arbitrary time segments of the generated high frequency signal and outputs the modified high frequency signal, when it is determined by the high frequency temporal envelope shape determiner that the temporal envelope shape is flat.

2. A speech decoding method executed by a speech decoding device that decodes an encoded speech signal, sent from an encoding device, to output a speech signal, the speech decoding method comprising:

a low frequency decoding step of receiving and decoding a code sequence representative of the encoded speech signal, the code sequence including encoded information of a low frequency signal to obtain the low frequency signal;

a high frequency decoding step of receiving first information obtained in the low frequency decoding step and generating a high frequency signal based on the first information;

a high frequency temporal envelope shape determining step of determining a temporal envelope shape of the generated high frequency signal based on the second information sent from the encoding device regarding a temporal envelop of the high frequency signal;

a high frequency temporal envelope modifying step of modifying the temporal envelope shape of the generated high frequency signal based on the temporal envelope shape determined by the high frequency temporal envelope shape determining step and outputting the modified high frequency signal; and a low frequency/high frequency signal combining step of receiving the low frequency signal obtained in the low frequency decoding step, receiving the high frequency signal, whose temporal envelope shape is modified, obtained in the high frequency temporal envelope modifying step and combining the low frequency signal and the high frequency signal, whose temporal envelope shape is modified, to obtain a speech signal to be output, wherein the high frequency temporal envelope modifying step modifies the temporal envelope shape using a function that comprises a square root of a summation of a squared high frequency signal in each of a plurality of arbitrary time segments of the generated high frequency signal and outputs the modified high frequency signal, when it is determined by the high frequency temporal envelope shape determining step that the temporal envelope shape is flat.

3. The speech decoding device according to claim 1, further comprising:

a code sequence demultiplexer that divides a code sequence including the encoded speech signal into at least a code sequence including information of a low frequency signal of the encoded speech signal and a code sequence including information of a high frequency signal of the encoded speech signal.

4. The speech decoding device according to claim 1, wherein the high frequency temporal envelope modifier modifies, based on the temporal envelope shape determined by the high frequency temporal envelope shape determiner, a temporal envelope shape of an intermediate signal appearing when the high frequency decoder generates a high frequency signal, and the high frequency decoder generates a residual high frequency signal based on the intermediate signal whose temporal envelope shape is modified.

5. The speech decoding device according to claim 4, wherein the high frequency decoder includes:

an analysis filter that receives the low frequency signal decoded by the low frequency decoder, and divides the signal into subband signals;

a high frequency signal generator that generates a high frequency signal at least based on the subband signals divided by the analysis filter; and a frequency envelope adjuster that adjusts a frequency envelope of the high frequency signal generated by the high frequency signal generator, and the intermediate signal is the high frequency signal generated by the high frequency signal generator.

6. The speech decoding device according to claim 1, further comprising:

a code sequence demultiplexer that divides a code sequence including the encoded speech signal into at least a code sequence including information of a low frequency signal of the encoded speech signal and a code sequence including information of a high frequency signal of the encoded speech signal.

7. The speech decoding device according to claim 1, wherein the high frequency temporal envelope modifier modifies, based on the temporal envelope shape determined by the high frequency temporal envelope shape determiner, a temporal envelope shape of an intermediate signal appearing when the high frequency decoder generates a high frequency signal, and the high frequency decoder generates a residual high frequency signal based on the intermediate signal whose temporal envelope shape is modified.

8. The speech decoding device according to claim 1, wherein temporal envelope information of a high frequency signal generated by the high frequency signal decoder is used and temporal envelope information of a low frequency signal obtained from the low frequency signal decoder is not used, in the course of obtaining a speech signal by decoding an encoded speech signal.

9. The speech decoding device according to claim 6, wherein temporal envelope information of a high frequency signal generated by the high frequency signal decoder is used and temporal envelope information of a low frequency signal obtained from the low frequency signal decoder is not used, in the course of obtaining a speech signal by decoding an encoded speech signal.

10. The speech decoding device according to claim 7, wherein temporal envelope information of a high frequency signal generated by the high frequency signal decoder is used and temporal envelope information of a low frequency signal obtained from the low frequency signal decoder is not used, in the course of obtaining a speech signal by decoding an encoded speech signal.

* * * * *